US005824442A

United States Patent [19]

Tanikawa et al.

[11] Patent Number: 5,824,442

[45] Date of Patent: Oct. 20, 1998

[54] DEVELOPING METHOD, IMAGE FORMING METHOD, AND HEAT FIXING METHOD, WITH TONER

[75] Inventors: Hirohide Tanikawa; Hiroaki Kawakami; Masatsugu Fujiwara, all of Yokohama; Kazunori Kato, Mitaka, all of Japan

[73] Assignee: Canon Kabushiki Kaisha, Tokyo, Japan

[21] Appl. No.: 919,260

[22] Filed: Aug. 28, 1997

Related U.S. Application Data

[62] Division of Ser. No. 555,173, Nov. 8, 1995, Pat. No. 5,707,770.

[30] Foreign Application Priority Data

| | | | |
|---|---|---|---|
| Nov. 8, 1994 | [JP] | Japan | 6-298017 |
| Nov. 9, 1994 | [JP] | Japan | 6-299072 |
| Nov. 18, 1994 | [JP] | Japan | 6-308382 |
| Dec. 6, 1994 | [JP] | Japan | 6-329805 |
| Dec. 15, 1994 | [JP] | Japan | 6-332876 |
| Dec. 21, 1994 | [JP] | Japan | 6-335147 |

[51] Int. Cl.[6] ..... G03G 13/20; G03G 13/14; G03G 13/01

[52] U.S. Cl. ..... 430/45; 430/47; 430/120; 430/124; 430/126; 427/474; 427/203; 427/366

[58] Field of Search ..... 430/45, 47, 110, 430/124, 126, 120; 427/203, 366, 474

[56] References Cited

U.S. PATENT DOCUMENTS

| | | | |
|---|---|---|---|
| 2,297,691 | 10/1942 | Carlson | 95/5 |
| 3,666,363 | 5/1972 | Tanaka et al. | 355/17 |
| 4,071,361 | 1/1978 | Marushima | 96/1.4 |
| 4,902,570 | 2/1990 | Heinemann et al. | 430/110 |
| 5,486,420 | 1/1996 | Nishihara et al. | 428/405 |
| 5,501,963 | 3/1996 | Deusser et al. | 430/110 |

FOREIGN PATENT DOCUMENTS

| | | | |
|---|---|---|---|
| 0237038 | 9/1987 | European Pat. Off. | G03F 9/08 |
| 0498942 | 8/1992 | European Pat. Off. | G03F 9/097 |
| 0523654 | 1/1993 | European Pat. Off. | G03G 9/097 |
| 0609870 | 8/1994 | European Pat. Off. | G03G 9/097 |
| 42-23910 | 11/1967 | Japan . | |
| 43-24748 | 10/1968 | Japan . | |
| 48-47345 | 7/1973 | Japan . | |
| 53-22447 | 8/1978 | Japan . | |
| 58-216252 | 12/1983 | Japan . | |
| 59-201063 | 11/1984 | Japan . | |
| 60-112052 | 6/1985 | Japan . | |
| 60-238847 | 11/1985 | Japan . | |
| 60-238849 | 11/1985 | Japan . | |
| 61-188546 | 8/1986 | Japan . | |
| 61-188547 | 8/1986 | Japan . | |
| 62-174772 | 7/1987 | Japan . | |
| 63-30850 | 2/1988 | Japan . | |
| 64-88554 | 4/1989 | Japan . | |
| 1-31442 | 6/1989 | Japan . | |

(List continued on next page.)

OTHER PUBLICATIONS

Patent Abstracts of Japan, vol. 8, No. 19, C–207, C–1984, for JP58–185405 Published Oct. 1983.

*Primary Examiner*—Christopher D. Rodee
*Attorney, Agent, or Firm*—Fitzpatrick, Cella, Harper & Scinto

[57] ABSTRACT

A toner for developing electrostatic images has toner particles containing a binder resin and a colorant, and fine titanium oxide particles or fine alumina particles. The surfaces of the fine titanium oxide particles or fine alumina particles have been subjected to an organic treatment and have a methanol wettability half value of 55% or more.

161 Claims, 20 Drawing Sheets

OTHER PUBLICATIONS

| | | |
|---|---|---|
| 2-109058 | 4/1990 | Japan . |
| 2-27644 | 6/1990 | Japan . |
| 2-151872 | 6/1990 | Japan . |
| 2-222966 | 9/1990 | Japan . |
| 2-291565 | 12/1990 | Japan . |
| 3-39307 | 6/1991 | Japan . |
| 4-204750 | 7/1992 | Japan . |
| 4-204751 | 7/1992 | Japan . |
| 4-214568 | 8/1992 | Japan . |
| 4-280255 | 10/1992 | Japan . |
| 4-340558 | 11/1992 | Japan . |
| 4-345168 | 12/1992 | Japan . |
| 4-345169 | 12/1992 | Japan . |
| 4-348354 | 12/1992 | Japan . |
| 5-19528 | 1/1993 | Japan . |
| 5-61224 | 3/1993 | Japan . |
| 5-94037 | 4/1993 | Japan . |
| 5-113688 | 5/1993 | Japan . |
| 5-119517 | 5/1993 | Japan . |
| 5-139748 | 6/1993 | Japan . |
| 5-188633 | 7/1993 | Japan . |
| 5-289391 | 11/1993 | Japan . |
| 6-11886 | 1/1994 | Japan . |
| 6-11887 | 1/1994 | Japan . |
| 6-19186 | 1/1994 | Japan . |

TITRATION CURVE OF ORGANIC-TREATED FINE PARTICLES 1

TITRATION CURVE OF ORGANIC-TREATED FINE PARTICLES 2

TITRATION CURVE OF ORGANIC-TREATED FINE PARTICLES 3

TITRATION CURVE OF ORGANIC-TREATED FINE PARTICLES 31

$I_o$ : TRANSMITTANCE BEFORE ADDITION OF SAMPLE
$I_{min}$ : MINIMUM TRANSMITTANCE DURING TITRATION
$M_{WH}$ : METHANOL VOL. % OF METHANOL WETTABILITY HALF WIDTH
$M_{WE}$ : METHANOL VOL. % OF METHANOL WETTABILITY END POINT

TITRATION CURVE OF ORGANIC-TREATED FINE PARTICLES 33

TITRATION CURVE OF ORGANIC-TREATED FINE PARTICLES 34

TITRATION CURVE OF ORGANIC-TREATED FINE PARTICLES 49

TITRATION CURVE OF ORGANIC-TREATED FINE PARTICLES 62

DEVELOPING METHOD, IMAGE FORMING METHOD, AND HEAT FIXING METHOD, WITH TONER

This application is a division of application Ser. No. 08/555,173 filed Nov. 8, 1995, now U.S. Pat. No. 5,707,700.

BACKGROUND OF THE INVENTION

1. Field of the Invention

This invention relates to a toner for developing electrostatic images, used to develop electrostatic images in electrophotography, electrostatic recording and electrostatic printing, a two component type developer having this toner and a carrier, and a developing method and an image forming method and a heat fixing method which make use of this toner. It also relates to a process for producing this toner.

2. Related Background Art

It is conventionally well known to form an image on the surface of a photoconductive material through an electrostatic means and develop it. More specifically, a number of methods as disclosed in U.S. Pat. No. 2,297,691, Japanese Patent Publications No. 42-23910 and No. 43-24748 and so forth are known in the art. Copies are commonly obtained by forming an electrostatic latent image on a photosensitive member by utilizing a photoconductive substance and by various means, subsequently developing the latent image by the use of a toner, and transferring the toner image to a transfer medium such as paper if necessary, followed by fixing by heat, pressure, heat and pressure, or solvent vapor. The toner that has not transferred to and has remained on the photosensitive member is cleaned by various means, and then the above process is repeated.

In recent years, electrophotographic apparatus of such a system are sought to be constituted of more simple components in respect of specifications for small size, light weight, low power consumption and so forth while achieving requirements for full colors, high minuteness and high image quality.

In recent years, there is an increasing commercial demand for high minuteness and high image quality in electrophotography. Accordingly, in the present technical field, it is attempted to achieve high image quality, full-color electrophotography. In the case of full-color electrophotography, an image is formed by superimposing three or four color toners, where color reproduction may be poor or color non-uniformity may occur unless color toners of different colors are developed all alike. In these color toners, however, dyes or pigments participate in coloring, and these may greatly affect the development. Also, fixing performance, color mixing performance and anti-offset performance at the time of fixing are important in full-color images, and binder resins suitable for these performances are selected, which binder resins also may greatly affect developing performance. As one of such effects, the effect of temperature and humidity upon charge quantity is noted, and it is considered urgent to bring out color toners that can have stable charge quantity in a wide range of environment.

As a means for solving such problems, there is a method in which toners are incorporated with various external additives. In particular, for the purpose of improving various image characteristics such as resolution, density uniformity and fog, it is common to externally add fine powders of various types in order to improve charging performance and fluidity of toners.

Those which are widely used as the fine powders include (i) inorganic fine powders surface-treated with silicone oil, silicone varnish or a silane compound, and (ii) surface-treated titanium oxide, e.g., surface-treated with aminosilane, which are preferably used. Examples thereof are disclosed in Japanese Patent Publications No. 53-22447 and No. 1-31442, Japanese Patent Applications Laid-open No. 58-216252, No. 59-201063 and No. 64-88554, Japanese Patent Publication No. 3-39307, and Japanese Patent Applications Laid-open No. 4-204750, No. 4-214568, No. 4-340558, No. 5-19528, No. 5-61224, No. 5-94037, No. 5-119517, No. 5-139748, No. 6-11886 and No. 6-11887.

Also preferably used are (iii) those in which two kinds of inorganic fine powders are added. Examples thereof are disclosed in Japanese Patent Publication No. 2-27664, and Japanese Patent Applications Laid-open No. 60-238847, No. 61-188546, No. 61-188547, No. 62-174772, No. 2-151872, No. 2-222966, No. 2-291565, No. 4-204751, No. 4-280255, No. 4-345168, No. 4-345169, No. 4-348354 and No. 5-113688.

In these proposals, electrophotographic performance has been certainly improved, but toners are not so well uniformly made hydrophobic that no sufficient quantity of triboelectricity can be obtained after they have been left in an environment of high humidity or for a long term, causing a decrease in image density and fog in some cases. In other cases, the quantity of triboelectricity may become excess in an environment of low humidity to cause non-uniformity of image density and fog. No sufficient releasability of toners from drums can not be obtained, resulting in unsatisfactory transfer performance to cause a lowering of transfer efficiency and blank areas caused by poor transfer in some cases. None of the prior art has not solved these problems simultaneously. Situation is especially severe when such powders are applied in full-color toners, bringing about no satisfactory results.

Moreover, in recent years, there is an increasing commercial demand for higher minuteness and higher image quality in electrophotography. In the present technical field, it is attempted to make toner particle diameter smaller so that a color image can be formed in a high image quality. Making smaller the particle diameters of toner particles results in an increase in the surface area per unit weight, tending to bring about an excessively large quantity of triboelectricity of the toner. This is accompanied with a possibility of the insufficiency of image density or the deterioration of durability or running performance. In addition, because of the large quantity of triboelectricity, toner particles may strongly adhere one another to cause a decrease in fluidity, bringing about a problem in the stability of toner feeding and the providing of triboelectricity to the toner.

In the case of color toners, they contain no conductive substances such as magnetic materials, and hence have no portions from which charges are leaked, to commonly tend to have a larger quantity of triboelectricity. This tendency is more remarkable when polyester type binders having a high charging performance is used.

In particular, color toners are also strongly desired to have performances as shown below. (1) Fixed toners are required to nearly come into a substantially completely molten state to the extent that the forms of toner particles can not be recognized, so as for their color reproduction not to be hindered because of irregular reflection upon exposure to light. (2) Color toners must have a transparency not to obstruct the toner layer having a different color tone that lies beneath an upper layer thereof. (3) The respective constituent toners must have well-balanced hues and spectral reflection properties, and sufficient chroma.

From such viewpoints, studies are made on many binder resins. However, none of toners that satisfy all of the above performances have been brought out. Nowadays, in the present technical field, resins of a polyester type are widely used as binder resins for color toners. Toners comprised of a polyester resin, however, commonly tend to be affected by temperature and humidity, and tend to cause problems of an excessive charge quantity in an environment of low humidity and an insufficient charge quantity in an environment of high humidity. Thus, it is considered urgent to bring out color toners that can have stable charge quantity in a wide range of environment.

Incidentally, as methods for developing electrostatic latent images, two-component development making use of a blend of a toner with a carrier and one-component development making use of only a toner are commonly available. The two-component development conflicts with the requirements for small size and light weight, in view of the fact that it requires what is called the ATR mechanism for controlling the blend ratio of toner to carrier.

On the other hand, the one-component development, which is a system having no carrier, requires no mechanism for controlling toner concentration and requires no device for agitating the toner and the carrier. Hence, this is feasible for making apparatus small-sized and light-weight. Since, however, no means for making the carrier impart charges to the toner can be taken in the one-component development, it has been the subject how charges are imparted efficiently and stably.

As a means therefor, a method is proposed in which the toner is coated on a toner carrying member in a thin layer by means of a thickness control member and at the same time charged. In such a development method also, however, toner feed performance onto the toner carrying member, transport performance to the developing zone and charging and thin-layer coating performances can not be well achieved at the same time unless the toner itself has good properties in charging performance, fluidity and so forth. Thus, no satisfactory method for one-component development has been established.

That is, in developing assemblies, there have been the problems that materials for and surface properties of the toner thickness control member and toner carrying member greatly affect the transport performance, thin-layer coating performance and charging performance of the toner and the development has a narrow latitude and lacks stability.

There also have been the problems that the mechanical and thermal stress repeatedly applied when the toner is thin-layer coated under restraint and pressure by the thickness control member may cause melt-adhesion of toner to the toner carrying member and thickness control member and cause agglomeration and sticking of toner, or inversely the problems that the reduction of such control results in a lowering of charge-providing performance and thin-layer coating performance to make the charging of toner insufficient after they have been left in an environment of high humidity or for a long term.

To cope with such problems, in approaches from the direction of toners, there is the method in which toners are incorporated with various external additives, as previously stated. In particular, for the purpose of improving various image characteristics such as resolution, density uniformity and fog, it is common to externally add fine powders of various types in order to improve charging performance and fluidity of toners.

As one of those which are widely used as the fine powders, fine titanium oxide particles are noted. Those surface-treated with silicone oil, silane compound or silicone varnish have a high hydrophobicity and are preferably used.

Hitherto, examples where toners are incorporated with hydrophobic titanium oxide are seen in Japanese Patent Publication No. 3-39307, and Japanese Patent Applications Laid-open No. 60-238849, 4-204750, No. 64-88554, No. 60-112052, No. 2-109058, No. 5-19528, No. 5-188633, No. 5-119517, No. 5-139748, No. 5-289391, No. 6-11886, No. 6-11887 and No. 6-19186, where toners containing surface-treated titanium oxide are proposed. The addition of titanium oxide has certainly brought about an improvement in electrophotographic performance, but toners are not so well uniformly made hydrophobic that no sufficient quantity of triboelectricity can be obtained after they have been left in an environment of high humidity or for a long term, causing a decrease in image density and fog in some cases. In addition, no sufficient releasability of toners from drums can not be obtained, resulting in unsatisfactory transfer performance to cause a lowering of transfer efficiency and blank areas caused by poor transfer in some cases. None of the prior art has not solved these problems simultaneously. Situation is especially severe when such particles are applied in full-color toners, bringing about no satisfactory results.

In addition, in printers and copying machines employing electrophotographic techniques, corona charging assemblies have been commonly put into wide use as means for uniformly charging the surface of a photosensitive member (electrostatic latent image bearing member), while methods of directly charging the photosensitive member by directly bringing a charging member into touch or pressure contact with its surface are on research and development and are being put into practical use.

When usual toners where toner particles comprised of a binder resin and a colorant contain a fluidity-providing agent such as silica are used in image forming apparatus having such a contact charging means, the toner particles remaining on the photosensitive member which slightly have not been removed in the cleaning step after transfer are subject to the action of a charging roller brought into pressure contact with the photosensitive member and stick to the surfaces of the roller and photosensitive member. As copies are taken more and more times, the remaining toner particles more toughly stick and accumulate to cause melt-adhesion of toner to worsen the condition, resulting in faulty charging and faulty cleaning to tend to cause on the resulting images a decrease and non-uniformity in image density, white spots in solid images or black spots in solid white images. There are such problems.

The proposals stated above have certainly brought about an improvement in electrophotographic performance, but no sufficient releasability of toners from drums or members coming into contact with drums can not be obtained, so that these members may be contaminated to cause defective images in some cases. Situation is especially severe when applied in full-color toners, bringing about no satisfactory results, since images are formed by multiple development or transfer.

For the purpose of preventing the toner from sticking to the photosensitive member, it is proposed in Japanese Patent Application Laid-open No. 48-47345 to add in a toner both a friction reducing substance and an abrasive material. However, the friction reducing substance is a substance that forms an adherent deposited film matter, and hence, when the toner is used in an image forming apparatus having contact charging and contact transfer systems, a film ascribable to the friction reducing substance is formed on the charging roller provided therein, to cause the problem that faulty charging and faulty transfer tend to greatly occur.

As a photosensitive member used in medium-speed machines for the purpose of making copying apparatus small-sized and low-cost, organic photosensitive members (organic photoconductors) are commonly used. Especially for the purpose of taking up wears of the surface layer of the organic photosensitive member to prevent charging performance from deteriorating, Japanese Patent Application Laid-open No. 63-30850 proposes an organic photosensitive member containing a lubricant such as a fine fluorine type resin powder in the surface layer. Such an organic photosensitive member containing a lubricant can certainly enjoy a longer lifetime of the photosensitive member itself, but on the other hand the lubricant is poorly dispersed in the binder resin such as polycarbonate that constitutes the surface layer, resulting in a low smoothness of the surface of the photosensitive member. When such a photosensitive member is used in the image forming method having contact charging and contact transfer systems, the toner remaining after development comes into concaves of that surface, resulting in a greatly low cleaning performance for removing the remaining toner in the cleaning after transfer, to tend to worsen the melt-adhesion of toner to the surfaces of the charging roller and photosensitive member. There have been such problems.

SUMMARY OF THE INVENTION

The present invention aims at providing a toner for developing electrostatic images, that has solved the problems discussed above, a two component type developer having this toner and a carrier, a developing method, an image forming method and a heat fixing method which make use of this toner, and also a process for producing this toner.

More specifically, an object of the present invention is to provide a toner for developing electrostatic images, that can obtain a satisfactory developing performance also in an environment of high humidity; a two component type developer having this toner and a carrier; a developing method, an image forming method and a heat fixing method which make use of this toner; and also a process for producing this toner.

Another object of the present invention is to provide a toner for developing electrostatic images, that can obtain a satisfactory developing performance also in an environment of high humidity and an environment of low humidity; a two component type developer having this toner and a carrier; a developing method, an image forming method and a heat fixing method which make use of this toner; and also a process for producing this toner.

Still another object of the present invention is to provide a toner for developing electrostatic images, that may be hardly affected by humidity and can maintain satisfactory performances also after storage; a two component type developer having this toner and a carrier; a developing method, an image forming method and a heat fixing method which make use of this toner; and also a process for producing this toner.

A further object of the present invention is to provide a toner for developing electrostatic images, that can enjoy a high transfer efficiency because of a superior releasability and facilitates formation of beautiful, pictorial full-color images; a two component type developer having this toner and a carrier; a developing method, an image forming method and a heat fixing method which make use of this toner; and also a process for producing this toner.

A still further object of the present invention is to provide a toner for developing electrostatic images, that may cause no blank areas caused by poor transfer at line image areas; a two component type developer having this toner and a carrier; a developing method, an image forming method and a heat fixing method which make use of this toner; and also a process for producing this toner.

A still further object of the present invention is to provide a toner for developing electrostatic images, that has a superior fluidity, enables uniform feed of the toner to the development and can obtain images free of uneven density and with a uniform quality; a two component type developer having this toner and a carrier; a developing method, an image forming method and a heat fixing method which make use of this toner; and also a process for producing this toner.

A still further object of the present invention is to provide a toner for developing electrostatic images, that can well maintain releasability and lubricity and does not deteriorate over time and running; a two component type developer having this toner and a carrier; a developing method, an image forming method and a heat fixing method which make use of this toner; and also a process for producing this toner.

A still further object of the present invention is to provide a toner for developing electrostatic images, that can well maintain releasability and lubricity, has a superior developing performance without damaging such properties and has a superior durability thereof; a two component type developer having this toner and a carrier; a developing method, an image forming method and a heat fixing method which make use of this toner; and also a process for producing this toner.

A still further object of the present invention is to provide a toner for developing electrostatic images, that has a superior cleaning performance, does not slip away from a cleaner and may cause no faulty cleaning; a two component type developer having this toner and a carrier; a developing method, an image forming method and a heat fixing method which make use of this toner; and also a process for producing this toner.

A still further object of the present invention is to provide an image forming method that may cause no scratch, melt-adhesion and filming on the latent image bearing member in an image forming method making use of a member coming into contact with the latent image bearing member.

A still further object of the present invention is to provide an image forming method that does not contaminate a contact charging member for carrying out charging in contact with the latent image bearing member and may cause no defective images due to abnormal charging.

A still further object of the present invention is to provide an image forming method that can enjoy a superior performance of cleaning the toner adhering to the surfaces of a contact charging member and a contact transfer member.

The present invention provides a toner for developing electrostatic images, comprising toner particles containing a binder resin and a colorant, and fine titanium oxide particles or fine alumina particles;

the surfaces of the fine titanium oxide particles or fine alumina particles having been subjected to an organic treatment and having a methanol wettability half value of 55% or more.

The present invention also provides a two component type developer comprising a toner and a carrier; the toner comprising toner particles containing a binder resin and a colorant, and fine titanium oxide particles or fine alumina particles;

wherein the surfaces of the fine titanium oxide particles or fine alumina particles have been subjected to an organic treatment and have a methanol wettability half value of 55% or more.

The present invention also provides a developing method comprising;

controlling on a developer carrying member the layer thickness of a one component type developer through a developer layer thickness control means to form on the developer carrying member a thin layer of the one component type developer; and developing an electrostatic latent image on an electrostatic latent image bearing member by the use of the one component type developer carried on the developer carrying member; the developer carrying member being provided opposingly to the electrostatic latent image bearing member;

wherein the one component type developer comprises toner particles containing a binder resin and a colorant, and fine titanium oxide particles or fine alumina particles; and the surfaces of the fine titanium oxide particles or fine alumina particles have been subjected to an organic treatment and have a methanol wettability half value of 55% or more.

The present invention still also provides an image forming method comprising;

bringing a contact charging means into contact with an electrostatic latent image bearing member to electrostatically charge the surface of the electrostatic latent image bearing member;

forming an electrostatic latent image on the electrostatic latent image bearing member charged; and developing the electrostatic latent image by the use of a toner to render it visible;

wherein the toner comprises toner particles containing a binder resin and a colorant, and fine titanium oxide particles or fine alumina particles; and the surfaces of the fine titanium oxide particles or fine alumina particles have been subjected to an organic treatment and have a methanol wettability half value of 55% or more.

The present invention still also provides an image forming method comprising;

forming toner images superimposingly on an electrostatic latent image bearing member or an intermediate transfer member by the use of a plurality of toners; and transferring the toner images at one time as a multiple toner image to a recording medium;

wherein the toner comprises toner particles containing a binder resin and a colorant, and fine titanium oxide particles or fine alumina particles; and the surfaces of the fine titanium oxide particles or fine alumina particles have been subjected to an organic treatment and have a methanol wettability half value of 55% or more.

The present invention still also provides an image forming method comprising;

developing an electrostatic latent image formed on an electrostatic latent image bearing member, by the use of a toner to form a toner image; and transferring to a recording medium the toner image formed on the electrostatic latent image bearing member;

wherein the toner comprises toner particles containing a binder resin and a colorant, and fine titanium oxide particles or fine alumina particles; and the surfaces of the fine titanium oxide particles or fine alumina particles have been subjected to an organic treatment and have a methanol wettability half value of 55% or more.

The present invention still also provides a heat fixing method comprising;

heat-fixing toner images superimposingly formed on a recording medium as a multiple image by the use of at least two kinds of toners; the toner images being fixed to the recording medium through a heat fixing means comprised of a heater element and a pressure member that stands opposite to the heater element in pressure contact and brings the recording medium into close contact with the heater element through a film interposed between them;

wherein the toner comprises toner particles containing a binder resin and a colorant, and fine titanium oxide particles or fine alumina particles; and the surfaces of the fine titanium oxide particles or fine alumina particles have been subjected to an organic treatment and have a methanol wettability half value of 55% or more.

The present invention still also provides a process for producing a toner, comprising the steps of;

dispersing fine titanium oxide particles or fine alumina particles in an organic solvent;

adding to the resulting dispersion a silane compound and a silicone oil at the same time, or a silane compound and a silicone oil in this order, to treat the fine titanium oxide particles or fine alumina particles with the silane compound and the silicone oil;

drying the fine titanium oxide particles or fine alumina particles thus treated, to obtain fine titanium oxide particles or fine alumina particles having a methanol wettability half value of 55% or more; and mixing toner particles with the resulting fine titanium oxide particles or fine alumina particles to obtain a toner.

The present invention still also provides a process for producing a toner, comprising the steps of;

forming fine titanium oxide particles or fine alumina particles in a gaseous phase;

vaporizing or atomizing in the gaseous phase a silane compound and a silicone oil at the same time, or a silane compound and a silicone oil in this order, to treat the fine titanium oxide particles or fine alumina particles with the silane compound and the silicone oil to obtain fine titanium oxide particles or fine alumina particles having a methanol wettability half value of 55% or more; and mixing toner particles with the resulting fine titanium oxide particles or fine alumina particles to obtain a toner.

DESCRIPTION OF THE PREFERRED EMBODIMENTS

Figure 1:
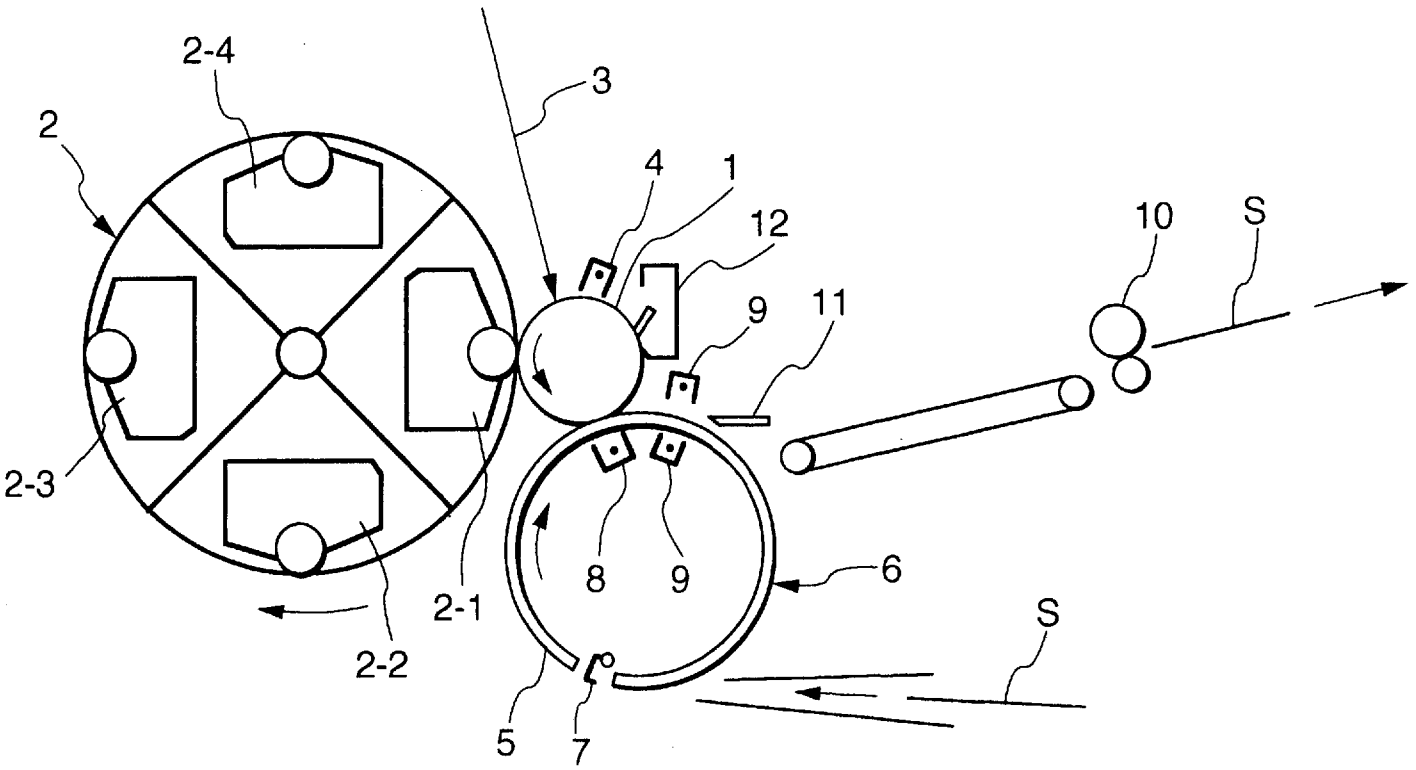
FIG. 1 schematically illustrates the steps of image formation, used in a first embodiment of a first image forming method of the present invention.

As a result of extensive studies, the present inventors have discovered that toners for developing electrostatic images can have a superior developing performance in an environment of high humidity, can make deterioration of developing performance less occur upon leaving and can enjoy a superior transfer performance when fine titanium oxide particles or fine alumina particles externally added and mixed in the toner have been subjected to an organic treatment on their surfaces and have a methanol wettability half value of 55% or more.

Herein, the methanol wettability half value is a value obtained by measuring transmittance in methanol titration utilized when methanol hydrophobicity is measured, and is defined as percent by volume of methanol used, at a point of time when the transmittance reaches a transmittance intermediate between i) transmittance at the point where all the sample has settled, i.e., the point where the transmittance becomes minimum (this point is regarded as an end point, and the methanol hydrophobicity is represented by percent by volume of methanol used) and ii) transmittance before addition of the sample.

This value shows the uniformity in hydrophobicity of fine titanium oxide particles or fine alumina particles; the greater this value is, the more uniformly fine titanium oxide particles or fine alumina particles having high hydrophobic properties stand. That is, when the methanol hydrophobicity is small, toners can be endowed with no moisture resistance as a matter of course. However, also when the methanol hydrophobicity is great, toners having a small methanol wettability half value can not be endowed with sufficient moisture resistance. This is because such toners contain fine titanium oxide particles or fine alumina particles having low hydrophobic properties because of a broad distribution of hydrophobicity of such particles and these particles adversely affect the moisture resistance of toners. Accordingly, the toners can be endowed with sufficient moisture resistance and releasability because the fine titanium oxide particles or fine alumina particles are uniformly held by those having high hydrophobic properties when this methanol wettability half value is 55% or more.

The constitution of the present invention will be detailed below.

The fine titanium oxide particles or fine alumina particles used in the toner of the present invention have a methanol wettability half value of 55% or more, preferably 60% or more, and more preferably 65% or more. The methanol wettability half value obtained by measurement of transmittance enables simple observation of the hydrophobicity distribution of fine titanium oxide particles or fine alumina particles, and shows that fine titanium oxide particles or fine alumina particles having sufficient hydrophobic properties are contained in a large quantity when its value is 55% or more. Hence, the toner can be endowed with good charging performance, releasability and fluidity, and superior developing performance and transfer performance can be obtained. If this value is less than 55%, fine titanium oxide particles or fine alumina particles having no sufficient hydrophobic properties become larger in quantity, and hence as difficulties arising therefrom the moisture resistance may become poor and the developing performance may become poor after toners have been left in an environment of high humidity for a long term, to bring about fog and a decrease in image density. Also, when the toner is used in an image forming method making use of a contact charging means and if this value is less than 55%, fine titanium oxide particles or fine alumina particles having no sufficient hydrophobic properties and having been non-uniformly treated become larger in quantity, and hence as difficulties arising therefrom the releasability may become poor and particles tending to adhere may increase to cause contamination of the electrostatic latent image bearing member and members coming in contact with the electrostatic latent image bearing member, resulting in a decrease or uneveness of image density and occurrence of dot or streak patterns.

Even if the methanol hydrophobicity commonly defined is great, such a difficulty may occur if this methanol wettability half value is small, because fine titanium oxide particles or fine alumina particles highly made hydrophobic are certainly contained but fine titanium oxide particles or fine alumina particles having a small hydrophobicity are also contained in a large quantity. In the present invention, the use of the fine titanium oxide particles or fine alumina particles made to have this methanol wettability half value of 55% or more has made it possible for the toner to contain fine titanium oxide particles or fine alumina particles more uniformly having high hydrophobic properties than conventional toners and to exhibit superior performances. Meanwhile, in the methanol titration, in which particles having lower hydrophobic properties become wet first, the point where the fine titanium oxide particles or fine alumina particles become wet and begin to settle (in the measurement of transmittance, the point where the transmittance begins to decrease) may be present anywhere. So long as the methanol wettability half value is in a sufficient value, the fine titanium oxide particles or fine alumina particles having low hydrophobic properties are contained in a small quantity, and may cause no great problem. The upper limit value of this methanol wettability half value may preferably be 90%, and more preferably 85%.

The methanol wettability half value used in the present invention can be measured by utilizing the methanol titration that measures methanol hydrophobicity. More specifically, a sample is floated on the water and is titrated with methanol, during which the sample having lower hydrophobic properties becomes wet first and the sample begins to settle. Then the addition of methanol is continued and finally the sample having high hydrophobic properties becomes wet, whereupon all the sample settles in the liquid. Regarding this point as the end point, the methanol hydrophobicity is commonly defined. In the present invention, the methanol wettability half value can be determined by measuring transmittance during this methanol titration. That is, the transmittance decreases as the sample begins to settle, and a minimum transmittance comes to be indicated upon settlement of all the sample. If the titration is further continued, the quantity of methanol increases and the transmittance begins to again increase. Namely, the point where the transmittance has become minimum is the end point of the methanol titration, which has a meaning equivalent to the methanol hydrophobicity commonly defined.

With progress of methanol titration, the transmittance first decreases slowly and, at an approach to the end point, the transmittance comes to decrease at a higher rate, which indicates that those having hydrophobic properties close to the end point are contained in a large quantity. Thus, it follows that those having high hydrophobic properties are contained in a large quantity when the percent by volume determined at the point where the transmittance comes to be a half of the transmittance at the end point, i.e., the methanol hydrophobicity is high. Namely, in the present invention, this point is defined as the methanol wettability half value. When this value is 55% or more, not only those having high hydrophobic properties are in a larger content but also they are uniformly treated. Hence, their properties can be uniform and, compared with conventional ones, good results can be obtained, so that the toner can be endowed with superior fluidity, charging performance, releasability, moisture resistance and stability with time.

If the hydrophobicity distribution is broad, the transmittance is seen to decrease successively. Even those in which the end point is presented slowly and a great hydrophobicity is indicated (although certainly those having high hydrophobic properties are contained) come to have a small methanol wettability half value, which means that those having low hydrophobic properties are contained in a large quantity and that they are treated non-uniformly. If the hydrophobicity distribution is narrow but the methanol wettability half value is small, it follows that particles are held by those having insufficient hydrophobic properties.

In the present invention, the methanol wettability half value is determined in the following way. Forty-two (42) $cm^3$ of ion-exchanged water and 28 $cm^3$ of methanol are weighed out and put in a beaker. Since the present invention is characterized in that the methanol wettability half value is 55% or more, the measurement is started at initial concentration of 40%. In an aqueous methanol solution, 0.0100 g of a sample is put and the transmittance is measured using a powder wettability tester WET-100P (manufactured by K.K. Resuka). In the measurement of transmittance, a semiconductor laser with an output of 3 mW and a wavelength of 780 nm is used. The measurement is carried out under conditions of a stirrer rotational speed of 5 $s^{-1}$ and a methanol flow rate of 2.5 $cm^3$ per minute. The transmittance before addition of the sample is represented by $I_0$ (100%), the transmittance during the measurement I (%), and the minimum transmittance measured $I_{min}$ (%), where the methanol wettability half value is expressed as percent by volume of methanol used, at the time the transmittance I come to be $$I=100-[(I_0-I_{min})/2](\%).$$

The methanol wettability half value is calculated as shown below.

Methanol wettability half value (%) = {[amount of methanol used ($cm^3$)]/[amount of methanol used + 42.0 ($cm^3$)]} × 100
Methanol wettability half value (%) = {[amount of methanol titration + 28.0 ($cm^3$)]/[amount of methanol titration + 28.0 + 42.0 ($cm^3$)]} × 100

Here, the percent by volume of methanol used, at the time of the transmittance of $I_{min}$ has a meaning equivalent to the methanol hydrophobicity, and this point is defined as a methanol wettability end point. Methanol wettability end point (%)={[amount of methanol used ($cm^3$) until transmittance minimum point]/[amount of methanol used until transmittance minimum point+42.0 ($cm^3$)]}×100

The methanol hydrophobicity is determined in the following way. Fifty (50) $cm^3$ of ion-exchanged water is put in a beaker, and 0.200 g of a sample is weighed out and also put therein. Methanol is continued to be dropwise added, and the point where the sample floating on the liquid surface has completely disappeared is regarded as the end point. The hydrophobicity is calculated from the following expression.

Hydrophobicity (%) = {titration quantity ($cm^3$)/[titration quantity ($cm^3$) + 50 ($cm^3$)]} × 100

The fine titanium oxide particles or fine alumina particles used in the present invention may preferably have a methanol wettability end point and a methanol hydrophobicity of 60% or more, more preferably 65% or more, and preferably 70% or more, each. If it is less than 60%, the hydrophobic properties of main constituents begin to become insufficient, resulting in poorer moisture resistance with a decrease in this value, and causing deterioration with time of developing performance in an environment of high humidity and developing performance after storage. The upper limit value of this methanol wettability half value and methanol hydrophobicity may preferably be 95%, and more preferably 90%.

The fine titanium oxide particles used in the present invention may include sulfuric acid process titanium oxide, chlorine process titanium oxide and volatile titanium compounds, as exemplified by titanium oxide produced by low-temperature oxidation (thermal decomposition or hydrolysis) of titanium alkoxides, titanium halides or acetylacetonatotitanium. Crystal forms may be anatase type, rutile type, mixed-crystal form of these, or amorphous, any of which may be used.

The fine alumina particles used in the present invention may include alumina produced by the Bayer process, the improved Bayer process, the ethylene chlorohydrin process, the spark-in-water discharge process, the organic aluminum hydrolysis process, the aluminum-alum thermal decomposition process, the ammonium-aluminum-carbonate thermal decomposition process or the aluminum chloride flame decomposition process. Crystal forms may be alpha, beta, gamma, delta, xi, eta, theta, kappa, chi or rho type, mixed-crystal form of any of these, or amorphous, any of which may be used. Alpha, delta, gamma or theta type, mixed-crystal form and amorphous ones are preferably used.

As treating agents used for the organic treatment in the present invention, organosilicon compounds, organotitanium compounds or organoaluminum compounds, capable of reacting with or being physically adsorbed on the fine titanium oxide particles or fine alumina particles may be used, and silane compounds, silicone oils and silicone varnishes are preferably used. A plural kinds of treating agents may be used in combination.

In particular, those treated with a silane compound or a silicone oil are preferred, and those treated with the both are particularly preferred. That is, the surface treatment with the treating agents of these two types makes it possible to uniform the hydrophobicity distribution with that of those having high hydrophobic properties, to make particles uniformly treated, to impart superior fluidity, uniform charging performance, releasability and moisture resistance, and to thereby endow the toner with good developing performance (in particular, developing performance in an environment of high humidity), transfer performance, running performance, and storage stability.

If the silicone oil is not used, it is possible that no sufficient hydrophobic properties are obtained or no releasability is obtained, making poor the developing performance in an environment of high humidity, causing a decrease in transfer efficiency, or bringing about the phenomenon of blank areas caused by poor transfer at line image areas.

If the silane compound is not used, no sufficient hydrophobic properties may be obtained, or the uniformity may be so insufficient that the fluidity and the uniform charging performance may become poor to cause a lowering of developing performance, make image density uneven, cause fog, or make poor the developing performance in an environment of high humidity.

In addition to the above treating agents for making the organic treatment, the fine titanium oxide particles or fine alumina particles may preferably be subjected to organic treatment using in combination, as an additional treating agent, a compound having a substituent containing nitrogen element as shown below.

That is, in the present invention, the fine titanium oxide particles or fine alumina particles are treated with the silane compound or the silicone oil, or the both of them, and those further treated with at least either a silane compound N having a substituent containing nitrogen element or a silicone oil N having a substituent containing nitrogen element are particularly preferred. The surface treatment with the treating agents of these three types makes it more possible to uniform the hydrophobicity distribution with that of those having high hydrophobic properties, to make particles uniformly treated, to impart superior uniform charging performance, releasability and the performance to prevent excess charging, and to thereby endow the toner with good developing performance (in particular, developing performance in an environment of high humidity and an environment of low humidity), transfer performance, running performance, and storage stability. Moreover, in the case of a positively chargeable toner, the toner can be prevented from excess charging, and, in the case of a negatively chargeable toner, its positive charging can be uniformly made stable and particles with reverse polarity can be prevented from being caused. Thus, the toner thus treated can be preferably used in all environments.

The fine titanium oxide particles or fine alumina particles having been thus treated may preferably have an average particle diameter smaller than 0.1 $\mu$m. If it is 0.1 $\mu$m or larger, no sufficient fluidity and no uniform charging performance can be obtained, resulting in poor developing performance and running performance. In the present invention, the average particle diameter of the fine titanium oxide particles or fine alumina particles is a value obtained by actually measuring particle diameters of 400 primary particles sampled at random on a transmission electron microscope of 100,000 magnifications, and calculating their number average diameter. Here, the major axes are measured. With regard to those having a major axis/minor axis ratio of 2 or more, their average values are calculated to determine an average value.

The fine titanium oxide particles or fine alumina particles may also preferably have a moisture content of not more than 3.0% by weight after treatment, where good moisture resistance can be achieved. If their moisture content is more than 3.0% by weight, the fine titanium oxide particles or fine alumina particles may have so high a moisture absorption that the developing performance in an environment of high humidity or after long-term storage may become poor to cause fog. They may more preferably have a moisture content of not more than 2.5% by weight, and particularly preferably from 0.5 to 2.0% by weight. If it is less than 0.5% by weight, the charge quantity may become too high.

In the present invention, the moisture content is measured using a full-automatic moisture content measuring system Model AQS-624 (manufactured by Hiranuma Sangyo K.K.). To obtain a sample, 1 g of a specimen left to stand for 12 hours in an environment of 23° C. and 60% RH is used, and about 0.2 g of the sample is precisely weighed out (A g) to make measurement. The sample is heated at 200° C. to evaporate the adsorbed moisture, and then titrated for 20 minutes by means of the above moisture content meter to determine an adsorbed moisture content (B $\mu$g) of the sample and a reference moisture content (C $\mu$g). The moisture content is calculated according to the following expression.

$$\text{Moisture content(\% by weight)}=[(B-C)/(A\times 1{,}000{,}000)]\times 100$$

The fine titanium oxide particles or fine alumina particles used in the present invention may preferably have a specific surface area of 15 $m^2/g$ or larger as measured by the BET one-point method, more preferably 20 $m^2/g$ or larger, and particularly preferably 25 $m^2/g$ or larger. If their specific surface area is smaller than 15 $m^2/g$, the fluidity and releasability may become poor to adversely affect the developing performance and the transfer performance.

The fine titanium oxide particles or fine alumina particles used in the present invention may also preferably have a bulk density of 0.5 g/cm$^3$ or below, and more preferably 0.45 g/cm$^3$ or below, and particularly preferably 0.4 g/cm$^3$ or below. If their bulk density exceeds 0.5 g/cm$^3$, the fluidity and uniform charging performance may become poor to make developing performance non-uniform and cause uneven density.

The fine titanium oxide particles or fine alumina particles used in the present invention may still also preferably have a blow-off charge quantity of 100 mC/kg or below as an absolute value, and more preferably 80 mC/kg or below. If it exceeds 100 mC/kg, the charging performance tends to become non-uniform or excess charging tends to occur, tending to cause uneven image density and fog.

The fine titanium oxide particles or fine alumina particles used in the present invention may preferably be contained in an amount of from 0.2 to 5.0 parts by weight, more preferably from 0.3 to 4.0 parts by weight, and particularly preferably from 0.4 to 3.5 parts by weight, based on 100 parts by weight of the toner. If they are in a content less than 0.2 part by weight, their addition may become less effective, and if more than 5.0 parts by weight, filming or faulty cleaning tends to occur on the photosensitive drum.

In the present invention, the specific surface area is measured using a fluid type automatic specific surface area measuring device MICROMERITIX FLOWSOAB II Model 2300 (manufactured by Shimadzu Corporation), where 0.2 g of a sample is subjected to degassing at 70° C. for 30 minutes, using a mixed stream of 30% by volume of nitrogen and 70% by volume of helium, and thereafter its specific surface area is measured.

In the present invention, the bulk density is measured according to JIS K-5101.

In the present invention, the blow-off charge quantity is measured using a blow-off powder charge measuring device TB-200 (manufactured by Toshiba Chemical Co., Ltd.). A sample for measurement and a carrier (TEFV 200/300, reduced iron powder, available from Nippon Teppun K.K.) are stored for 12 hours or more in an environment of 23° C. and 60% RH.

The sample for measurement and the carrier are weighed out in a proportion of sample (A):carrier (B)=0.15 g:29.85 g, and are put in a sample mixing container (made of polypropylene; a 50 cm$^3$ cylindrical bottle), which was then hermetically stoppered, followed by shaking for 5 minutes by means of a mix rotor (Model MR-2, Manufactured by Iuchi Seieido K.K.). Thereafter, the resulting sample is left to stand for 5 minutes. About 0.2 g of the mixed sample in the mixing container is precisely weighed out (the weighing value is represented by C) and put in a Faraday's gauge of the blow-off measuring device to make measurement under conditions shown below.

Blow pressure: $9.8\times10^{-2}$ MPa
Blow time: 10 seconds
Blow gas: Nitrogen
Measurement environment: 23° C., 60% RH.
Faraday's gauge filter: SUS316, 400 meshes The charge quantity (triboelectricity) is calculated according to the following expression.

$$\text{Charge quantity}=\text{Quantity of charges measured}(Q)/[C\times A/(A+B)]\ \text{mC/kg}$$

The silane compound may include alkoxysilanes such as methoxysilane, ethoxysilane and propoxysilane, halosilanes such as chlorosilane, bromosilane and iodosilane, silazanes, hydrosilanes, alkylsilanes, arylsilanes, vinylsilanes, acrylsilanes, silyl compounds, siloxanes, silylureas, silylacetamides, and silane compounds having together a different kind of substituent any of these silane compounds have. As specific examples thereof, it includes hexamethyldisilazane, hexamethyltricyclotrisilazane, trimethylsilane, trimethylchlorosilane, trimethylethoxysilane, dimethyldichlorosilane, methyltrichlorosilane, t-butyldimethylmethoxylsilane, allyldimethylchlorosilane, allylphenyldichlorosilane, benzylmethyldichlorosilane, bromomethyldimethylchlorosilane, α-chloroethyltrichlorosilane, β-chloroethyltrichlorosilane, chloromethyldimethylchlorosilane, triorganosilylmercaptane, trimethylsilylmercaptane, triorganosilyl acrylate, vinyldimethylacetoxysilane, dimethyldiethoxysilane, dimethyldimethoxysilane, diphenyldiethoxysilane, hexamethyldisiloxane, 1,3-divinyltetramethyldisiloxane, 1,3-diphenyltetramethyldisiloxane, and a dimethylpolysiloxane having 2 to 12 siloxane units per molecule and containing a silanol group in its units positioned at the terminals.

Of these silane compounds, a silane compound represented by the following Formula (1) is preferred.

$$(R_1)_nSi(OR_2)_{4-n} \quad (1)$$

wherein $R_1$ represents an aryl group, aralkyl group, alkynyl group, alkenyl group or alkyl group which is unsubstituted or part or the whole of hydrogen atoms of which is/are substituted with a fluorine atom or atoms; $R_2$ represents an alkyl group; and n represents an integer of 1 to 3. The substituents $R_1$'s may be the same or, when they have a plurality of substituents, the respective substituents $R_1$'s may be different from each other.

$R_1$ is exemplified by a tolyl group, a styryl group, a phenyl group, a naphthyl group, a benzyl group, an ethynyl group, a vinyl group, a propenyl group, a butenyl group, a methyl group, an ethyl group, a propyl group, an isopropyl group, a butyl group, an isobutyl group, a t-butyl group, a pentyl group, a neopentyl group, a hexyl group, a cyclohexyl group, a heptyl group, an octyl group, a nonyl group and a decyl group, part or the whole of hydrogen atoms of which may be substituted with a fluorine atom or atoms and an alkoxysilane which may have a substituent, or a plurality of substituents of the same or different kinds, which is/are selected from such groups is preferred.

In the above Formula (1), $R_1$ may preferably be unsubstituted, in order to improve the photosensitive drum cleaning performance or in order to uniformly treat the surfaces of particles so that the methanol wettability half value can be made greater.

In particular, in Formula (1), it is preferable for $R_1$ to be an alkyl group having 5 or less carbon atoms, in order to lessen agglomerates and make uniform treatment. The alkyl group having 5 or less carbon atoms is exemplified by a methyl group, an ethyl group, a propyl group, an isopropyl group, a butyl group, an isobutyl group, a t-butyl group, a pentyl group, an isopentyl group, a t-pentyl group, a neopentyl group and a cyclopentyl group, and an alkoxysilane which may have a substituent, or a plurality of substituents of the same or different kinds, which is/are selected from such groups is preferred.

It may specifically include methyltrimethoxysilane, dimethyldimethoxysilane, trimethylmethoxysilane, ethyltrimethoxysilane, diethyldimethoxysilane, triethylmethoxysilane, propyltrimethoxysilane, dipropyldimethoxysilane, tripropylmethoxysilane, isopropyltrimethoxysilane, diisopropyldimethoxysilane, butyltrimethoxysilane, dibutyldimethoxysilane, tributyltrimethoxysilane, isobutyltrimethoxysilane, diisobutyldimethoxysilane, t-butyltrimethoxysilane, di-t-butylmethoxysilane, pentyltrimethoxysilane, ethylmethyldimethoxysilane, ethyldimethylmethoxysilane, propylmethyldimethoxysilane, propyldimethylmethoxysilane, buylmethyldimethoxysilane, buyldimethylmethoxysilane, and ethoxysilanes of these. A high fluidity, a high transfer performance and a stable charging performance can be obtained when these silane compounds are used.

The silicone oil preferably used in the present invention may include reactive silicone oils such as amino-modified silicone oil, epoxy-modified silicone oil, carboxyl-modified silicone oil, carbinol-modified silicone oil, methacryl-modified silicone oil, mercapto-modified silicone oil, phenol-modified silicone oil and heterofunctional group-modified silicone oil; non-reactive silicone oils such as polyether-modified silicone oil, methyl styryl-modified silicone oil, alkyl-modified silicone oil, fatty acid-modified silicone oil, alkoxyl-modified silicone oil and fluorine-modified silicone oil; and straight silicone oils such as dimethylsilicone oil, methylphenylsilicone oil, diphenylsilicone oil and methylhydrogensilicone oil.

Of these silicone oils, preferred is a silicone oil having as a substituent an alkyl group, an aryl group, an alkyl group part or the whole of hydrogen atoms of which is/are substituted with a fluorine atom or atoms, or a hydrogen atom. Stated specifically, it includes dimethylsilicone oil, methylphenylsilicone oil, methylhydrogensilicone oil and fluorine-modified silicone oil.

These silicone oils may preferably have a viscosity at 25° C. of from 5 to 2,000 $mm^2/s$, and more preferably from 10 to 1,000 $mm^2/s$. If it is less than 5 $mm^2/s$, no sufficient hydrophobicity can be obtained in some cases. If it exceeds 2,000 $mm^2/s$, it may become difficult to make uniform treatment when the fine titanium oxide particles or fine alumina particles are treated, or agglomerates tend to be produced and no sufficient fluidity can be obtained in some cases.

The silane compound N having a substituent containing nitrogen element may include silane compounds represented by the following Formula (2), silane coupling agents having a substituent containing nitrogen element, siloxanes having a substituent containing nitrogen element, and silazanes having a substituent containing nitrogen element. Note, however, that the nitrogen atom directly bonded to the silicon atom is not included in the nitrogen element herein defined.

$$(R_2)_m SiY_{4-m} \quad (2)$$

wherein $R_2$ represents an amino group or an organo group having at least one nitrogen atom; Y represents an alkoxyl group or a halogen atom; and m represents an integer of 1 to 3. The organo group having at least one nitrogen atom is exemplified by amino groups having an organic group as a substituent, saturated nitrogen-containing heterocyclic groups, and groups having an unsaturated nitrogen-containing heterocyclic group. The heterocyclic groups are exemplified by those represented by the following formulas. In particular, those having a ring structure of 5 members or 6 members are preferred in view of stability.

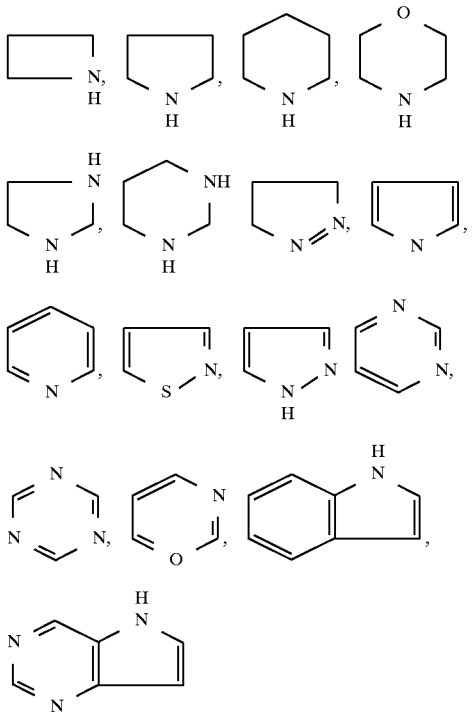

As examples of the silane compound represented by Formula (2) and the silane coupling agents having a substituent containing nitrogen element, they may include aminopropyltrimethoxysilane, aminopropyltriethoxysilane, dimethylaminopropyltrimethoxysilane, dimethylaminopropylmethyldiethoxysilane, diethylaminopropyltrimethoxysilane, dipropylaminopropyltrimethoxysilane, dibutylaminopropyltrimethoxysilane, monobutylaminopropyltrimethoxysilane, dioctylaminopropyltrimethoxysilane, dibutylaminopropylmethyldimethoxysilane, dibutylaminopropyldimethylmonomethoxysilane, dimethylaminophenyltriethoxysilane, trimethoxylsilyl-γ-propylphenylamine, trimethoxylsilyl-γ-propylbenzylamine, trimethoxylsilyl-γ-propylpiperidine, trimethoxylsilyl-γ-propylmorpholine, trimethoxylsilyl-γ-propylimidazole, γ-aminopropyldimethylmethoxysilane, γ-aminopropylmethyldimethoxysilane, 4-aminobutyldimethylmethoxysilane, 4-aminobutylmethyldiethoxysilane, and N-(2-aminoethyl) aminopropyldimethylmethoxysilane.

As examples of the silazanes having a substituent containing nitrogen element, they may include 1,3-bis(3-aminopropyl)-1,1,3,3-tetramethyldisilazane, 1,3-bis(4-aminobutyl)-1,1,3,3-tetramethyldisilazane, 1,3-bis{N(2-aminoethyl)aminopropyl}-1,1,3,3-tetramethyl disilazane, 1,3-bis(dimethylaminopropyl)-1,1,3,3-tetramethyldisilazane, 1,3-bis(diethylaminopropyl)-1,1,3,3-tetramethyldisilazane, 1,3-bis(3-propylaminopropyl)-1,1,3,3-tetramethyldisilazane, and 1,3-bis(3-aminopropyl)-1,1,3,3-tetramethyldisilazane.

As examples of the siloxanes having a substituent containing nitrogen element, they may include 1,3-bis(3-aminopropyl)-1,1,3,3-tetramethyldisiloxane, 1,3-bis(4-aminobutyl)-1,1,3,3-tetramethyldisiloxane, 1,3-bis{N(2-aminoethyl)aminopropyl}-1,1,3,3-tetramethyl disiloxane, 1,3-bis(dimethylaminopropyl)-1,1,3,3-tetramethyldisiloxane, 1,3-bis(diethylaminopropyl)-1,1,3,3-tetramethyldisiloxane, 1,3-bis(3-propylaminopropyl)-1,1,3,3-tetramethyldisiloxane, and 1,3-bis(3-aminopropyl)-1,1,3,3-tetramethyldisiloxane.

The silicone oil N having a substituent containing nitrogen element may include nitrogen-containing silicone oils comprising a silicone oil in which the substituent(s) on its silicon atom(s) is/are any of a hydrogen atom, a phenyl group and an alkyl group part or the whole of hydrogen atoms of which is/are substituted with a fluorine atom or atoms and in which the substituent(s) containing nitrogen element is/are introduced to the side chain, both terminals, one terminal, side-chain one terminal or side-chain both terminals of the polysiloxane skeleton. This substituent may preferably be a substituent represented by the following formula.

$$—R—NR_3R_4,\ —R'NR_5—R''—NR_6R_7,\ —R—R_8,\ \text{or}\ —R—NR_5—R_8$$

wherein R, R' and R" each represent a phenylene group or an alkylene group; $R_3$, $R_4$, $R_5$, $R_6$ and $R_7$ each represent a hydrogen atom, an alkyl group which may have a substituent, or an aryl group; and $R_8$ represents a nitrogen-containing heterocyclic ring. These substituents may have the form of ammonium salts.

These nitrogen-containing silicone oils may have together substituents such as an epoxy group, a polyether group, a methyl styryl group, an alkyl group, a fatty acid ester group, an alkoxyl group, a carboxyl group, a carbinol group, a methacrylic group, a mercapto group, a phenol group and a vinyl group.

These nitrogen-containing silicone oils may preferably have a viscosity at 25° C. of 5,000 $mm^2/s$ or below. If it exceeds 5,000 $mm^2/s$, the silicone oil may become insufficiently dispersed to make it difficult to attain uniform treatment. They may also preferably have an amine equivalent weight of from 200 to 40,000, and more preferably from 300 to 30,000, as determined by dividing the molecular weight by the number of amines per molecule. If this amine equivalent weight is more than 40,000, it may become difficult to effectively moderate charging. If it is less than 200, charges may become excessively largely leak. Any of these nitrogen-containing silicone oils may also be used in plurality. They may specifically include amino-modified silicone oils, and heterofunctional group-modified silicone oils including amino-modified ones.

In the the present invention, the treating agent may preferably be used in the treatment in an amount of from 1 to 60 parts by weight, and more preferably from 2 to 50 parts by weight, based on 100 parts by weight of the fine titanium oxide particles or fine alumina particles. If it is in an amount less than 1 part by weight, the treatment itself can not be effective. If the treating agent is in an amount more than 60 parts by weight, it is impossible to enhance the properties that the base material fine titanium oxide particles or fine alumina particles have a mild chargeability.

In the case when the treating agent is the silane compound, it may preferably be used in the treatment in an amount of from 1 to 40 parts by weight, more preferably from 2 to 40 parts by weight, and particularly preferably from 3 to 35 parts by weight, based on 100 parts by weight of the fine titanium oxide particles or fine alumina particles. If it is in an amount less than 1 part by weight, the particles may be insufficiently made hydrophobic, or no uniform treatment can be made in some cases. If it is in an amount more than 40 parts by weight, agglomerates may be caused or the treatment may become non-uniform.

In the case when the treating agent is the silicone oil, it may preferably be used in the treatment in an amount of from 2 to 40 parts by weight, more preferably from 3 to 35 parts by weight, and particularly preferably from 4 to 30 parts by weight, based on 100 parts by weight of the fine titanium oxide particles or fine alumina particles. If it is in an amount less than 2 parts by weight, the particles may be insufficiently made hydrophobic, or no releasability can be obtained in some cases. If it is in an amount more than 40 parts by weight, agglomerates may be caused or the treatment may become non-uniform.

The silane compound and the silicone oil may be used in plurality in kinds. The silane compound and the silicone oil may also be used in combination.

In the case when these two types of treating agents are used in combination, the treating agents are respectively used within the above ranges, and these may preferably be used in the treatment in an amount of not more than 50 parts by weight, more preferably from 3 to 45 parts by weight, and particularly preferably from 6 to 40 parts by weight, as a total of the both. If they are in an amount more than 50 parts by weight, agglomerates may be caused or the treatment may become non-uniform.

In the case when the treating agent is the silane compound N having a substituent containing nitrogen element, it may preferably be used in the treatment in an amount of from 0.01 to 20 parts by weight, more preferably from 0.05 to 15 parts by weight, and particularly preferably from 0.1 to 10 parts by weight, based on 100 parts by weight of the fine titanium oxide particles or fine alumina particles. If it is in an amount less than 0.01 part by weight, it may become insufficient to prevent excess charging due to leak of charges and to achieve stable positive or negative charging. If it is in an amount more than 30 parts by weight, charges may leak in a large quantity to cause faulty charging or insufficient charging in an environment of high humidity. In the case of negatively chargeable toners, particles with reverse polarity may be caused. In the case of positively chargeable toners, excess charging and selective development may occur.

In the case when the treating agent is the silicone oil N having a substituent containing nitrogen element, it may preferably be used in the treatment in an amount of from 0.1 to 30 parts by weight, more preferably from 0.2 to 20 parts by weight, and particularly preferably from 0.5 to 15 parts by weight, based on 100 parts by weight of the fine titanium oxide particles or fine alumina particles. If it is in an amount less than 0.1 part by weight, it may become insufficient to prevent excess charging due to leak of charges and to achieve stable positive or negative charging. If it is in an amount more than 20 parts by weight, charges may leak in a large quantity to cause faulty charging or insufficient charging in an environment of high humidity. In the case of negatively chargeable toners, particles with reverse polarity may be caused. In the case of positively chargeable toners, excess charging and selective development may occur.

In the case when these three types of treating agents, i.e., the compound having a substituent containing nitrogen element, the silane compound and the silicone oil, are used in combination, the treating agents are respectively used within the above ranges, and these may preferably be used in treatment in an amount of not more than 50 parts by weight, more preferably from 3 to 45 parts by weight, and particularly preferably from 6 to 40 parts by weight, as a total of the three. If they are in an amount more than 50 parts by weight, agglomerates may be caused or the treatment may become non-uniform.

The amount of treatment with the silane compound and the amount of treatment with the silicone oil may preferably be in a ratio of from 0.2 to 5. When treated in this ratio, the surface treatment can be uniformly made with ease, and also high hydrophobic properties can be attained. Effective releasability can also be attained with ease.

The amount of treatment with the treating agent having a substituent containing nitrogen element and the amount of treatment with the treating agent having no substituent containing nitrogen element may preferably be in a ratio of from 0.001 to 0.5. When treated in this ratio, the charging performance can be made more stable, bringing about a superior developing performance in an environment of low humidity.

In the present invention, in addition to the fine titanium oxide particles or fine alumina particles (inorganic fine powder A) described above, another inorganic fine powder may be used in combination. As the inorganic fine powder, any materials may be used so long as the effect of the toner, attributable to external addition of the above fine titanium oxide particles or fine alumina particles is not hindered.

As the inorganic fine powder, an inorganic fine powder B such as those having (i) a larger specific surface area, (ii) a smaller hydrophobicity or (iii) a larger specific surface and smaller hydrophobicity than the fine titanium oxide particles or fine alumina particles subjected to the organic treatment may be used. In such an instance, superior developing performance and fluidity in an environment of low humidity and an environment of high humidity can be attained, and the toner can be made to cause less deterioration of developing performance due to storage and can have a superior transfer performance.

More specifically, the methanol wettability half value can be made greater by uniformly treating the fine titanium oxide particles or fine alumina particles with the organic-treating agent having high hydrophobic properties. Also, the present invention is characterized in that this methanol wettability half value is 55% or more, and thereby toners having superior developing performance and transfer performance can be obtained. Moreover, when the inorganic fine powder B having a larger specific surface area and/or a smaller hydrophobicity than the fine titanium oxide particles or fine alumina particles subjected to the organic treatment is contained, the inorganic fine powder B moderates triboelectricity to a given level because of its action to leak excess charges and make charges non-localized, through polar groups on the surfaces and water molecules around them, so that the charging can be stabilized especially in an environment of low humidity where the charges tend to become excess. Also, it prevents electrostatic agglomeration, imparts a good fluidity, and is effective especially in the environment of low humidity.

As the inorganic fine powder which may be added in addition to the above fine titanium oxide particles or fine alumina particles subjected to the organic treatment, an inorganic fine powder C having a pH of 7 or above may be used. In such an instance, superior developing performance and fluidity in an environment of low humidity and an environment of high humidity can be attained, and the toner can be made to cause less deterioration of developing performance due to storage and can have a superior transfer performance. More specifically, the methanol wettability half value can be made greater by uniformly treating the fine titanium oxide particles or fine alumina particles with the organic-treating agent having high hydrophobic properties. Also, the present invention is characterized in that this methanol wettability half value is 55% or more, and thereby toners having superior developing performance and transfer performance can be obtained. When the inorganic fine powder C having a pH of 7 or above is contained, the inorganic fine powder C moderates triboelectricity to a given level because of its action to leak excess charges and make charges non-localized, through polar groups on the surfaces and water molecules around them, so that the charging can be stabilized especially in an environment of low humidity where the charges tend to become excess. Also, the portions where the inorganic fine powder C has a pH of 7 or above (polar substances and functional groups present on the surfaces) can effectively leak charges without adsorption of excess moisture while making the hydrophobicity higher and also can make small the quantity of triboelectricity of the inorganic fine powder itself, so that the charging can be stabilized without damage of the developing performance and storage stability in the environment of high humidity. Moreover, it prevents electrostatic agglomeration, imparts a good fluidity, and is effective especially in the environment of low humidity.

The inorganic fine powders B and C used in the present invention may include powders of oxides, double oxides, metal oxides, metals, silicon compounds, carbon, carbon compounds, fraren, boron compounds, carbides, nitrides, silicides or ceramics, and preferably metal oxides. Of the metal oxides, silica, alumina, titania and zirconia are particularly preferred. Silica is more particularly preferred, as being capable of appropriate leak of charges and being stable in the action to moderate charges through moisture.

The silica used as the inorganic fine powders B and C may include silica produced by a dry process utilizing vapor phase oxidation of a silicon halide (e.g., thermal decomposition oxidation reaction in oxygen or hydrogen flame), and silica produced by a wet process utilizing decomposition of sodium silicate, alkaline rare earth metal silicates or other silicates by using acid, ammonia, salts or alkali salts. As crystal forms, amorphous silica is used. Metal halides such as aluminum chloride, titanium chloride, germanium chloride, tin chloride, zirconium chloride and zinc chloride and silicon halides may be used together to obtain fine powders of oxides of silicon with other metals, and such powders may also be used. In particular, those produced by the dry process, having not so large internal surface area, are preferably used because of appropriate adsorption of moisture.

The titania used as the inorganic fine powders B and C may include sulfuric acid process titania, chlorine process titania and volatile titanium compounds, as exemplified by titania produced by low-temperature oxidation (thermal decomposition or hydrolysis) of titanium alkoxides, titanium halides or acetylacetonatotitanium. Crystal forms may be anatase type, rutile type, mixed-crystal form of these, or amorphous, any of which may be used. In particular, amorphous ones produced by low-temperature oxidation and anatase type or mixed-crystal type ones produced by the chlorine process or sulfuric acid process are preferably used.

The alumina used as the inorganic fine powders B and C may include alumina produced by the Bayer process, the improved Bayer process, the ethylene chlorohydrin process, the spark-in-water discharge process, the organic aluminum hydrolysis process, the aluminum-alum thermal decomposition process, the ammonium-aluminum-carbonate thermal decomposition process or the aluminum chloride flame decomposition process. Crystal forms may be alpha, beta, gamma, delta, xi, eta, theta, kappa, chi or rho type, mixed-crystal form of any of these, or amorphous, any of which may be used. Alpha, gamma, delta or theta type, mixed-crystal form and amorphous ones are preferably used. In particular, gamma or delta type ones produced by thermal decomposition or flame decomposition are preferably used.

The inorganic fine powder B may have been subjected to an organic treatment. As treating agents therefor, organosilicon compounds, organotitanium compounds or organoaluminum compounds, capable of reacting with or being physically adsorbed on inorganic fine powders may be used, and silane compounds, silicone oils and silicone varnishes are preferably used. A plural kinds of treating agents may be used in combination.

In particular, those treated with either a silane compound or silicone oil are preferred. That is, the surface treatment with such a treating agent makes it possible to prevent charges from excessively leaking when the specific surface area of the inorganic fine powder B becomes larger, and hence the developing performance, transfer performance, running performance and storage stability in an environment of high humidity can be improved.

The silane compound used in the surface treatment of the inorganic fine powder B may include alkoxysilanes such as methoxysilane, ethoxysilane and propoxysilane, halosilanes such as chlorosilane, bromosilane and iodosilane, silazanes, hydrosilanes, alkylsilanes, arylsilanes, vinylsilanes, acrylsilanes, epoxysilanes, silyl compounds, siloxanes, silylureas, silylacetamides, and silane compounds having together a different kind of substituent any of these silane compounds have. The use of these silane compounds facilitates achievement of fluidity, transfer performance and stable charging performance. These silane compounds may be used in combination of plural kinds.

The silicone oil preferably used in the surface treatment of the inorganic fine powder B may include reactive silicone oils such as epoxy-modified silicone oil, carboxyl-modified silicone oil, carbinol-modified silicone oil, methacryl-modified silicone oil, mercapto-modified silicone oil, phenol-modified silicone oil and heterofunctional group-modified silicone oil; non-reactive silicone oils such as polyether-modified silicone oil, methyl styryl-modified silicone oil, alkyl-modified silicone oil, fatty acid-modified silicone oil, alkoxyl-modified silicone oil and fluorine-modified silicone oil; and straight silicone oils such as dimethylsilicone oil, methylphenylsilicone oil, diphenylsilicone oil and methylhydrogensilicone oil.

Of these silicone oils, non-reactive silicone oils and straight silicone oils are preferably used. As specific examples, they include dimethylsilicone oil and polyether-modified silicone oil.

These silicone oils may preferably have a viscosity at 25° C. of from 5 to 2,000 $mm^2/s$, and more preferably from 10 to 1,000 $mm^2/s$. If it is less than 5 $mm^2/s$, no sufficient hydrophobicity can be obtained in some cases. If its viscosity exceeds 2,000 $mm^2/s$, it may become difficult to make uniform treatment when the inorganic fine powder is treated, or agglomerates tend to be produced and no sufficient fluidity can be obtained in some cases. These silicone oils may be used in combination of plural kinds.

The inorganic fine powder B has a larger specific surface area and/or a smaller methanol wettability half value than the fine titanium oxide particles or fine alumina particles, and hence it can moderate leak of charges and charging. If the powder has a smaller specific surface area and a greater methanol hydrophobicity than the fine titanium oxide particles or fine alumina particles, it becomes impossible to moderate the leak of triboelectric charges produced by the toner or moderate the charges through moisture. In other words, the total number of adsorption points of moisture, leak points of charges and migration points of charges can be increased when the inorganic fine powder B has a larger specific surface area than the fine titanium oxide particles or fine alumina particles. Also, the densities of adsorption points of moisture, leak points of charges and migration points of charges can be maintained at a high level when the inorganic fine powder B has a smaller methanol hydrophobicity than the fine titanium oxide particles or fine alumina particles. It is preferable to accomplish the both of them at the same time.

From the viewpoint of the leak of charges, one may think of making small the methanol hydrophobicity of the fine titanium oxide particles or fine alumina particles. However, if it is made small, the treatment is non-uniform, and hence the developing performance, fluidity and transfer performance can no longer be balanced or the leak of charges becomes excess. Thus, the appropriate leak of charges and the action to moderate charges can be effectively achieved when the fine titanium oxide particles or fine alumina particles having a methanol wettability half value of as great as 55% or above as being characteristic of the present invention are used and in addition thereto the inorganic fine powder B is used. Also, when such fine titanium oxide particles or fine alumina particles are simultaneously used, any excess leak of charges, which is a difficulty ascribable to the inorganic fine powder B, can be made minimum. As a matter of course, use of only the inorganic fine powder B chiefly brings out the action of leak of charges, resulting in insufficient charging. Namely, the presence of the fine titanium oxide particles or fine alumina particles assures generation of charges therefrom to keep a balance. In other words, the charges generated from the toner particles and fine titanium oxide particles or fine alumina particles can be made non-localized on the toner particles by the aid of the inorganic fine powder B, and at the same time the excess charges can be leaked to keep the quantity of triboelectricity constant. This is greatly effective especially in an environment of low humidity. Moreover, since polarization can be controlled and also charges do not become excess, electrostatic agglomeration may less occur and the fluidity can be greatly improved. Since also the inorganic fine powder B itself has the action of fluidization, the fluidity can be made very good from this point of view.

Especially, the inorganic fine powder B may preferably have a specific surface area of 30 $m^2/g$ or larger as measured by the BET one-point method, more preferably from 30 to 400 $m^2/g$, and particularly preferably from 50 to 300 $m^2/g$. If its specific surface area is smaller than 30 $m^2/g$, it may become less effectively done to make the leak of charges moderate and the charging non-localized, and it can no longer be so much expected in some cases to effectively make charges moderate and uniform. If its specific surface area is larger than 400 $m^2/g$, the leak of charges becomes excess in some cases.

The inorganic fine powder B may preferably have a methanol hydrophobicity of less than 60%. If it exceeds 60%, the effect of leak of charges and the effect of diffusion of charges tend to be small. However, this methanol hydrophobicity closely correlates with the specific surface area of the inorganic fine powder B, and may be approximately from 20 to 70% when its specific surface area is larger than 200 $m^2/g$, making it possible to well prevent difficulties and make its addition well effective. If it is less than 20%, difficulties may arise. If it exceeds 70%, its addition may be less effective. Similarly, when its specific surface area is 100 to 200 $m^2/g$, its methanol hydrophobicity should be about 10 to 65%, and, when the former is smaller than 100 $m^2/g$, the latter should be 60% or below. That is, the inorganic fine powder B may be made hydrophobic to a certain degree as its specific surface area becomes larger. This makes its use more effective and makes difficulties less occur, keeping a good balance. Thus the hydrophobicity can be made higher depending on the specific surface area. If the specific surface area is smaller than 100 $m^2/g$, it is not so necessary to make the powder hydrophobic. If larger than 100 $m^2/g$, it is preferable to make the powder hydrophobic. If larger than 200 $m^2/g$, it is preferable to make the powder hydrophobic to a certain degree. When the inorganic fine powder B having a specific surface area larger than 100 $m^2/g$ is made hydrophobic and put into use, those having smaller particle diameters can be added in a larger quantity, and hence not only it is easy to make charges moderate and uniform but also it can be much expected to effectively improve fluidity.

The inorganic fine powder B having been treated may preferably have an average particle diameter smaller than 0.1 $\mu$m. If it is 0.1 $\mu$m or larger, it may be difficult to make the leak of charges moderate, and no sufficient fluidity and no uniform charging performance can be obtained, resulting in no effectiveness or poor developing performance and running performance. In particular, its average particle diameter may preferably be smaller than the double of the average particle diameter of the fine titanium oxide particles or fine alumina particles, and particularly preferably be substantially the same as or a little smaller than that of the fine titanium oxide particles or fine alumina particles. Here, the average particle diameter is a value obtained by actually measuring particle diameters of 400 primary particles sampled at random on a transmission electron microscope of 100,000 magnifications, and calculating their number average diameter. The major axes are measured. With regard to those having a major axis/minor axis ratio of 2 or more, their average values are calculated to determine an average value.

The inorganic fine powder B may also preferably have a moisture content of not more than 6.0% by weight, where the toner can be not adversely affected in an environment of high humidity. If its moisture content is more than 6.0% by weight, the inorganic fine powder B may have so high a moisture absorption that the leak of charges in an environment of high humidity or after storage for a long term may become excess to cause fog. The inorganic fine powder B may more preferably have a moisture content of not more than 5.0% by weight, and particularly preferably from not more than 3.0% by weight.

The inorganic fine powder B may also preferably have a bulk density of 0.5 $g/cm^3$ or below, more preferably 0.3 $g/cm^3$ or below, and particularly preferably 0.2 $g/cm^3$ or below. If its bulk density exceeds 0.5 $g/cm^3$, the fluidity may be adversely affected and the developing performance may become non-uniform to cause uneven density.

The inorganic fine powder B may preferably be contained in an amount of 0.05 to 1.5 parts by weight, more preferably from 0.05 to 1.0 part by weight, particularly preferably from 0.1 to 1.0 part by weight, based on 100 parts by weight of the toner. If it is in a content less than 0.05 part by weight, its addition may become less effective, and if more than 1.5 parts by weight, the leak of charges may become greater to tend to cause faulty charging.

The inorganic fine powder B may preferably be contained in an amount not more than 1, and more preferably from 0.02 to 0.8 part by weight, based on 1 part by weight of the fine titanium oxide particles or fine alumina particles. If it is in a content less than 0.02, the addition of the inorganic fine powder B may become less effective, and if more than 1, its addition may make the fine titanium oxide particles or fine alumina particles less effective.

The inorganic fine powder C is treated with one of following compounds to control pH to 7 or more: a silazane compound which can react with or physically adsorbed by the inorganic fine powder C, a silane compound having a nitrogen atom which is directly bonding to the silicon atom, a silane compound having a nitrogen-containing substituent, and a silicone oil having nitrogen-containing substituents. If necessary, for example when sufficient hydrophobicity cannot be obtained by the above treatment, the fine powder C treated with another silane compound or silicone oil may be used. For example, in order to obtain higher hydrophobicity, the powder C may be further treated with other organic silicon compounds, organic titanium compounds, and organic aluminum compounds, preferably silane compounds, silicone oils and silicone varnishes. Plural treating agents may be used concomitantly.

By this surface treatment with these treating agents, the inorganic fine powder C can obtain sufficient hydrophobicity, thus the relaxation of electric charge is effectively carried out at the same time preventing excess leak of the charge. As a result, besides excellent developability, transferability, durability and storage stability under a condition of high humidity, the prevention of excess and uneven charging under a condition of low humidity, as well as charge stability, charge uniformity, and prevention of electrostatic agglomeration can be achieved. In other words, the charge leaking points are once diminished by the hydrophobic modification of the inorganic fine powder, and then mildly functioning charge leaking points can be introduced by newly introducing, for example, a polar substance or functional group, the sites giving pH 7 or more. Accordingly, without unnecessary water adsorption which causes excess charge leak, the charge relaxation can be smoothly carried out. These sites are usually positively chargeable, so that the treated inorganic fine powder C becomes to have small negative triboelectricity, or positively charged. Since inorganic fine powders ordinarily have strong negative charge, thus treated inorganic fine powder can effect mild triboelectricity also from this point. In addition, since the hydrophobicity and specific surface area can be arbitrarily increased, the inorganic fine powder can be adjusted to markedly improve the fluidity of the toner. This effect is especially prominent under a condition of low humidity where the charge amount and electrostatic agglomeration increase. In one-component development, especially, poor fluidity often causes uneven density like stripes or ripples. In this point, the toner of the present invention has great advantage.

Examples of silazane compounds and silane compounds having a nitrogen atom directly bonding to the silicon atom, which are used for the surface treatment of the inorganic fine powder C, include following compounds: hexamethyldisilazane, 1,3-bis(chloromethyl)-1,1,3,3-tetramethyldisilazane, bi(diethylamino)dimethylsilane, bis(dimethylamino)diphenylsilane, bis(dimethylamino)methylvinylsilane, bis(ethylamino)dimethylsilane, bis-N,N'-(trimethylsilyl)piperazine, t-butylaminotriethylsilane, t-butyldimethylaminosilane, t-butyldimethylsilylimidazole, t-butyldimethylsilylpyrrole, N,N'-diethylaminotrimethylsilane, 1,3-di-n-octyltetramethyldisilazane, 1,3-diphenyltetramethyldisilazane, 1,3-divinyl-1,3-dimethyl-1,3-diphenyldisilazane, 1,3-divinyltetramethyldisilazane, heptamethyldisilazane, 1,1,3,3,5,5-hexamethylcyclotrisilazane, nonamethyltrisilazane, octamethylcyclotetrasilazane, 1,1,3,3-tetramethyldisilazane, 2,2,5,5-tetramethyl-2,5-disila-1-azacyclopentane, 1,3,5,7-tetramethyl-1,3,5,7-tetravinylcyclotetrasilazane, 1,1,3,3-tetraphenyl-1,3-dimethyldisilazane, N-trimethylsilylimidazole, N-trimethylsilylmorpholine, N-trimethylsilylpiperazine, N-trimethylsilylpyrrole, N-trimethylsilyltriazole, 1,3,5-trimethyl-1,3,5-trivinylcyclotrisilazane, hexaphenylcyclosilazane, and silazanes having siloxane unit as the substituent. Silazane compounds are specifically preferable to use, because high hydrophobicity can obtained, pH is controlled easily, and the balance in high humidity and low humidity can be easily kept.

The silane compound N having a substituent containing nitrogen element may include silane compounds represented by the following Formula (3), silane coupling agents having a substituent containing nitrogen element, siloxanes having a substituent containing nitrogen element, and silazanes having a substituent containing nitrogen element.

$$(R_3)_pSiY_{4-p} \quad (3)$$

wherein $R_3$ represents an amino group or an organo group having at least one nitrogen atom; Y represents an alkoxyl group or a halogen atom; and p represents an integer of 1 to 3. The organo group having at least one nitrogen atom is exemplified by amino groups having an organic group as a substituent, saturated nitrogen-containing heterocyclic groups, and groups having an unsaturated nitrogen-containing heterocyclic group. The heterocyclic groups are exemplified by those represented by the following formulas. In particular, those having a ring structure of 5 members or 6 members are preferred in view of stability.

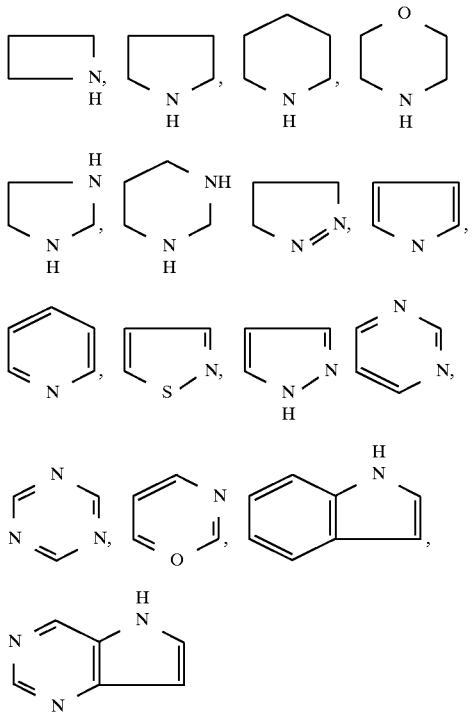

As examples of the silane compound represented by Formula (3) and the silane coupling agents having a substituent containing nitrogen element, they may include aminopropyltrimethoxysilane, aminopropyltriethoxysilane, dimethylaminopropyltrimethoxysilane, dimethylaminopropylmethyldiethoxysilane, diethylaminopropyltrimethoxysilane, dipropylaminopropyltrimethoxysilane, dibutylaminopropyltrimethoxysilane, monobutylaminopropyltrimethoxysilane, dioctylaminopropyltrimethoxysilane, dibutylaminopropylmethyldimethoxysilane, dibutylaminopropyldimethylmonomethoxysilane, dimethylaminophenyltriethoxysilane, trimethoxylsilyl-γ-propylphenylamine, trimethoxylsilyl-γ-propylbenzylamine, trimethoxylsilyl-γ-propylpiperidine, trimethoxylsilyl-γ-propylmorpholine, trimethoxylsilyl-γ-propylimidazole, γ-aminopropyldimethylmethoxysilane, γ-aminopropylmethyldimethoxysilane, 4-aminobutyldimethylmethoxysilane, 4-aminobutylmethyldiethoxysilane, and N-(2-aminoethyl) aminopropyldimethylmethoxysilane.

As examples of the silazanes having a substituent containing nitrogen element, they may include 1,3-bis(3-aminopropyl)-1,1,3,3-tetramethyldisilazane, 1,3-bis(4-aminobutyl)-1,1,3,3-tetramethyldisilazane, 1,3-bis{N(2-aminoethyl)aminopropyl)}-1,1,3,3-tetramethyl disilazane, 1,3-bis(dimethylaminopropyl)-1,1,3,3-tetramethyldisilazane, 1,3-bis(diethylaminopropyl)-1,1,3,3-tetramethyldisilazane, 1,3-bis(3-propylaminopropyl)-1,1,3,3-tetramethyldisilazane, and 1,3-bis(3-aminopropyl)-1,1,3,3-tetramethyldisilazane.

As examples of the siloxanes having a substituent containing nitrogen element, they may include 1,3-bis(3-aminopropyl)-1,1,3,3-tetramethyldisiloxane, 1,3-bis(4-aminobutyl)-1,1,3,3-tetramethyldisiloxane, 1,3-bis{(N(2-aminoethyl)aminopropyl}-1,1,3,3-tetramethyl disiloxane, 1,3-bis(dimethylaminopropyl)-1,1,3,3-tetramethyldisiloxane, 1,3-bis(diethylaminopropyl)-1,1,3,3-tetramethyldisiloxane, 1,3-bis(3-propylaminopropyl)-1,1,3,3-tetramethyldisiloxane, and 1,3-bis(3-aminopropyl)-1,1,3,3-tetramethyldisiloxane.

The silicone oil N having a substituent containing nitrogen element may include nitrogen-containing silicone oils comprising a silicone oil in which the substituent(s) on its silicon atom(s) is/are any of a hydrogen atom, a phenyl group and an alkyl group part or the whole of hydrogen atoms of which is/are substituted with a fluorine atom or atoms and in which the substituent(s) containing nitrogen element is/are introduced to the side chain, both terminals, one terminal, side-chain one terminal or side-chain both terminals of the polysiloxane skeleton. This substituent may preferably be a substituent represented by the following formula.

$$—R—NR_3R_4,\ —R'NR_5—R''—NR_6R_7,\ —R—R_8,\ \text{or}\ —R—NR_5—R_8$$

wherein R, R' and R" each represent a phenylene group or an alkylene group; $R_3$, $R_4$, $R_5$, $R_6$ and $R_7$ each represent a hydrogen atom, an alkyl group which may have a substituent, or an aryl group; and $R_8$ represents a nitrogen-containing heterocyclic ring. These substituents may have the form of ammonium salts.

These nitrogen-containing silicone oils may have together substituents such as an epoxy group, a polyether group, a methyl styryl group, an alkyl group, a fatty acid ester group, an alkoxyl group, a carboxyl group, a carbinol group, a methacrylic group, a mercapto group, a phenol group and a vinyl group.

These nitrogen-containing silicone oils may preferably have a viscosity at 25° C. of 5,000 $mm^2/s$ or below. If it exceeds 5,000 $mm^2/s$, the silicone oil may become insufficiently dispersed to make it difficult to attain uniform treatment. They may also preferably have an amine equivalent weight of from 200 to 40,000, and more preferably from 300 to 30,000, as determined by dividing the molecular weight by the number of amines per molecule. If this amine equivalent weight is more than 40,000, it may become difficult to effectively moderate charging. If it is less than 200, charges may become excessively largely leak. Any of these nitrogen-containing silicone oils may also be used in plurality. They may specifically include amino-modified silicone oils, and heterofunctional group-modified silicone oils including amino-modified ones.

As the other silane compounds to be used for surface treatment of the inorganic fine powder C, there are alkoxysilanes such as methoxysilane, ethoxysilane and propoxysilane; halosilanes such as chlorosilane, bromosilane, and iodosilane; hydrosilanes; alkylsilanes; arylsilanes; vinylsilanes; acrylsilanes; epoxysilanes, silyl compounds, siloxanes, silylureas, silylacetoamides, and silane compounds having substituents of these silane compounds in one molecule. Specifically, there are trimethylsilane, trimethylchlorosilane, trimethylethoxysilane, dimethyldichlorosilane, methyltrichlorosilane, t-butyldimethylmethoxysilane, allyldimethylchlorosilane, allylphenyldichlorosilane, benzylmethyldichlorosilane, bromomethyldimethylchlorosilane, α-chloroethyltrichlorosilane, β-chloroethyltrichlorosilane, chloromethyldimethylchlorosilane, triorganosilylmercaptan, trimethylsilylmercaptan, triorganosilylacrylate, vinylmethylacetoxysilane, dimethyldiethoxysilane, dimethyldimethoxysilane, diphenylethoxysilane, N,O-(bistrimethylsilyl)acetoamide, N,N-bis(trimethylsilyl)urea, hexamethyldisiloxane, 1,3-divinyltetramethyldisiloxane, 1,3-diphenyltetramethyldisiloxane, dimethylpolysiloxane containing 2–12 siloxane units per molecule and having a silanol group in the siloxane unit at the end of the molecule.

The other silicone oils to carry out the surface treatment of the inorganic fine powder includes reactive silicones such as epoxy-modified, carboxy-modified, carbinol-modified, methacryl-modified, mercapto-modified and phenol-modified and silicones modified with different functional groups; non-reactive silicones such as polyether-modified, methylstyryl-modified, alkyl-modified, fatty acid-modified, alkoxy-modified, fluorine-modified silicones; straight silicones such as dimethylsilicone, methylphenylsilicone, diphenylsilicone and methylhydrogensilicone.

Of these silicone oils, non-reactive silicone and straight silicone are preferably used, specifically, dimethylsilicone and polyether-modified silicone.

It is preferable that these silicones have a viscosity of 5–2,000 $mm^2/s$ at 25° C., more preferably 10–1,000 $mm^2/s$. If it is less than 5 $mm^2/s$, sufficient hydrophobicity may not be obtained, and if more than 2,000 $mm^2/s$, uniform treatment of the inorganic fine powder may become difficult or agglomeration may occur and sufficient fluidity may not be obtained. These silicone oils can be used in combination.

The inorganic fine powder C is characterized in that pH is 7 or more, and it can carry out charge leak and charge relaxation. Preferably, the pH is 7.5–12.0, more preferably 8.0–11.0. If the pH is less than 7.0, it is difficult to leak the triboelectric charge generated from organo-treated titanium oxide fine particles, alumina fine particles, or toner, through the charge leakage and charge redistribution with moisture. If the pH is more than 12, the charge leak may become too large, because pH of the inorganic fine powder C is attributed to the polar substance or functional groups, and with a certain amount or more of them, pH becomes 7 or higher. Therefore, the polar substance or functional groups determining pH is a key factor of the charge relaxation. Such substances are obtained by introducing the substituents or functional residues of the treating agent. For example, when a silazane or a silylamine is used, ammonia and amines play this role. When aminosilane or an amino-modified silicone oil is used, the aminoalkyl group on the silicon atom plays this role.

By controlling the pH of the inorganic fine powder C at 7 or higher, the effective density of moisture adsorbing, charge leaking and charge migration points can be maintained. When the specific surface area of the inorganic fine powder is increased, the effective range of moisture-adsorption points, charge-leaking points and charge transfer points can be enlarged.

If only the charge leak is concerned, the half value of methanol wettability of the organo-treated titanium oxide or alumina fine particles might be made small, but this makes the treatment uneven, thus resulting in unbalance between developing performance, fluidity and transferability or in excess charge leak. Accordingly, besides using the organo-treated titanium oxide or alumina fine particles, the use of the inorganic fine powder C of the present invention can provide appropriate charge leak and charge relaxation effects without spoiling the merit of the organo-treated titanium oxide or alumina fine particles. When only the inorganic fine powder C is used, the charge leak increases under a condition of high humidity, often resulting in charge deficiency. This means that the balance is kept by the charge generated from the organo-treated titanium oxide or alumina fine particles. The charge generated from the organo-treated titanium oxide or alumina fine particles is evenly distributed on the toner by the inorganic fine powder C, and at the same time excess charge is leaked to maintain the triboelectricity at a steady level. The effect is greater under a condition of low humidity. In addition, since polarization is inhibited and the charge amount is maintained low, the electrostatic agglomeration hardly occurs and the fluidity of the toner is greatly improved. Further, the inorganic fine powder itself has a fluidization effect to improve the fluidity of the toner to a considerable extent. Also the hydrophobicity of the inorganic fine powder C can be increased, which enables the reduction of the particle diameter or the increase of the specific surface area, thus the fluidizing effect of the inorganic fine powder C can be further increased. It is expected that the addition of the inorganic fine powder C remarkably improves the fluidity of the toner.

In particular, the specific surface area of the inorganic fine powder C according to a BET one-point method is preferably 50 $m^2/g$ or more, while being more preferably 60–400 $m^2/g$, particularly 70–300 $m^2/g$. When that specific surface area is smaller than 50 $m^2/g$, the effect on the charge leakage and delocalization is diluted, so that the effect on the uniform charging and charge relaxation may be reduced. When the specific surface area is larger than 400 $m^2/g$, the charge leakage may be too large.

The degree to which the inorganic fine powder C is made hydrophobic, when measured using methanol (methanol hydrophobicity), is preferably 30% or more, while being more preferably 40% or more, particularly 50% or more. When the metanol hydrophobicity is less than 30%, the charge leakage and charge diffusion effect tends to be larger. When that degree is large, since powder having a smaller particle diameter can be used in a larger amount, the charge relaxation can be easily made uniform and improvement in flowability may be significant.

The particle diameter of the inorganic fine powder C preferably should be smaller than 0.1 μm. When that particle diameter is 0.1 μm or larger, uniform charge leakage is difficult and, since sufficient flowability and uniform chargeability are not imparted, no effect is exhibited, or developability and durability deteriorate. Smaller particle diameter less than twice the particle diameter of titanium oxide and alumina particles is especially preferable, in particular, about the same as, or smaller than, the inorganic fine powder A. Here, the average particle diameter is obtained by measuring the diameters of 400 primary particles, which are optionally selected, by the use of a transmission electron microscope of 100,000 magnifications and by determining a number average diameter from the measured diameters. The major axis and a minor axis of each of the particles are measured, and the major axis is used as a diameter, but when the ratio of the major axis to the minor axis is smaller than 2, the average value of the major and minor axis is used as a diameter.

Bulk density is preferably 0.5 g/cm$^3$ or less, while being more preferably 0.3 g/cm$^3$ or less, particularly 0.2 g/cm$^3$. When the sulk density is more than 0.5 g/cm$^3$, the flowability is affected, and the developability deteriorates so that uneven density may occur.

The content of the inorganic fine powder B is preferably 0.05–2.0 parts by weight based on 100 parts by weight of toner, while being more preferably 0.05–1.5 parts by weight, particularly 0.1–1.0 parts by weight. When that content is smaller than 0.05 parts by weight, the effect of the addition is reduced, and when larger than 2.0, the effect of the inorganic fine powder A is diluted.

The content of the inorganic fine powder C is preferably 1 part by weight or smaller based on 1 part by weight of titanium oxide fine particles or alumina fine particles, while being more preferably 0.02–0.8 parts by weight. When that content is smaller than 0.02 parts by weight, the effect of the inorganic fine powder C may not be exhibited, and when larger than 1 part by weight, the effect of the titanium oxide or alumina particles may be reduced.

In the present invention, the amount of the treating agent is preferably 1–40 parts by weight based on 100 parts by weight of the inorganic fine powder C before being treated, while being more preferably 2–30 parts by weight. When that amount is smaller than 1 part by weight, the effect of the treatment is not exhibited, and when larger than 40 parts by weight, agglomerates increase so that the flowability may deteriorate.

In the case where the treating agent is a silane compound having a nitrogen containing substituent, it is used preferably in 0.01–20 parts by weight based on 100 parts by weight of the inorganic fine powder untreated, while being used more preferably in 0.05–15 parts by weight, particularly 0.1–10 parts by weight. When the amount of the treating agent is smaller than 0.01 parts by weight, the inhibition of excessive charging depending upon the charge leakage and the stability of positive and negative charging may not be sufficient, and when larger than 20 parts by weight, the charge leakage is so large that poor charging or insufficient charging under high humidity conditions may occur. When toner has negative chargeability, reversed polarity particles may be generated, and when having positive chargeability, excessive charging or the selection phenomenon may occur.

In the case where the treating agent is silicone oil having a nitrogen containing substituent, it is used preferably in 0.1–30 parts by weight based on 100 parts by weight of the inorganic fine powder untreated, while being used more preferably in 0.2–20 parts by weight, particularly 0.5–15 parts by weight. When the amount of the treating agent is smaller than 0.1 parts by weight, the inhibition of excessive charging depending upon the charge leakage and the stability of positive and negative charging may not be sufficient, and when larger than 30 parts by weight, the charge leakage is so large that poor charging or insufficient charging under high humidity conditions may occur. When toner has negative chargeability, reversed polarity particles may be generated, and when having positive chargeability, excessive charging or the selection phenomenon may occur.

In the case where those treating agents are used in combination, they each are used in the aforementioned range. The total amount of the treating agents used is preferably 50 parts by weight or smaller, while being more preferably 3–45 parts by weight, particularly 6–40 parts by weight. When that amount is larger than 50 parts by weight, agglomerates may be produced or the treatment is liable to become not uniform.

In the present invention, the pH measurement is carried out by the use of a pH meter using a glass electrode. A sample (4.0 g) is weighed out in a beaker, 50 cm$^3$ of methanol is added to wet the sample, and then 50 cm$^3$ of water is added to be stirred well, followed by measuring pH.

Silica treated with silazane is particularly preferable for the inorganic fine powder C, because it has high hydrophobicity, and in addition, significantly exhibits the effect on the charge relaxation. The reaction of silanol groups on the silica surface with silazanes is promoted by water contained in raw silica, and hence, due to the water the methanol hydrophobicity can be controlled. When the water content is 0.5% or more, the hydrophobicity can be enhanced. The water content is preferably 0.7% or more, more preferably 1.0% or more. The water content can be controlled by wetting or drying raw silica.

As methods for treating the fine titanium oxide particles or fine alumina particles and the inorganic fine powder B or C, they may include a method of treatment in an aqueous medium, a method of treatment in an organic solvent and a method of treatment in a gaseous phase (gaseous phase method).

The method of treatment in an aqueous medium is carried out by dispersing in an aqueous medium the particles to be treated, such as the fine titanium oxide particles or fine alumina particles and the inorganic fine powder B or C, so as to become primary particles, and treating them while hydrolyzing the silane compound. In the case of the silicone oil, the particles are treated utilizing an emulsion. In this method of treatment, since the particles to be treated can be dispersed in the aqueous medium in the form of an aqueous paste as such without the step of drying after their production, the particles can be dispersed in the state of primary particles with ease. On the other hand, since the particles treated exhibit hydrophilic properties after the treatment, the particles begin to coalesce to tend to form agglomerates. When treated using several kinds of treating agents, they may be added simultaneously or may be added successively.

The gaseous phase method includes a method in which a treating agent is dropwise added or sprayed to make treatment while the particles to be treated are well agitated mechanically or by an air stream (hereinafter "gaseous phase method 1"). In this instance, it is also preferable to replace the inside of a reaction vessel with nitrogen or to heat it to 50° to 350° C. When the treating agent has a high viscosity, it may be diluted with a solvent of an alcohol, ketone or hydrocarbon type. In order to enhance the reactivity during the treatment, ammonia, amine, alcohol or water may be added. This method of treatment enables the reaction to surely proceed, and is a preferred method that can make the particles highly and uniformly hydrophobic with ease. If, however, untreated particles are strongly agitated for a long time, the particles may coalesce or may have been treated non-uniformly, and hence care must be taken.

Another gaseous phase method is a method in which, immediately after the particles to be treated have been formed in a carrier gas by gaseous phase processing (chlorine processing or low-temperature oxidation) (and without taking out the particles), the treating agent is, optionally diluted with a solvent, vaporized or atomized to treat in a gaseous phase the particles to be treated (hereinafter "gaseous phase method 2"). In this method, in addition to the advantage of the gaseous phase method 1, the particles to be treated are treated before they coalesce, and hence agglomerates may hardly be formed. Thus, this is a preferred method. When treated using several kinds of treating agents, they may be added simultaneously or may be added successively.

The method of treatment in an organic solvent is a method in which the particles to be treated are dispersed in an organic solvent, treated with a treating agent, followed by filtration or removal of the solvent and then drying. In order to lessen the agglomerates, it is preferable to thereafter carry out disintegration using a pin mill or a jet mill. The drying may be carried out while the particles are left stand at rest or while they are fluidized, and may preferably be carried out while heating to about 50° C. to about 350° C. It may also be done under reduced pressure. As the organic solvent, a hydrocarbon type organic solvent such as toluene, xylene, hexane or Isopar (trademark; available from Humble Oil & Refining Co.). The particles may be dispersed by a method making use of an agitator, a shaker, a pulverizer, a mixing machine or a dispersion machine, among which a dispersion machine making use of media such as balls or beads made of ceramic, agate, alumina or zirconia is preferably used. It is exemplified by a sand mill, a grain mill, a basket mill, a ball mill, a sand grinder, a visco mill, a paint shaker, an attritor, a Daino mill and a pearl mill. As particularly preferred methods of treatment, there are a method in which the particles to be treated are dispersed in the organic solvent to form a paste or a slurry, followed by addition of the treating agent, and the mixture obtained is processed in the dispersion machine; a method in which a paste or slurry of the particles to be treated which is formed using the organic solvent containing the treating agent is processed in the dispersion machine; a method in which a paste or slurry prepared by adding to the organic solvent the treating agent and the particles to be treated is processed in the dispersion machine; a method in which a paste or slurry of the particles to be treated which is formed using the organic solvent containing the treating agent is processed in the dispersion machine; a method in which the treating agent is added while the paste or slurry is processed in the dispersion machine. When treated using several kinds of treating agents, they may be added simultaneously or may be added successively, when the paste or slurry is prepared, or may be added one by one when processed in the dispersion machine. Alternatively, when batch-treated in the dispersion machine, they may be previously added and mixed in the paste or slurry at every batching to the dispersion machine, or may be added successively when processed in the dispersion machine.

The treatment can be made utilizing any of the above four methods, and the treating agents, when used in plurality, may be applied simultaneously, or stepwise dividedly in unspecified order. When applied dividedly several times, these methods of treatment may be used in any combination.

Whatever methods are used, in order to lessen the agglomerates and make well effective the fine titanium oxide particles or fine alumina particles and inorganic fine powder B or C used in the present invention, it is preferable after the treatment to carry out disintegration utilizing a pulverizer such as a pin mil, a hammer mill or a jet mill.

In the case of the fine titanium oxide particles or fine alumina particles, in order to prevent the particles from coalescing during the treatment, control occurrence of the agglomerates or achieve a uniformly high hydrophobicity and a uniform releasability, it is preferable to make simultaneous treatment with the treating agent of a silane compound type and the treating agent of a silicone oil type (the both are simultaneously added as treating agents), or to make treatment with the treating agent of a silane compound type and thereafter with the treating agent of a silicone oil type. As methods for such treatment, the treatment in an organic solvent and the gaseous phase method are preferred. Particularly preferred methods include a method in which the particles are treated simultaneously with the treating agent of a silane compound type and the treating agent of a silicone oil type in an organic solvent; a method in which the particles are treated simultaneously with the treating agent of a silane compound type and the treating agent of a silicone oil type by the gaseous phase method 2; and a method in which particles treated with the treating agent of a silane compound type in the aqueous medium, by the gaseous phase method or in the organic solvent are treated with the treating agent of a silicone oil type in the organic solvent or by the gaseous phase method. Of these methods, a particularly preferred method is to make treatment with the treating agent of a silicone oil type in the organic solvent.

With regard to the inorganic fine powder B or C, the gaseous phase method 1 or the gaseous phase method 2 is preferred in the case of silica, the aqueous medium method, the organic solvent method or the gaseous phase method 2 is preferred in the case of titanium oxide, and the organic solvent method, the gaseous phase method 1 or the gaseous phase method 2 is preferred in the case of alumina.

In the case of the inorganic fine powder C, when silica is used and is treated with a silazane, it is preferable to use a silica material having a moisture content of from 0.5 to 5% by weight and to treat it by the gaseous phase method 1. After the treatment, the powder may preferably be not completely deaerated so that reaction residual groups may remain to a certain extent. Such manner of production makes it easy to obtain an inorganic fine powder having high hydrophobic properties and a superior action of moderating charges.

In the present invention, as the binder resin of the toner, the following binder resins may be used.

For example, usable ones are homopolymers of styrene or derivatives thereof such as polystyrene poly-p-chlorostyrene and polyvinyltoluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl α-chloromethacrylate copolymer, a styrene-acrylonitrile copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer and a styrene-acrylonitrile-indene copolymer; polyvinyl chloride, phenol resins, natural resin modified phenol resins, natural resin modified maleic acid resins, acrylic resins, methacrylic resins, polyvinyl acetate, silicone resins, polyester resins, polyol resins, polyurethanes, polyamide resins, furan resins, epoxy resins, xylene resins, polyvinyl butyral, terpene resins, cumarone indene resins, and petroleum resins. As preferred binder resins, they include styrene copolymers, polyester resins and epoxy resins, and particularly polyester resins, epoxy resins and polyol resins.

Comonomers copolymerizable with styrene monomers in the styrene copolymers may include vinyl monomers such as monocarboxylic acids having a double bond and derivatives thereof as exemplified by acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile and acrylamide; dicarboxylic acids having a double bond and derivatives thereof as exemplified by maleic acid, butyl maleate, methyl maleate and dimethyl maleate; vinyl esters as exemplified by vinyl chloride, vinyl acetate and vinyl benzoate; olefins as exemplified by ethylene, propylene and butylene; vinyl ketones as exemplified by methyl vinyl ketone and hexyl vinyl ketone; and vinyl ethers as exemplified by methyl vinyl ether, ethyl vinyl ether and isobutyl vinyl ether; any of which may be used alone or in combination of two or more.

The styrene polymers or styrene copolymers may be cross-linked or may be mixed resins.

As a cross-linking agent, compounds mainly having at least two polymerizable double bonds may be used, including, for example, aromatic divinyl compounds such as divinyl benzene and divinyl naphthalene; carboxylic acid esters having two double bonds such as ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having at least three vinyl groups; any of which may be used alone or in the form of a mixture.

The fine titanium oxide particles or fine alumina particles used in the present invention have so good a moisture resistance that they can be preferably used in toners containing polyester resin, epoxy resin or polyol resin which is subject to the effect of humidity upon charging performance. That is, they can compensate the disadvantages of such resins and maintain a good developing performance in an environment of high humidity. The polyester resin, epoxy resin and polyol resin are preferably used since they contribute a superior fixing performance and especially a superior color mixing performance in the case of full-color toners. More specifically, when the fine titanium oxide particles or fine alumina particles of the present invention are used in combination with toners containing the polyester resin, epoxy resin or polyol resin as the binder resin, the fixing performance, the developing performance in an environment of high humidity and the storage stability with time can be well obtained. Moreover, in color toners, superior transfer performance and color mixing performance can be achieved, and hence beautiful pictorial images can be obtained.

For the reasons as stated above, the fine titanium oxide particles or fine alumina particles of the present invention are preferably used in styrene resin, polyester resin, and mixtures thereof polyol resin and epoxy resin, and also in graft copolymers or block copolymers of any of these and mixtures thereof.

The epoxy resin and polyol resin used in the present invention are those as shown below. For example, as skeletal factors, those of bisphenol-A type, halogenated bisphenol-A type, biphenyl type, saligenin type, sulfone type, long-chain bisphenol type, resorcin type, bisphenol-F type, tetrahydroxyphenylethane type, novolak type, alcohol type, polyglycol type, polyol type, glycerol triether type, polyolefin type, epoxidated soy bean oil or alicyclic type. Those of bisphenol type are preferred. Also preferably used are any of these further reacted with curing agents, those having a terminal epoxy group reacted with a compound having active hydrogen, those reacted with phenols or polyhydric phenols, those reacted with amines or polyvalent amines, those reacted with carboxylic acids, polybasic acids, acid anhydrides, ester derivatives or lactones, those reacted with polyamides, and those reacted with oligomers having a carboxylic acid group. Those having a hydroxyl group reacted with a carboxylic acid, acid anhydride, lactone or lactam are more particularly preferably used.

The compound having active hydrogen may include, for example, the following. As phenols, it may include phenol, cresol, isopropylphenol, aminophenol, nonylphenol, dodecylphenol, xylenol and p-cumylphenol; and as dihydric phenols, bisphenol-A, bisphenol-F, bisphenol-AD and bisphenol-S. As carboxylic acids, it may include acetic acid, propionic acid, capric acid, lauric acid, myristic acid, palmitic acid, stearic acid, acrylic acid, oleic acid, margaric acid, arachic acid, linolic acid and linolenic acid. As ester derivatives, it may include alkylesters of the above carboxylic acids, among which lower alkyl esters thereof are preferred and methyl esters and ethyl esters are particularly preferably used. As lactones, it may include β-propiolactone, δ-valerolactone, ε-caprolactone, γ-butylolactone, β-butylolactone, and γ-valerolactone. As amines, it may include methylamine, ethylamine, propylamine, isopropylamine, butylamine, amylamine, hexylamine, heptylamine, octylamine, nonylamine, decylamine, undecylamine, dodecylamine, tridecylamine, tetradecylamine, laurylamine and stearylamine.

The polyester resin used in the present invention has the composition as shown below.

As a dihydric alcohol component, it may include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, a bisphenol derivative represented by the following Formula (A):

Formula (A)

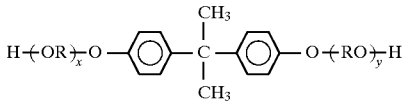

wherein R represents an ethylene group or a propylene group, x and y are each an integer of 0 or more, and a total value of x+y is 0 to 10; and a diol represented by the following Formula (B):

Formula (B)

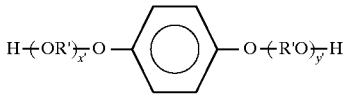

wherein R' represents $-CH_2CH_2-$, $-CH_2-CH(CH_3)-$ or $-CH_2-C(CH_3)_2-$;

x' and y' are each an integer of 0 or more, and a total value of x'+y' is 0 to 10.

As a dibasic acid, it may include dicarboxylic acids and derivatives thereof as exemplified by benzene dicarboxylic acids such as phthalic acid, terephthalic acid, isophthalic acid and phthalic anhydride, or anhydrides or lower alkyl esters thereof; alkyldicarboxylic acids such as succinic acid, adipic acid, sebacic acid and azelaic acid, or anhydrides or lower alkyl esters thereof; alkenylsuccinic acids or alkylsuccinic acids such as n-dodecenylsuccinic acid and n-dodecylsuccinic acid, or anhydrides or lower alkyl esters thereof; unsaturated dicarboxylic acids such as fumaric acid, maleic acid, citraconic acid and itaconic acid, or anhydrides or lower alkyl esters thereof.

A trihydric or higher alcohol component and a tribasic or higher acid component serving also as cross-linking components may preferably be used in combination in order to improve running performance.

The trihydric or higher, polyhydric alcohol component may include, for example, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxybenzene.

The tribasic or higher, polycarboxylic acid component may include polybasic carboxylic acids and derivatives thereof a exemplified by trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl) methane, 1,2,7,8-octanetetracarboxylic acid, Empol trimer acid, and anhydrides or lower alkyl esters of these; and a tetracarboxylic acid represented by the formula:

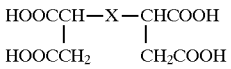

wherein X represents an alkylene group or alkenylene group having 30 or less carbon atoms which may have at least one side chain having 1 or more carbon atoms, and anhydrides or lower alkyl esters thereof.

In the polyester resin used in the present invention, the alcohol component may be used in an amount of from 40 to 60 mol %, and preferably from 45 to 55 mol %; and the acid component, from 60 to 40 mol %, and preferably from 55 to 45 mol %.

The trihydric or -basic or higher, polyhydric or -basic component may preferably be in an amount of from 1 to 60 mol % of the whole components.

From the viewpoint of developing performance, fixing performance and cleaning performance, styrene copolymers, polyester resins, polyol resins and epoxy resins, block copolymers or graft copolymers of any of these, and mixtures of any of these resins are preferred.

In the styrene resin and a mixture of the styrene resin, it may preferably have, in molecular weight distribution as measured by gel permeation chromatography (GPC), a peak in the region of molecular weight of not less than 100,000 and also another peak in the region of molecular weight of from 3,000 to 50,000. This is preferable in view of fixing performance and running performance.

Such a binder resin can be obtained using, for example, the method as describe below.

Polymer (L) having a main peak in the region of molecular weight of from 3,000 to 50,000 and polymer (H) containing a polymer or gel component having a main peak in the region of molecular weight of not less than 100,000 are each prepared using solution polymerization, bulk polymerization, suspension polymerization, emulsion polymerization, block polymerization or grafting. Then these components are blended during melt processing to obtain the binder resin. Part or the whole of the gel component can be cut during the melt kneading, and comes to be a tetrahydrofuran(THF)-soluble matter and measurable by GPC as the component in the region of molecular weight of not less than 100,000.

Particularly preferred methods may include a method in which one of polymer (L) and polymer (H) is prepared by solution polymerization and is blended with the other when polymerization is completed, a method in which one of the polymers is polymerized in the presence of the other polymer, a method in which polymer (H) is formed by suspension polymerization and polymer (L) is prepared by solution polymerization in the presence of the polymer (H), a method in which polymer (H) is blended in a solvent when solution polymerization for polymer (L) is completed, and a method in which polymer (H) is prepared by suspension polymerization in the presence of polymer (L). Use of any of these methods can give a polymer comprised of a low-molecular weight component and a high-molecular weight component which are uniformly mixed.

As a binder resin for the toner used in a pressure fixing system, it may include low-molecular weight polyethylene, low-molecular weight polypropylene, an ethylene-vinyl acetate copolymer, an ethylene-acrylate copolymer, higher fatty acids, polyamide resins and polyester resins. These may be used alone or in the form of a mixture.

When styrene copolymers are used as the binder resin, toners having the following binder resin are preferred in order to obtain good fixing performance, blocking resistance and developing performance.

Good fixing performance, developing performance and blocking resistance can be obtained when, in the molecular weight distribution as measured by GPC (gel permeation chromatography) of the toner, at least one peak (P1) is present in the region of molecular weight of from 3,000 to 50,000, and preferably in the region of molecular weight of from 3,000 to 30,000. If it is present in the region of molecular weight less than 3,000 , no good blocking resistance can be obtained, and, if present in the region of molecular weight more than 50,000, no good fixing performance can be obtained. It is particularly preferred that at least one peak (P2) is present in the region of molecular weight of 100,000 or more, and preferably from 300,000 to 5,000,000, and a maximum peak in the region of molecular weight of 100,000 or more is present in the region of molecular weight of from 300,000 to 2,000,000, where good high-temperature anti-offset properties, blocking resistance and developing performance can be obtained. The larger this peak molecular weight is, the higher the high-temperature anti-offset properties are. When a peak is present in the region of molecular weight of 5,000,000 or more, there is no problem in the case of heat rolls to which a pressure can be applied. However, in the case where no pressure can be applied, fixing performance may be affected because of a excessively high elasticity of toner particles. Hence, in heat fixing carried out under application of a relatively low pressure as used in low-speed copying machines, it is preferred that a peak is present in the region of molecular weight of from 300,000 to 2,000,000 and such a peak is the maximum peak in the region of molecular weight of 100,000 or more.

The component in the region of a molecular weight of 100,000 or less may be in an amount of 50% by weight or more, preferably from 60 to 90% by weight, and particularly preferably 65 to 85% by weight, in the binder resin, within the range of which good fixing performance and anti-offset properties can be obtained. If this component is less than 50%, not only no satisfactory fixing performance can be obtained but also grindability may become poor. If it is more than 90%, anti-offset properties and blocking resistance tend to become weak.

When the polyester resins, epoxy resins and polyol resins are used, a main peak may preferably be present in the region of molecular weight of from 3,000 to 20,000, preferably from 4,000 to 17,000, and particularly preferably from 5,000 to 15,000, in the molecular weight distribution as measured by GPC. When such a binder resin is used in magnetic toners, it is preferred that at least one peak or shoulder is present in the region of molecular weight of 15,000 or more or the component in the region of molecular weight of 50,000 or more may be in an amount not less than 5% by weight. It is also preferred that Mw/Mn (weight average molecular weight/number average molecular weight) is not less than 10.

When the binder resin has the molecular weight distribution as described above, good developing performance, blocking resistance, fixing performance and anti-offset properties can be obtained.

If the main peak is present in the region of molecular weight less than 3,000 , blocking resistance and developing performance tend to lower. If the main peak is in the region of molecular weight more than 20.000, no good fixing performance can be obtained. Good anti-offset properties can be obtained when the component in the region of molecular weight of 50,000 or more is in an amount not less than 5% by weight and Mw/Mn is not less than 10.

The binder resin used in the toner of the present invention may preferably have a glass transition point (Tg) of from 50° to 70° C. If the Tg is lower than 50° C., blocking resistance may become poor. If the Tg exceeds 70° C., fixing performance may become poor.

In the present invention, the molecular weight distribution of the chromatogram obtained by GPC of the toner is measured under the following conditions.

Columns are stabilized in a heat chamber of 40° C. To the columns kept at this temperature, THF (tetrahydrofuran) as a solvent is flowed at a flow rate of 1 ml per minute, and about 100 $\mu$l of THF sample solution is injected thereinto to make measurement. In measuring the molecular weight of the sample, the molecular weight distribution ascribed to the sample is calculated from the relationship between the logarithmic value and count number of a calibration curve prepared using several kinds of monodisperse polystyrene standard samples. As the standard polystyrene samples used for the preparation of the calibration curve, it is suitable to use samples with molecular weights of from $10^2$ to $10^7$, which are available from Showa Denko K.K. or Toso Co., Ltd., and to use at least about 10 standard polystyrene samples. An RI (refractive index) detector is used as a detector. Columns should be used in combination of a plurality of commercially available polystyrene gel columns. For example, they may preferably comprise a combination of Shodex GPC KF-801, KF-802, KF-803, KF-804, KF-805, KF-806, KF-807 and KF-800P, available from Showa Denko K.K.; or a combination of TSKgel G1000H($X_{XL}$), G2000H($X_{XL}$), G3000H($X_{XL}$), G4000H($X_{XL}$), G5000H($X_{XL}$), G6000H($X_{XL}$), G7000H($X_{XL}$) and TSK guard column, available from Toso Co., Ltd.

The sample is prepared in the following way.

A sample is put in THF, and is left to stand for several hours, followed by thorough shaking so as to be well mixed with the THF (until coalescent matter of the sample has disappeared), which is further left to stand for at least 12 hours. At this time, the sample is so left as to stand in THF for at least 24 hours in total. Thereafter, the solution having been passed through a sample-treating filter (pore size: 0.45 to 0.5 $\mu$m; for example, MAISHORI DISK H-25-5, available from Toso Co., Ltd. or EKICHRO DISK 25CR, available from German Science Japan, Ltd., can be utilized) is used used as the sample for GPC. The sample is so prepared to have resin components in a concentration of from 0.5 to 5 mg/ml.

The glass transition point is measured according to ASTM D3418-82. The DSC curve used in the present invention is a DSC curve measured when temperature is once raised and dropped to previously take a history and thereafter the temperature is raised at a rate of temperature raise of 10° C./min. The glass transition point is defined as follows: Glass transition point:

The temperature at a point where a line connecting the middle points of base lines before and after occurrence of changes in specific heat in the DSC curve at the time of temperature rise intersects the DSC curve.

From the viewpoint of an improvement in releasability from a fixing member at the time of fixing and an improvement in fixing performance, it is also preferable to incorporate into the toner any of the following waxes.

For example, they may include paraffin wax and derivatives thereof, montan wax and derivatives thereof, microcrystalline wax and derivatives thereof, Fischer-Tropsch wax and derivatives thereof, polyolefin wax and derivatives thereof, and carnauba wax and derivatives thereof. The derivatives may include oxides, block copolymers with vinyl monomers, and graft-modified products. As other waxes, it is also possible to use alcohols, fatty acids, acid amides, esters, ketones, hardened castor oil and derivatives thereof, vegetable waxes, animal waxes, mineral waxes and petrolactams.

In particular, waxes preferably usable are waxes obtained from low-molecular weight polyolefins obtained by radical polymerization of olefins under a high pressure or polymerization thereof in the presence of a Ziegler catalyst, and by-products from the polymerization; low-molecular weight polyolefins obtained by thermal decomposition of high-molecular weight polyolefins; and waxes obtained from distillation residues of hydrocarbons obtained from a synthetic gas comprised of carbon monoxide and hydrogen, in the presence of a catalyst, or synthetic hydrocarbons obtained by hydrogenation of these. An antioxidant may also be added. The wax may also include those obtained from alcohols, acid amides, esters or montan type derivatives. Those from which impurities such as fatty acids have been removed are also preferred.

As a colorant that can be used in the toner of the present invention may include any suitable dyes or pigments. The colorant of the toner include, for example, as pigments, carbon black, Aniline Black, acetylene black, Naphthol Yellow, Hanza Yellow, Rhodamine Lake, Alizarine Lake, red iron oxide, Phthalocyanine Blue and Indanethrene Blue. Any of these may be used in an amount necessary and sufficient for maintaining optical density of fixed images, and may preferably be added in an amount of from 0.1 to 20 parts by weight, and more preferably from 0.2 to 10 parts by weight, based on 100 parts by weight of the binder resin.

For the same purpose as the above, dyes are also used, including, for example, azo dyes, anthraquinone dyes, xanthene dyes and methine dyes. Any of these may preferably be added in an amount of from 0.1 to 20 parts by weight, and more preferably from 0.3 to 10 parts by weight, based on 100 parts by weight of the binder resin.

As colorants used in cyan color, magenta color and yellow color toners according to the present invention, the following organic pigments or organic dyes are preferably used.

The pigments include disazo yellow pigments, insoluble azo pigments and copper phthalocyanine pigments, and the dyes include basic dyes and oil-soluble dyes.

The dyes may specifically include C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, and C.I. Mordant Blue 7.

The pigments may include Naphthol Yellow S, Hanza Yellow G, Permanent Yellow NCG, Permanent Orange GTR, Pyrazolone Orange G, Benzidine Orange G, Permanent Red 4R, Watching Red calcium salt, Brilliant Carmine 3B, Fast Violet B, Methyl Violet Lake, Phthalocyanine Blue, Fast Sky Blue, and Indanthrene Blue BC.

The pigments may particularly preferably include C.I. Pigment Yellow 83, C.I. Pigment Yellow 97, C.I. Pigment Yellow 17, C.I. Pigment Yellow 15, C.I. Pigment Yellow 13, C.I. Pigment Yellow 14, C.I. Pigment Yellow 12, C.I. Pigment Red 5, C.I. Pigment Red 3, Pigment Red 2, C.I. Pigment Red 6, Pigment Red 7, C.I. Pigment Red 57, C.I. Pigment Red 122, and C.I. Pigment Blue 15, and C.I. Pigment Blue 16 or copper phthalocyanine type pigments having the structural formula (I) shown below, having a phthalocyanine skeleton in which 2 or 3 hydrogen atoms are substituted.

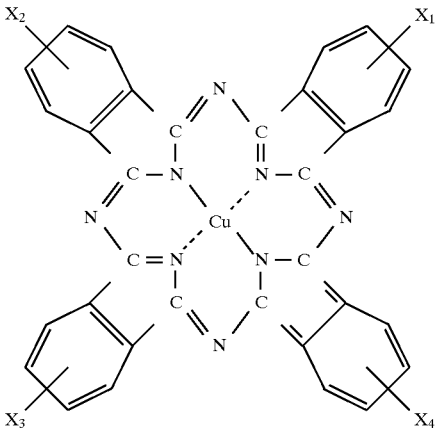

(I)

wherein $X_1$, $X_2$, $X_3$ and $X_4$ each represent a group of

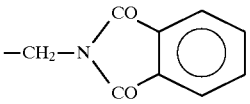

or a hydrogen atom, provided that an instance where all the $X_1$ to $X_4$ are hydrogen atoms is excluded.

The dyes may specifically include C.I. Solvent Red 49, C.I. Solvent Red 52, C.I. Solvent Red 109, C.I. Basic Red 12, C.I. Basic Red 1, and C.I. Basic Red 3b.

In respect of the yellow color toner, which sensitively reflects transmission of OHP films, the colorant may preferably be in a content not more than 12 parts by weight, and more preferably from 0.5 to 7 parts by weight, based on 100 parts by weight of the binder resin.

If it is in a content more than 12 parts by weight, the reproducibility of green color and red color formed by mixture of yellow color with other colors becomes poor, also resulting in a poor reproducibility of human flesh color.

With regard to other magenta and cyan toners, the colorants may each preferably be in a content not more than 15 parts by weight, and preferably from 0.1 to 9 parts by weight, based on 100 parts by weight of the binder resin.

As a colorant for black color, a mixture of dyes or pigments, carbon black, and a metal oxide presenting black color are preferably used.

Such a black colorant may be used in an amount of from 0.1 to 20 parts by weight, and preferably from 1 to 10 parts by weight, based on 100 parts by weight of the binder resin.

When materials having magnetic properties are used in colorants, the colorants can be made to also serve as magnetic materials, and the toners can be used as magnetic toners. As magnetic powders that can be used as such colorants, oxides such as magnetite, hematite and ferrite; and powders of metals such as iron, cobalt and nickel, or alloys and mixtures of any of these metals with a metal such as aluminum, cobalt, copper, lead, magnesium, tin, zinc, antimony, beryllium, bismuth, cadmium, calcium, manganese, selenium, titanium, tungsten or vanadium may be used. Magnetic iron oxide particles containing on the surfaces or insides thereof a compound such as an oxide, hydrous oxide or hydroxide of metal ions such as Si, Al or Mg may preferably be used. Magnetic iron oxide containing silicon element is particularly preferred, which may preferably be in a content of from 0.1 to 3% by weight, more preferably from 0.15 to 3% by weight, and particularly preferably from 0.2 to 2.0% by weight, based on the magnetic powder.

As to the shape of magnetic powder particles, they may be polyhedral, e.g., hexahedral, octahedral, decahedral, dodecahedral or tetradecahedral, or acicular, flaky, spherical or amorphous.

The magnetic powder may preferably have a BET specific surface area as measured using nitrogen gas adsorption, of from 1 $m^2/g$ to 40 $m^2/g$, and more preferably from 2 $m^2/g$ to 30 $m^2/g$, and more preferably 3 $m^2/g$ to 20 $m^2/g$.

The magnetic powder may preferably have a saturation magnetization within the range of from 5 to 200 $Am^2/kg$, and more preferably from 10 to 150 $Am^2/kg$, under application of a magnetic field of 796 kA/m.

The magnetic powder may preferably have a residual magnetization of from 1 to 100 $Am^2/kg$, and more preferably from 1 to 70 $Am^2/kg$, under application of a magnetic field of 796 kA/m.

The magnetic powder may preferably have an average particle diameter of 2.0 $\mu$m or smaller, preferably from 0.03 to 1.0 $\mu$m, more preferably from 0.05 to 0.6 $\mu$m, and still more preferably from 0.1 to 0.4 $\mu$m.

The magnetic powder may be contained in the toner in an amount of from 10 to 200 parts by weight, preferably from 20 to 170 parts by weight, and more preferably from 30 to 150 parts by weight, based on 100 parts by weight of the binder resin.

Using the colorants as described above, the toner of the present invention can be used as a one component type developer or as a two component type developer which is a blend of the toner with a carrier.

In order to impart a suitable charge quantity to the toner of the present invention, it is preferable to add to the toner the following charge control agent. The degree of charging can be controlled by selecting the type and amount of the compound to be added, in accordance with other component materials.

A charge control agent capable of controlling the toner to be positively chargeable includes the following materials.

Nigrosine and products modified with a fatty acid metal salt; quaternary ammonium salts such as tributylbenzylammonium 1-hydroxy-4-naphthosulfonate and tetrabutylammonium teterafluoroborate, and analogues of these, i.e., onium salts such as phosphonium salts, and lake pigments of these, triphenylmethane dyes and lake pigments of these (laking agents include tungstophosphoric acid, molybdophosphoric acid, tungstomolybdophosphoric acid, tannic acid, lauric acid, gallic acid, ferricyanic acid and ferrocyanic acid), and metal salts of higher fatty acids; diorganotin oxides such as dibutyltin oxide, dioctyltin oxide and dicyclohexyltin oxide; and diorganotin borates such as dibutyltin borate, dioctyltin borate and dicyclohexyltin borate; guanidine compounds, and imidazole compounds. Any of these may be used alone or in combination of two or more kinds. Of these, triphenylmethane dyes compounds and quaternary ammonium salts whose counter ions are not halogens may preferably be used. Homopolymers of monomers represented by the following formula (C);

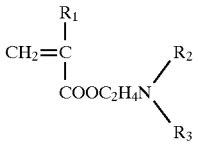

(C)

wherein $R_1$ represents H or $CH_3$; $R_2$ and $R_3$ each represent a substituted or unsubstituted alkyl group (preferably having 1 to 4 carbon atoms); or copolymers of polymerizable monomers such as styrene, acrylates or methacrylates as described above may also be used as positive charge control agents. In this case, these charge control agents can also act as binder resins (as a whole or in part).

In particular, a compound represented by the following formula (D) is preferred in the constitution of the present invention.

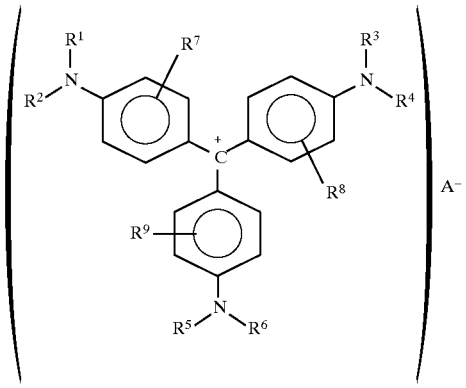

(D)

wherein $R^1$, $R^2$, $R^3$, $R^4$, $R^5$ and $R^6$ may be the same or different from one another and each represent a hydrogen atom, a substituted or unsubstituted alkyl group or a substituted or unsubstituted aryl group; $R^7$, $R^8$ and $R^9$ may be the same or different from one another and each represent a hydrogen atom, a halogen atom, an alkyl group or an alkoxyl group; and $A^-$ represents a negative ion such as a sulfate ion, a nitrate ion, a borate ion, a phosphate ion, a hydroxide ion, an organic sulfate ion, an organic sulfonate ion, an organic phosphate ion, a carboxylate ion, an organic borate ion, or tetrafluorborate.

A charge control agent capable of controlling the toner to be negatively chargeable includes the following materials.

For example, organic metal complex salts and chelate compounds are effective, including monoazo metal complexes, acetylyacetone metal complexes, aromatic hydroxycarboxylic acid and aromatic dicarboxylic acid type metal complexes. Besides, they also include aromatic hydroxycarboxylic acid, aromatic mono- and polycarboxylic acids, and metal salts, anhydrides or esters thereof, and phenol derivatives such as bisphenol.

Azo type metal complexes represented by the formula (E) shown below are preferred.

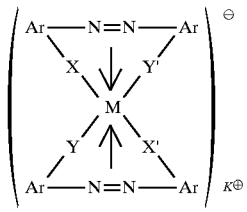

(E)

In the formula, M represents a central metal of coordination, as exemplified by Sc, Ti, V, Cr, Co, Ni, Mn or Fe. Ar represents an aryl group as exemplified by a phenyl group or a naphthyl group, which may have a substituent. In such a case, the substituent includes a nitro group, a halogen atom, a carboxyl group, an anilide group, and an alkyl group or alkoxyl group having 1 to 18 carbon atoms. X, X', Y and Y' each represent —O—, —CO—, —NH— or —NR— (R is an alkyl group having 1 to 4 carbon atoms). $K^+$ represents hydrogen, sodium, potassium, ammonium or aliphatic ammonium.

As the central metal, Fe or Cr is particularly preferred. As the substituent, a halogen atom, an alkyl group or an anilide group is preferred. As counter ions, hydrogen, alkali metal, ammonium or aliphatic ammonium is preferred. Basic organic acid metal complex salts represented by the formula (F) shown below are also capable of imparting negative chargeability, and may be used in the present invention.

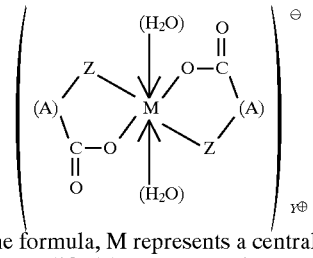

(F)

In the formula, M represents a central metal of coordination, as exemplified by Cr, Co, Ni, Mn, Fe, Zn, Al, Si or B. A represents;

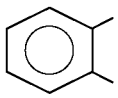

(which may have a substituent such as an alkyl group)

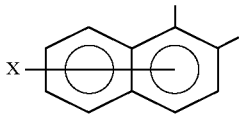

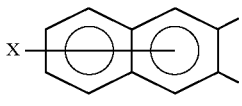

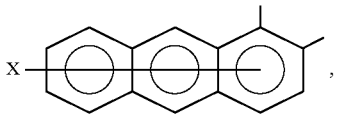

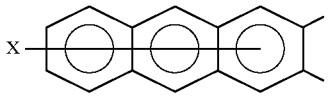

(X represents a hydrogen atom, a halogen atom, a nitro group or an alkyl group), and

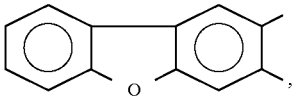

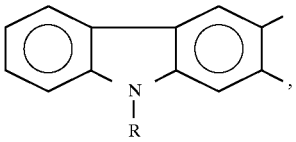

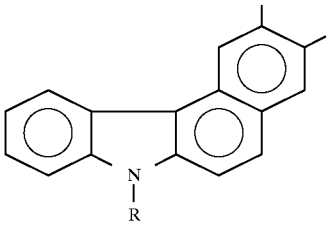

(R represents a hydrogen atom, an alkyl group or alkenyl group having 1 to 18 carbon atoms); Y+ represents hydrogen, sodium, potassium, ammonium, aliphatic ammonium or nothing. Z represents —O— or

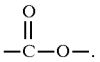

As the central metal, Fe, Cr, Si, Zn or Al is particularly preferred. As the substituent, an alkyl group, an anilide group, an aryl group or a halogen atom is preferred. As counter ions, hydrogen, ammonium or aliphatic ammonium is preferred.

As methods for incorporating the toner with the charge control agent, there are a method of internally adding it into the toner particles and a method of externally adding it to the toner particles. The amount of the charge control agent used depends on the type of the binder resin, the presence or absence of any other additives, and the manner by which the toner is produced, including the manner of dispersion, and can not be absolutely specified. Preferably, the charge control agent may be used in an amount ranging from 0.1 to 10 parts by weight, and more preferably from 0.1 to 5 parts by weight, based on 100 parts by weight of the binder resin. When externally added to toner particles, it may preferably be added in an amount of from 0.01 to 10 parts by weight based on 100 parts by weight of the binder resin, and especially may preferably be made to mechanochemically adhere to the surfaces of toner particles.

To produce the toner according to the present invention, it is preferable to use a method in which the toner component materials as described above are thoroughly mixed by means of a ball mill, a Henschel mixer or other mixer, thereafter the mixture obtained is well kneaded by means of a heat kneader such as a heat roll kneader or an extruder, and the kneaded product is cooled to solidify, followed by mechanical pulverization and classification of the pulverized product to obtain a toner. As other methods, there are a method in which the component materials are dispersed in a solution of the binder resin and thereafter the dispersion obtained is spray-dried to obtain a toner; and a method for producing a toner by polymerization in which given materials are mixed with monomers that will constitute a binder resin to form an emulsion suspension, followed by polymerization. The toner may be a microcapsule toner comprised of a core material and a shell material.

The toner of the present invention can be obtained by thoroughly mixing the toner particles with the fine titanium oxide particles or fine alumina particles and also preferably the inorganic fine powder B or C by means of a mixer such as a Henschel mixer.

To the toner of the present invention, the following additive may be optionally further added.

In order to improve developing performance and running performance, the following inorganic powder may be added, which may include oxides of metals such as magnesium, zinc, aluminum, cerium, cobalt, iron, zirconium, chromium, manganese, strontium, tin and antimony; composite metal oxides such as calcium titanate, magnesium titanate and strontium titanate; metal salts such as calcium carbonate, magnesium carbonate and aluminum carbonate; clay minerals such as kaolin; phosphoric acid compounds such as apatite; silicon compounds such as silicon carbide and silicon nitride; and carbon powders such as carbon black and graphite powder. In particular, zinc oxide, aluminum oxide, cobalt oxide, manganese dioxide, strontium titanate or magnesium titanate is preferred.

For the same purpose, the following organic particles or composite particles may also added, which may include resin particles such as polyamide resin particles, silicone resin particles, silicone rubber particles, urethane resin particles, melamine-formaldehyde resin particles and acrylic resin particles; and composite particles of any of rubber, wax, fatty acid compound or resin with particles of an inorganic material such as metal, metal oxide or salt, or carbon black.

A lubricant powder as shown below may also be added. It may include fluorine resins such as Teflon and polyvinylidene fluoride; fluorine compounds such as carbon fluoride; fatty acid metal salts such as zinc stearate; fatty acids, and fatty acid derivatives such as fatty acid esters; molybdenum sulfide; amino acid, and amino acid derivatives.

When the toner of the present invention is used as the two component type developer, the toner is blended with a carrier. The toner and the carrier may be blended in a ratio giving a toner concentration of from 0.1 to 50% by weight, preferably from 0.5 to 20% by weight, and more preferably from 3 to 10% by weight.

As a core material of the carrier, for example, metals such as iron, cobalt, nickel, copper, zinc, manganese, chromium and rare earth elements, and alloys or oxides thereof, having been surface-oxidized or unoxidized. In particular, materials containing 98% by weight or more of ferrite carrier are preferably used.

There are no particular limitations on methods of producing the carrier. A coated carrier comprising core material particles whose surfaces are coated with resin or the like is particularly preferred. As methods for the coating, conventionally known methods may be applied, e.g., a method in which a coating material such as a resin may be dissolved or suspended in a solvent to prepare a coating solution, and the solution may be coated to make it adhere to carrier particle surfaces, and a method in which carrier particles are merely mixed with coating powder by a dry process.

As a binder resin used for the coating to obtain the coated carrier, it may include homopolymers or copolymers of styrenes such as styrene and chlorostyrene; monoolefins such as ethylene, propylene, butylene and isobutylene; vinyl esters such as vinyl acetate, vinyl propionate, vinyl benzoate and vinyl lactate; α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; vinyl ethers such as methyl vinyl ether, ethyl vinyl ether and butyl vinyl ether; vinyl ketones such as methyl vinyl ketone, hexyl vinyl ketone and isopropenyl vinyl ketone. In particular, as typical binder resins, it may include polystyrene, a styrene-alkyl acrylate copolymer, a styrene-acrylonitrile copolymer, a styrene-butadiene copolymer, a styrene-maleic anhydride copolymer, polyethylene and polypropylene, in view of dispersibility of conductive fine particles, film forming properties as coat layers, prevention of toner-spent, productivity and so forth. It may further include polycarbonate, phenol resins, polyesters, polyurethanes, epoxy resins, polyolefins, fluorine resins, silicone resins and polyamides. Especially from the viewpoint of the prevention of toner-spent, it is more preferable to contain a resin having a small critical surface tension, as exemplified by polyolefin resin, fluorine resin and silicone resin.

The fluorine resin, polyolefin resin or silicone resin may be blended in a content of from 1.0 to 60% by weight, particularly from 2.0 to 40% by weight as its proportion to the total weight of the binder. If it is in a content less than 1.0% by weight, the surface modification can not be well effective and can be less effective against the toner-spent. If it is in a content more than 60% by weight, the both components can be uniformly dispersed with difficulty to cause a partial non-uniformity in volume resistivity, resulting in a poor charging performance.

The fluorine resin used as the binder resin for the coating of carrier particles may specifically include solvent-soluble copolymers of vinyl fluoride, vinylidene fluoride, trifluoroethylene, chlorotrifluoroethylene, dichlorodifluoroethylene, tetrafluoroethylene or hexafluoropropylene with other monomers.

The silicone resin used as the binder resin for the coating of carrier particles may specifically include KR271, KR271, KR311, KR255 and KR255 (straight silicone varnish), KR211, KR212, KR216, KR213, KR217 and KR9218 (modifying silicone varnish), SA-4, KR206 and KR206 (silicone alkyd varnish), ES1001, ES10001N, ES1002T and ES1004 (silicone epoxy varnish), KR9706 (silicone acrylic varnish), and KR5203 and KR5221 (silicone polyester varnish), all available from Shin-Etsu Silicone Co., Ltd.; and SR2100, SR2101, SR2107, SR2110, SR2108, SR2109, SR2400, SR2410, SR2411, SH805, SH806A and SH8401, available from Toray Silicone Co., Ltd.

The above material may be used in an amount appropriately determined. Usually, it may preferably be used in an amount of from 0.1 to 30% by weight, and more preferably from 0.5 to 20% by weight, based on the weight of the carrier.

The carrier may preferably have an average particle diameter of from 20 to 100 $\mu$m, preferably from 25 to 70 $\mu$m and still more preferably from 25 to 65 $\mu$m.

A particularly preferred carrier may include carriers comprising Cu—Zn—Fe [compositional weight ratio of (5–20):(5–20):(30–80)] three-component ferrite particles whose surfaces are coated with fluorine resin, styrene resin or silicone resin, or a mixed resin thereof, as exemplified by mixed resins such as a mixture of polyvinylidene fluoride with styrene-methyl methacrylate resin, a mixture of polytetrafluoroethylene with styrene-methyl methacrylate resin, and a mixture of a fluorine type copolymer with a styrene type copolymer, in a ratio of from 90:10 to 20:80, and preferably from 70:30 to 30:70. As a preferred carrier, it may include a coated magnetic ferrite carrier coated with such a coating resin in a coating weight of from 0.01 to 5% by weight, and preferably from 0.1 to 1% by weight, containing 70% by weight or more of 250 mesh-pass and 400 mesh-on carrier particles and having the above average particle diameter. The fluorine type copolymer is exemplified by a vinylidene fluoride-tetrafluoroethylene copolymer (10:90 to 90:10) and the styrene type copolymer is exemplified by a styrene-2-ethylhexyl acrylate copolymer (20:80 to 80:20)) and a styrene-2-ethylhexyl acrylate-methyl methacrylate copolymer (20–60:5–30:10–50).

The above coated ferrite carrier having a sharp particle size distribution can provide a triboelectric chargeability preferable for the toner of the present invention, and also is effective for improving electrophotographic performances.

When the two-component developer is prepared by blending the toner of the present invention with the carrier, good results can be obtained when they are blended in such a proportion that gives a toner concentration of from 1% by weight to 15% by weight, and preferably from 2% by weight to 13% by weight in the developer. If it is in a con cent ration more than 15% by weight, fog and in-machine toner scatter may increase to tend to shorten the lifetime of the developer.

The image forming method and developing method making use of the toner of the present invention will be described below.

In the the image forming method of the present invention, a first image forming method has the steps of;

developing an electrostatic latent image formed on an electrostatic latent image bearing member, by the use of a toner to form a toner image; and transferring to a recording medium the toner image formed on the electrostatic latent image bearing member.

A first embodiment of the first image forming method of the present invention will be described with reference to FIG. 1, taking an example of a full-color electrophotographic process.

An electrostatic latent image formed on a photosensitive drum 1 serving as an electrostatic latent image bearing member, through a latent image forming means 3 is rendered visible by a two component type developer having a first color toner and a carrier, held in a developing assembly 2-1 serving as a developing means, fitted to a rotary developing unit 2 which is rotated in the direction of an arrow. The color toner image (the first color) thus formed on the photosensitive drum 1 is transferred by means of a transfer charging assembly 8 to a transfer medium (a recording medium) S held on a transfer drum 6 by a gripper 7.

In the transfer charging assembly 8, a corona charging assembly or a contact transfer charging assembly is used. In the case when the corona charging assembly is used in the transfer charging assembly 8, a voltage of −10 kV to +10 kV is applied, and transfer electric currents are set at −500 $\mu$A to +500 $\mu$A. On the periphery of the transfer drum 6, a holding member is provided. This holding member is formed of a film-like dielectric sheet such as a polyvinylidene fluoride resin film or a polyethylene terephthalate film. For example, a sheet with a thickness of from 100 $\mu$m to 200 $\mu$m and a volume resistivity of from $10^{12}$ to $10^{14}$ $\Omega$·cm is used.

Next, for the second color, the rotary developing unit 2 is rotated until a developing assembly 2-2 faces the photosensitive drum 1. Then, a second latent image is developed by a two component type developer having a second color toner and a carrier, held in a developing assembly 2-2, and the color toner image thus formed is also superimposingly transferred to the same transfer medium (recording medium) as the above.

Similar operation is also repeated for the third and fourth colors. Thus, the transfer drum 6 is rotated given times while the transfer medium (recording medium) is kept being gripped thereon, so that the toner images corresponding to the number of given colors are multiple-transferred to the transfer medium. Transfer electric currents for electrostatic transfer may preferably be made greater in the order of first color, second color, third color and fourth color so that the toners may less remain on the photosensitive drum 1 after transfer.

Excessively high transfer electric currents are not preferable since the images being transferred may be distorted. Since, however, the toner of the present invention has a superior transfer performance, the second, third and fourth color images to be multiple-transferred can be neatly transferred even if the transfer electric currents are not made greater. Hence, images of any turn of colors are neatly formed, and a multi-color image with sharp tones can be obtained. Also, in full-color images, beautiful images with a superior color reproduction can be obtained. Moreover, since it is no longer necessary to make the transfer electric currents great so much, the image distortion in the transfer step can be made less occur. When the transfer medium is separated from the transfer drum 6, charges are eliminated by means of a separation charging assembly 9, where the transfer medium may greatly be electrostatically attracted to the transfer drum if the transfer electric currents are great, and the transfer medium can not be separated unless the electric currents at the time of separation are made greater. If made greater, since such electric currents have a polarity reverse to the transfer electric currents, the toner images may be distorted, or the toners may scatter from the transfer medium to contaminate the inside of the image forming apparatus. Since the toner of the present invention can be transferred with ease, the transfer medium can be readily separated without making the separation electric currents greater, so that the image distortion and toner scatter at the time of separation can be prevented. Hence, the toner of the present invention can be preferably used especially in the image forming method that forms multi-color images or full-color images, having the step of multiple transfer.

The transfer medium on which the multiple transfer has been completed is separated from the transfer drum 6 by means of the separation charging assembly 9. Then the toner images held thereon are fixed by means of a heat-pressure roller fixing assembly 10 having a web impregnated with silicone oil, and color-additively mixed at the time of fixing, whereupon a full-color copied image is formed.

Supply toners to be fed to the developing assemblies 2-1 to 2-4 are transported in quantities predetermined in accordance with supply signals, from supply hoppers provided for the respective color toners, through toner transport cables and to toner supply cylinders provided at the center of the rotary developing unit 2, and fed therefrom to the respective developing assemblies.

In the image forming method of the present invention, a second image forming method comprises;

forming toner images superimposingly on an electrostatic latent image bearing member or an intermediate transfer member by the use of a plurality of toners; and transferring the toner images at one time to a recording medium.

Figure 2:
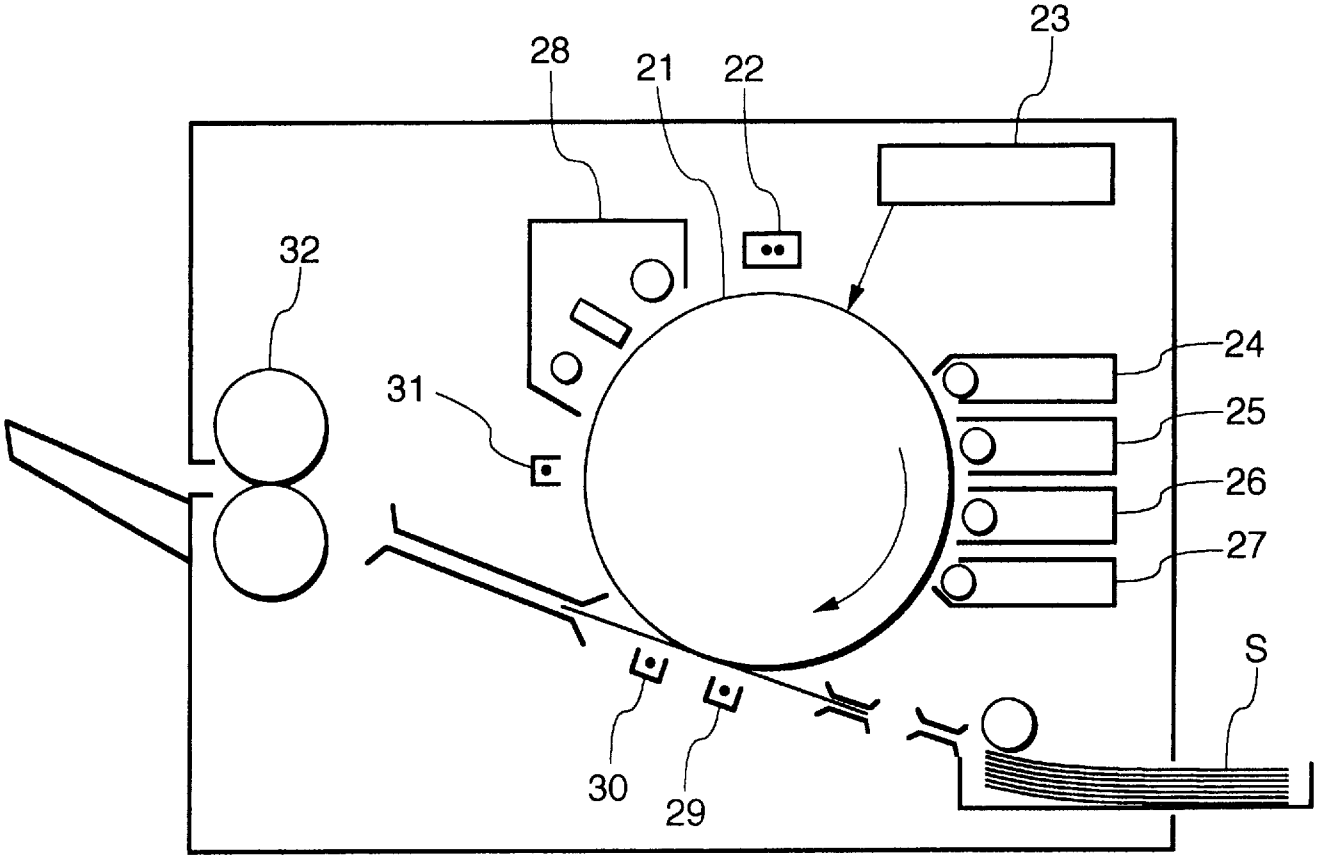
FIG. 2 schematically illustrates the steps of image formation, used in a first embodiment of a second image forming method of the present invention.

A first embodiment of the second image forming method of the present invention, which forms a multiple toner image (toner images superimposingly formed) on an electrostatic latent image bearing member, will be described with reference to FIG. 2, taking an example of a full-color electrophotographic printer.

Electrostatic latent images formed on a photosensitive drum 21 serving as the electrostatic latent image bearing member, by a charging assembly 22 and an exposure means 23 making use of laser light is rendered visible by development successively carried out using toners by means of developing assemblies 24, 25, 26 and 27. In the developing process, non-contact development is preferably used. In the non-contact development, the developer layer formed in the developing assembly does not rub on the surface of the photosensitive drum 21, and hence the developing can be carried out without distortion of the image formed in the preceding developing step in the second and subsequent developing steps. As to the order of developing, in the case of multi-colors, the developing may preferably be carried out first on a color other than black and having higher brightness and chroma. In the case of full-colors, the developing may preferably be carried out in the order of yellow, then either magenta or cyan, thereafter the remainder of either magenta or cyan, and finally black.

The toner images for a multi-color image or full-color image which have been superimposingly formed on the photosensitive drum 21 are transferred to a transfer medium (a recording medium) S by means of a transfer charging assembly 29. In the transfer step, electrostatic transfer is preferably used, where corona discharging or contract transfer is utilized. The former is a method in which a transfer charging assembly 29 that generates corona discharge is provided opposingly to the toner images, interposing the transfer medium S between them, and corona discharge is acted on the back of the transfer medium S to electrostatically transfer the toner images. The latter is a method in which a transfer roller or transfer belt is brought into contact with the photosensitive drum 21 and then the toner images are transferred while applying a bias to the roller, or by electrostatic charging from the back of the belt. By such an electrostatic transfer, the multi-color toner images held on the photosensitive drum 21 are transferred at one time to the transfer medium S. Since, in such a one-time transfer system, the toners transferred are in a large quantity, the toners may remain in a large quantity after transfer to tend to cause non-uniform transfer and, in the full-color image, tend to cause color non-uniformity.

However, the toner of the present invention has so good a transfer performance that any color images of the multi-color image can be neatly formed. In full-color images, beautiful images with a superior color reproduction can be obtained. Moreover, since it is easy to separate the transfer medium, the image distortion and toner scatter at the time of separation can be made less occur. Also, because of a superior releasability, a good transfer performance can be exhibited in the contact transfer means. Hence, the toner of the present invention can be preferably used also in the image forming method having the step of multiple image one-time transfer.

The transfer medium on which the multi-color toner images have been transferred at one time is separated from the photosensitive drum 21 by means of a separation charging assembly 30, and then fixed by means of a heat roller fixing assembly 32, whereupon a multi-color image is formed.

Figure 3:
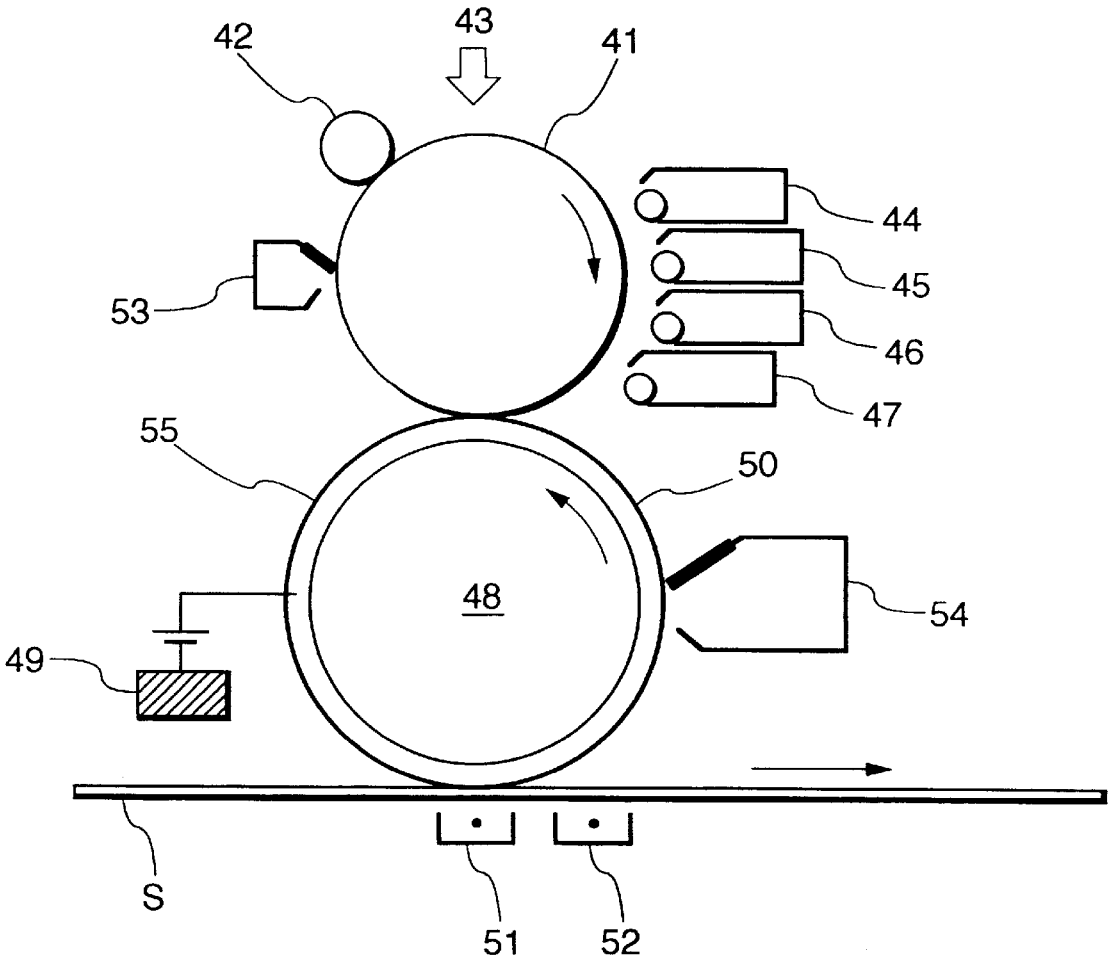
FIG. 3 schematically illustrates the steps of image formation, used in a second embodiment of the second image forming method of the present invention.

In the second image forming method of the present invention, a second embodiment, in which the multiple toner image (toner images superimposingly formed) is formed on an intermediate transfer member, will be described with reference to FIG. 3, taking an example of a full-color image forming apparatus employing an intermediate transfer member.

A photosensitive drum 41 serving as an electrostatic latent image bearing member is made to have a surface potential thereon by means of a charging roller 42 provided opposingly to the photosensitive drum and rotated in contact therewith, and an electrostatic latent image is formed thereon by means of an exposure means 43. The electrostatic latent image thus formed is developed by means of developing assemblies 44, 45, 46 and 47 to form toner images. The toner images thus formed are transferred to an intermediate transfer member 48 for each color. Upon repetition of the transfer given times, multiple toner images are formed. The intermediate transfer member used has the shape of a drum, which has a holding member stretched over its periphery and has a substrate provided thereon with a conductivity-providing member, e.g., an elastic layer (made of, e.g., nitrile butadiene rubber) containing carbon black, zinc oxide, tin oxide or titanium oxide well dispersed therein. A belt-like intermediate transfer member may be used. The intermediate transfer member 48 may preferably be constituted of an elastic layer 50 having a hardness of from 10 to 50 degrees (JIS K-6301) or, in the case of a transfer belt, constituted of a support member 55 having the elastic layer 50 having such a hardness at the part where toner images are transferred to a transfer medium (a recording medium). The toner images are transferred from the photosensitive drum 41 to the intermediate transfer member 48 by applying a bias voltage to a mandrel 55 serving as the support member of the intermediate transfer member 48, so that transfer electric currents are produced and the toner images are transferred. Corona discharging or roller charging from the back of the belt may also be utilized. The multiple toner images on the intermediate transfer member 48 are transferred at one time to a transfer medium S by means of a transfer means 51. As the transfer means, a corona charging assembly or a contact electrostatic transfer means making use of a transfer roller or transfer belt is used. This image forming method is also preferably used since the effect as in the two methods previously described can be also obtained.

Figure 4:
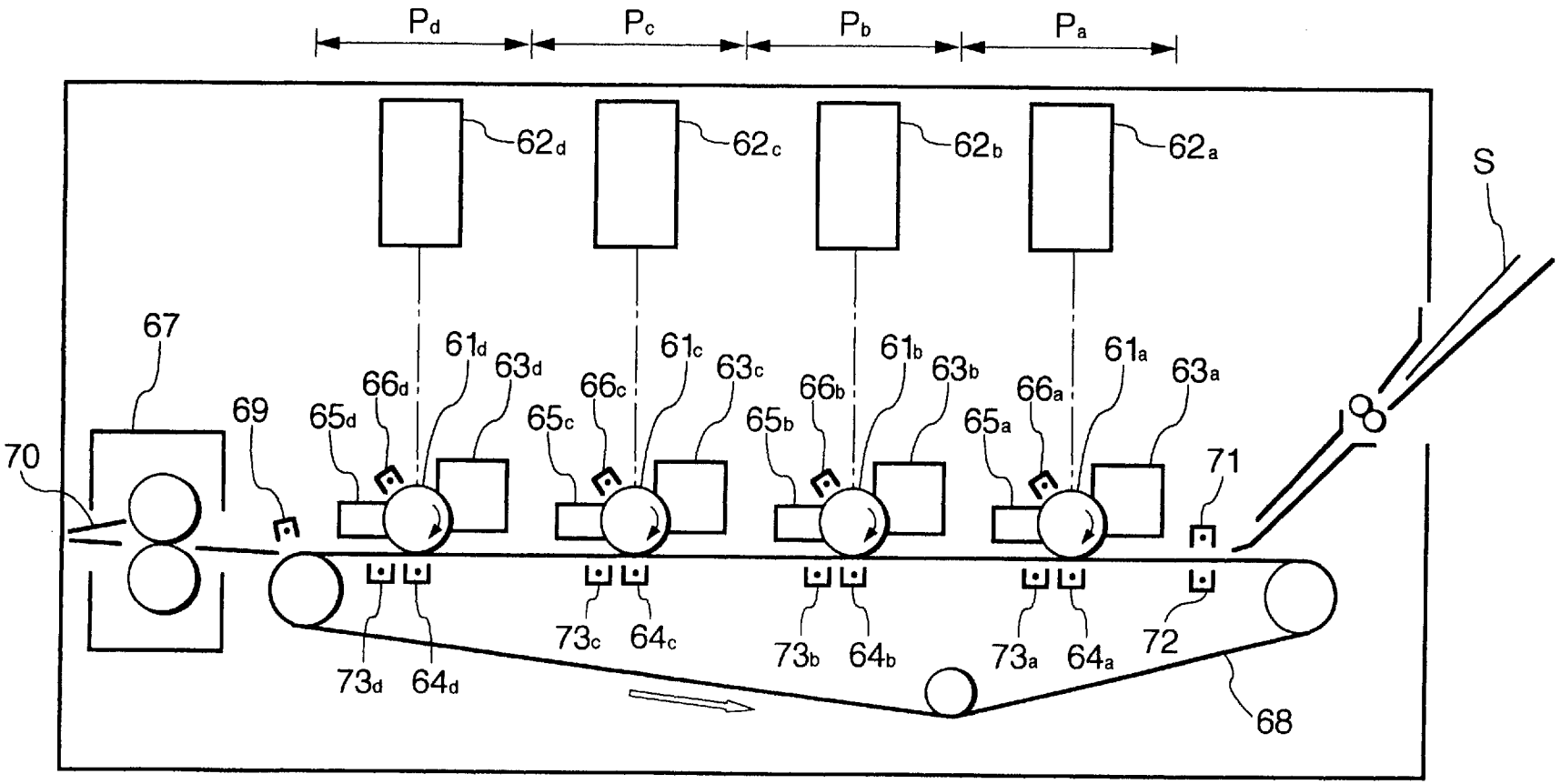
FIG. 4 schematically illustrates the steps of image formation, used in a second embodiment of the first image forming method of the present invention.

A second embodiment of the first image forming method of the present invention will be described with reference to FIG. 4, taking an example of a full-color image forming apparatus provided with a plurality of image forming sections each having at least an blocking resistance and a developing means.

In this embodiment, first, second, third and fourth image forming sections Pa, Pb, Pc and Pd are arranged, and the image forming sections have electrostatic latent image bearing members exclusively used therein, i.e., photosensitive drums 61*a*, 61*b*, 61*c* and 61*d*, respectively.

The photosensitive drums 61*a* to 61*d* are respectively provided around their peripheries with latent image forming means 62*a*, 62*b*, 62*c* and 62*d*, developing means 63*a*, 63*b*, 63*c* and 63*d*, transfer discharging means 64*a*, 64*b*, 64*c* and 64*d*, and cleaning means 65*a*, 65*b*, 65*c* and 65*d*.

Under such constitution, first, on the photosensitive drum 61*a* of the first image forming section Pa, for example, a yellow component color latent image is formed by the latent image forming means 62*a*. This latent image is converted into a visible image (a toner image) by the use of a developer having a yellow toner, of the developing means 63*a*, and the toner image is transferred to a transfer medium S (a recording medium) by means of the transfer means 64*a*.

While the yellow toner image is transferred to the transfer medium S as described above, in the second image forming section Pb a magenta component color latent image is formed on the photosensitive drum 61*b*, and is subsequently converted into a visible image (a toner image) by the use of a developer having a magenta toner, of the developing means 63*b*. This visible image (magenta toner image) is superimposingly transferred to a preset position of the transfer medium S when the transfer medium S on which the transfer in the first image forming section Pa has been completed is transported to the transfer means 64*d*.

Subsequently, in the same manner as described above, cyan and black color toner images are formed in the third and fourth image forming sections Pc and Pd, respectively, and the cyan and black color toner images are superimposingly transferred to the same transfer medium (recording medium). Upon completion of such an image forming process, the transfer medium S is transported to a fixing section 67, where the toner images on the transfer medium S are fixed. Thus, a multi-color image is obtained on the transfer medium S. The respective photosensitive drums 61*a*, 61*b*, 61*c* and 61*d* on which the transfer has been completed are cleaned by the cleaning means 65*a*, 65*b*, 65*c* and 65*d*, respectively, to remove the remaining toner, and are served on the next latent image formation subsequently carried out.

In the above image forming apparatus, a transport belt 68 is used to transport the transfer medium S. As viewed in FIG. 4, the transfer medium S is transported from the right side to the left side, and, in the course of this transport, passes through the respective transfer means 64*a*, 64*b*, 64*c* and 64*d* of the image forming sections Pa, Pb, Pc and Pd, respectively.

In this image forming method, as a transport means for transporting the transfer medium, a transport belt comprised of a mesh made of Tetoron fiber and a transport belt comprised of a thin dielectric sheet made of a polyethylene terephthalate resin, a polyimide resin or a urethane resin are used from the viewpoint of readiness in working and durability.

After the transfer medium S has passed through the fourth image forming section Pd, an AC voltage is applied to a charge eliminator 69, whereupon the transfer medium S is destaticized, separated from the belt 68, thereafter sent into a fixing assembly 67 where the toner images are fixed, and finally sent out through a paper outlet 70.

In this image forming method, as described above, the image forming sections may be provided with respectively independent electrostatic latent image bearing members and the transfer medium (recording medium) may be so made as to be successively sent to the transfer zones of the respective electrostatic latent image bearing members by a belt type transport means.

Alternatively, in this image forming method, an electrostatic latent image bearing member common to the respective image forming sections may be provided, and the transfer medium may be so made as to be repeatedly sent to the transfer zone of the electrostatic latent image bearing member by a drum type transport means so that the toner images of the respective colors are received there.

Since, however, the transfer belt has a high volume resistivity, the transport belt continues to increase charge quantity in the course the transfer is repeated several times, as in the case of color image forming apparatus. Hence, no uniform transfer can not be maintained unless the transfer electric currents are successively made greater at every transfer.

However, the toner of the present invention has so good a transfer performance that the transfer performance of the toner at every transfer can be made uniform under the like transfer electric currents even if the charging of the charging means has increased at every repetition of transfer, so that images with a good quality and a high quality level can be obtained.

In the image forming method of the present invention, a third image forming method has the steps of;

bringing a contact charging means into contact with an electrostatic latent image bearing member to electrostatically charge the surface of the electrostatic latent image bearing member;

forming an electrostatic latent image on the electrostatic latent image bearing member charged; and developing the electrostatic latent image by the use of a toner to render it visible.

In the charging step in the third image forming method of the present invention, a contact charging means making use of a roller or a blade is used so that efficient primary charging can be made, the method can be made simple and ozone can be less generated. The toner of the present invention is most suitably used in the image forming method having such a contact charging means.

The toner of the present invention contains the fine titanium oxide particles or fine alumina particles whose surfaces have been treated with organic matter to have uniformly high hydrophobic properties, and the toner is endowed with a good releasability and a stable lubricity, so that images free of faulty images can be stably obtained. Faulty images are exemplified by those wherein image density turn uneven at stained areas, image non-uniformity is caused by faulty charging, patterns in spots or streaks occur at halftone areas and non-image areas. The toner of the present invention also has superior contamination-free properties and cleaning performance, and hence also has a good durability in long-term service or continuous service. That is, since the toner can be endowed with superior contamination-free properties, the toner may less contaminate the electrostatic latent image bearing member and the member coming into contact with the electrostatic latent image bearing member, such as the contact charging means.

In general, when the same electrostatic latent image bearing member is used given times to superimposingly develop a plurality of electrostatic latent images and transfer the developed images or to develop a plurality of electrostatic latent images and superimposingly transfer the developed images, any contamination thereof may repeatedly affect the images in the number of times corresponding to that of development. Hence, it has been difficult to apply the contact charging means in the full-color image formation, where such contamination may superposingly affect the same image to tend to cause many faulty images. However, the use of the toner of the present invention can settle this problem and makes it possible to accomplish an image forming method that can prevent faulty images and ozone from being caused and can simplify image forming apparatus.

In addition, in the full-color image formation, latent images are developed on the same electrostatic latent image bearing member by the use of different toners. In such a case, the different toners tend to cause mutual agglomeration or tend to adhere to areas where they slightly remain unremoved. Thus, they more tend to cause contamination on the electrostatic latent image bearing member or the member coming into contact therewith, than the case where a single toner is used. From this point of view also, the use of the toner of the present invention can make such agglomeration and adhesion less occur on account of its superior releasability, contamination-free properties and cleaning performance, and to accomplish a superior image forming method having the contact charging means.

Figure 9:
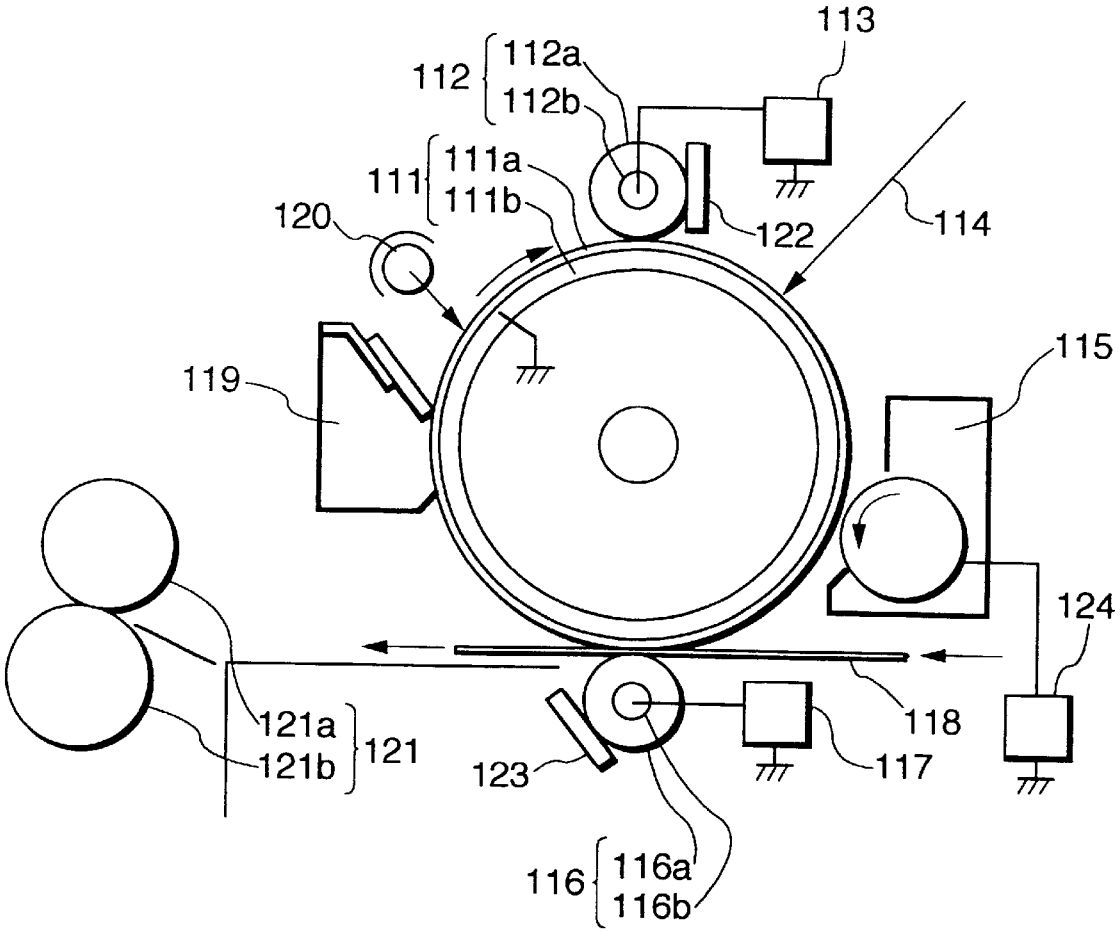
FIG. 9 also schematically illustrates the steps of image formation, used in the image forming method of the present invention.

The third image forming method of the present invention will be described with reference to FIG. 9, a schematic illustration of its constitution.

Reference numeral 111 denotes a rotary drum type electrostatic latent image bearing member (hereinafter "photosensitive member"). The photosensitive member 111 has a basic layer structure comprised of a conductive substrate layer 111*b* made of aluminum or the like and a photoconductive layer 111*a* formed on its periphery, and is rotated at a given peripheral speed (process speed) in the clockwise direction as viewed in the drawing.

Reference numeral 112 denotes a charging roller, which is basically comprised of a mandrel 112*b* at the center and a conductive elastic layer 112*a* that forms the periphery thereof. The charging roller 112 is brought into contact with the surface of the photosensitive member 111 under a pressure, and is follow-up rotated with the rotation of the photosensitive member 111. Reference numeral 113 denotes a charging bias power source for applying a voltage to the charging roller 112. As a result of application of bias V2 to the charging roller 112, the surface of the photosensitive member is charged to given polarity and potential. Next, electrostatic latent images are formed by imagewise exposure 114, and rendered visible one after another as toner images by a developing means 115. Reference numeral 122 denotes a cleaning member, which cleans the charging roller 112.

To a developing sleeve constituting the developing means 115, a bias V1 is applied through a bias applying means 124. The toner images formed on the electrostatic latent image bearing member as a result of development is electrostatically transferred to a transfer medium (recording medium) 118 by a contact transfer means 116. The toner images on the transfer medium 118 are fixed under application of heat and pressure by a heat and pressure means 121.

A transfer bias V3 is applied to the contact transfer means 116.

In the image forming apparatus having such a contact charging and contact transfer means, the photosensitive member can be uniformly charged with a bias of relatively low voltage compared with corona charging and corona transfer, and hence the apparatus is advantageous in that the charging assembly itself can be made small-sized and corona discharge products such as ozone can be prohibited.

Figure 10:
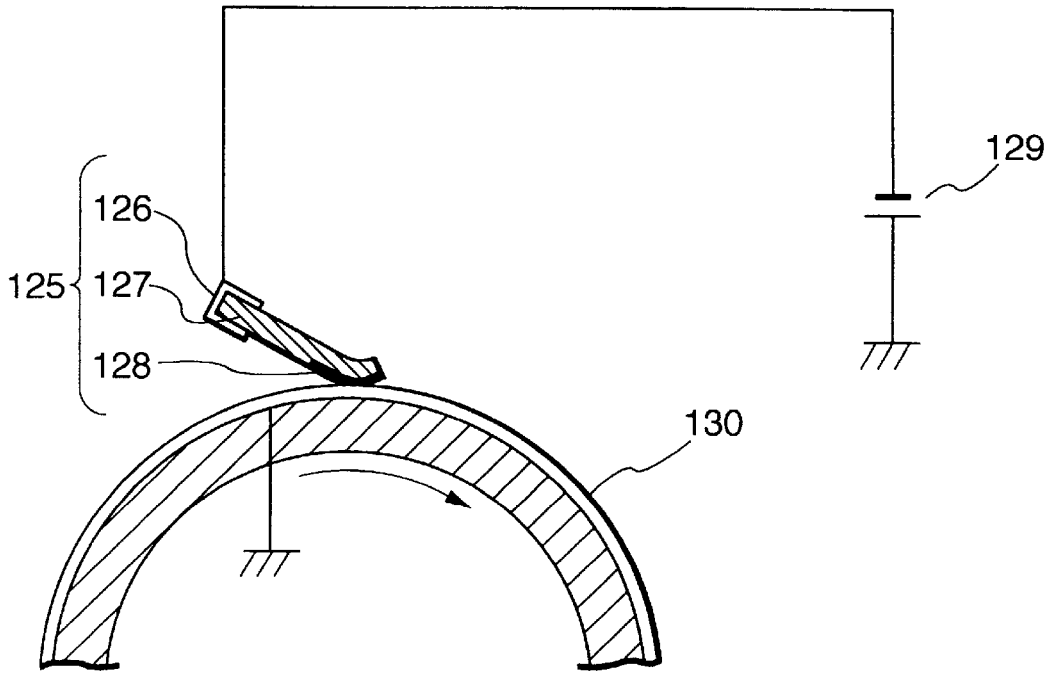
FIG. 10 schematically illustrates the step of primary charging, used in the image forming method of the present invention.

As other examples of this contact charging means, there are a method in which a charging blade as shown in FIG. 10 is used and a method in which a conductive brush is used.

A charging blade 125 as shown in FIG. 10 comprises a conductive rubber 127 having an elasticity, supported with a metallic support member 126, and a release surface layer 128 provided at the free end of the rubber. This charging blade 125 is elastically brought into touch with a photosensitive drum 130 serving as the electrostatic latent image bearing member, and is so formed as to uniformly charge the photosensitive drum 130 with charging bias applied from a bias applying means 129.

These contact charging means are effective in making it unnecessary to apply a high voltage or making ozone less occur, but on the other hand cause a difficulty of adhesion of toner because of the direct touch of the member to the photosensitive drum. However, the toner used in the present invention has so good contamination-free properties that such contact charging means are most suitable in the present invention as a specific contact charging means. The present invention by no means limits how the contact charging means should be applied and what operation and effect it should have. Any means can be applied to the present invention so long as they are charging methods carried out by bringing the member into direct touch or contact with a photosensitive member.

When the charging roller is used, preferable process conditions are as follows: Contact pressure of the roller is 0.5 to 50 kg/m; when an AC voltage is superimposed on a DC voltage, AC voltage is 0.5 to 5 kVpp, AC frequency is 50 to 5 kHz, and DC voltage is plus-minus 0.2 to plus-minus 1.5 kV; and when DC voltage is used, DC voltage is plus-minus 0.2 to plus-minus 5 kV.

The charging roller and the charging blade may preferably be made of conductive rubber, and a release coating may be provided on its surface. To form the release coating, it is possible to use nylon resins, PVDF (polyvinylidene fluoride) or PVDC (polyvinylidene chloride).

Next, the transfer medium 118 is transported to a fixing assembly 121 basically comprised of a heating roller 121*a* internally provided with a halogen heater, and an elastic material pressure roller 121*b* brought into contact therewith under pressure, and is passed between the rollers 121*a* and 121*b*, whereupon the toner images are fixed. A method of fixing them by means of a heater through a film may also be used. A developer used in pressure fixing may also be used to carry out pressure fixing. After the toner images have been transferred, the surface of the photosensitive member 111 is cleaned to remove the adherent contaminants such as toner remaining after transfer, by means of a cleaning device 119 having a cleaning blade brought into pressure contact with the photosensitive member 111 in the counter direction, and is further destaticized by means of a charge eliminating exposure device 120. Then, images are repeatedly formed thereon.

When the contact charging means such as the charging roller or the charging blade is used, the toner of the present invention has so high releasability and lubricity that it does not contaminate these members and also does not cause abnormal images due to faulty charging. Even if it has adhered, it can be so easily released that the charging means may neither scratch nor excessively scrape the photosensitive member.

In the present invention, toner particles are made to hardly adhere directly to the surface of the contact charging member, the surface of the contact transfer member and the surface of the photosensitive member and at the same time the releasability of the toner particles to such surfaces is improved to prevent the toner itself from sticking thereto. Also, even if toner particles have adhered to the surface of the contact charging member, the surface of the contact transfer member or the surface of the photosensitive member, the positions to which the toner adheres always change in the areas of the contact charging member, the contact transfer member and the photosensitive member or between them, on account of the lubricity and releasability attributable to the toner particles. Thus the toner particles having adhered by no means stays at the same positions, and hence do not come to stick. In addition, when the cleaning member is brought into contact with the contact charging member and the contact transfer member, the cleaning performance for the toner particles having adhered to their surfaces can be well improved because of the release properties.

The heat fixing method of the present invention will be described below with reference to FIG. 11.

In the case of heat fixing, the toner of the present invention is heat-fixed to a transfer medium (recording medium) such as plain paper or an overhead projector (OHP) transparent sheet through a contact heat fixing means.

The contact heat fixing means may include a heating means for heat-fixing the toner image by means of (i) a heat and pressure roll fixing device, or (ii) a heater element stationarily supported and a pressure member that stands opposite to the heater element in pressure contact and brings said recording medium into close contact with the heater element through a film interposed between them.

Figure 11:
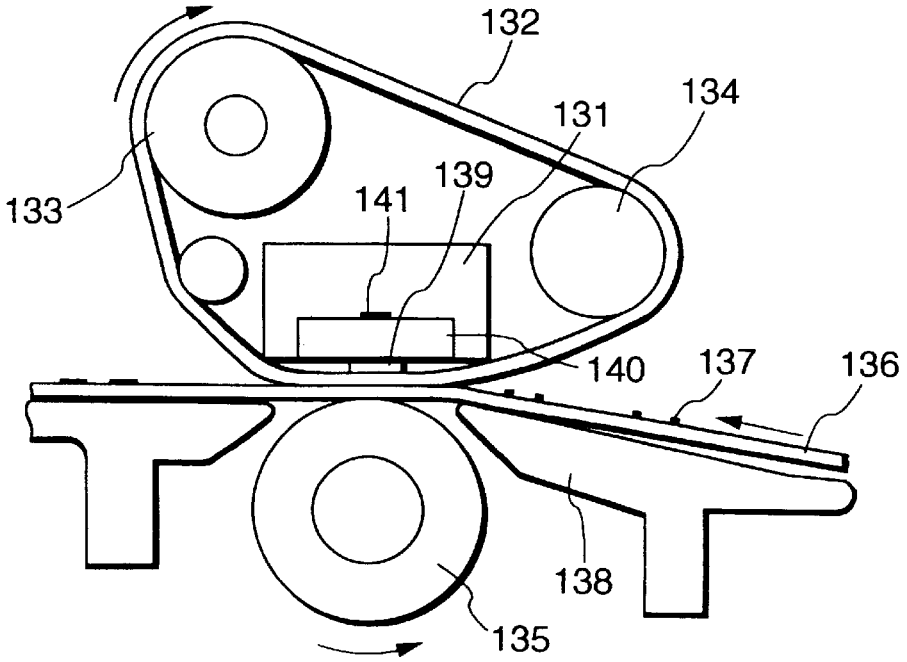
FIG. 11 schematically illustrates the step of fixing, used in the heat fixing method of the present invention.

FIG. 11 illustrates an example of the above (ii) fixing means.

In the fixing device shown in FIG. 11, the heater element has a smaller heat capacity than conventional heat rolls, and has a linear heating part. The heating part may preferably be made to have a maximum temperature of from 100° C. to 300° C.

The film interposed between the heater element and the pressure member may preferably comprise a heat-resistant sheet of from 1 to 100 μm thick. Heat-resistant sheets used therefor may include sheets of polymers having high heat-resistance, such as polyester, PET (polyethylene terephthalate), PFA (a tetrafluoroethylene-perfluoroalkyl vinyl ether copolymer), PTFE (polytetrafluoroethylene), polyimide and polyamide, sheets of metals such as aluminum, and laminate sheets comprised of a metal sheet and a polymer sheet.

In a preferred constitution of the film, these heat-resistant sheets have a release layer and/or a low-resistance layer.

A specific example of the fixing device will be described with reference to FIG. 11.

Reference numeral 131 denotes a low heat capacitance linear heater element stationarily supported in the fixing device. An example thereof comprises an alumina substrate 140 of 1.0 mm thick, 10 mm wide and 240 mm in longitudinal length and a resistance material 139 coated thereon to have a width of 1.0 mm, which is electrified from the both ends in the longitudinal direction. The electricity is applied under variations of pulse widths of the pulses corresponding with the desired temperatures and energy emission quantities which are controlled by a temperature sensor 141, in the pulse-like waveform with a period of 20 msec of DC 100V. The pulse widths range approximately from 0.5 msec to 5 msec. In contact with the heater element 131 the energy and temperature of which have been controlled in this way, a fixing film 132 moves in the direction of an arrow shown in the drawing.

An example of this fixing film includes an endless film comprised of a heat-resistant film of 20 μm thick (comprising, for example, polyimide, polyether imide, PES, or PFA) and a release layer comprising a fluorine resin such as PTFE or PFA to which a conductive material is added, coated at least on the side coming into contact with the image to have a thickness of 10 μm. In general, the total thickness of the film may preferably be less than 100 μm, and more preferably less than 40 μm. The film is moved in the direction of the arrow in a wrinkle-free state by the action of the drive of, and tension between, a drive roller 133 and a follower roller 134.

Reference numeral 135 denotes a pressure roller having on its surface an elastic layer of rubber with good release properties as exemplified by silicone rubber. This pressure roller is pressed against the heater element at a total pressure of from 4 to 20 kg through the film interposed between them and is rotated in pressure contact with the film. Toner 137 having not been fixed on a transfer medium 136 is led to the fixing zone by means of an inlet guide 138, and thus a fixed image is thus obtained by the heating described above.

The above has been described with reference to an embodiment having the endless belt. Alternatively, using a sheet-feeding shaft and a wind-up shaft, the fixing film may not be endless.

In the fixing method as described above, the heater element has a hard flat surface and hence, at the fixing nip portion, the transfer medium pressed by the pressure roller is fixed thereon with the toner in a flat state and also the gap between the fixing film and the transfer medium becomes narrow on account of its structure, right before the latter thrusts into the gap portion. Hence, the air around the fixing film and transfer medium is brought to be driven out rearwards.

In that state, lines (of toner images) on the transfer medium, formed in parallel in the longitudinal direction of the heater element thrust in, whereupon the air comes to be driven out toward the lines. If in this situation the toner lightly stands on the lines, the air having its escape cut off breaks down the lines to go out rearwards, so that the lines are broken off to cause the phenomenon of toner scatter where toner particles fly rearwards.

Especially when transfer paper as the transfer medium has no smooth surface or has absorbed moisture, the transfer electric field may become weak to weaken the attraction of the toner to the transfer medium, so that the toner particles come to be softly laid on the lines to tend to cause the toner scatter. Also when the process speed is high, the wind pressure is so high as to more tend to cause the toner scatter.

In the case of color images, since a plurality of toner images are superimposed when a line image with certain colors is formed, the height of lines is greater to more tend to cause the toner scatter.

In the case of the toner of the present invention, when a transfer electric field is applied, the toner particles turn dielectric with ease and can be strongly attracted to the transfer medium or undergo electrostatic agglomeration. Hence, they can be laid on the lines in a tight state, and the toner scatter can be prevented or made less occur. Such toner scatter can be prevented also when a plurality of toner images are superimposed.

Moreover, the toner of the present invention has a high charge quantity also when triboelectrically charged. Hence the toner held on the electrostatic latent image bearing member can have a high charge quantity, and can be firmly transferred to the transfer medium upon application of the transfer electric field. This also preferably acts against the toner scatter.

The toner of the present invention may be used in one-component developing methods such as a magnetic one-component developing method or a non-magnetic one-component developing method, and in two-component developing methods using a toner and a carrier.

The toner of the present invention has a very good fluidity, can be quickly charged, has a stable charging performance and can be uniformly charged. Hence, a one component type developer making use of the toner of the present invention has a superior transfer performance of the developer in the developing assembly, can effect quick rise of charging even when a triboelectric charge providing member has a small surface area, so that the one component type developer in the neighborhood of a developer carrying member and the one component type developer newly fed thereto can be smoothly mixed, whereby the charge quantities can be quickly made uniform. Accordingly, in the developing method in which the latent image on the electrostatic latent image bearing member is developed with a one component type developer held on a developer carrying member which carries the one component type developer, the toner of the present invention can be preferably used in a developing method having a developer layer thickness control member that controls the layer thickness of the one component type developer on the developer carrying member to form a thin layer. This toner is greatly effective when used in the non-magnetic one-component developing method, where the developer has a small ability to impart triboelectric charges.

The one component type developer making use of the toner of the present invention also may hardly cause melt adhesion, and can be smoothly fed to the layer thickness control portion, so that the developer can be supplied in a quantity large enough for its consumption and also friction can be decreased to make torque smaller. Hence, it can be preferably used also in an image forming method in which a layer thickness control member makes the developer layer thin by applying a pressure of an elastic member.

The developing method of the present invention has the steps of;

controlling on a developer carrying member a layer thickness of a one component type developer through a developer layer thickness control means to form on the developer carrying member a thin layer of the one component type developer; and developing an electrostatic latent image on an electrostatic latent image bearing member by the use of the one component type developer carried on the developer carrying member; the developer carrying member being provided opposingly to the electrostatic latent image bearing member.

The non-magnetic one-component developing method, which is a first embodiment of the developing method of the present invention, will be described below with reference to FIG. 5.

Figure 5:
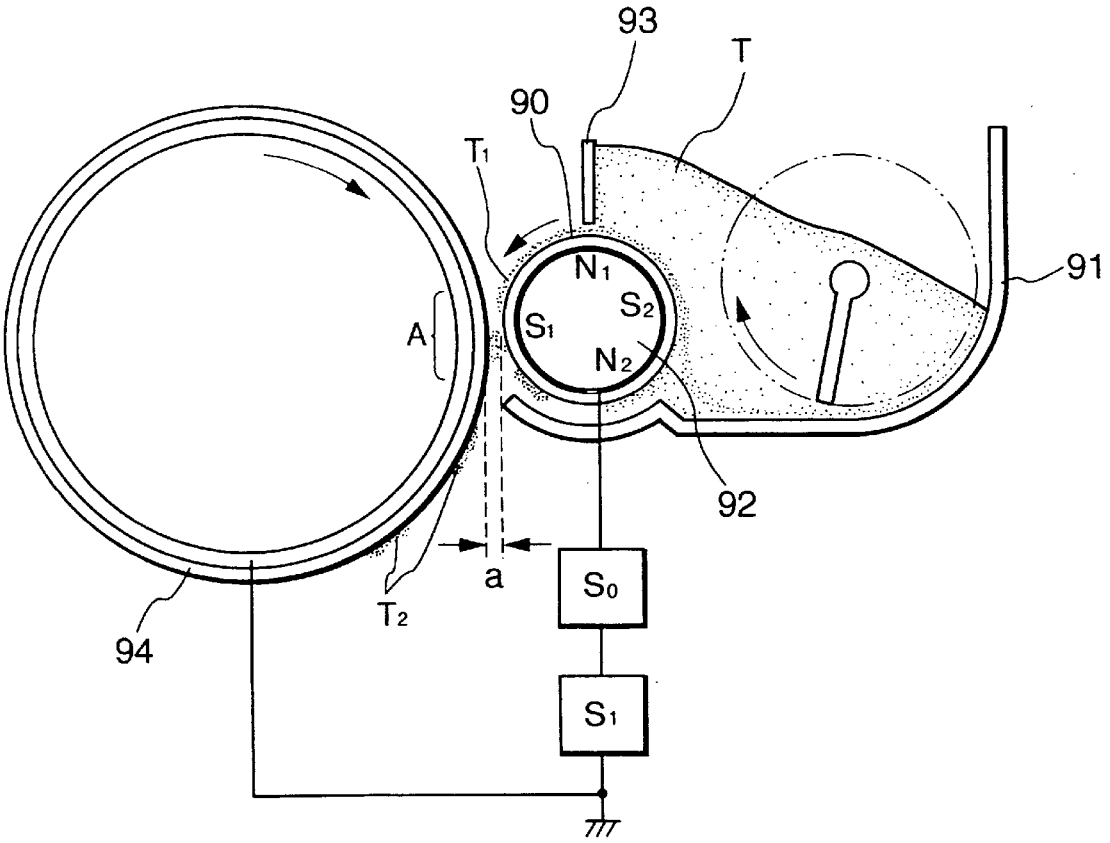
FIG. 5 schematically illustrates a developing assembly of a first embodiment in the developing method of the present invention.

In FIG. 5, right half peripheral surface of the developing sleeve 90 as a developer bearing member always contacts with a developer reservoir within the developer container 91 and one-component magnetic developer in the vicinity of the developing sleeve surface is adhered and retained to the developing sleeve surface by magnetic force and/or electrostatic force generated by magnetic field generating means 92 within the sleeve. When the developing sleeve 90 drives rotationally, a developer layer in the sleeve surface is arranged as a tin layer $T_1$ of one-component magnetic developer having uniform thickness during passing through a position of the doctor blade 93. The one-component magnetic developer is charged by frictional contacting with the sleeve surface and the one-component magnetic developer in the developer reservoir in the vicinity of the sleeve surface while mainly rotating the developing sleeve 90. Thin layer surface of the one-component magnetic developer on the developing sleeve 90 is rotated to the direction of the electrostatic latent image holding member 94 while rotation of the developing sleeve and passes through the developing region A which is most access portion of the electrostatic latent image holding member 94 and the developing sleeve 90. During this passing process, one-component magnetic developer of the thin layer on the side of the developing sleeve surface 90 is flied by direct current applied between the electrostatic latent image holding member 94 and the developing sleeve 90, direct current by alternating voltage, and alternating field so that the one-component magnetic developer reciprocates between the gap $\alpha$ of the electrostatic latent image bearing member 94 surface and the developing sleeve 90 surface in the developing region A. Finally, the one-component magnetic developer in the side of the developing sleeve 90 surface is selectively adhered to the surface of the electrostatic latent image holding member 94 in accordance with potential patterns of the electrostatic latent image so that developer image $T_2$ is formed successively.

When the developing sleeve is passed passed through the developing region A and the one-component magnetic developer is consumed selectively, the surface of the developing sleeve rerotates to the developer reservoir of the hopper 91 and then is subjected to resupply one-component magnetic developer and the surface of the thin layer $T_1$ of the one-component magnetic developer on the developing sleeve 90 is transferred into the developing region A so that developing process is repeated.

A doctor blade used as developer layer thickness controlling means in the present invention includes metal blade and magnetic blade (for example, the denote 93 in FIG. 5) which are arranged with the developing sleeve at an interval.

Instead of using the doctor blade as developer layer thickness controlling means, a rigid roller and a sleeve which comprise a metal, a resin and a ceramic may be used and magnetic force generating means may be placed inside thereof.

In a method for developing one-component developer such as a method for developing one-component magnetic developer and one-component non-magnetic developer, an elastic blade which brings into contact with the surface of a developing sleeve by elastic force used as a developer layer thickness controlling means. In stead of using a doctor blade as a developer layer thickness controlling member, an elastic roller may be used. The toner of the present invention is particularly used for developing method in which thin layer coating of one-component developer is carried out by bringing into contact with a developer bearing member by means of elasticity of the developer layer thickness controlling member.

An elastic blade and an elastic roller comprise synthetic resin elastomer such as silicone rubber, urethan rubber, NBR, and metal elastomer such as stainless steel and steel. The composite thereof may be also used. The rubber elastomer is preferably.

The properties of material of an elastic blade and an elastic roller are greatly concerned in chargeability of a toner on a developer bearing member. Therefore, into an elastic member organic material and inorganic material may be added, melt-kneaded, and dispersed. Such materials include for example metal oxide, metal powder, ceramic, carbon allotrope, whisker, inorganic fiber, dye, pigment and surfactant. In order to control toner chargeability, materials in which resin, rubber, metal oxide and metal is attached to rubber, synthetic resin and metal elastomer so as to bring into contact with a contacting portion of the sleeve. If an elastic member and a developer bearing member is required for durability, materials in which resin or rubber is laminated on metal elastomer so as to bring into contact with the contacting portion of the sleeve are preferably.

If the developer has negative chargeability, urethan rubber, urethan resin, polyamide, nylon and materials which tend to be positive charge are preferably. If the developer has positive chargeability, urethan rubber, urethan resin, silicone rubber, silicone resin, polyester resin, fluorine type resin (for example, Teflon resin), polyimide resin and materials which tend to be negative charge are preferably. If the contacting portion of the developing sleeve is molding product such as resin and rubber, in order to control developer chargeability, metal oxide such as silica, alumina, titania, tin oxide, zirconia and zinc oxide, carbon black and charge control agent which is generally used for preparing a toner are preferable contained in the molding product.

Figure 6:
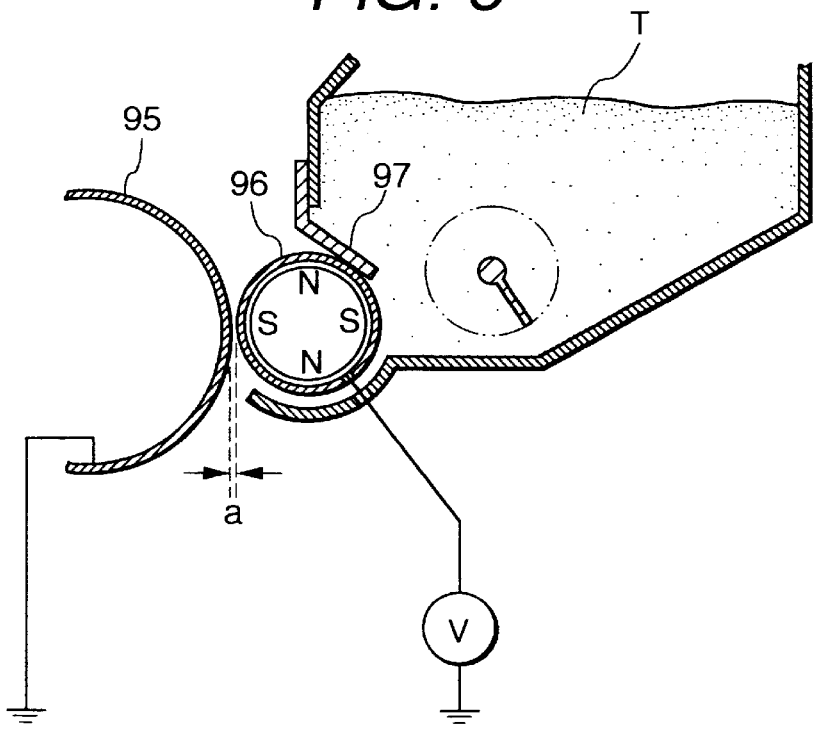
FIG. 6 schematically illustrates a developing assembly of a second embodiment in the developing method of the present invention.

A developing apparatus which is second embodiment of a developing method in the present invention is explained based on FIG. 6.

A base portion which is upper edge portion of the elastic blade 97 as a developer layer thickness controlling means is fixed at the side of developer container. Lower edge portion is provided against elasticity of the elastic blade and is deflected in regular direction or opposite direction of the developing sleeve 96 so that inside surface of the elastic blade (outer surface of the blade in case of opposite direction) is brought into contact with the surface of the developing sleeve by means of suitable elastic pressure. By means of such apparatus, a toner layer with thin and denseness and having stability against fluctation of environmental condition can be obtained. Such reasons are not clarified, but is guessed that as compared with an apparatus in which metal blade used in common is provided apart from the developing sleeve at an interval the developer is forbitarly made friction with the surface of the developing sleeve by means of the elastic blade 97 so that charge is carried out always in the same state not depending on attitude change by environmental change.

However, the charge tends to be excessive and melt-adhesion of toner on a developing sleeve and a blade tends to be occurred, but a toner of the present invention has superior fluidity and stable frictional chargeability and is preferably used.

Figure 7:
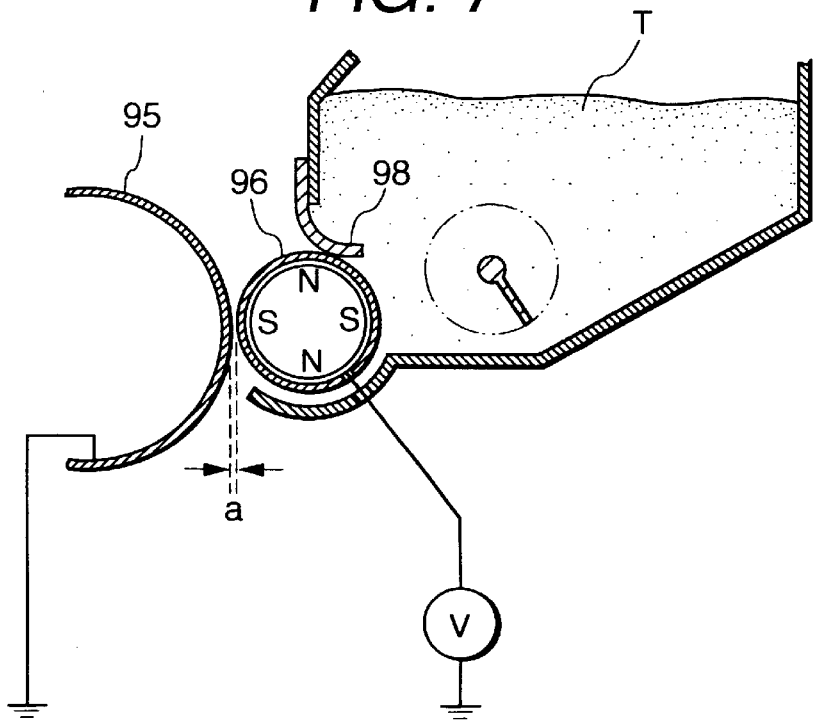
FIG. 7 schematically illustrates a developing assembly of a second embodiment in the developing method of the present invention.

FIG. 7 is an embodiment of using the elastic blade 98 having the shape in which the shape of the elastic blade used in FIG. 6 at the time of contacting is changed.

In a case of developing method of one-component magnetic developer, the contacting pressure between the elastic blade and the developing sleeve is not less than 0.1 kg/m, preferably 0.3 to 25 kg/m, more preferably 0.5 to 12 kg/m as a line-pressure of the developing sleeve generant direction. When the contacting pressure is less than 0.1 kg/m, it is difficult to uniformly coat a developer and a distribution of charge amount of the developer becomes broad and such phenomina cause fog and toner scattering. When the contacting pressure is more than 25 kg/m, great pressure is applied on the developer, the developer is deteriorates and agglomeration of the developer often caused and is not preferably. Further, in order to drive a developer bearing member great torque is required and is not preferably.

The gap $\alpha$ between the electrostatic latent image holding member and the developer bearing member is set to for example 50 to 500 $\mu$m. When a magnetic blade is used as a developer layer thickness controlling means, the gap between the magnetic blade and the developer bearing member is preferable set to 50 to 400 $\mu$m.

A layer thickness of the one-component magnetic developer layer on the developer bearing member is most preferable thinner than the gap $\alpha$ between the electrostatic latent image holding member and the developer bearing member. But, in one of a plurality of ears of the one-component magnetic developer consisting of layers of the one-component magnetic developer, layer thickness of the layer of the one-component magnetic developer may be controlled to such a degree that one part of the ears brings into contact with the electrostatic latent image holding member.

The developing sleeve is rotated at a peripheral speed of 100 to 200% based on an electrostatic latent image holding member. The alternating bias voltage is not less than 0.1 kV, preferably 0.2 to 3.0 kV, more preferable 0.3 to 2.0 kV in peak to peak. The alternating bias frequency is 1.0 to 5.0 kHz, preferable 1.0 to 3.0 kHz, more preferable 1.5 to 3.0 kHz. As the alternating bias form, wave forms such as a rectangle wave, a sine wave, a sawtooth wave and a triangular wave can be applied. Further, plus and minus voltage and asymmetrical alternating current bias with different times can be utilized. Direct current bias may be preferable overlayed.

In the present invention, materials for the developing sleeve include metal and ceramic. In view of a chargeability to a developer, aluminium and SUS are preferably. The developing sleeve can be used as product prepared by only pulling out or chipping, but in order to control carrier performance and frictional charge providing performance of the developer, grinding, insertion of rough particles in a peripheral direction or a longitudinal direction, blast treatment and coating are carried out. In the present invention, the blast treatment is preferably carried out by using figurate particles and amorphous particles as a blasting agent and the blasting agent can be used alone or combination, and holded-hammered product can be utilized.

Ground particles can be used as an amorphous particle.

As figurate particles, for example, several kinds of rigid body balls comprising metals such as stainless steel, aluminum, rigid iron, nickel and brass which have specific particle diameter or several kinds of rigid body balls such as ceramic, plastic and glass bead can be used. The figurate particles has substantially a curved surface and are preferable ball shape particles or rotation ellipsoid particles having a ratio of length to breadth of 1 to 2, preferably 1 to 1.5, more preferably 1 to 1.2. Therefore, the figurate particles used for blast treating the surface of the developing sleeve have preferably diameter (or length) of 20 to 250 $\mu$m. In case of holding-hammerring, figurate blast particle has preferably greater than amorphous blast particle and particularly 1 to 20 times is preferably, more preferable is 1.5 to 9 times.

When hold-hammer treatment is carried out by figurate particle, at least treatment time and impact force of treated particles is smaller than a case of using amorphous particle blast.

As the developing sleeve, on its surface a coating layer containing fine conductive particles is preferably formed. Fine carbon particles, fine carbon particles and crystalline graphite or crystalline graphite are preferred as the fine conductive particles.

The crystalline graphite used in the present invention is mainly classified in natural graphite and artificial graphite. The artificial graphite is prepared by the following: pitch coke is solidified by tar pitch and the solidified material is calcined at about 1,200° C. and then placed into graphitization oven and treated at high temperature of about 2,300° C. so that crystal of carbon is grown to change graphite. The natural graphite is completely graphitization by natural geothermy and high pressure of underground for a long time and produces from underground. These graphites have several superior properties and wide application for engineering. The graphite is crystalline mineral having dark gray or black brightness, very soft and lubricity so that the graphite is utilized for pencil. Further, the graphite has heat resistance and chemical stability and is utilized for a lubricant, a fire resistance material, electrical material and so forth in a form as powder, solid or coating paint. Its crystalline structure belongs to hexagonal system and rhombohedral system and has completely laminate structure. With respect to electrical properties, free electron is present between the bonding of carbon and carbon, and the structure can be conducted electric field. The present invention can be used either the natural graphite or the artificial graphite.

The graphite used in the present invention has preferably particle diameter of 0.5 to 20 $\mu$m.

The polymer materials which form a coating layer include thermoplastic resin such as styrene resin, viny resin, polyethersulfon resin, polycarbonate resin, polyphenylene oxide resin, polyamide resin, fluorine resin, fiber element resin and acrylic resin, and heatcurable resin or photocurable resin such as epoxy resin, polyester resin, alkyd resin, phenol resin, melamine resin, polyurethan resin, urea resin, silicone resin and polyimide resin. Of these, silicone resin and fluorine resin which have releasing performance, polyethersulfon, polycarbonate, polyphenylene oxide, polyamide, phenol resin, polyester, polyurethan and styrene resin which have superior mechanical performance are more preferably.

The electroconductive amorphous carbon is generally defined an aggregate of crystals obtained by burning or heat decomposition of compounds containing hydrocarbon or carbon in a state of insufficient air supply. Particularly, the amorphous carbon has superior electroconductive performance and is packed in polymer material to provide electroconductive performance and can obtain optional electroconductivity by controlling an amount of addition and therefore is widely used. The electroconductive amorphous carbon used in the present invention has particle diameter of 10 nm to 80 nm, preferably 15 nm to 40 nm.

Figure 8:
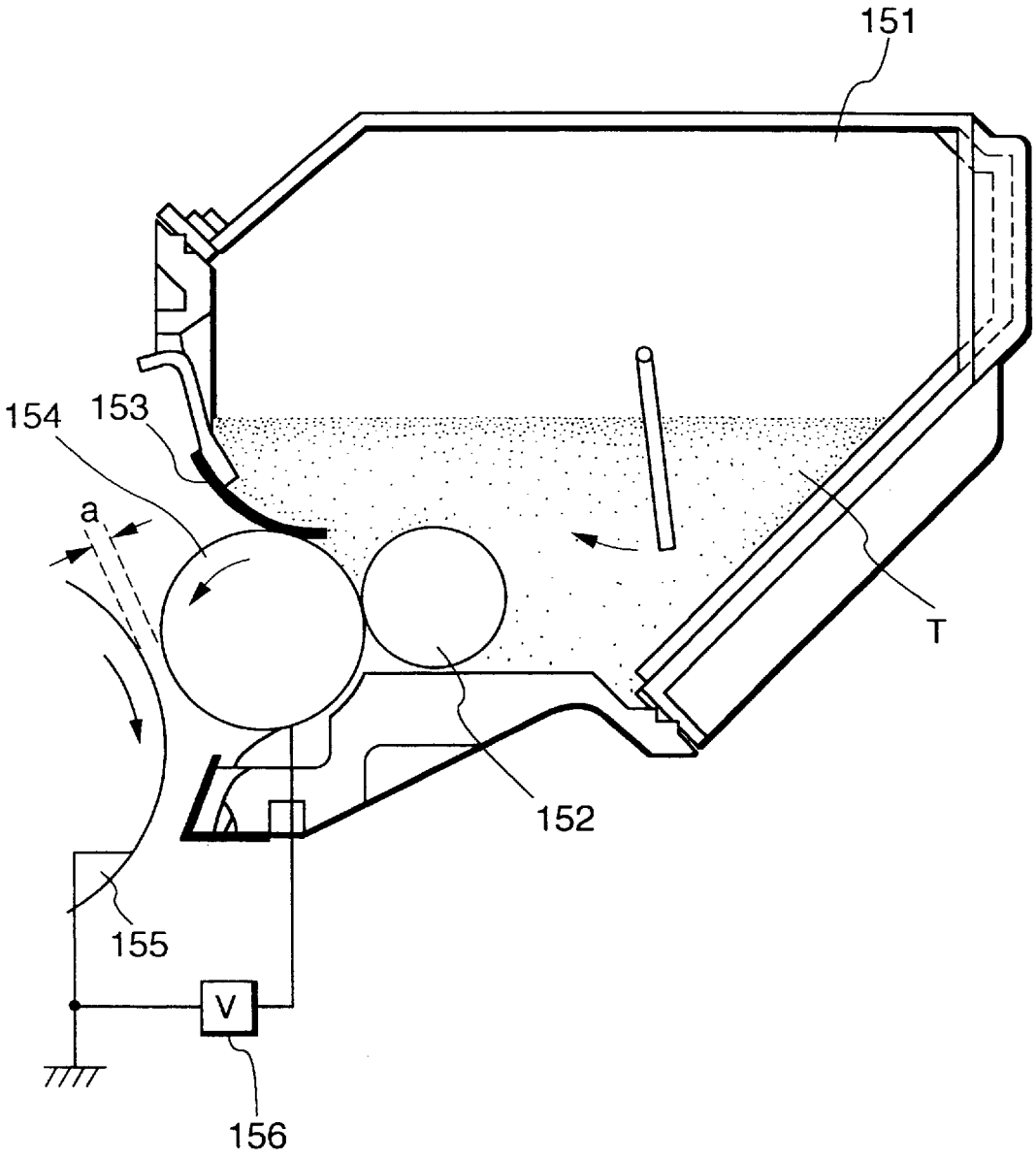
FIG. 8 schematically illustrates another developing assembly used in the developing method of the present invention.

A method for developing one-component non-magnetic developer which is third embodiment of the developing method of the present invention is explained based on FIG. 8.

FIG. 8 shows a developing apparatus for developing an electrostatic latent image formed on an electrostatic latent image holding member by using one-component non-magnetic developer. The denote 115 is an electrostatic latent image holding member and a latent image formation is achieved by electrophotography process means or electrostatic recording means not shown in the figure. The denote 154 is a developing sleeve as a developer bearing member and the sleeve comprises non-magnetic sleeve comprising aluminium or stainless steel.

As the developing sleeve, a rough tube made of aluminium or stainless steel may be used as such. It is preferred that uniform rough tube obtained by spraying glass bead to its surface, a tube mirror finished and a tube by coating resin are used. Further, the sleeve used in a method for developing one-component magnetic developer can be applied correspondingly.

The one-component non-magnetic developer T is stored in the hopper 151 and is supplied on the developer bearing member 154 by the supply roller 152. The supply roller 152 comprises a foaming agent such as polyurethan foam and rotates in a regular direction or reverse direction with relative speed not containing zero value based on the developer bearing member and scrapes a developer on the developer bearing member after developing (non-developing developer) while supplying a developer. The one-component non-magnetic developer supplied on the developer bearing member 154 is coated uniformly and thin by developer coating blade 153 as a developer layer thickness controlling means.

The contacting pressure of the developer coating blade and the developer bearing member is 0.3 to 25 kg/m, preferably 0.5 to 12 kg/m, as line pressure of the developing sleeve generant direction. When the contacting pressure is less than 0.3 kg/m, it is difficult to uniformly coat the one-component non-magnetic developer and distribution of charge amount of the one-component non-magnetic developer becomes broad and such phenomina cause fog and toner scattering. When the contacting pressure is more than 25 kg/m, great pressure is applied on the one-component non-magnetic developer, the one-component non-magnetic developer deteriorates and agglomeration of the one-component non-magnetic developer caused and is not preferably. Further, in order to drive a developer bearing member great torque is required and is not preferably. That is, by controlling the contacting pressure of 0.3 to 25 kg/m, an aggregate of the one-component non-magnetic developer by using the toner of the present invention can be effectively loosened and an amount of charge of the one-component non-magnetic developer can be risen in an instant.

As the developer layer thickness controlling member, the developer layer thickness controlling materials used in a method for developing one-component magnetic developer can be applied correspondingly. Materials for the elastic blade and the elastic roller are materials of frictional charge series suitable for charging a developer with desired polarity. The materials used in a method for developing one-component magnetic developer can be applied correspondingly. In the present invention, silicone rubber, urethan rubber and styrene-butadiene rubber are preferably. Further, an organic resin layer such as polyamide, polyimide, nylon, melamine, melamine-crosslinked nylon, phenol resin, fluorine resin, silicone resin, polyester resin, urethan resin and styrene resin may be provided. The use of an electroconductive rubber and an electroconductive resin, and the dispersion of a metal oxide in accordance with the materials used in a developing method of one-component magnetic developer, carbon black, inorganic whisker, a filler such as inorganic fiber and charge controlling agent in a rubber of the blade and in a resin are preferably because suitable electroconductivity, charge providing performance can be achieved and the one-component non-magnetic developer can be suitably charged.

In a system that the one-component non-magnetic developer is thin coated on the developing sleeve by the blade proposed by the developing method of one-component non-magnetic developer in the third embodiment of the developing method of the present invention, in order to obtain enough image density, a thickness of the one-component non-magnetic developer layer on the developing sleeve is smaller than opposition gap length a of the developing sleeve and the electrostatic latent image holding member and alternating electrical field is applied to this gap. An alternating electric field or developing bias in which direct current electric field is overlaid on alternating electric field is applied between the developing sleeve 154 and the electrostatic latent image holding member 155 by means of bias source 156 shown in FIG. 8 so that the one-component non-magnetic developer can easily move from the developing sleeve to the electrostatic latent image bearing member and image with good quality can be obtained. These conditions corresponds to the method for developing one-component magnetic developer.

The electrostatic latent image holding member used in a image forming method and a developing method of the present invention is explained below.

The electrostatic latent image holding member used in the present invention includes amorphous silicon photosensitive member and organic photosensitive member.

The organic photosensitive member may be single layer type in which the photosensitive layer contains materials having charge generating materials and charge transporting performance in the same layer, or function separated type photosensitive member comprising charge transporting layer and charge generating layer. One of a preferred embodiment is a laminate type photosensitive member having structure in which a charge generating layer is provided on an electorconductive substrate and a charge transporting layer is laminated on the charge generating layer in this order.

The embodiment of an organic photosensitive member is explained below.

As an electroconductive substrate, metal such as aluminium or stainless steel, a plastic having a coating layer comprising aluminium alloy or indium oxide-tin oxide alloy, an electroconductive particle-impregnated paper or plastic, and cylindrical cylinder or film such as plastic having an electroconductive polymer are used.

A subbing layer may be provided on these electroconductive substrate in order to improve adhesion property of the photosensitive member, improve coating property, protect the substrate, coat defects in the substrate, improve electron injection performance from the substrate, and protect electrical destruction of the photosensitive member. The subbing layer is formed by materials such as polyvinyl alcohol, poly-N-vinyl imidazole, polyethylene oxide, ethyl cellose, methyl cellose, notro cellose, ethylene-acrylic acid copolymer, polyvinylbuthyral, phenol resin, casein, polyamide, copolymer nylon, glue, gelatin, polyurethan and aluminium oxide. The thickness of the subbing layer is generally 0.1 to 10 $\mu$m, preferably about 0.1 to 3 $\mu$m.

A charge generating layer is formed as follows: a charge generating material such as organic compounds such as azo type pigments, phthalocyanine type pigments, indigo type pigments, perrylene type pigments, polyaromatic quinone type pigment, squallium dye, pyrrylium salts, thiopyrrylium salts and triphenyl methane type dye, and inorganic material such as selen or amorphous silicon are dispersed and coated or vaper deposited to a suitable binder. A binder can be selected from wide kinds of binder resins such as for example polycarbonate resin, polyester resin, polyvinylbutyral resin, polystyrene resin, acrylic resin, methacrylic resin, phenol resin, silicone resin, epoxy resin and vinyl acetate resin. The amount of the binder contained in the charge generating layer is not more than 80% by weight, preferably 0 to 40% by weight. The layer thickness is not more than 5 $\mu$m, particularly 0.05 to 2 $\mu$m.

The charge transporting layer receives a charge carrier from the charge generating layer in a presence of electrical field and has a function of transporting the carrier. The charge transporting layer is formed by dissolving a charge transporting material in a solvent with optionally binder resin and coating. The layer thickness is 5 to 40 $\mu$m, preferably 10 to 30 $\mu$m. The charge transporting material includes polycyclic aromatic compound having a structure of biphenylene, anthracene, pyrene or phenanthrene in a main chain or a side chain, nitrogen-containing cyclic compound such as indole, carbazole, oxadiazole and pyrazoline, hydrazone compound and styrene compound.

The binder resin dispersing these charge transporting material includes binder resins such as polycarbonate resin, polyester resin, polymethacrylate, polystyrene resin, acrylic resin and polyamide resin, and organic photoconductive polymer such as poly-N-vinylcarbazole and polyvinylanthracene.

Of these binder resins, polycarbonate resin, polyester resin and acrylic resin are preferred as a developing method in the present invention because cleaning performance is good, and the faulty of cleaning, melt-adhesion of a toner to a photosensitive member and filming of an external additive tend to be not occurred. An amount of the binder resin in the charge transporting layer is preferably 40 to 70% by weight.

It is preferable to contain a lubricating material in the most outer layer in the photosensitive member in view of improvement of cleaning performance and improvement of transfer performance. A fluorine type material and a silicone-containing compound are preferred as the lubricating material. Of these, the materials containing a fluorine type resin powder are particularly preferred. By using such materials with the toner of the present invention, the above effect can be increased and contamination can be greatly improved.

The fluorine type resin powder is optionally selected from one or more kinds of tetrafluoroethylene resin, trifluorochloroethylene resin, tetrafluoroethylene hexafluoroethylene resin, vinyl fluoride resin, vinylidene fluoride resin, difluorodichloroethylene resin and copolymer of these. Particularly, tetrafluoroethylene resin and vinylidene fluoride are preferred. Molecular weight and particle diameter of the resins can be optionally selected from commercial grade, particularly, the resin having low molecular weight grade and primary particle diameter of not larger than 1$\mu$ is preferred.

An amount of the fluorine type resin powder to be dispersed in a surface layer is suitably 1 to 50% by weight, particularly 2 to 40% by weight, preferably 3 to 30% by weight. When the amount is less than 1% by weight, surface layer modified effect due to the fluorine type resin powder is not sufficient. When the amount is more than 50% by weight, light transmittance is decreased and mobility of the carrier is decreased.

When the fluorine type resin powder is contained, in order to improve dispersibility into photosensitive member binder, it is preferred to add fluorine type graft polymer.

The fluorine type graft copolymer used in the present invention can be obtained by copolymerization of oligomer (herein after referred to "macromer") having polymerizable group at its one terminal portion and constant repetition and having molecular weight of about 1,000 to 10,000 and polymerizable monomer. The fluorine type graft polymer has the following structure:

(i) in a case of copolymer comprising non-fluorine type macromer synthesized by non-fluorine type polymerizable monomer and fluorine type polymerizable monomer, main chain is fluorine type segment and branch chain is non-fluorine type segment, and (ii) in a case of copolymer comprising fluorine type macromer synthesized by fluorine type polymerizable monomer and non-fluorine type polymerizable monomer, main chain is non-fluorine type segment and branch chain is fluorine type segment.

In the fluorine type graft polymer, the fluorine type segment and the non-fluorine type segment are individually localized as mentioned above. Therefore, the graft polymer has functional separated structure in which the fluorine type segment is oriented to the fluorine type resin powder and the non-fluorine type segment is oriented to the resin layer added. Particularly, since the fluorine type segment is oriented sequentially, the fluorine type segment adsorbs to the fluorine type resin powder in high density and efficiency and the non-fluorine type segment is oriented to the resin layer so that improvement of dispersion stability of the fluorine type resin powder can be achieved which can not be attained by using a conventional dispersant.

The fluorine type resin powder generally exists in an aggregate with several $\mu$m oeder. However, by using the fluorine type graft polymer in the present invention as a dispersant, the powder can be dispersed to such a degree that the primary particle diameter is not more than 1 $\mu$m.

To utilize such function separation effect to the full, it is necessary to adjust the molecular weight of the macromer to approximately 1,000 to 10,000 as mentioned above. The molecular weight of less than 1,000 results in too short length of the segment, so that in case of the fluorine type segment, the adsorption efficiency onto the fluorine type resin powder reduces, and in case of the non-fluorine type segment, the orientation to the surface resin layer becomes weakened, thus hindering the dispersion stability of the fluorine type resin powder in both cases. On the other hand, the molecular weight of more than 10,000 reduces the compatibility with the surface resin layer, and particularly in case of the fluorine type segment, this phenomenon becomes remarkable. The segment takes a coil form in which it is shrunk within the resin layer so that the number of adsorption active points onto the fluorine type resin powder is decreased to thereby impede the dispersion stability.

The molecular weight of the fluorine type graft polymer itself has a great influence, but it may preferably be from 10,000 to 100,000. The molecular weight of less than 10,000 results in insufficient dispersion stability, while the molecular weight of more than 100,000 results in reduction of the compatibility with the surface resin layer so that the dispersion stability function is not displayed as well.

The amount of the fluorine type segment in the fluorine type graft polymer may be preferably 5 to 90% by weight, but more preferably 10 to 70% by weight. In case that the amount of the fluorine type segment is less than 5% by weight, the dispersion stability function of the fluorine type resin powder is not fully performed. On the other hand, in case that it is more than 90% by weight, the compatibility with the resin layer as the surface layer becomes poor.

The fluorine type graft polymer may be preferably added in an amount of 0.1 to 30% by weight, more preferably 1 to 20% by weight based on the fluorine type resin powder. If the amount is less than 0.1% by weight, the dispersion stability effect of the fluorine type resin powder is not sufficient, and if the amount is more than 30% by weight, the fluorine type graft polymer exists in the state adsorbed onto the fluorine type resin powder and further is present within the inside of the surface resin layer in the free state so that the residual potential is stored when the electrophotographic process is to be repeated.

Examples of the silicone containing compound are monomethylsiloxane three-dimensional cross-linked products, dimethylsiloxane-monomethylsiloxane three-dimensional cross-linked products, ultra-high-molecular-weight polydimethyl-siloxanes, block polymers containing polydimethylsiloxane segments, surface active agents, macromonomers, and terminal-modified polydimethylsiloxanes. The three-dimensional cross-linked products may be used in the form of finely divided particles having a particle diameter ranging from 0.01 to 5 $\mu$m. In case of the polydimethylsiloxane compounds, those having a molecular weight ranging from 3,000 to 5,000,000 may be used. They are dispersed in a photosensitive layer composition together with a binder resin when in the form of finely divided particles. The dispersing may be conducted by using a sand mill, ball mill, roll mill, homogenizer, nanomizer, paint shaker, or ultrasonic. The fluorine substituted compound and/or silicone-containing compound may be contained in the outermost layer of the photosensitive member preferably in an amount of 1 to 70% by weight, more preferably 2 to 55% by weight. If it is less than 1% by weight, lowering of the surface energy is insufficient, and if it is more than 70% by weight, the film strength of the surface layer lowers.

The fluorine substituted compound and/or silicone-containing compound may be dispersed in a binder resin such as for example, polyester, polyurethane, polyarylate, polyethylene, polystyrene, polybutadiene, polycarbonate, polyamide, polypropylene, polyimide, polyamide-imide, polysulfone, polyarylether, polyacetal, nylon, phenolic resin, acrylic resin, silicone resin, epoxy resin, urea resin, allyl resin, alkyd resin, and butyral resin. Further, a reactive epoxy, (meth)acrylic monomer or oligomer also may be mixed with the binder resin and then cured for use.

The photosensitive member has preferably a protective layer as the outermost layer for the purpose of making its service life longer, but its service life can be further extended when it is used together with the developer of the present invention.

A resin for the protective layer includes, for example polyesters, polycarbonates, acrylic resins, epoxy resins, phenolic resins, and phosphazene resins. These resins may be used alone or in combination of two or more kinds, or they may be mixed with a curing agent for those materials so as to provide a protective layer having a desired hardness. The protective layer may preferably have a thickness of 0.1 to 6 μm, more preferably 0.5 to 4 μm to remove such an evil that the residual potential is raised or the sensitivity is decreased during the continuous use of the photosensitive member due to the constitution of the photosensitive member wherein a layer is provided wherein no charges are transported.

The protective layer may be formed by spray coating, or beam coating of a coating liquid. Alternatively, it may be provided by a penetration coating with an appropriate solvent selected.

The protective layer may be incorporated with charge transporting materials previously mentioned, or particles of metals, metal oxides, metal oxide-covered metal salts, or metal oxide-covered metal oxides to adjust the electric resistance. The metal oxide particles include superfine particles of zinc oxide, titanium oxide, tin oxide, antimony oxide, indium oxide, bismuth oxide, tin oxide-covered titanium oxide, tin oxide-covered indium oxide, antimony oxide-covered tin oxide, and zirconium oxide. These metal oxides may be used alone or in combination of two or more kinds. When two or more kinds of them are mixed, they may be in a form of a solid solution or fusion body.

The developer of the present invention is especially effective for an organic photosensitive member having an organic compound such as a resin at the surface of an electrostatic latent image holding member. When the surface layer is formed of an organic compound, it is apt to adhere to a binder resin in the toner, and particularly when the same material is used, a chemical bonding is liable to be formed at a contact point between the toner and the photosensitive member surface so that the release property is lowered. As a result, the transfer property or the cleaning property is deteriorated, and further fusion or filming is apt to occur.

A surface material on the electrostatic latent image holding member includes, for example silicone resins, vinylidene chloride resins, ethylene-vinylidene chloride resins, styrene-acrylonitrile copolymers, styrene-methylmethacrylate copolymers, styrene resins, polyethyleneterephthalate resins, and polycarbonate resins. However, it is not restricted to those materials, and their copolymers or blends with other monomers or among the exemplified resins may be used. The polycarbonate resins are especially effective for an image forming apparatus provided with a photosensitive drum having a diameter of 50 mm or below, particularly 40 mm or below, for example, 25 to 35 mm. The effect can be increased by incorporation of a lubricating material, or provision of a protective layer since in case of a photosensitive drum having such a small diameter, the curvature is large even under the same line pressure, and as a result, the pressure is liable to be centered on the contact portion. Also, in case of a belt shaped photosensitive member, the same phenomenon is considered to occur, and therefore, the incorporation of a lubricating material or provision of a protective layer are also effective for an image forming apparatus having a belt shaped photosensitive member with a curvature of 25 mm or below at the transfer portion.

Cleaning is performed preferably by the blade cleaning. For example, a urethane rubber, silicone rubber or resin having elasticity may be used as a blade, and alternatively a metal blade with a resin chip at the tip may be used. It is brought into contact with or pressure contact with the photosensitive member in the same direction as or the opposite direction to the moving direction of the member. It is preferred to bring the blade into pressure contact with the photosensitive member in the opposite direction to the moving direction of the member. At that time, the contact pressure of the blade to the photosensitive member is preferably 0.5 kg/m or above in the line pressure, more preferably 1 to 5 kg/m. Further, the blade cleaning may be conducted in conjunction with the magnetic brush cleaning, fur brush cleaning, and roller cleaning methods.

The toner of the present invention produces a moderate friction and further is excellent in the release property and the lubricating property so that it can display good cleaning property in the blade cleaning, and even if the blade is brought into a pressure contact with the photosensitive member, the member is hardly scratched or abraded. Neither fusion nor filming occurs.

A toner remaining on the electrostatic latent image holding member after transferring may be removed, for example by known methods such as a blade system, fur brush system and magnetic brush system as mentioned before. However, under the existing circumstances, these cleaning methods cannot remove completely the toner. As for this point, the toner of the present invention can be preferably used since it does not accumulate on the photosensitive member, nor does it cause any contamination.

EXAMPLES

The present invention will be described below by specifically giving Examples. The present invention is by no means limited to these.

GROUP I

Organic-treated Fine Titanium Oxide Particles or Organic-treated Fine Alumina Particles, Production Examples 1 to 27

Particles to be treated and used in the following Examples are shown in Table 1 (at the end of all Examples; the same applies hereinafter).

The organic treatment was carried out by any of the following methods.

Organic Solvent Method 1 (Solvent Method 1)

In a container, 1 kg of toluene and 200 g of particles to be treated were put, and agitated by means of a mixer to form a slurry. To the slurry, a treating agent or agents was/were added in a prescribed amount, followed by thorough agitation by means of a mixer. The resulting slurry was processed for 30 minutes in a sand mill using zirconia balls as media.

The slurry was then taken out of the sand mill, and the toluene was removed under reduced pressure at 60° C., followed by drying at 250° C. for 2 hours while agitating in a stainless steel container. The powder thus obtained was disintegrated using a hammer mill to obtain organic-treated fine particles.

Organic Solvent Method 2 (Solvent Method 2)

In a container, 2 kg of toluene and 200 g of particles to be treated were put, and agitated by means of a mixer, followed by addition of a treating agent or agents added in a prescribed amount, and then agitation for 20 minutes.

Thereafter, the toluene was removed under reduced pressure at 60° C., followed by drying at 200° C. for 2 hours to obtain organic-treated fine particles.

Gaseous Phase Method 1

In a closed high-speed agitation mixer, 20 g of particles to be treated were put, and its inside was replaced by nitrogen. While gently agitating, a treating agent or agents optionally diluted with a suitable quantity of n-hexane was/were sprayed thereon. Then, 180 g of particles to be treated were further added and at the same time the remaining treating agent was sprayed thereon in a prescribed amount. After the addition was completed, the mixture was agitated for 10 minutes, followed by heating with high-speed agitation, and temperature was raised to 300° C. to continue agitation for 1 hour. While agitating, the temperature was restored to room temperature, and the resulting powder was taken out of the mixer, followed by disintegration using a hammer mill to obtain organic-treated fine particles.

Gaseous Phase Method 2

In an evaporator, a volatile titanium compound (e.g., titanium tetraisopropoxide, was vaporized at 200° C. in an atmosphere of nitrogen. In an evaporator, water was vaporized in an atmosphere of nitrogen, and then introduced into a heating container heated to 500° C. The vaporized titanium compound and the heated water vapor were introduced into a reaction vessel heated to 250° C. to carry out hydrolysis to obtain titanium oxide particles. Here, a prescribed amount of a treating agent or agents was/were vaporized in an atmosphere of nitrogen in an evaporator heated to 200° C. or atomized at 200° C. in an atmosphere of nitrogen, and then introduced into the reaction vessel. It was introduced into the reaction vessel in the manner that the titanium compound was mixed with the treating agent after the titanium oxide was formed. The above was operated in a stream of nitrogen, and the resulting organic-treated fine particles were collected through a filter.

Gaseous Phase Method 3

In a closed high-speed agitation mixer, 200 g of particles to be treated were put, and its inside was replaced by nitrogen. While agitating, a prescribed amount of a treating agent or agents was/were sprayed thereon. After the addition was completed, the mixture was agitated for 10 minutes at room temperature, and while agitating at a high speed the temperature was raised to 300° C. to continue agitation for 1 hour. While agitating, the temperature was restored to room temperature, and the resulting powder was taken out of the mixer to obtain organic-treated fine particles.

Aqueous Solvent Method 1 (Aqueous Method 1)

In an attritor, 200 g (as solid matter) of particles to be treated were added to an aqueous solvent prepared by adding 1% by weight of a nonionic surface active agent in water. Here, when the particles to be treated were added, a wet cake or water-containing paste of the particles was used and the amount of water and the amount of surface active agent were so adjusted that the particles to be treated were in a concentration of 5 parts by weight based on 100 parts by weight of the aqueous solvent. After high-speed agitation for 10 minutes, a treating agent was dropwise added in a prescribed amount to carry out agitation for 30 minutes. The solid matter was filtered, and then dried at 200° C. for 5 hours using a dryer, followed by disintegration using a hammer mill to obtain organic-treated fine particles.

Figure 12:
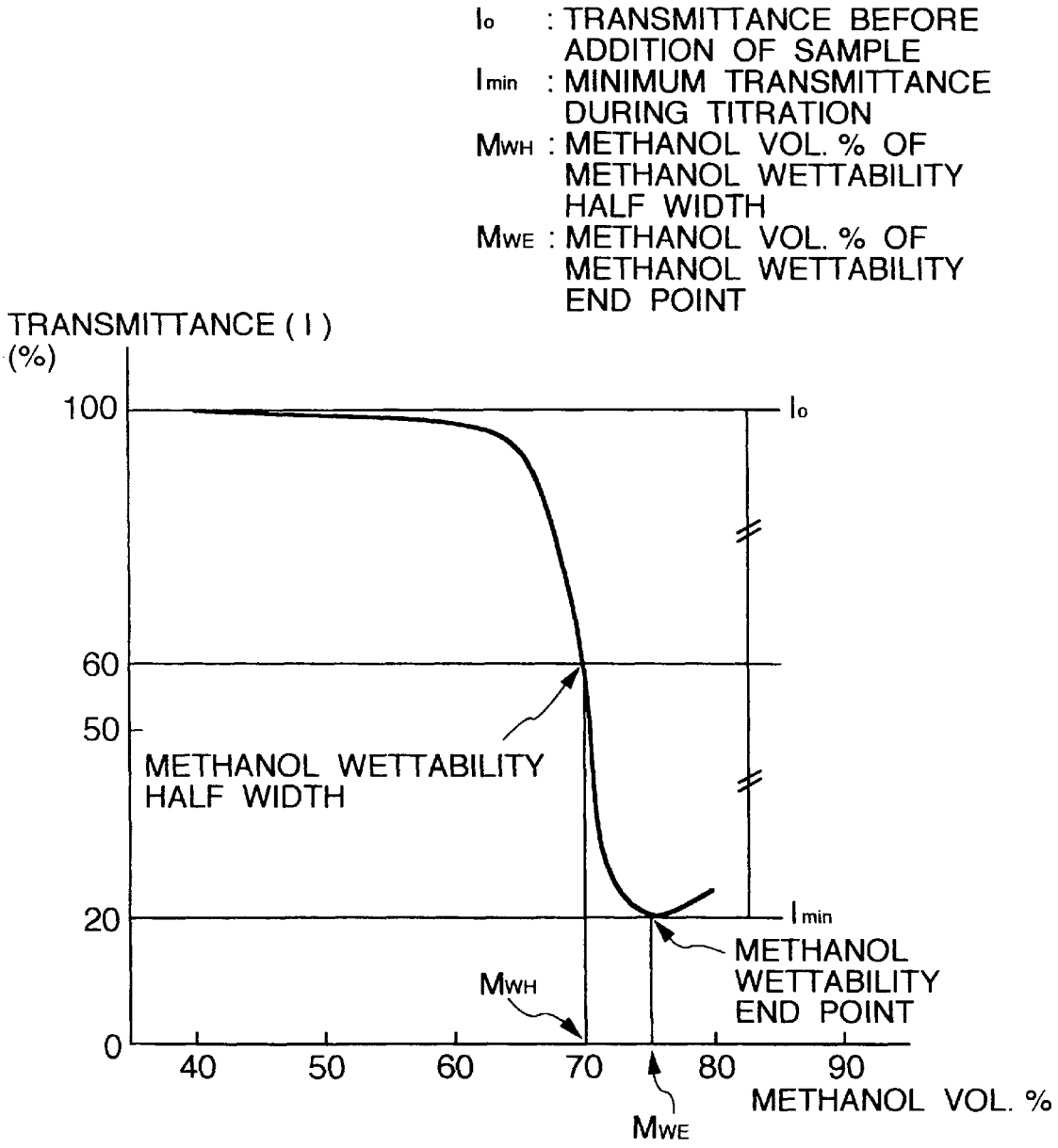
FIG. 12 shows a methanol titration curve from the analysis of which the methanol wettability half value of organic-treated fine particles 1 is determined.
Figure 13:
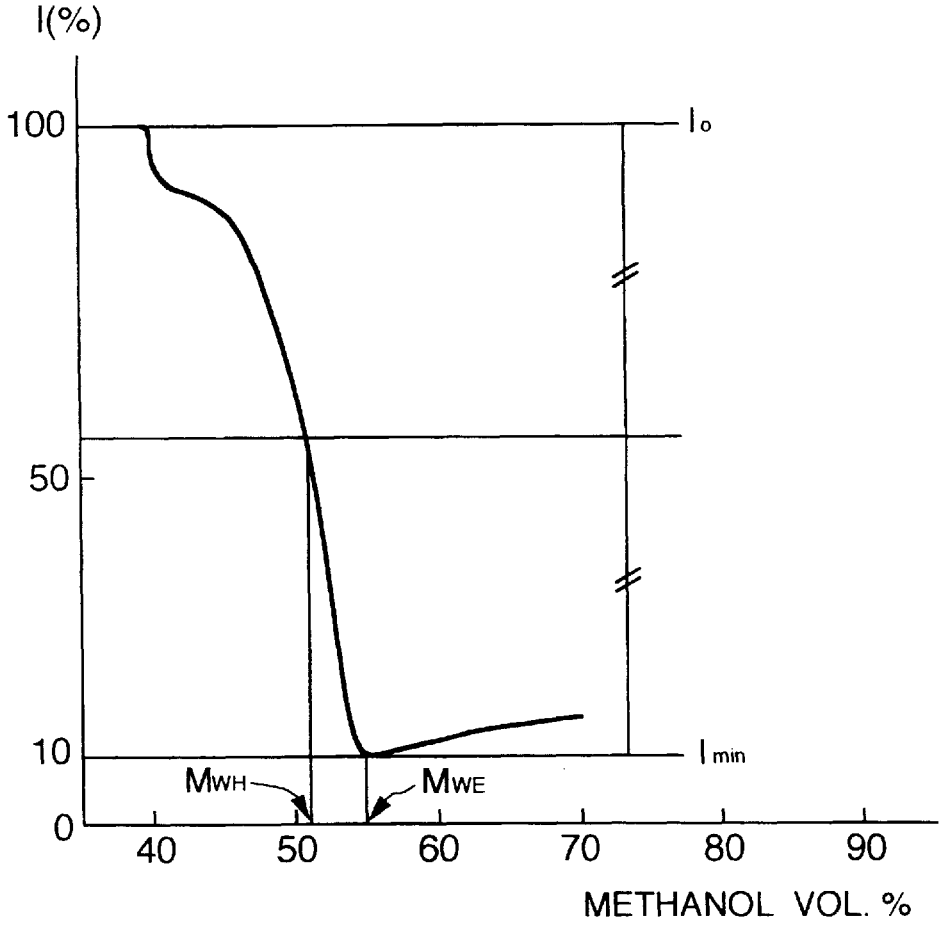
FIG. 13 shows a methanol titration curve from the analysis of which the methanol wettability half value of organic-treated fine particles 2 is determined.
Figure 14:
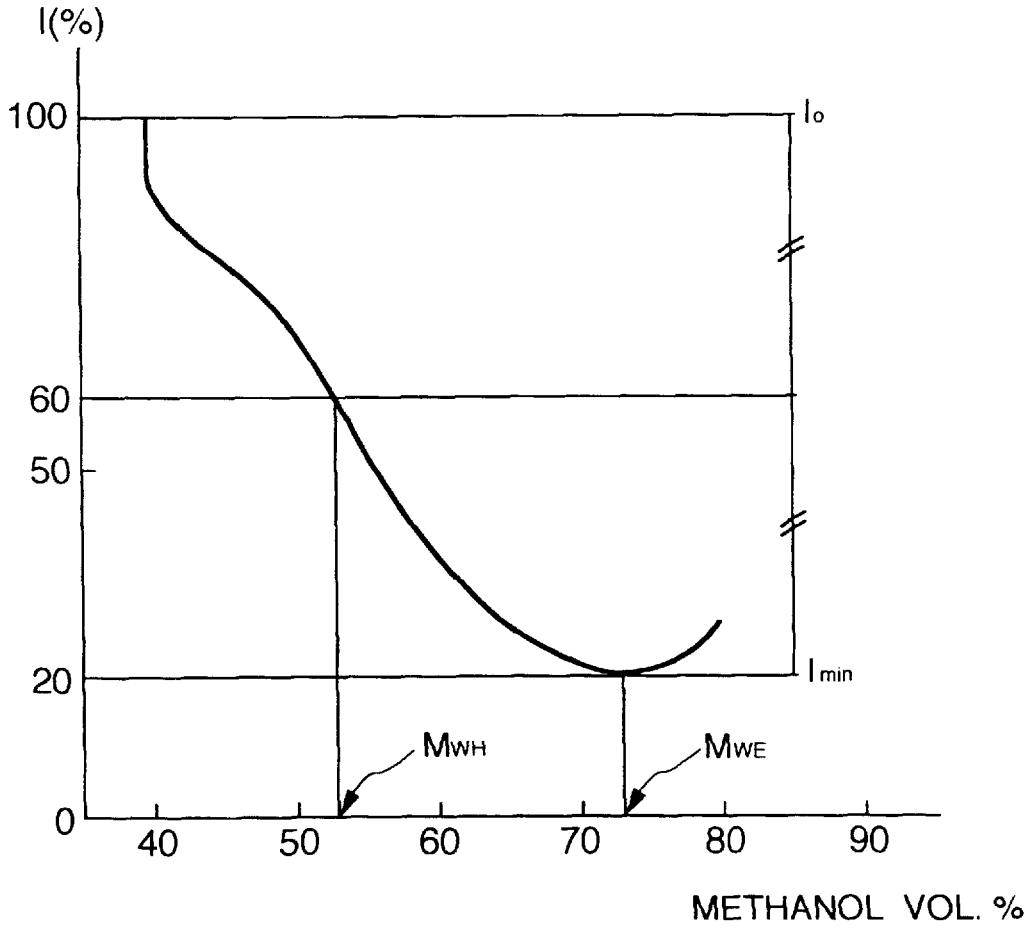
FIG. 14 shows a methanol titration curve from the analysis of which the methanol wettability half value of organic-treated fine particles 3 is determined.

The production process and formulation of the organic-treated fine particles used in the following Examples are shown in Table 2, and the physical properties thereof in Tables 3 and 4. The titration curves of the organic-treated fine particles 1, 2 and 3 are shown in FIGS. 12, 13 and 14, respectively. The amount of the treating agent and the diluent in the treatment is given as part(s) by weight (pbw) based on 100 parts by weight of the particles to be treated.

In Table 2, in the column "[1]", numerical symbols "2", "8" and so forth correspond to those denoted in the column "[A]"; i.e., organic-treated particles are further used. (The same applies hereinafter.)

Production Examples of Binder Resins:

Polyester resin 1

| | |
|---|---|
| Terephthalic acid | 6.0 mol |
| n-Dodecenylsuccinic acid anhydride | 3.0 mol |
| Bisphenol-A propylene oxide 2.2 mol addition product | 10.0 mol |
| Dibutyltin oxide | 0.05 g |

The above compounds were put into a reaction vessel, and a thermometer, a stirring rod, a capacitor and a nitrogen feed pipe were fitted thereto. After its inside was replaced by nitrogen, temperature was gradually raised with stirring, to carry out reaction at 170° C. for 5 hours. Subsequently the temperature was raised to 190° C., and the reaction was carried out for 4 hours. Thereafter, the following compounds were added.

| | |
|---|---|
| Trimellitic acid anhydride | 0.7 mol |
| Dibutyltin oxide | 0.3 g |

Thereafter, the reaction was carried out at 190° C. for 3 hours. Then the temperature was raised to 200° C., pressure was reduced (15 hPa), and the reaction was carried out for 5 hours to effect dehydration condensation, where the reaction was completed to obtain polyester resin 1.

This polyester resin 1 had a peak molecular weight of 8,700 and a glass transition point of 64° C.

Polyester resin 2

| | |
|---|---|
| Fumaric acid | 9.5 mol |
| Bisphenol-A propylene oxide 2.2 mol addition product | 10.0 mol |
| Dibutyltin oxide | 0.5 g |

The above compounds were put into a reaction vessel, and a thermometer, a stirring rod, a capacitor and a nitrogen feed pipe were fitted thereto. After its inside was replaced by nitrogen, temperature was gradually raised with stirring, to carry out reaction at 220° C. for 6 hours. Subsequently, pressure was reduced (15 hPa), and the reaction was carried out for 2 hours to effect dehydration condensation, where the reaction was completed to obtain polyester resin 2.

This polyester resin 2 had a peak molecular weight of 9,800 and a glass transition point of 58° C.

Polyester resin 3

| | |
|---|---|
| Terephthalic acid | 9.5 mol |
| Bisphenol-A ethylene oxide 2.2 mol addition product | 5.0 mol |
| Dicyclohexane dimethanol | 5.0 mol |
| Dibutyltin oxide | 1.0 g |

The above compounds were put into a reaction vessel, and a thermometer, a stirring rod, a capacitor and a nitrogen feed pipe were fitted thereto. After its inside was replaced by nitrogen, temperature was gradually raised with stirring, to carry out reaction at 240° C. for 6 hours. Subsequently, pressure was reduced (15 hPa), and the reaction was carried out for 2 hours to effect dehydration condensation, where the reaction was completed to obtain polyester resin 3.

This polyester resin 3 had a peak molecular weight of 9,100 and a glass transition point of 62° C.

| Epoxy Resin 4 | |
|---|---|
| Bisphenol-A type liquid epoxy resin (a condensate of bisphenol-A with epichlorohydrin; epoxy equivalent weight: 188; viscosity: 13,000 mPa · s/25° C.) | 2,000 g |
| Bisphenol-A | 937 g |
| p-Cumylphenol | 559 g |
| Xylene | 400 g |

The above compounds were put into a reaction vessel, and a thermometer, a stirring rod, a capacitor and a nitrogen feed pipe were fitted thereto. After its inside was replaced by nitrogen, temperature was gradually raised up to 70° C. with stirring, where an aqueous 5N solution of 0.64 g of lithium chloride was added. The temperature was raised to 170° C. to evaporate the water and xylene while reducing the pressure, and the reduced pressure was cancelled to carry out the reaction for 6 hours. At this stage, 184 g of ϵ-caprolactone was added and the reaction was carried out for 6 hours to obtain a modified epoxy polyol resin (epoxy resin 4).

This epoxy resin 4 had a peak molecular weight of 7,600 and a glass transition point of 60° C.

| Styrene Resin 5 | |
|---|---|
| Styrene | 1,600 g |
| Butyl acrylate | 400 g |
| 2,2-Bis(4,4-di-t-butylperoxycyclohexyl)propane | 4 g |

From the above compounds, polymer A was obtained by suspension polymerization.

| | |
|---|---|
| Styrene | 2,550 g |
| Butyl acrylate | 450 g |
| Di-t-butyl peroxide | 60 g |

From the above compounds, polymer B was obtained by solution polymerization using xylene as a solvent, and the polymer A and polymer B were solution-mixed so as to be in a weight ratio of 25:75 to obtain styrene resin 5.

This styrene resin 5 had peak molecular weights of 9,400 and 720,000 , and a glass transition point of 60° C.

Production Examples of Classified Products 1–6:

| Classified Product 1 | (by weight) |
|---|---|
| Polyester resin 1 | 100 parts |
| Copper phthalocyanine phthalimide derivative pigment | 5 parts |
| Di-t-butylsalicylic acid chromium complex | 4 parts |

The above materials were premixed using a Henschel mixer, and thereafter melt-kneaded using a twin-screw extruder set to 130° C. The kneaded product was cooled, and then finely pulverized by means of a fine grinding mill making use of a jet stream, followed by classification using an air classifier to obtain a cyan classified product (cyan toner particles) 1 with a weight average particle diameter of 8 μm.

A magenta classified product (magenta toner particles) 1, a yellow classified product (yellow toner particles) 1 and a black classified product (black toner particles) 1 were obtained in the same manner as the above except that the pigment used for the cyan classified product 1 was replaced with 5 parts by weight of C.I. Pigment Red 122, 3.5 parts by weight of C.I. Pigment Yellow 17 and 5 parts by weight of carbon black, respectively.

| Classified Product 2 | (by weight) |
|---|---|
| Polyester resin 2 | 100 parts |
| Copper phthalocyanine phthalimide derivative pigment | 5 parts |
| Di-t-butylsalicylic acid chromium complex | 4 parts |

The above materials were premixed using a Henschel mixer, and thereafter melt-kneaded using a twin-screw extruder set to 130° C. The kneaded product was cooled, and then finely pulverized by means of a fine grinding mill making use of a jet stream, followed by classification using an air classifier to obtain a cyan classified product (cyan toner particles) 2 with a weight average particle diameter of 8 μm.

A magenta classified product (magenta toner particles) 2, a yellow classified product (yellow toner particles) 2 and a black classified product (black toner particles) 2 were obtained in the same manner as the above except that the pigment used for the cyan classified product 2 was replaced with 5 parts by weight of C.I. Pigment Red 122, 3.5 parts by weight of C.I. Pigment Yellow 17 and 5 parts by weight of carbon black, respectively.

| Classified Product 3 | (by weight) |
|---|---|
| Polyester resin 3 | 100 parts |
| Copper phthalocyanine phthalimide derivative pigment | 5 parts |
| Di-t-butylsalicylic acid chromium complex | 4 parts |

The above materials were premixed using a Henschel mixer, and thereafter melt-kneaded using a twin-screw extruder set to 130° C. The kneaded product was cooled, and then finely pulverized by means of a fine grinding mill making use of a jet stream, followed by classification using an air classifier to obtain a cyan classified product (cyan toner particles) 3 with a weight average particle diameter of 8 μm.

A magenta classified product (magenta toner particles) 3, a yellow classified product (yellow toner particles) 3 and a black classified product (black toner particles) 3 were obtained in the same manner as the above except that the pigment used for the cyan classified product 3 was replaced with 5 parts by weight of C.I. Pigment Red 122, 3.5 parts by weight of C.I. Pigment Yellow 17 and 5 parts by weight of carbon black, respectively.

| Classified Product 4 | (by weight) |
|---|---|
| Epoxy resin 4 | 100 parts |
| Copper phthalocyanine phthalimide derivative pigment | 5 parts |
| Di-t-butylsalicylic acid chromium complex | 4 parts |

The above materials were premixed using a Henschel mixer, and thereafter melt-kneaded using a twin-screw extruder set to 130° C. The kneaded product was cooled, and then finely pulverized by means of a fine grinding mill making use of a jet stream, followed by classification using an air classifier to obtain a cyan classified product (cyan toner particles) 4 with a weight average particle diameter of 8 μm.

A magenta classified product (magenta toner particles) 4, a yellow classified product (yellow toner particles) 4 and a black classified product (black toner particles) 4 were obtained in the same manner as the above except that the pigment used for the cyan classified product 4 was replaced with 5 parts by weight of C.I. Pigment Red 122, 3.5 parts by weight of C.I. Pigment Yellow 17 and 5 parts by weight of carbon black, respectively.

| Classified Product 5 | (by weight) |
|---|---|
| Styrene resin 5 | 100 parts |
| Copper phthalocyanine phthalimide derivative pigment | 5 parts |
| Di-t-butylsalicylic acid chromium complex | 4 parts |
| Low-molecular weight ethylene-propylene copolymer | 3 parts |

The above materials were premixed using a Henschel mixer, and thereafter melt-kneaded using a twin-screw extruder set to 130° C. The kneaded product was cooled, and then finely pulverized by means of a fine grinding mill making use of a jet stream, followed by classification using an air classifier to obtain a cyan classified product (cyan toner particles) 5 with a weight average particle diameter of 8 μm.

A magenta classified product (magenta toner particles) 5, a yellow classified product (yellow toner particles) 5 and a black classified product (black toner particles) 5 were obtained in the same manner as the above except that the pigment used for the cyan classified product 5 was replaced with 5 parts by weight of C.I. Pigment Red 122, 3.5 parts by weight of C.I. Pigment Yellow 17 and 5 parts by weight of carbon black, respectively.

| Classified Product 6 | (by weight) |
|---|---|
| Styrene resin 5 | 100 parts |
| Magnetite (magnetic iron oxide) | 80 parts |
| Di-t-butylsalicylic acid chromium complex | 4 parts |
| Low-molecular weight ethylene-propylene copolymer | 3 parts |

The above materials were premixed using a Henschel mixer, and thereafter melt-kneaded using a twin-screw extruder set to 130° C. The kneaded product was cooled, and then finely pulverized by means of a fine grinding mill making use of a jet stream, followed by classification using an air classifier to obtain a black classified product (black toner particles) 6 with a weight average particle diameter of 8 μm.

Toner and Developer Production Examples

Based on 100 parts by weight of each classified product and according to the formulation as shown in Table 5, the fine titanium oxide particles or fine alumina particles of the present invention were externally added and mixed, which were well agitated using a Henschel mixer, to obtain toners as shown in the table.

Any one of cyan toners 1 to 27, magenta toner 1, yellow toner 1 and black toner 1 were each blended with a Cu—Zn—Fe ferrite carrier coated with 0.35% by weight of a styrene-methyl methacrylate copolymer (weight ratio: 80:20), so as to be in a toner concentration of 5% by weight to obtain two component type developers.

Cyan toner 28, magenta toner 2, yellow toner 2 and black toner 2 were each blended with a Cu—Zn—Fe ferrite carrier coated with 0.45% by weight of silicone resin, so as to be in a toner concentration of 5% by weight to obtain two component type developers.

Cyan toner 31, magenta toner 5, yellow toner 5 and black toner 5 were each blended with a Cu—Zn—Fe ferrite carrier coated with 0.35% by weight of a styrene-butyl methacrylate copolymer (weight ratio: 15:85) and 0.15% by weight of silicone resin, so as to be in a toner concentration of 7% by weight to obtain two component type developers.

Cyan toner 30, magenta toner 4, yellow toner 4 and black toner 4 were each blended with a Cu—Zn—Fe ferrite carrier coated with 2.5% by weight of a styrene-methyl methacrylate copolymer (weight ratio: 65:35), so as to be in a toner concentration of 7% by weight to obtain two component type developers.

Cyan toner 29, magenta toner 3, yellow toner 3 and black toner 3 were each blended with a Cu—Zn—Fe ferrite carrier coated with 0.35% by weight of a styrene-methyl methacrylate copolymer (weight ratio: 65:35) and 0.15% by weight of fluorine resin, so as to be in a toner concentration of 7% by weight to obtain two component type developers.

Black toner 6 was used as it was, without use of a carrier, as a one component type developer.

Example 1

Cyan toner 1 was applied in a commercially available digital full-color electrophotographic copying machine (Color Laser Copyer 550, manufactured by Canon Inc.), having the construction as shown in FIG. 1, and a 10,000 sheet running test was made in an environment of 23° C./60% RH.

Image density was measured on reflection density by means of a Macbeth densitometer Model RD918 (manufactured by Macbeth Co.), using an SPI filter. Measurement was made on circular images of 5 mm diameter to determine the image density.

Fog on images was measured by means of a reflection densitometer (Refelctometer Model TC-6DS, manufactured by Tokyo Denshoku Co., Ltd.). The worst value of white background reflection density after image formation was denoted by Ds, and an average reflection density of a transfer medium before image formation was denoted by Dr, where a value of Ds−Dr was regarded as fog quantity to make evaluation on fog. When this value is 1% or less, the fog is on a very good level; when it is 1.5% or less, images are substantially free of fog and are good images; and when it is 2% or less, there is no problem in practical use.

Transfer efficiency was determined from changes in Macbeth density of toner images on a photosensitive drum before and after their transfer under a transfer electric current of 275 μA. Toner images on the photosensitive drum before and after their transfer in the case when images formed after fixing on transfer paper have a Macbeth density of 1.5, are respectively taken off with adhesive tapes made of polyester film, and the tapes with which the toner images were took off and a virgin tape were stuck to transfer paper, and the Macbeth densities thereof are measured. The density before transfer is denoted as Da, the density after transfer as Db, and the density of the virgin tape as Dc, where the transfer efficiency is defined as the value determined from the following expression.

$$\text{Transfer efficiency}=\{[(Da-Dc)-(Db-Dc)]/(Da-Dc)\}\times 100$$

The higher this value is, the higher the transfer efficiency is and the better the transfer performance is.

To evaluate transfer latitude, images with sixteen gradations were formed, and those formed by fixing transferred images obtained under various transfer electric currents were visually judged. The range of transfer electric currents within which good images free of non-uniform transfer, coarse images and black spots around line images are obtained in respect of the images with all gradations is determined. That is, when the transfer performance is good, toner images are neatly transferred even at a low transfer electric current, and images free of non-uniform transfer, having a sure image density and having a gradation can be obtained. Toners having a good transfer performance do not require a higher transfer electric current than is necessary, and hence good images free of coarse images and black spots around line images can be obtained. In other words, those having a wide range of values within which the transfer electric current for achieving good transfer starts at a low value until it reaches a transfer upper limit have a good transfer performance, and are toners having a wide transfer latitude. Namely, when the transfer latitude is broad, the range within which transfer mediums and environment for image formation are selected can be widened and also the control of transfer in image forming apparatus can be made easy.

With regard to blank areas caused by poor transfer, blank areas in character areas were visually judged to make evaluation according to the following evaluation criteria. "A": blank areas are little seen; "B": blank areas are slightly seen; "C": blank areas are seen, but there is no problem in practical use; and "D": blank areas are conspicuous and not feasible for practical use.

With regard to gradation, images with sixteen gradations were visually judged to make evaluation according to the following evaluation criteria. "A": sixteen gradations are conceivable, halftone areas are not coarse, and highlight areas are also neatly reproduced; "B": sixteen gradations are conceivable, but halftone areas are seen a little coarse; "C": reproduction at halftone areas turns poor, but there is no problem in practical use; and "D": fourteen or higher gradations are not conceivable, not feasible for practical use.

The fog, image density, blank areas caused by poor transfer at line portions and gradation examined at the initial stage, on the 1,000th sheet and on the 10,000th sheet are shown in Table 6. The transfer efficiency and transfer latitude examined on the 1,000th sheet are shown in Table 7.

The running test was also made in an environment of 30° C./80% RH. The test was started after the developing assembly and the supply toner were made adapted to the test environment for a week, and images were printed on 1,000 sheets. Thereafter, the machine was left to stand for a week in this environment, where the test was again started, and images were printed on 1,000 sheets. The machine was further left to stand for two weeks, and then images were printed on 1,000 sheets. The fog, image density, blank areas caused by poor transfer at line portions and gradation examined at the initial stage, on the 100th sheet and on the 1,000th sheet in each step are shown in Tables 8, 9 and 10.

As shown in Tables 6 to 10, using the cyan toner 1 of the present invention, sharp cyan images having a high image density, free of fog, free of blank areas at line portions and having a good gradation were obtained in both usual environment and environment of high temperature and high humidity. The toner showed a good transfer efficiency and also a broad transfer latitude.

Examples 2 to 17

Using cyan toners 4 to 7, 9 to 11 and 13 to 21, images were formed and evaluated in the same manner as in Example 1 to obtain the results also shown in Tables 6 to 10.

Comparative Example 1

Using cyan toner 2, images were formed and evaluated in the same manner as in Example 1 to obtain the results shown in Tables 6 to 10. The blank areas at character portions were seen and the transfer latitude was narrow. The developing performance was poor in the environment of high humidity, and fog greatly occurred especially at the initial stage and at the start after leaving.

Comparative Example 2

Using cyan toner 3, images were formed and evaluated in the same manner as in Example 1 to obtain the results shown in Tables 6 to 10. There were no problems on the blank areas at character portions and the transfer latitude. However, the developing performance was poor in the environment of high humidity, and fog greatly occurred especially at the initial stage and at the start after leaving.

Comparative Example 3

Using cyan toner 8, images were formed and evaluated in the same manner as in Example 1 to obtain the results shown in Tables 6 to 10. The cyan toner 8 showed a narrow transfer latitude, and blank areas caused by poor transfer were also seen. In the environment of high humidity, fog greatly occurred, with a low image density, especially at the start after leaving.

Comparative Example 4

Using cyan toner 12, images were formed and evaluated in the same manner as in Example 1 to obtain the results shown in Tables 6 to 10. The cyan toner 12 showed a narrow transfer latitude, and blank areas caused by poor transfer occurred. The developing performance was poor in the environment of high humidity, and was especially poor after leaving.

Comparative Example 5

Using cyan toner 22, images were formed and evaluated in the same manner as in Example 1 to obtain the results shown in Tables 6 to 10. The cyan toner 22 showed a little poor developing performance in the environment of high humidity.

Comparative Example 6

Using cyan toner 23, images were formed and evaluated in the same manner as in Example 1 to obtain the results shown in Tables 6 to 10. The cyan toner 23 showed a little poor developing performance in the environment of high humidity.

Comparative Example 7

Using cyan toner 24, images were formed and evaluated in the same manner as in Example 1 to obtain the results shown in Tables 6 to 10. The cyan toner 24 showed a little poor developing performance in the environment of high humidity.

Comparative Example 8

Using cyan toner 25, images were formed and evaluated in the same manner as in Example 1 to obtain the results shown in Tables 6 to 10. The cyan toner 25 showed a little poor developing performance in the environment of high humidity.

Comparative Example 9

Using cyan toner 26, images were formed and evaluated in the same manner as in Example 1 to obtain the results shown in Tables 6 to 10. The cyan toner 26 showed a little poor developing performance in the environment of high humidity.

Comparative Example 10

Using cyan toner 27, images were formed and evaluated in the same manner as in Example 1 to obtain the results shown in Tables 6 to 10. The cyan toner 27 caused an increase in fog with progress of the running test.

Example 18

Cyan toner 1, magenta toner 1, yellow toner 1 and black toner 1 were applied in the digital full-color electrophotographic copying machine (Color Laser Copyer 550, manufactured by Canon Inc.) as used in Example 1, and a 2,000 sheet full-color running test (copying test) was made in an environment of 23° C./60% RH. As a result, beautiful and pictorial images having good color reproduction and gradation and free of color non-uniformity were obtained, and color differences were little seen in the images during the copying.

The running test was also made in an environment of 30° C./80% RH. Copies were taken on 500 sheets after the developers and supply toners were made adapted to the test environment for a week. Thereafter, the machine was left to stand for a week in this environment, and the test was again started to make a 500 sheet running test. As a result, beautiful full-color images were obtained. The fog was 1.5% or less as the worst value on the four colors superimposed. There was also no problem at the initial stage and the stage where the test was again started.

Example 19

Figure 15:
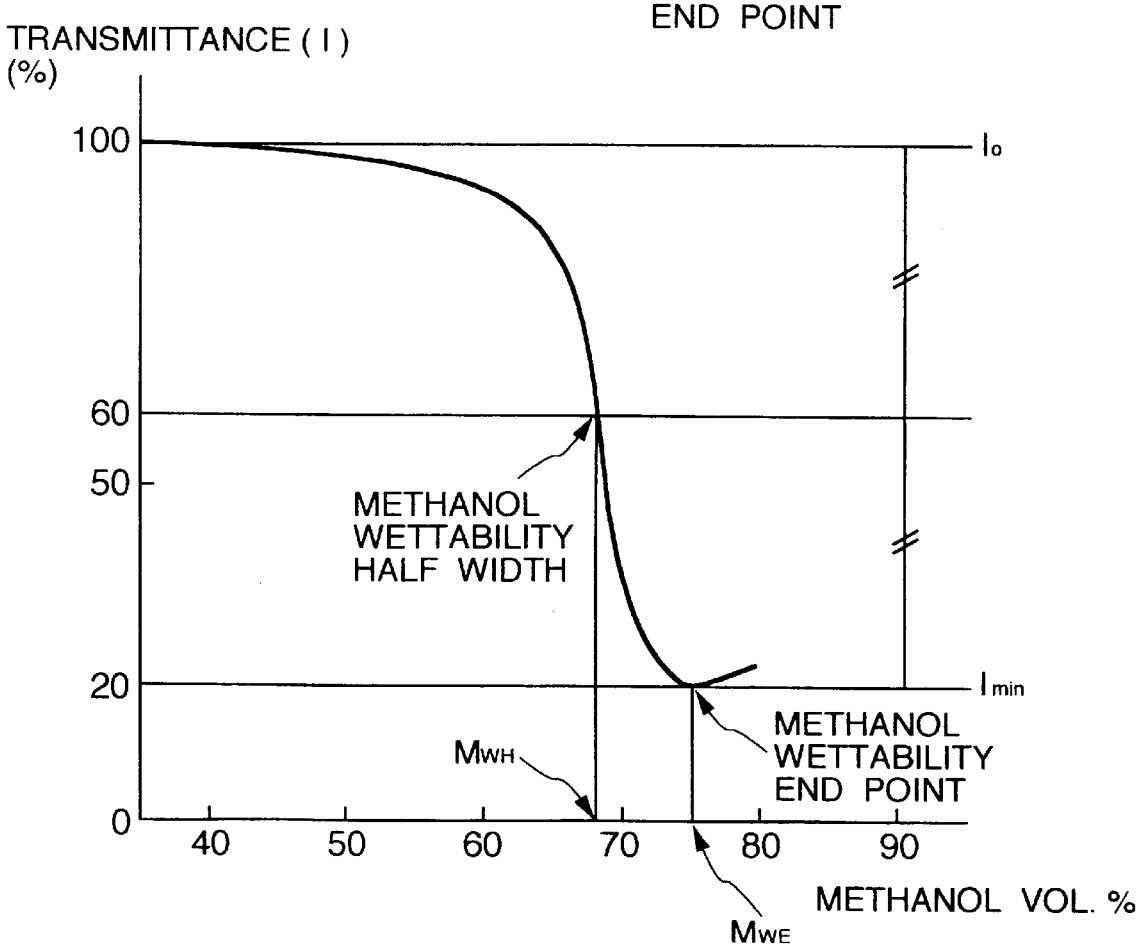
FIG. 15 shows a methanol titration curve from the analysis of which the methanol wettability half value of organic-treated fine particles 31 is determined.

Developers produced using cyan toner 28, magenta toner 2, yellow toner 2 and black toner 2 were applied in a digital full-color electrophotographic copying machine as shown in FIG. 15, and a 2,000 sheet full-color running test (copying test) was made in an environment of 23° C./60% RH.

Figure 18:
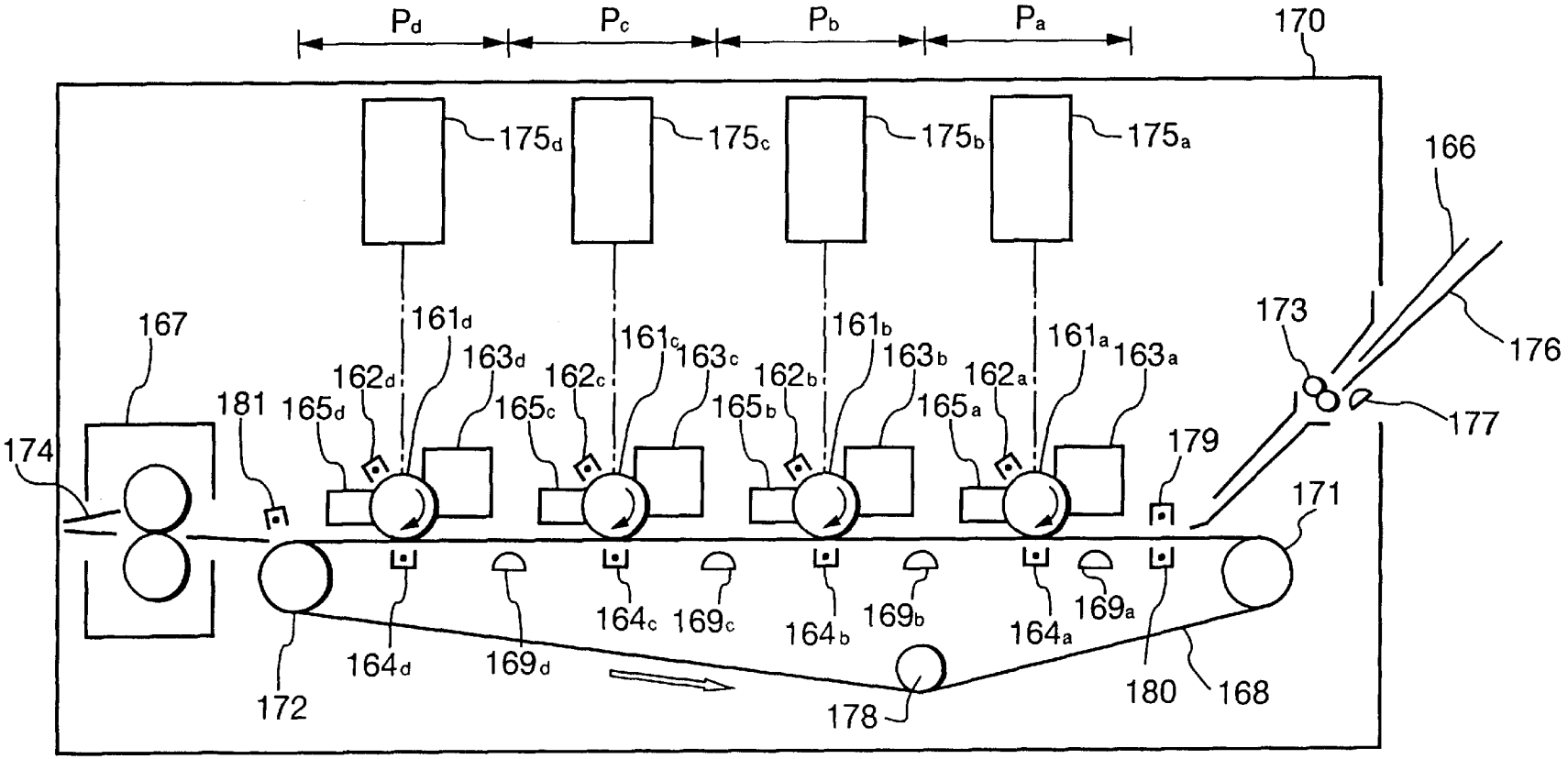
FIG. 18 schematically illustrates an image forming apparatus used in Example 18.

The image forming apparatus shown in FIG. 18 is provided with image forming units Pa, Pb, Pc and Pd in the body 170 of the apparatus. A transfer medium transport means comprised of a belt 168 wound over drive rollers 171, 172, 178 is provided beneath the image forming units. The belt 168 is circulatingly moved in the direction of an arrow. On the right side of the belt 168, a paper feed mechanism 173 is provided so that a transfer medium 166 is sent onto the belt 168 through the paper feed mechanism 173. The transfer medium 166 on which toner images have been transferred in the image forming units Pa, Pb, Pc and Pd is so designed as to be delivered to a fixing assembly 167 from the left side of the belt 168. Then the transfer medium 166 on which images have been fixed is put out of the body of the apparatus through an outlet 174.

The first, second, third and fourth image forming units Pa, Pb, Pc and Pd, arranged above the transport means, have photosensitive drums 161*a*, 161*b*, 161*c* and 161*d*, respectively, serving as electrostatic latent image bearing members, and the photosensitive drums 161*a*, 161*b*, 161*c* and 161*d* are provided on the upper left sides thereof with charging assemblies 162*a*, 162*b*, 162*c* and 162*d*, respectively.

Above the photosensitive drums 161*a*, 161*b*, 161*c* and 161*d*, laser beam scanners 175*a*, 175*b*, 175*c* and 175*d* are provided, respectively, which are each comprised of a semiconductor laser, a polygon mirror and an fθ lens, and respectively scan the photosensitive drums 161*a*, 161*b*, 161*c* and 161*d* in the direction of the normals thereof, between the charging assemblies 162*a*, 162*b*, 162*c* and 162*d* and developing assemblies 161*a*, 161*b*, 161*c* and 161*d*, to carry out exposure to form latent images. Stated in detail in this regard, image signals corresponding to an yellow component image of color images and image signals corresponding to a magenta component image are respectively inputted to the laser scanner 175*a* of the first image forming unit Pa and to the laser scanner 175*b* of the second image forming unit Pb. Also, image signals corresponding to a cyan component image and image signals corresponding to a black component image are respectively inputted to the laser scanner 175*c* of the third image forming unit Pc and to the laser scanner 175*d* of the fourth image forming unit Pb.

The paper feed mechanism 173 is provided with a paper feed guide 176 and a sensor 177. Once the transfer medium 166 is inserted to the paper feed guide 176, its leading end is detected by the sensor 177, whereupon signals to start rotation are sent to the photosensitive drums 161*a*, 161*b*, 161*c* and 161*d* and at the same time the drive rollers 171, 172 and 178 are driven to rotate the belt 168. The transfer medium 166 fed onto the belt 168 is corona-charged from attraction charging assemblies 179 and 180 and securely attracted to the surface of the belt 168. In the present Example, high voltages applied to the attraction charging assemblies 179 and 180 are so set as to be in polarities reverse to each other, and the charging assembly 180 is set to have the same polarity as transfer charging assemblies 164*a*, 164*b*, 164*c* and 164*d*.

Once the leading end of the transfer medium 166 comes to the position where it intersects sensors 169*a*, 169*b*, 169*c* and 169*d*, signals therefrom make the latent images begin to be successively formed on the photosensitive drums 161*a*, 161*b*, 161*c* and 161*d* which are being rotated. After the transfer medium 166 has passed through the fourth image forming unit Pd, an AC voltage is applied to a charge eliminating assembly 189, so that the transfer medium 166 is destaticized and separated from the belt 168. Thereafter, it enters into the fixing assembly 167, where toner images are fixed, and then is put out of the apparatus through the outlet 174.

In the above example, for the belt 168 used as the transport means, a material that may less elongate and can effectively transmit the control of the rotation of the drive rollers is selected, as exemplified by a polyurethane belt (available from Hokushin Kogyo K.K.). As a structural factor, the belt may preferably not greatly affect transfer corona electric currents pertaining to the transfer process. The above belt may preferably be a polyurethane belt having, e.g., a thickness of about 100 μm, a rubber hardness of 97° D and a modulus in tension of 16,000 kg/cm$^2$.

Here, as transfer conditions, each image forming unit is set to have a total transfer electric current of 450 μA; a distance between a transfer discharge wire and the drum, of 11 mm; and a distance between the transfer discharge wire and an electrode back plate, of 8.5 mm (on either side). As conditions for the attraction charging preceding to the transfer, both the upper and lower attraction charging assemblies 179 and 180 are made to have the same shapes as the transfer charging assemblies 164*a* to 164*d*, and both the upper and lower assemblies are set to have a total transfer electric current of 200 μA, and a distance between the transfer discharge wire and the transfer belt, of 11 mm.

As a result of the running test, beautiful and pictorial images having good color reproduction and gradation and free of color non-uniformity were obtained, and color differences were little seen in the images during the copying.

The running test was also made in an environment of 30° C./80% RH. Copies were taken on 500 sheets after the developers and supply toners were made adapted to the test environment for a week. Thereafter, the machine was left to stand for a week in this environment, and the test was again started to make a 500 sheet running test. As a result, beautiful full-color images were obtained. The fog was 1.4% or less as the worst value on the four colors superimposed. There was also no problem at the initial stage and the stage where the test was again started.

The toner of the present invention has so good a transfer performance that the transfer performance of the toner at every transfer can be made uniform under the like transfer electric currents even if the charging of the charging means has increased at every repetition of transfer. Thus, images with a good quality and a high quality level were obtained, and also the force to attract the transfer medium to the transport belt did not deteriorate. Moreover, the transfer performance can be made uniform in the state the transfer conditions in all the image forming units are kept alike. Hence, it was easy to make control when the full-color images were formed.

Example 20

Two component type developers produced using cyan toner 29, magenta toner 3, yellow toner 3 and black toner 3 were applied in a commercially available digital full-color electrophotographic copying machine (PRETALE 550, manufactured by Ricoh Co., Ltd.), employing a transfer belt as the intermediate transfer member, and a 2,000 sheet full-color running test (copying test) was made in an environment of 23° C./60% RH. As a result, beautiful full-color images having a good color reproduction and free of color non-uniformity were obtained, and color differences were little seen in the images during the copying.

The running test was also made in an environment of 30° C./80% RH. Copies were taken on 500 sheets after the developing assemblies and supply toners were made adapted to the test environment for a week. Thereafter, the machine was left to stand for a week in this environment, and the test was again started to make a 500 sheet running test. As a result, beautiful full-color images were obtained. The fog was 1.6% or less as the worst value on the four colors superimposed. There was also no problem at the initial stage and the stage where the test was again started.

Example 21

Two component type developers produced using cyan toner 30, magenta toner 4, yellow toner 4 and black toner 4 were applied in a commercially available digital full-color electrophotographic copying machine (U-Bix 9028, manufactured by Konica Corporation), employing a multiple development one-time transfer system, and a 2,000 sheet full-color running test (copying test) was made in an environment of 23° C./60% RH. As a result, beautiful full-color images having a good color reproduction and free of color non-uniformity were obtained, and color differences were little seen in the images during the copying.

The running test was also made in an environment of 30° C./80% RH. Copies were taken on 500 sheets after the developing assemblies and supply toners were made adapted to the test environment for a week. Thereafter, the machine was left to stand for a week in this environment, and the test was again started to make a 500 sheet running test. As a result, beautiful full-color images were obtained. The fog was 1.8% or less as the worst value on the four colors superimposed. There was also no problem at the initial stage and the stage where the test was again started.

Example 22

Two component type developers produced using cyan toner 31, magenta toner 5, yellow toner 5 and black toner 5 were applied in a commercially available digital full-color electrophotographic copying machine (A-Color 635, manufactured by Fuji Xerox Corporation), and a 2,000 sheet full-color running test (copying test) was made in an environment of 23° C./60% RH. As a result, full-color images having a good color reproduction and free of color non-uniformity were obtained, and color differences were little seen in the images during the copying.

The running test was also made in an environment of 30° C./80% RH. Copies were taken on 500 sheets after the developing assemblies and supply toners were made adapted to the test environment for a week. Thereafter, the machine was left to stand for a week in this environment, and the test was again started to make a 500 sheet running test. As a result, beautiful full-color images were obtained. The fog was 1.2% or less as the worst value on the four colors superimposed. There was also no problem at the initial stage and the stage where the test was again started.

Example 23

Two component type developers produced using cyan toner 1, magenta toner 1 and yellow toner 1 and a one component type developer produced using black toner 6 were applied in a commercially available digital full-color electrophotographic copying machine (Color Laser Copyer 550, manufactured by Canon Inc.) as used in Example 1 , and a 2,000 sheet full-color running test (copying test) was made in an environment of 23° C./60% RH. In this instance, the doctor blade of the black developing assembly was modified as shown in FIG. 5 to change the system to a magnetic one component type development system so as to enable development and transfer from black images. As a result, beautiful and pictorial images having good color reproduction and gradation and free of color non-uniformity were obtained, and color differences were little seen in the images during the copying.

The running test was also made in an environment of 30° C./80% RH. Copies were taken on 500 sheets after the developers and supply toners were made adapted to the test environment for a week. Thereafter, the machine was left to stand for a week in this environment, and the test was again started to make a 500 sheet running test. As a result, beautiful full-color images were obtained. The fog was 1.3% or less as the worst value on the four colors superimposed. There was also no problem at the initial stage and the stage where the test was again started.

GROUP II

Organic-treated fine titanium oxide particles and organic-treated fine alumina particles used in the following Examples were selected from the organic-treated fine particles 1 to 27 used in GROUP I, and those shown in Tables 11 and 12 were used.

Toner particles (classified products) used in the following Examples were selected from the classified products 1 to 6 used in Examples of GROUP I, and the following classified products 1 and 4 to 6 were used.

Classified product 1
(cyan classified product 1, magenta classified product 1, yellow classified product 1, black classified product 1)
Classified product 4
(cyan classified product 4, magenta classified product 4, yellow classified product 4, black classified product 4)
Classified product 5
(cyan classified product 5, magenta classified product 5, yellow classified product 5, black classified product 5)
Classified product 6
(black classified product 6)

Toner Production Examples

Based on 100 parts by weight of each classified product and according to the combination as shown in Table 13, the organic-treated fine particles were externally added to obtain toners as shown therein.

Example 24

Using magenta toner A and the digital full-color electrophotographic copying machine (CLC 550, manufactured by Canon Inc.) as shown in FIG. 1 and whose developing assembly was modified to the one as shown in FIG. 8, a 3,000 sheet running test for 500 sheets a day was made at a developer carrying member peripheral speed of 103 mm/sec (peripheral speed ratio to the electrostatic latent image bearing member: 170%) in environments of 23° C./60% RH (hereinafter "N/N") and 30° C./80% RH (hereinafter "H/H"). Also, in the environment of H/H, the machine was left to stand for 10 days on the 7th day (a week) before the start and on the way of the test at the 2,000th sheet copying to examine any deterioration due to leaving.

The results are shown in Tables 14 and 15. No melt-adhesion of toner to the developer carrying member and developer layer thickness control blade was seen, and also no image deterioration such as spots around images due to toner scatter, fog, and density decrease was seen. Also, no image deterioration occurred after leaving.

The developer layer thickness control blade used here was a phosphor bronze base plate to which urethane rubber was bonded, whose side coming into touch with the developer carrying member had been coated with nylon.

Image density was measured on reflection density by means of a Macbeth densitometer Model RD918 (manufactured by Macbeth Co.), using an SPI filter. Measurement was made on images of 5 mm square to determine the image density.

Fog was measured by means of a reflection densitometer (Refelctometer Model TC-6DS, manufactured by Tokyo Denshoku Co., Ltd.). As a test method, toner images on the electrostatic latent image bearing member before transfer, formed when a solid white image is copied, are taken off with an adhesive tape made of polyester film (its density is denoted as Dd). This tape and a virgin tape (its density is denoted as Dt) are stuck to transfer paper, and a value of Dd−Dt is regarded as fog quantity. When this fog quantity is 5% or less, good images are obtained, and when it is 10% or less, there is no problem in practical use.

With regard to the spots around images;

A: Toner scatter not so occurred, and there was no problem in practical use.
B: Toner scatter much occurred to cause conspicuous in-machine contamination.
C: Toner scatter much occurred to cause serious in-machine contamination, resulting in a large toner consumption.

With regard to the toner melt-adhesion and sticking of toner to the developer carrying member and developer layer thickness control blade;

A: No melt-adhesion and sticking occurred, and no problem also on images.
B: Melt-adhesion and sticking occurred at some points, and lines appeared on the images.
C: Melt-adhesion and sticking seriously occurred to cause distorted images.

Examples 25 to 32

Using magenta toners D to K, images were formed and evaluated in the same manner as in Example 24 to obtain the results shown in Tables 14 and 15.

Comparative Example 11

Using magenta toner B, images were formed and evaluated in the same manner as in Example 24 to obtain the results shown in Tables 14 and 15. The developing performance was poor in the environment of H/H, and fog greatly occurred especially at the initial stage and after leaving. Melt-adhered matter was also seen on the developer layer thickness control blade.

Comparative Example 12

Using magenta toner C, images were formed and evaluated in the same manner as in Example 24 to obtain the results shown in Tables 14 and 15. The developing performance was poor in the environment of H/H, and fog greatly occurred especially at the initial stage and after leaving.

Comparative Example 13

Using magenta toner L, images were formed and evaluated in the same manner as in Example 24 to obtain the results shown in Tables 14 and 15. The developing performance was a little poor in the environment of H/H.

Comparative Example 14

Using magenta toner M, images were formed and evaluated in the same manner as in Example 24 to obtain the results shown in Tables 14 and 15. The developing performance was a little poor in the environment of H/H.

Comparative Example 15

Using magenta toner N, images were formed and evaluated in the same manner as in Example 24 to obtain the results shown in Tables 14 and 15. The developing performance was a little poor in the environment of H/H.

Comparative Example 16

Using magenta toner 0, images were formed and evaluated in the same manner as in Example 24 to obtain the results shown in Tables 14 and 15. The developing performance was a little poor in the environment of H/H.

Example 33

Images were formed and evaluated in the same manner as in Example 24 except that the running test was made on full-color images, using magenta toner A, cyan toner A, yellow toner A and black toner A.

As a result, in both the N/N and H/H, beautiful and pictorial images having good color reproduction and gradation and free of color non-uniformity were obtained, and color differences were little seen in the images during the copying. Neither toner scatter nor fog did not occur even after leaving in the environment of H/H.

Example 34

Images were formed and evaluated in the same manner as in Example 24 except that the running test was made on full-color images, using magenta toner P, cyan toner B, yellow toner B and black toner B.

As a result, in both the N/N and H/H, beautiful and pictorial images having good color reproduction and gradation and free of color non-uniformity were obtained, and color differences were little seen in the images during the copying. Neither toner scatter nor fog did not occur even after leaving in the environment of H/H.

Example 35

Images were formed and evaluated in the same manner as in Example 24 except that the running test was made on full-color images, using magenta toner Q, cyan toner C, yellow toner C and black toner C.

As a result, in both the N/N and H/H, beautiful and pictorial images having good color reproduction and gradation and free of color non-uniformity were obtained, and color differences were little seen in the images during the copying. Neither toner scatter nor fog did not occur even after leaving in the environment of H/H.

Examples 36 to 38

Using black toner D, images were formed and evaluated in the same manner as in Example 24 . Here, evaluation was made in an instance where the developing assembly was modified to the type as shown in FIG. 8 (Example 36), an instance where it was modified to the type as shown in FIG. 5 (Example 37), and an instance where it was modified to the type as shown in FIG. 7 (Example 38).

The results are shown in Tables 14 and 15.No melt-adhesion and sticking of toner to the developer carrying member, developer layer thickness control member and developer feeding member was seen, and also no image deterioration such as black spots around images due to toner scatter, fog, and image density decrease was seen. Also no image deterioration occurred after leaving.

GROUP III

Production Examples of Organic-treated Fine Titanium Oxide Particles or Organic-treated Fine Alumina Particles Particles to be treated and used in the following Examples are shown in Table 16.

The particles to be treated, A, C and D in Table 16 are the same particles as the particles A, C and D used in Examples of GROUP I.

The production process and formulation of the organic-treated fine particles used in the following Examples are shown in Table 17, and the physical properties thereof in Tables 18 and 19. The amount of the treating agent and the diluent in the treatment is given as part(s) by weight (pbw) based on 100 parts by weight of the particles to be treated.

The organic-treated fine particles 1 to 3 and 21 to 26 in Table 17 are the same as those used in Examples of GROUP I.

Toner particles (classified products) used in the following Examples were selected from the classified products 1 to 6 used in Examples of GROUP I, and the following classified products 1 and 3 to 6 were used.

Classified product 1
(cyan classified product 1, magenta classified product 1, yellow classified product 1, black classified product 1)
Classified product 3
(cyan classified product 3, magenta classified product 3, yellow classified product 3, black classified product 3)
Classified product 4
(cyan classified product 4, magenta classified product 4, yellow classified product 4, black classified product 4)
Classified product 5
(cyan classified product 5, magenta classified product 5, yellow classified product 5)
Classified product 6
(black classified product 6)

Toner Production Examples

Based on 100 parts by weight of each classified product and according to the formulation as shown in Table 20, the organic-treated fine particles were well agitated using a Henschel mixer, to obtain toners as shown in the table.

Example 39

Cyan toner 51, magenta toner 51, yellow toner 51 and black toner 51 (a group of toners 51) were each blended with a Cu—Zn—Fe ferrite carrier coated with 0.35% by weight of a styrene-methyl methacrylate copolymer (weight ratio: 65:35), so as to be in a toner concentration of 5% by weight to obtain two component type developers.

The two component type developers produced using the group of toners 51 were applied in a commercially available digital full-color electrophotographic copying machine (Color Laser Copyer 550, manufactured by Canon Inc.; mounted with a nylon-coated urethane rubber blade cleaner and an organic photosensitive member having a surface protective layer formed of polycarbonate resin with 8% by weight of Teflon resin particles dispersed therein), and a 10,000 sheet full-color running test was made in an environment of 23° C./60% RH. Here, the primary charging was carried out using a charging roller as a contact charging member, basically comprised of a mandrel at the center and provided on its periphery a conductive elastic layer formed of epichlorohydrin rubber containing carbon black. The charging roller is brought into pressure contact with the photosensitive drum surface under a pressure of 4 kg as a linear pressure, and is followingly rotated with the rotation of the photosensitive drum. As a cleaning member, a felt pad is also brought into touch with the charging roller.

Test results were evaluated on image density, fog on images, faulty images caused by the photosensitive member, faulty images caused by the charging member, and faulty cleaning.

Results of the evaluation are shown in Table 21.

The image density was measured on reflection density by means of a Macbeth densitometer Model RD918 (manufactured by Macbeth Co.), using an SPI filter. Measurement was made on circular images of 5 mm diameter to determine the image density.

The fog on images was measured by means of a reflection densitometer (Refelctometer Model TC-6DS, manufactured by Tokyo Denshoku Co., Ltd.). The worst value of white background reflection density after image formation was denoted by Ds, and an average reflection density of a transfer medium before image formation was denoted by Dr, where a value of Ds−Dr was regarded as fog quantity to make evaluation on fog. When this value is 1.5% or less, the fog is on a very good level; when it is 2.0% or less, images are substantially free of fog and are good images; and when it is 2.5% or less, there is no problem in practical use.

In making evaluation on the faulty images caused by the photosensitive member, the charging roller was changed for new one.

A: No faulty images at all.
B: Patterns in spots or streaks slightly occur.
C: Patterns in spots or streaks and density non-uniformity occur, but no problem in practical use.
D: Melt adhesion and filming occur, and images other than latent images much appear on copied images.

In making evaluation on the faulty images caused by the charging member, the photosensitive member was changed for new one.

A: No faulty images are seen at all.
B: Patterns in spots or streaks slightly occur.
C: Patterns in spots or streaks and density non-uniformity occur, but no problem in practical use.
D: The charging member is so greatly affected by contamination that density non-uniformity and charging non-uniformity occur and copied images are distorted.

With regard to the faulty cleaning, faulty cleaning is judged to have occurred when longitudinal lines of the toner having remained unremoved appear on the copied images.

Examples 40 to 43

Two component type developers were prepared using groups of toners 55 to 58, respectively, in place of the group of toners 51 used in Example 39, and images were formed and evaluated in the same manner as in Example 39 to obtain the results also shown in Table 21.

Comparative Example 17

Two component type developers were prepared using a group of toners 52 in place of the group of toners 51 used in Example 39, and images were formed and evaluated in the same manner as in Example 39 to obtain the results also shown in Table 21. Scratches and toner melt-adhesion occurred on the photosensitive member, and their marks appeared on copied images.

Comparative Example 18

Two component type developers were prepared using a group of toners 53 in place of the group of toners 51 used in Example 39, and images were formed and evaluated in the same manner as in Example 39 to obtain the results also shown in Table 21. Filming occurred on the photosensitive member, patterns in spots due to contamination of the charging roller also occurred, and their marks appeared on copied images.

Comparative Example 19

Two component type developers were prepared using a group of toners 54 in place of the group of toners 51 used in Example 39, and images were formed and evaluated in the same manner as in Example 39 to obtain the results also shown in Table 21. Toner melt-adhesion occurred on the photosensitive member, and its marks appeared on copied images.

Comparative Example 20

Two component type developers were prepared using a group of toners 59 in place of the group of toners 51 used in Example 39, and images were formed and evaluated in the same manner as in Example 39 to obtain the results also shown in Table 21. Patterns in lines due to contamination of the charging roller also occurred, and their marks appeared on copied images.

Comparative Example 21

Two component type developers were prepared using a group of toners 60 in place of the group of toners 51 used in Example 39, and images were formed and evaluated in the same manner as in Example 39 to obtain the results also shown in Table 21. Filming occurred on the photosensitive member, and its marks appeared on copied images.

Comparative Example 22

Two component type developers were prepared using a group of toners 61 in place of the group of toners 51 used in Example 39, and images were formed and evaluated in the same manner as in Example 39 to obtain the results also shown in Table 21. Patterns in spots due to contamination of the charging roller also occurred, and their marks appeared on copied images.

Comparative Example 23

Two component type developers were prepared using a group of toners 62 in place of the group of toners 51 used in Example 39, and images were formed and evaluated in the same manner as in Example 39 to obtain the results also shown in Table 21. Image density non-uniformity due to charging non-uniformity occurred.

Comparative Example 24

Two component type developers were prepared using a group of toners 63 in place of the group of toners 51 used in Example 39, and images were formed and evaluated in the same manner as in Example 39 to obtain the results also shown in Table 21. Filming occurred on the photosensitive member, and its marks appeared on copied images.

Example 44

Cyan toner 64, magenta toner 64, yellow toner 64 and black toner 64 were each blended with a Cu—Zn—Fe ferrite carrier coated with 0.45% by weight of silicone resin, so as to be in a toner concentration of 5% by weight to obtain two component type developers.

Using the above two component type developers in place of the two component type developers used in Example 39, images were formed and evaluated in the same manner as in Example 39.

The results of evaluation are shown in Table 21.

Example 45

Cyan toner 65, magenta toner 65, yellow toner 65 and black toner 65 were each blended with a Cu—Zn—Fe ferrite carrier coated with 0.35% by weight of a styrene-butyl methacrylate copolymer (weight ratio: 80:20) and 0.15% by weight of silicone resin, so as to be in a toner concentration of 7% by weight to obtain two component type developers.

Using the above two component type developers in place of the two component type developers used in Example 39, images were formed and evaluated in the same manner as in Example 39.

The results of evaluation are shown in Table 21.

Example 46

Cyan toner 66, magenta toner 66 and yellow toner 66 were each blended with a Cu—Zn—Fe ferrite carrier coated with 0.35% by weight of a styrene-methyl methacrylate copolymer (weight ratio: 15:85) and 0.15% by weight of fluorine resin, so as to be in a toner concentration of 7% by weight to obtain two component type developers.

Black toner 66 was used as it was, without use of the carrier, as a one component type developer.

Using the above two component type three color developers and the one component type black developer in place of the two component type developers used in Example 39, and also using a modified machine in which the doctor blade of the black developing assembly was modified as shown in FIG. 5 to change the system to a magnetic one component type development system so as to enable development and transfer from black images, the running test was carried out in the same manner as in Example 39.

The results of evaluation are shown in Table 21.

Example 47

The two component type developers produced using a group of toners 61 were applied in the digital full-color electrophotographic copying machine used in Example 39, and a 10,000 sheet full-color running test was made in an environment of 23° C./60% RH.

Here, the primary charging was carried out using a charging blade as a contact charging member, the blade being basically comprised of a conductive elastic layer formed of epichlorohydrin rubber containing carbon black. The charging blade is brought into pressure contact with the photosensitive drum surface under a pressure of 2 kg/m as a linear pressure. Results obtained are shown in Table 21.

Examples 48 to 51

Unfixed images obtained in Examples 39 and 44 to 46, formed using the groups of toners 61, 64 to 66, respectively, the following fixing test was made. Results obtained are shown in Table 22.

A test for fixing the unfixed images was carried out using the external fixing device as shown in FIG. 11, comprising the pressure roller 135 that stands opposite to the heater element 131 in pressure contact and brings the transfer medium 136 into close contact with the heater element 131 through the film 132 interposed between them. Used as a material of the fixing film 132 was an endless film comprising a polyimide film coated in a thickness of 10 $\mu$m, with a release layer made of fluorine resin to which a conductive material were added. Silicone rubber was used as the pressure roller 135, and the fixing was tested with a nip of 4.0 mm, under a total pressure of 10 kg between the heater element 131 and the pressure roller 135, and at a process speed of 100 mm/sec. The film was driven in the direction of an arrow by the action of the drive of, and tension between, the drive roller 133 and the follower roller 134.

To the heater element 11, a low heat capacitance linear member, energy was pulsewise applied and temperature was controlled at 190° C.

A4-size paper was lengthwise inserted to the fixing device, and in that way the fixing performance was evaluated by fixing line toner images (20 line images of 200 $\mu$m wide, drawn at intervals of 1 cm) formed in parallel in the longitudinal direction of the fixing member.

Fixing toner scatter was judged in the following way. A: Toner scatter little occurs; B: Toner scatter slightly occurs; C: Toner scatter more or less occurs, but no problem in practical use; and D: Toner scatter greatly occur and conspicuous.

Comparative Examples 25 to 31

Unfixed images formed using the groups of toners 52 to 54 and 59 to 63 in Comparative Examples 17 to 24, respectively, the same fixing test as in Example 48 was made. Results obtained are shown in Table 22. Toner scatter greatly occurred.

GROUP IV

Organic-treated Fine Titanium Oxide Particles or Organic-treated Fine Alumina Particles, Production Examples 31 to 48

Particles to be treated and used in the following Examples are shown in Table 23.

The particles to be treated, A to D in Table 23 are the same particles as the particles A to D used in Examples of GROUP I.

The organic treatment was carried out by any of the following methods.

Organic Solvent Method 3 (Solvent Method 3)

In a container, 1 kg of toluene and 200 g of particles to be treated were put, and agitated by means of a mixer to form a slurry. To the slurry, a treating agent or agents was/were added in a prescribed amount, followed by thorough agitation by means of a mixer. The resulting slurry was processed for 30 minutes in a sand mill using zirconia balls as media.

The slurry was then taken out of the sand mill, and the toluene was removed under reduced pressure at 60° C., followed by drying at 180° C. for 2 hours while agitating in a stainless steel container. The powder thus obtained was disintegrated using a hammer mill to obtain organic-treated fine particles.

Gaseous Phase Method 4

In a closed high-speed agitation mixer, 20 g of particles to be treated were put, and its inside was replaced by nitrogen. While gently agitating, a treating agent or agents optionally diluted with a suitable quantity of n-hexane was/were sprayed thereon. Then, 180 g of particles to be treated were further added and at the same time the remaining treating agent was sprayed thereon in a prescribed amount. After the addition was completed, the mixture was agitated for 10 minutes, followed by heating with high-speed agitation, and temperature was raised to 180° C. to continue agitation for 1 hour. While agitating, the temperature was restored to room temperature, and the resulting powder was taken out of the mixer, followed by disintegration using a hammer mill to obtain organic-treated fine particles.

Gaseous Phase Method 5

In an evaporator, a volatile titanium compound (e.g., titanium tetraisopropoxide) was vaporized at 200° C. in an atmosphere of nitrogen. In an evaporator, water was vaporized in an atmosphere of nitrogen, and then introduced into a heating container heated to 500° C. The vaporized titanium compound and the heated water vapor were introduced into a reaction vessel heated to 200° C. to carry out hydrolysis to obtain titanium oxide particles. Here, a prescribed amount of a treating agent or agents was/were vaporized in an atmosphere of nitrogen in an evaporator heated to 100° to 200° C. or atomized at 100° to 200° C. in an atmosphere of nitrogen, and then introduced into the reaction vessel. It was introduced into the reaction vessel in the manner that the titanium compound was mixed with the treating agent after the titanium oxide was formed. The above was operated in a stream of nitrogen, and the resulting organic-treated fine titania particles were collected through a filter.

Aqueous Solvent Method 2 (Aqueous Method 2)

In an attritor, 200 g (as solid matter) of particles to be treated were added to an aqueous solvent prepared by adding 1% by weight of a nonionic surface active agent in water. Here, when the particles to be treated were added, a wet cake or water-containing paste of the particles was used and the amount of water and the amount of surface active agent were so adjusted that the particles to be treated were in a concentration of 5 parts by weight based on 100 parts by weight of the aqueous solvent. After high-speed agitation for 10 minutes, a treating agent was dropwise added in a prescribed amount to carry out agitation for 30 minutes. The solid matter was filtered, and then dried at 180° C. for 5 hours using a dryer, followed by disintegration using a hammer mill to obtain organic-treated fine particles.

Figure 16:
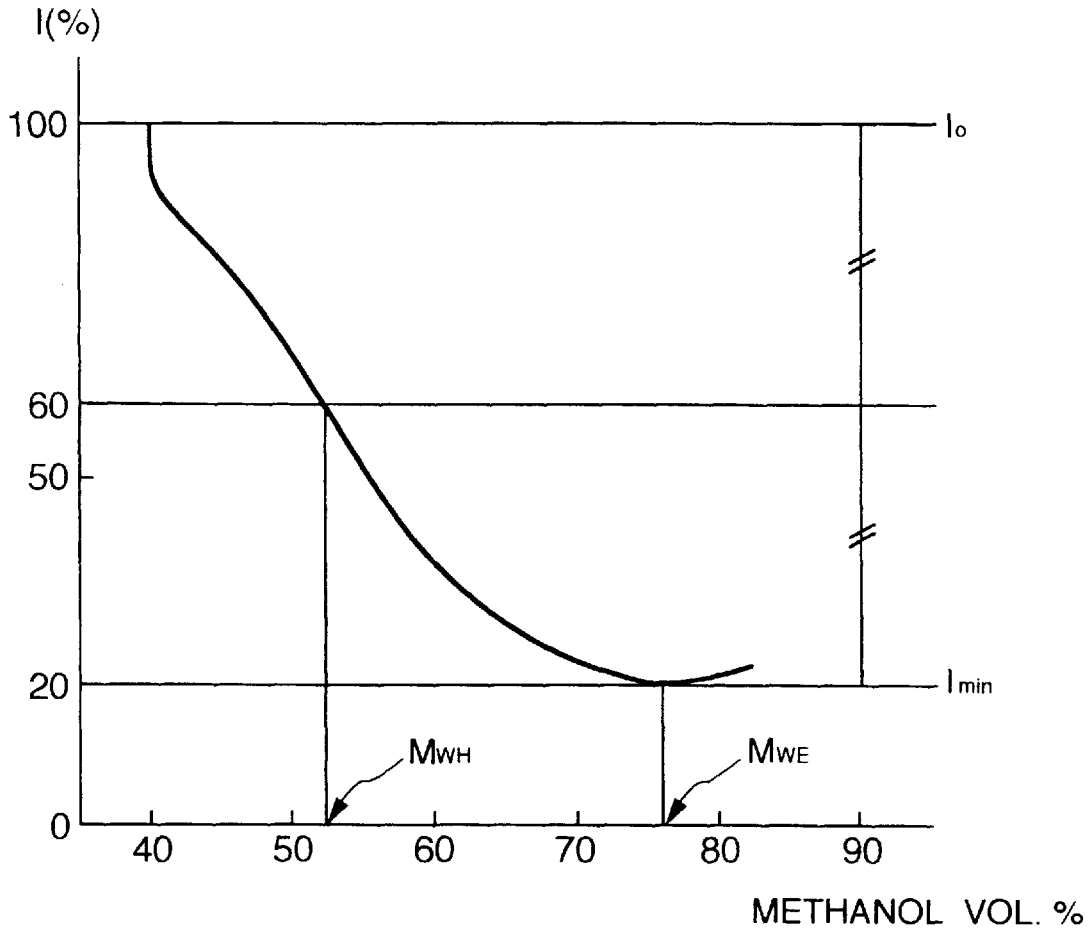
FIG. 16 shows a methanol titration curve from the analysis of which the methanol wettability half value of organic-treated fine particles 33 is determined.
Figure 17:
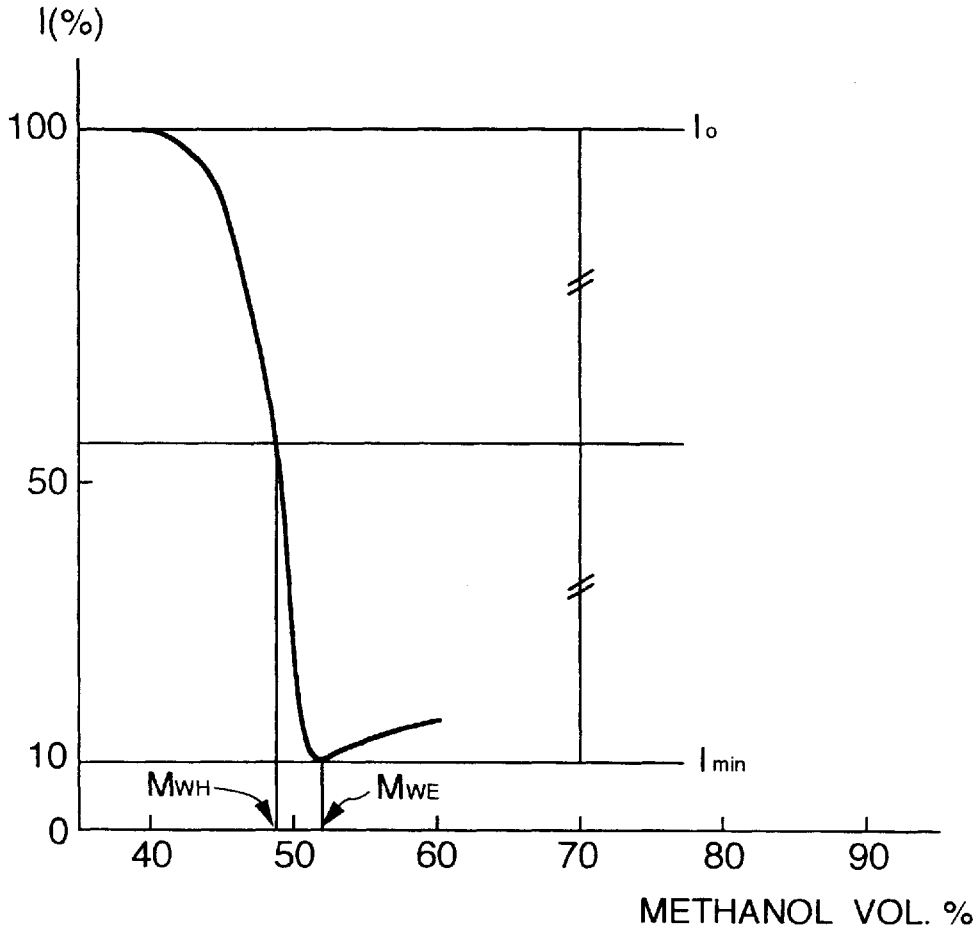
FIG. 17 shows a methanol titration curve from the analysis of which the methanol wettability half value of organic-treated fine particles 34 is determined.

The production process and formulation of the organic-treated fine particles used in the following Examples are shown in Table 24, and the physical properties thereof in Tables 25 and 26. The titration curves of the organic-treated fine particles 31, 33 and 34 are shown in FIGS. 15, 16 and 17, respectively. The amount of the treating agent and the diluent in the treatment is given as part(s) by weight (pbw) based on 100 parts by weight of the particles to be treated.

Production Examples of Binder Resins:

| Polyester resin 6 | |
|---|---|
| Terephthalic acid | 6.0 mol |
| n-Dodecenylsuccinic acid anhydride | 3.0 mol |
| Bisphenol-A propylene oxide 2.2 mol addition product | 10.0 mol |
| Trimellitic acid anhydride | 0.7 mol |
| Dibutyltin oxide | 0.1 g |

The above compounds were put into a reaction vessel, and a thermometer, a stirring rod, a capacitor and a nitrogen feed pipe were fitted thereto. After its inside was replaced by nitrogen, temperature was gradually raised with stirring, to carry out reaction at 180° C. for 5 hours. Subsequently the temperature was raised to 200° C., pressure was reduced (15 hPa), and the reaction was carried out for 4 hours to effect dehydration condensation, where the reaction was completed to obtain polyester resin 6.

This polyester resin 6 had a peak molecular weight of 10,700 and a glass transition point of 63° C.

| Polyester resin 7 | |
|---|---|
| Fumaric acid | 9.5 mol |
| Bisphenol-A propylene oxide 2.2 mol addition product | 10.0 mol |
| Dibutyltin oxide | 0.5 g |

The above compounds were put into a reaction vessel, and a thermometer, a stirring rod, a capacitor and a nitrogen feed pipe were fitted thereto. After its inside was replaced by nitrogen, temperature was gradually raised with stirring, to carry out reaction at 220° C. for 6 hours. Subsequently, pressure was reduced (15 hpa), and the reaction was carried out for 2 hours to effect dehydration condensation, where the reaction was completed to obtain polyester resin 7.

This polyester resin 7 had a peak molecular weight of 9,800 and a glass transition point of 58° C.

| Polyester resin 8 | |
|---|---|
| Terephthalic acid | 9.5 mol |
| Bisphenol-A ethylene oxide 2.2 mol addition product | 5.0 mol |
| Dicyclohexane dimethanol | 5.0 mol |
| Dibutyltin oxide | 1.0 g |

The above compounds were put into a reaction vessel, and a thermometer, a stirring rod, a capacitor and a nitrogen feed pipe were fitted thereto. After its inside was replaced by nitrogen, temperature was gradually raised with stirring, to carry out reaction at 240° C. for 6 hours. Subsequently, pressure was reduced (15 hPa), and the reaction was carried out for 2 hours to effect dehydration condensation, where the reaction was completed to obtain polyester resin 8.

This polyester resin 8 had a peak molecular weight of 9,100 and a glass transition point of 62° C.

| Epoxy Resin | |
|---|---|
| Bisphenol-A type liquid epoxy resin (a condensate of bisphenol-A with epichlorohydrin; epoxy equivalent weight: 188; viscosity: 13,000 mpa · s/25° C.) | 2,000 g |
| Bisphenol-A | 937 g |
| p-Cumylphenol | 559 g |
| Xylene | 400 g |

The above compounds were put into a reaction vessel, and a thermometer, a stirring rod, a capacitor and a nitrogen feed pipe were fitted thereto. After its inside was replaced by nitrogen, temperature was gradually raised up to 70° C. with stirring, where an aqueous 5N solution of 0.64 g of lithium chloride was added. The temperature was raised to 170° C. to evaporate the water and xylene while reducing the pressure, and the reduced pressure was cancelled to carry out the reaction for 6 hours. At this stage, 184 g of ϵ-caprolactone was added and the reaction was carried out for 6 hours to obtain a modified epoxy polyol resin (epoxy resin 9).

This epoxy resin 9 had a peak molecular weight of 7,600 and a glass transition point of 60° C.

| Styrene Resin 10 | |
|---|---|
| Styrene | 1,600 g |
| Butyl acrylate | 400 g |
| 2,2-Bis(4,4-di-t-butylperoxycyclohexyl)propane | 4 g |

From the above compounds, polymer C was obtained by suspension polymerization.

| | |
|---|---|
| Styrene | 2,550 g |
| Butyl acrylate | 450 g |
| Di-t-butyl peroxide | 60 g |

From the above compounds, polymer D was obtained by solution polymerization using xylene as a solvent, and the polymer C and polymer D were solution-mixed so as to be in a weight ratio of 25:75 to obtain styrene resin 10.

This styrene resin 10 had peak molecular weights of 9,400 and 720.000, and a glass transition point of 60° C.

Production Examples of Classified Products 7–12:

| Classified Product 7 | (by weight) |
|---|---|
| Polyester resin 6 | 100 parts |
| Copper phthalocyanine phthalimide derivative pigment | 5 parts |
| Di-t-butylsalicylic acid chromium complex | 4 parts |

The above materials were premixed using a Henschel mixer, and thereafter melt-kneaded using a twin-screw extruder set to 130° C. The kneaded product was cooled, and then finely pulverized by means of a fine grinding mill making use of a jet stream, followed by classification using an air classifier to obtain a cyan classified product (cyan toner particles) 7 with a weight average particle diameter of 8 μm.

A magenta classified product (magenta toner particles) 7, a yellow classified product (yellow toner particles) 7 and a black classified product (black toner particles) 7 were obtained in the same manner as the above except that the pigment used for the cyan classified product 7 was replaced with 5 parts by weight of C.I. Pigment Red 122, 3.5 parts by weight of C.I. Pigment Yellow 17 and 5 parts by weight of carbon black, respectively.

| Classified Product 8 | (by weight) |
|---|---|
| Polyester resin 7 | 100 parts |
| Copper phthalocyanine phthalimide derivative pigment | 5 parts |
| Di-t-butylsalicylic acid chromium complex | 4 parts |

The above materials were premixed using a Henschel mixer, and thereafter melt-kneaded using a twin-screw extruder set to 130° C. The kneaded product was cooled, and then finely pulverized by means of a fine grinding mill making use of a jet stream, followed by classification using an air classifier to obtain a cyan classified product (cyan toner particles) 8 with a weight average particle diameter of 8 μm.

A magenta classified product (magenta toner particles) 8, a yellow classified product (yellow toner particles) 8 and a black classified product (black toner particles) 8 were obtained in the same manner as the above except that the pigment used for the cyan classified product 8 was replaced with 5 parts by weight of C.I. Pigment Red 122, 3.5 parts by weight of C.I. Pigment Yellow 17 and 5 parts by weight of carbon black, respectively.

| Classified Product 9 | (by weight) |
|---|---|
| Polyester resin 8 | 100 parts |
| Copper phthalocyanine phthalimide derivative pigment | 5 parts |
| Di-t-butylsalicylic acid chromium complex | 4 parts |

The above materials were premixed using a Henschel mixer, and thereafter melt-kneaded using a twin-screw extruder set to 130° C. The kneaded product was cooled, and then finely pulverized by means of a fine grinding mill making use of a jet stream, followed by classification using an air classifier to obtain a cyan classified product (cyan toner particles) 9 with a weight average particle diameter of 8 μm.

A magenta classified product (magenta toner particles) 9, a yellow classified product (yellow toner particles) 9 and a black classified product (black toner particles) 9 were obtained in the same manner as the above except that the pigment used for the cyan classified product 9 was replaced with 5 parts by weight of C.I. Pigment Red 122, 3.5 parts by weight of C.I. Pigment Yellow 17 and 5 parts by weight of carbon black, respectively.

| Classified Product 10 | (by weight) |
|---|---|
| Epoxy resin 9 | 100 parts |
| Copper phthalocyanine phthalimide derivative pigment | 5 parts |
| Di-t-butylsalicylic acid chromium complex | 4 parts |

The above materials were premixed using a Henschel mixer, and thereafter melt-kneaded using a twin-screw extruder set to 130° C. The kneaded product was cooled, and then finely pulverized by means of a fine grinding mill making use of a jet stream, followed by classification using an air classifier to obtain a cyan classified product (cyan toner particles) 10 with a weight average particle diameter of 8 μm.

A magenta classified product (magenta toner particles) 10, a yellow classified product (yellow toner particles) 10 and a black classified product (black toner particles) 10 were obtained in the same manner as the above except that the pigment used for the cyan classified product 10 was replaced with 5 parts by weight of C.I. Pigment Red 122, 3.5 parts by weight of C.I. Pigment Yellow 17 and 5 parts by weight of carbon black, respectively.

| Classified Product 11 | (by weight) |
|---|---|
| Styrene resin 10 | 100 parts |
| Copper phthalocyanine phthalimide derivative pigment | 5 parts |
| Quaternary ammonium salt | 1 part |
| Low-molecular weight ethylene-propylene copolymer | 3 parts |

The above materials were premixed using a Henschel mixer, and thereafter melt-kneaded using a twin-screw extruder set to 130° C. The kneaded product was cooled, and then finely pulverized by means of a fine grinding mill making use of a jet stream, followed by classification using an air classifier to obtain a cyan classified product (cyan toner particles) 11 with a weight average particle diameter of 8 μm.

A magenta classified product (magenta toner particles) 11, a yellow classified product (yellow toner particles) 11 and a black classified product (black toner particles) 11 were obtained in the same manner as the above except that the pigment used for the cyan classified product 11 was replaced with 5 parts by weight of C.I. Pigment Red 122, 3.5 parts by weight of C.I. Pigment Yellow 17 and 5 parts by weight of carbon black, respectively.

| Classified Product 12 | (by weight) |
|---|---|
| Styrene resin 10 | 100 parts |
| Magnetite (magnetic iron oxide) | 80 parts |
| Triphenylmethane compound | 2 parts |
| Low-molecular weight ethylene-propylene copolymer | 3 parts |

The above materials were premixed using a Henschel mixer, and thereafter melt-kneaded using a twin-screw extruder set to 130° C. The kneaded product was cooled, and then finely pulverized by means of a fine grinding mill making use of a jet stream, followed by classification using an air classifier to obtain a black classified product (black toner particles) 12 with a weight average particle diameter of 8 μm.

Toner and Developer Production Examples

Based on 100 parts by weight of each classified product and according to the formulation as shown in Table 27, the fine titanium oxide particles or fine alumina particles of the present invention were externally added and mixed, which were well agitated using a Henschel mixer, to obtain toners as shown in the table.

When the toners are used as one component type developers, they were used as they were. When used as two component type developers, the developers were prepared in the following way.

Cyan toner 89, magenta toner 72, yellow toner 72 and black toner 72 were each blended with a Cu—Zn—Fe ferrite carrier coated with 0.45% by weight of silicone resin, so as to be in a toner concentration of 5% by weight to obtain two component type developers.

Cyan toner 89, magenta toner 73, yellow toner 73 and black toner 73 were each blended with a Cu—Zn—Fe ferrite carrier coated with 0.35% by weight of a styrene-butyl methacrylate copolymer (weight ratio: 80:20) and 0.15% by weight of silicone resin, so as to be in a toner concentration of 7% by weight to obtain two component type developers.

Cyan toner 90, magenta toner 74, yellow toner 74 and black toner 74 were each blended with a Cu—Zn—Fe ferrite carrier coated with 2.5% by weight of a styrene-methyl methacrylate copolymer (weight ratio: 65:35), so as to be in a toner concentration of 7% by weight to obtain two component type developers.

Cyan toner 88, magenta toner 76 and yellow toner 76 were each blended with a Cu—Zn—Fe ferrite carrier coated with 0.35% by weight of a styrene-methyl methacrylate copolymer (weight ratio: 15:85) and 0.15% by weight of fluorine resin, so as to be in a toner concentration of 7% by weight to obtain two component type developers.

Black toner 76 was used as it was, without use of a carrier, as a one component type developer.

Example 52

Cyan toner 71 was applied in a commercially available digital full-color electrophotographic copying machine (Color Laser Copyer 550, manufactured by Canon Inc.) having the construction as shown in FIG. 1, and a 5,000 sheet running test was made in an environment of 15° C./10% RH. In this instance, the developing assembly was modified so as to enable one-component development. Stated specifically, the doctor blade was changed for an elastic blade comprising a 150 $\mu$m thick elastic plate made of phosphor bronze, to which 1 mm thick urethane rubber was stuck and a 20 $\mu$m thick nylon resin layer was provided on its surface, and so set as to come in touch with the developing sleeve under a linear pressure of 4 kg/m. A urethane foam rubber roller was used as the feed roller. The magnet was removed from the inside of the developing sleeve, and the sleeve was changed for a sleeve having a surface blasted with #600 glass beads.

The fog, image density, blank areas caused by poor transfer at line portions and gradation examined at the initial stage and on the 5,000th sheet, and the transfer efficiency and transfer latitude examined on the 1,000th sheet are shown in Table 28.

The running test was also made in an environment of 30° C./80% RH. The test was started after the developing assembly and the supply toner were made adapted to the test environment for a week, and images were printed on 5,000 sheets. The fog, image density, blank areas caused by poor transfer at line portions and gradation examined at the initial stage and on the 5,000th sheet are shown in Table 29.

As shown in Tables 28 and 29, using the cyan toner 71 of the present invention, sharp cyan images having a high image density, free of fog, free of blank areas at line portions and having a good gradation were obtained in both the environment of low temperature and low humidity and the environment of high temperature and high humidity. The toner also showed a good transfer efficiency and a broad transfer latitude.

The image density, fog on images, transfer efficiency, transfer latitude, blank areas caused by poor transfer, and gradation were evaluated by the methods as used in Examples of GROUP I.

Examples 53 to 62

Using cyan toners 72, 75, 76, 78 to 81 and 83 to 85 images were formed and evaluated in the same manner as in Example 52 to obtain the results also shown in Tables 28 and 29.

Examples 63 and 64

Using cyan toners 86 and 87, images were formed and evaluated in the same manner as in Example 52 to obtain the results also shown in Tables 28 and 29. Here, the photosensitive drum was changed for a positively charging $\alpha$-Si photosensitive drum, the elastic blade was changed for a blade comprising a stainless steel elastic blade and silicone rubber stuck thereto, and the power sources of primary charging, developing bias, transfer charging and separation charging were modified so as to enable image formation using positively chargeable toners.

Comparative Example 33

Using cyan toner 73, images were formed and evaluated in the same manner as in Example 52 to obtain the results shown in Tables 28 and 29. There were no problems on the blank areas at character portions and the transfer latitude. However, fog was seen in the environments of low humidity and high humidity, and greatly occurred especially at the initial stage in the environment of high humidity.

Comparative Example 34

Using cyan toner 74, images were formed and evaluated in the same manner as in Example 52 to obtain the results shown in Tables 28 and 29. There was no problem on the developing performance in the environment of low humidity, but blank areas at character portions were seen and the transfer latitude was narrow. The developing performance was poor in the environment of high humidity, and fog greatly occurred especially at the initial stage.

Comparative Example 35

Using cyan toner 77, images were formed and evaluated in the same manner as in Example 52 to obtain the results shown in Tables 28 and 29. Blank areas at character portions were seen and the transfer latitude was narrow. The developing performance was poor in the environment of high humidity, and fog greatly occurred at the initial stage.

Comparative Example 36

Using cyan toner 82, images were formed and evaluated in the same manner as in Example 52 to obtain the results shown in Tables 28 and 29. Blank areas at character portions were seen and the transfer latitude was narrow. The developing performance was poor in the environment of high humidity, and fog greatly occurred at the initial stage.

Example 65

Cyan toner 71, magenta toner 71, yellow toner 71 and black toner 71 were applied in the modified machine of a digital full-color electrophotographic copying machine (Color Laser Copyer 550, manufactured by Canon Inc.) as used in Example 24, and a 2,000 sheet full-color running test (copying test) was made in an environment of 15° C./10% RH. As a result, beautiful and pictorial images having good color reproduction and gradation and free of color non-uniformity were obtained, and color differences were little seen in the images during the copying. The fog was 1.4% or less as the worst value on the four colors superimposed, and there was always no problem during the running.

The running test was also made in an environment of 30° C./80% RH. Copies were taken on 2,000 sheets after the developing assemblies and supply toners were made adapted to the test environment for a week. As a result, beautiful full-color images were obtained. The fog was 1.6% or less as the worst value on the four colors superimposed, and there was also no problem at the initial stage.

Example 66

Two component type developers produced using cyan toner 88, magenta toner 72, yellow toner 72 and black toner 72 were applied in a digital full-color electrophotographic copying machine (Color Laser Copyer 550, manufactured by Canon Inc.), and a 2,000 sheet full-color running test (copying test) was made in an environment of 15° C./10% RH. As a result, beautiful and pictorial images having good color reproduction and gradation and free of color non-uniformity were obtained, and color differences were little seen in the images during the copying. The fog was 1.5% or less as the worst value on the four colors superimposed, and there was always no problem during the running.

The running test was also made in an environment of 30° C./80% RH. Copies were taken on 2,000 sheets after the developing assemblies and supply toners were made adapted to the test environment for a week. As a result, beautiful full-color images were obtained. The fog was 1.7% or less as the worst value on the four colors superimposed, and there was also no problem at the initial stage.

Example 67

Two component type developers produced using cyan toner 89, magenta toner 73, yellow toner 73 and black toner 73 were applied in a commercially available digital full-color electrophotographic copying machine (PRETALE 550, manufactured by Ricoh Co., Ltd.), employing a transfer belt as the intermediate transfer member, and a 2,000 sheet full-color running test (copying test) was made in an environment of 15° C./10% RH. As a result, beautiful images having good color reproduction and free of color non-uniformity were obtained, and color differences were little seen in the images during the copying. The fog was 1.4% or less as the worst value on the four colors superimposed, and there was no problem.

The running test was also made in an environment of 30° C./80% RH. Copies were taken on 2,000 sheets after the developing assemblies and supply toners were made adapted to the test environment for a week. As a result, beautiful full-color images were obtained. The fog was 1.8% or less as the worst value on the four colors superimposed, and there was also no problem at the initial stage.

Example 68

Two component type developers produced using cyan toner 90, magenta toner 74, yellow toner 74 and black toner 74 were applied in a commercially available digital full-color electrophotographic copying machine (U-Bix 9028, manufactured by Konica Corporation), employing a multiple development one-time transfer system, and a 2,000 sheet full-color running test (copying test) was made in an environment of 15° C./10% RH. As a result, beautiful full-color images having a good color reproduction and free of color non-uniformity were obtained, and color differences were little seen in the images during the copying. The fog was 0.9% or less as the worst value on the four colors superimposed, and there was no problem.

The running test was also made in an environment of 30° C./80% RH. Copies were taken on 2000 sheets after the developing assemblies and supply toners were made adapted to the test environment for a week. As a result, beautiful full-color images were obtained. The fog was 1.2% or less as the worst value on the four colors superimposed, and there was also no problem at the initial stage.

Example 69

Cyan toner 86, magenta toner 75, yellow toner 75 and black toner 75 were applied in the digital full-color electrophotographic copying machine as used in Example 63, and a 2000 sheet full-color running test (copying test) was made in an environment of 15° C./10% RH. As a result, beautiful images having good gradation and free of color non-uniformity were obtained, and color differences were little seen in the images during the copying. The fog was 1.4% or less as the worst value on the four colors superimposed, and there was no problem.

The running test was also made in an environment of 30° C./80% RH. Copies were taken on 2000 sheets after the developing assemblies and supply toners were made adapted to the test environment for a week. As a result, beautiful full-color images were obtained. The fog was 1.9% or less as the worst value on the four colors superimposed, and there was also no problem at the initial stage.

Example 70

Two component type developers produced using cyan toner 87, magenta toner 76 and yellow toner 76 and as a one component type developer, black toner 76 were applied in the digital full-color electrophotographic copying machine as used in Example 63, and a 2000 sheet full-color running test (copying test) was made in an environment of 15° C./10% RH. In this instance, the doctor blade of the black developing assembly was modified (to a magnetic cut type) so as to enable development and transfer from black images, and the two-component developing assemblies as used in Example 66 were used for the two component type developers produced using the cyan, magenta and yellow toners. As a result, beautiful and pictorial images having good color reproduction and gradation and free of color non-uniformity were obtained, and color differences were little seen in the images during the copying. The fog was 1.2% or less as the worst value on the four colors superimposed, and there was no problem.

The running test was also made in an environment of 30° C./80% RH. Copies were taken on 2000 sheets after the developing assemblies and supply toners were made adapted to the test environment for a week. As a result, beautiful full-color images were obtained. The fog was 1.6% or less as the worst value on the four colors superimposed, and there was also no problem at the initial stage.

GROUP V

Production Examples of Organic-treated Fine Titanium Oxide Particles or Organic-treated Fine Alumina Particles and Inorganic Fine Powder B Particles to be treated and used in the following Examples are shown in Table 30.

Figure 19:
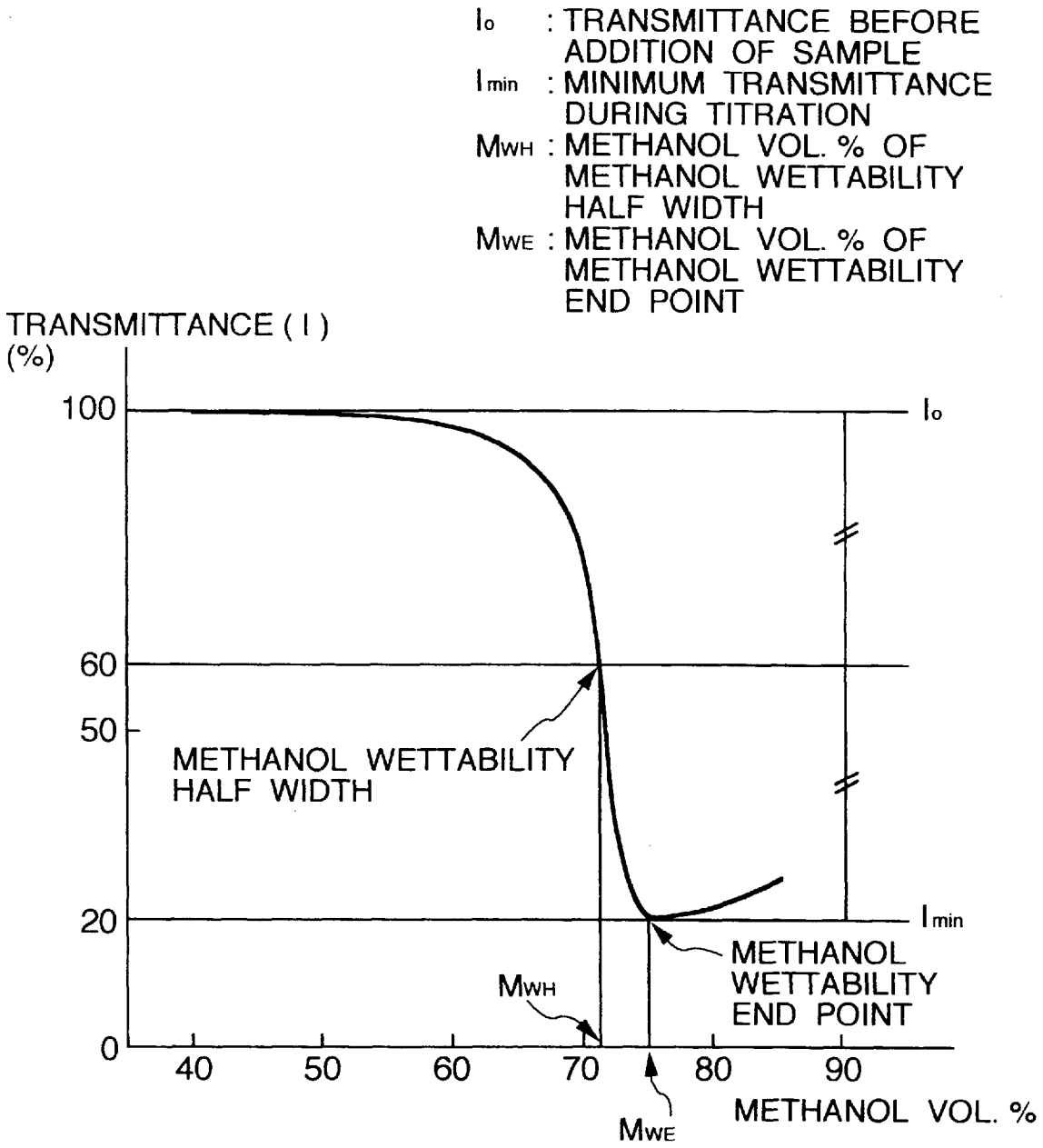
FIG. 19 shows a methanol titration curve from the analysis of which the methanol wettability half value of organic-treated fine particles 49 is determined.
Figure 20:
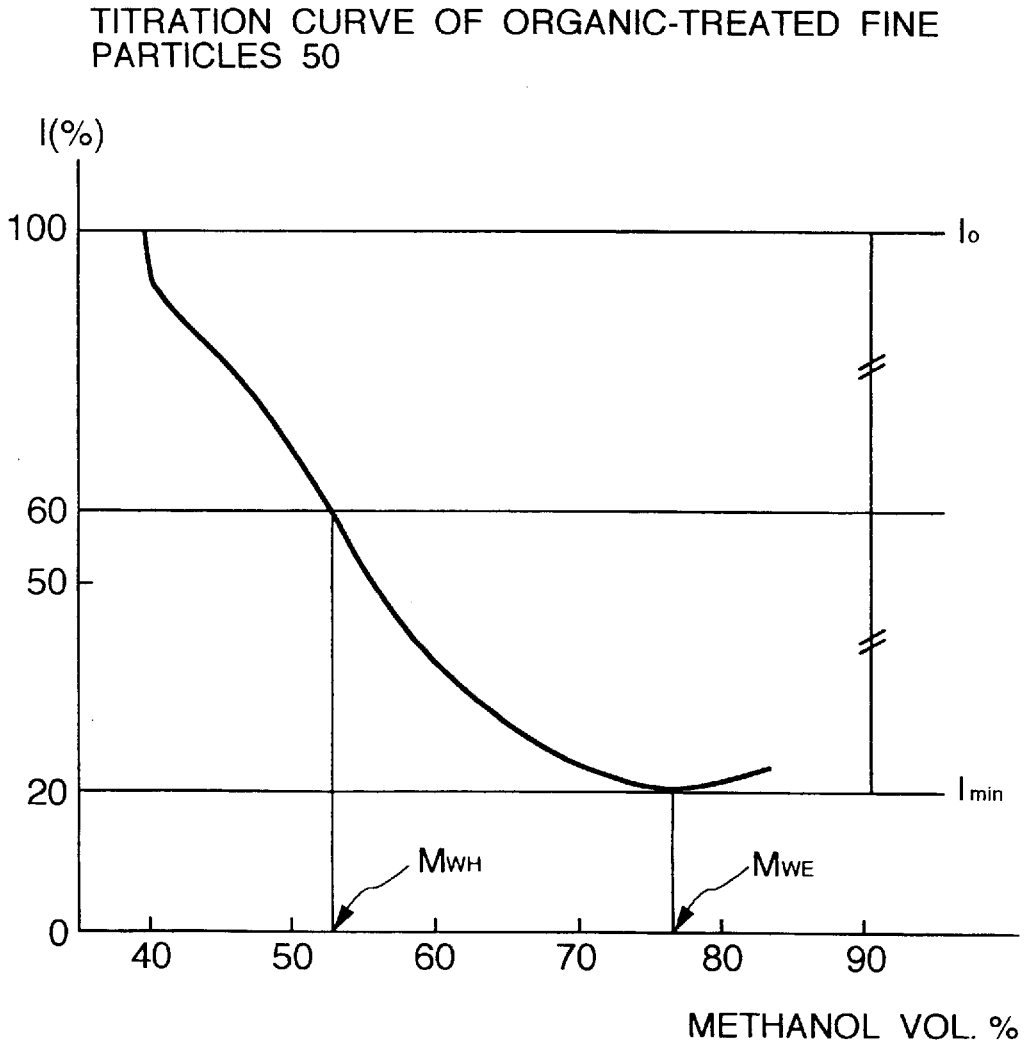
FIG. 20 shows a methanol titration curve from the analysis of which the methanol wettability half value of organic-treated fine particles 50 is determined.

The production process and formulation of the organic-treated fine titanium oxide particles or organic-treated fine alumina particles and inorganic fine powder B used in the following Examples are shown in Tables 31 and 33, the physical properties of these organic-treated fine particles in Table 32, and the physical properties of the inorganic fine powder B in Table 34. The titration curves of the organic-treated fine particles 49 and 50 are shown in FIGS. 19 and 20, respectively. The amount of the treating agent and the diluent in the treatment is given as part(s) by weight (pbw) based on 100 parts by weight of the particles to be treated.

Toner particles (classified products) used in the following Examples were selected from the classified products 7 to 11 used in Examples of GROUP IV, and the following classified products 7 to 10 were used.

Classified product 7

(cyan classified product 7, magenta classified product 7, yellow classified product 7, black classified product 7)

Classified product 8

(cyan classified product 8, magenta classified product 8, yellow classified product 8, black classified product 8)

Classified product 9

(cyan classified product 9, magenta classified product 9, yellow classified product 9, black classified product 9)

Classified product 10

(cyan classified product 10, magenta classified product 10, yellow classified product 10, and black classified product 10)

Classified product 12 was prepared in the following way.

| Classified Product 12 | (by weight) |
|---|---|
| Polyester resin 8 | 100 parts |
| Magnetite (magnetic iron oxide) | 80 parts |
| Di-t-butylsalicylic acid chromium complex | 4 parts |
| Low-molecular weight ethylene-propylene copolymer | 3 parts |

The above materials were premixed using a Henschel mixer, and thereafter melt-kneaded using a twin-screw extruder set to 130° C. The kneaded product was cooled, and then finely pulverized by means of a fine grinding mill making use of a jet stream, followed by classification using an air classifier to obtain a black classified product (black toner particles) 12 with a weight average particle diameter of 8 μm.

Toner and Developer Production Examples

Based on 100 parts by weight of each classified product and according to the formulation as shown in Table 35, the organic-treated fine particles and the inorganic fine powder B were well agitated using a Henschel mixer, to obtain toners as shown in the table.

When the toners are used as one component type developers, they were used as they were. When used as two component type developers, the developers were prepared in the following way.

Cyan toner 124, magenta toner 102, yellow toner 102 and black toner 102 were each blended with a Cu—Zn—Fe ferrite carrier coated with 0.45% by weight of silicone resin, so as to be in a toner concentration of 5% by weight to obtain two component type developers.

Cyan toner 125, magenta toner 103, yellow toner 103 and black toner 103 were each blended with a Cu—Zn—Fe ferrite carrier coated with 0.35% by weight of a styrene-butyl methacrylate copolymer (weight ratio: 80:20) and 0.15% by weight of silicone resin, so as to be in a toner concentration of 7% by weight to obtain two component type developers.

Cyan toner 126, magenta toner 104, yellow toner 104 and black toner 104 were each blended with a Cu—Zn—Fe ferrite carrier coated with 2.5% by weight of a styrene-methyl methacrylate copolymer (weight ratio: 65:35), so as to be in a toner concentration of 7% by weight to obtain two component type developers.

Example 71

Cyan toner 101 was applied in a commercially available digital full-color electrophotographic copying machine (Color Laser Copyer 550, manufactured by Canon Inc.) having the construction as shown in FIG. 1, and 5,000 sheet running tests were made in environments of 23° C./60% RH and 15° C./10% RH. In this copying machine, the developing assembly was modified so as to enable one-component development. Stated specifically, the doctor blade was changed for an elastic blade comprising a 150 μm thick elastic plate made of phosphor bronze, to which 1 mm thick urethane rubber was stuck and a 20 μm thick nylon resin layer was provided on its surface, and so set as to come in touch with the developing sleeve under a linear pressure of 4 kg/m. A urethane foam rubber roller was used as the feed roller. The magnet was removed from the inside of the developing sleeve, and the sleeve was changed for a sleeve having a surface blasted with #600 glass beads.

The fog, image density, blank areas caused by poor transfer at line portions and gradation examined at the initial stage and on the 5,000th sheet, and the transfer efficiency and transfer latitude examined on the 1,000th sheet were examined to make evaluation in the same manner as in Examples of GROUP I. The results of evaluation in the environment of 23° C./60% RH are shown in Table 36 and the results of evaluation in the environment of 15° C./10% RH in Table 37.

The running test was also made in an environment of 30° C./80% RH. The test was started after the developing assembly and the supply toner were made adapted to the test environment for a week, and images were printed on 5,000 sheets. The fog, image density, blank areas caused by poor transfer at line portions and gradation examined at the initial stage and on the 5,000th sheet to make evaluation.

The results of evaluation are shown in Table 38.

As shown in Tables 36 to 38, using the cyan toner 101 of the present invention, sharp cyan images having a high image density, free of fog, free of blank areas at line portions and having a good gradation were obtained in both the environment of low temperature and low humidity and the environment of high temperature and high humidity. The toner also showed a good transfer efficiency and a broad transfer latitude.

Examples 72 to 86

Using cyan toners 102, 103, 105 and 112 to 123, images were formed and evaluated in the same manner as in Example 71 to obtain the results also shown in Tables 36 to 38.

Comparative Example 37

Using cyan toner 104, image were formed and evaluated in the same manner as in Example 71 to obtain the results shown in Tables 36 to 38. There were no problems on the blank areas at character portions and the transfer latitude. There were no problems on the image density in the environment of low humidity and fog, but uneven densities were seen. The developing performance was poor in the environment of high humidity, and fog greatly occurred especially at the initial stage.

Comparative Example 38

Using cyan toner 106, images were formed and evaluated in the same manner as in Example 71 to obtain the results shown in Tables 36 to 38. The transfer latitude was narrow, the blank areas caused by poor transfer occurred, and the developing performance was poor in the environment of high humidity.

Comparative Example 39

Using cyan toner 107, images were formed and evaluated in the same manner as in Example 71 to obtain the results shown in Tables 36 to 38. The transfer latitude was narrow, the blank areas caused by poor transfer occurred, and the developing performance was poor in the environment of high humidity.

Comparative Example 40

Using cyan toner 108, images were formed and evaluated in the same manner as in Example 71 to obtain the results shown in Tables 36 to 38. The developing performance was a little poor in the environment of high humidity and the environment of low humidity. In the environment of low humidity, uneven densities were seen at halftone areas.

Comparative Example 41

Using cyan toner 109, images were formed and evaluated in the same manner as in Example 71 to obtain the results shown in Tables 36 to 38. The developing performance was a little poor in the environment of high humidity and the environment of low humidity. In the environment of low humidity, uneven densities were seen at halftone areas.

Comparative Example 42

Using cyan toner 110, images were formed and evaluated in the same manner as in Example 71 to obtain the results shown in Tables 36 to 38. The developing performance was a little poor in the environment of high humidity and the environment of low humidity. In the environment of low humidity, uneven densities were seen at halftone areas.

Comparative Example 43

Using cyan toner 111, images were formed and evaluated in the same manner as in Example 71 to obtain the results shown in Tables 36 to 38. The developing performance was a little poor in the environment of high humidity and the environment of low humidity. In the environment of low humidity, uneven densities were seen at halftone areas.

Example 87

Cyan toner 115, magenta toner 101, yellow toner 101 and black toner 101 were applied in the modified machine of a digital full-color electrophotographic copying machine (Color Laser Copyer 550, manufactured by Canon Inc.) as used in Example 71, and a 2000 sheet full-color running test (copying test) was made in an environment of 15° C./10% RH. As a result, beautiful and pictorial images having good color reproduction and gradation were obtained, and color differences were little seen in the images during the copying. The fog was 1.2% or less as the worst value on the four colors superimposed, and there was always no problem during the running.

The running test was also made in an environment of 30° C./80% RH. Copies were taken on 2000 sheets after the developing assemblies and supply toners were made adapted to the test environment for a week. As a result, beautiful full-color images were obtained. The fog was 1.8% or less as the worst value on the four colors superimposed, and there was also no problem at the initial stage.

Example 88

Two component type developers produced using cyan toner 124, magenta toner 102, yellow toner 102 and black toner 102 were applied in a digital full-color electrophotographic copying machine (Color Laser Copyer 550, manufactured by Canon Inc.), and a 2000 sheet full-color running test (copying test) was made in an environment of 15° C./10% RH. As a result, beautiful and pictorial images having good color reproduction and gradation were obtained, and color differences were little seen in the images during the copying. The fog was 1.4% or less as the worst value on the four colors superimposed, and there was always no problem during the running.

The running test was also made in an environment of 30° C./80% RH. Copies were taken on 2000 sheets after the developing assemblies and supply toners were made adapted to the test environment for a week. As a result, beautiful full-color images were obtained. The fog was 1.8% or less as the worst value on the four colors superimposed, and there was also no problem at the initial stage.

Example 89

Two component type developers produced using cyan toner 125, magenta toner 103, yellow toner 103 and black toner 103 were applied in a commercially available digital full-color electrophotographic copying machine (PRETALE 550, manufactured by Ricoh Co., Ltd.), employing a transfer belt as the intermediate transfer member, and a 2000 sheet full-color running test (copying test) was made in an environment of 15° C./10% RH. As a result, beautiful images having good color reproduction were obtained, and color differences were little seen in the images during the copying. The fog was 1.3% or less as the worst value on the four colors superimposed, and there was no problem.

The running test was also made in an environment of 30° C./80% RH. Copies were taken on 2000 sheets after the developing assemblies and supply toners were made adapted to the test environment for a week. As a result, beautiful full-color images were obtained. The fog was 1.7% or less as the worst value on the four colors superimposed, and there was also no problem at the initial stage.

Example 90

Two component type developers produced using cyan toner 126, magenta toner 104, yellow toner 104 and black toner 104 were applied in a commercially available digital full-color electrophotographic copying machine (U-Bix 9028, manufactured by Konica Corporation), employing a multiple development one-time transfer system, and a 2000 sheet full-color running test (copying test) was made in an environment of 15° C./10% RH. As a result, beautiful full-color images having a good color reproduction were obtained, and color differences were little seen in the images during the copying. The fog was 0.8% or less as the worst value on the four colors superimposed, and there was no problem.

The running test was also made in an environment of 30° C./80% RH. Copies were taken on 2000 sheets after the developing assemblies and supply toners were made adapted to the test environment for a week. As a result, beautiful full-color images were obtained. The fog was 1.3% or less as the worst value on the four colors superimposed, and there was also no problem at the initial stage.

Example 91

Two component type developers produced using cyan toner 125, magenta toner 103 and yellow toner 103 and as a one component type developer, black toner 105 were applied in the same digital full-color electrophotographic copying machine as used in Example 71, and a 2000 sheet full-color running test (copying test) was made in an environment of 15° C./10% RH. In this instance, the black developing assembly was modified to a magnetic one-component developing system (using a magnetic transport, elastic blade type, see FIG. 6) so as to enable development and transfer from black images. As a result, sharp full-color graphic images having good gradation were obtained, and color differences were little seen in the images during the copying. The fog was 1.4% or less as the worst value on the four colors superimposed, and there was no problem.

The running test was also made in an environment of 30° C./80% RH. Copies were taken on 2000 sheets after the developing assemblies and supply toners were made adapted to the test environment for a week. As a result, beautiful full-color images were obtained. The fog was 1.7% or less as the worst value on the four colors superimposed, and there was also no problem at the initial stage.

GROUP VI

Production Examples of Organic-treated Fine Titanium Oxide Particles or Organic-treated Fine Alumina Particles and Inorganic Fine Powder C Particles to be treated and used in the following Examples are shown in Table 39.

Figure 21:
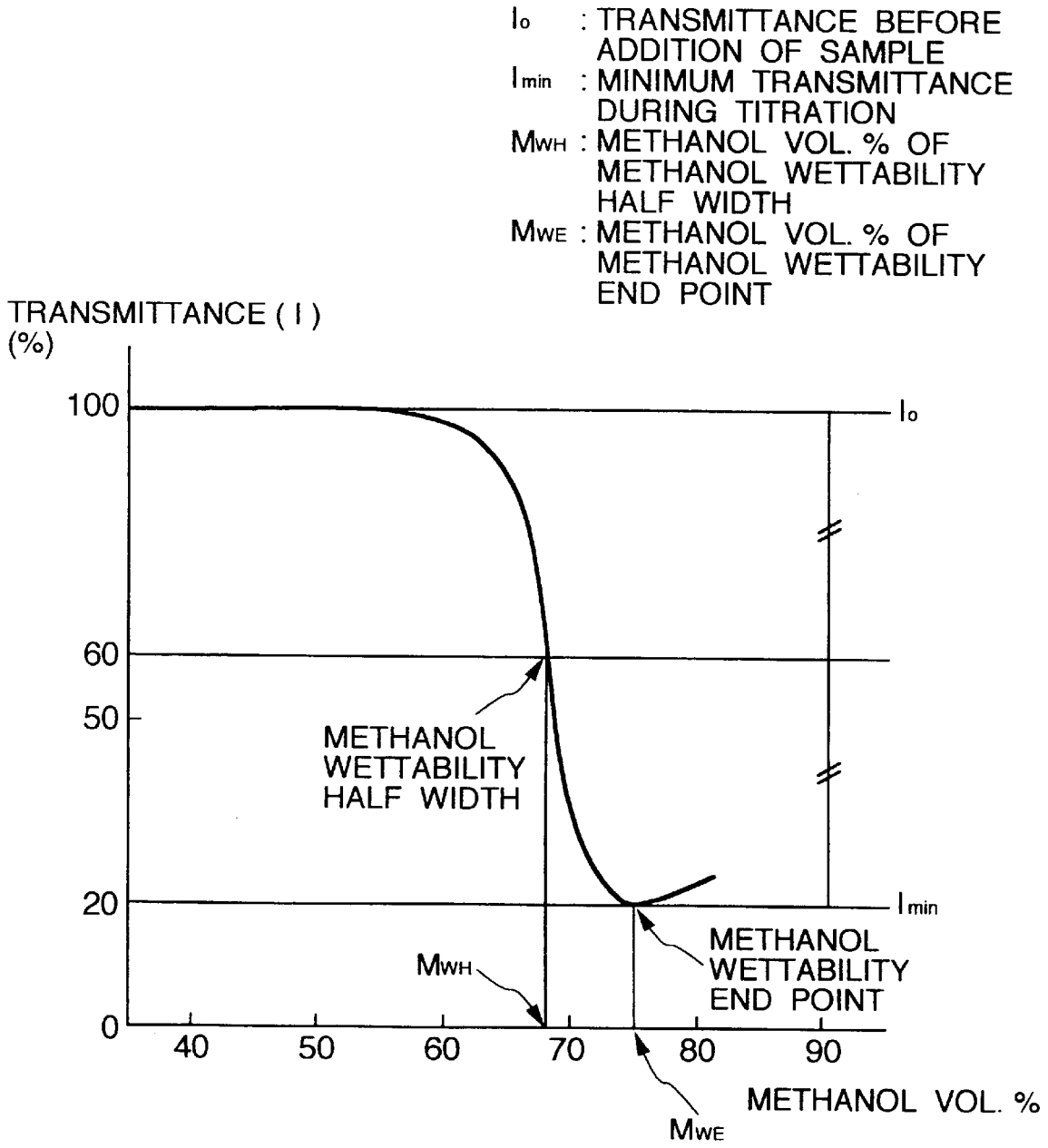
FIG. 21 shows a methanol titration curve from the analysis of which the methanol wettability half value of organic-treated fine particles 62 is determined.
Figure 22:
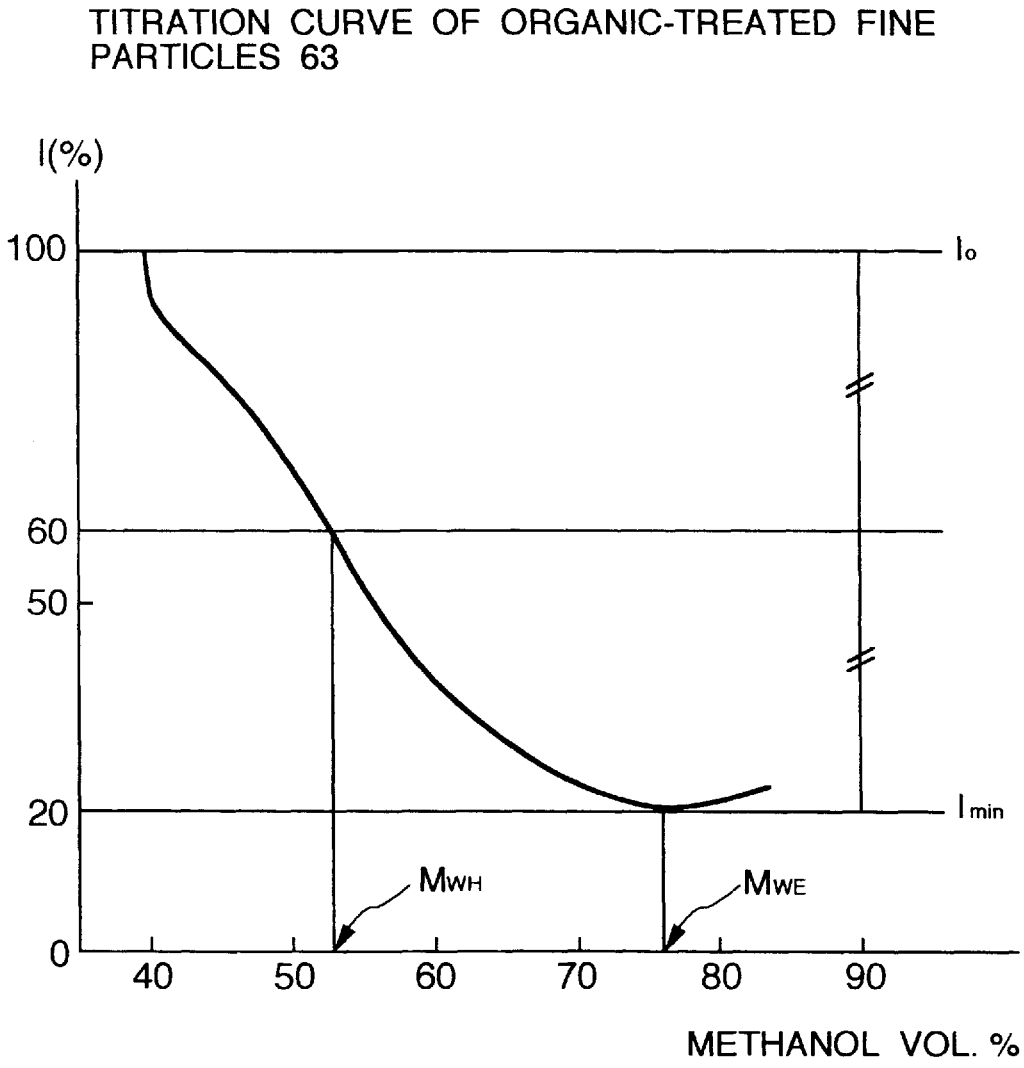
FIG. 22 shows a methanol titration curve from the analysis of which the methanol wettability half value of organic-treated fine particles 63 is determined.

The production process and formulation of the organic-treated fine titanium oxide particles or organic-treated fine alumina particles and inorganic fine powder C used in the following Examples are shown in Tables 40 and 42, the physical properties of these organic-treated fine particles in Table 41, and the physical properties of the inorganic fine powder C in Table 43. The titration curves of the organic-treated fine particles 62 and 63 are shown in FIGS. 21 and 22, respectively. The amount of the treating agent and the diluent in the treatment is given as part(s) by weight (pbw) based on 100 parts by weight of the particles to be treated.

Toner particles (classified products) used in the following Examples were selected from the classified products 7 to 11 used in Examples of GROUP IV, and the following classified products 7 to 10 were used. The following classified products as used in GROUP V were also used.

Classified product 7
(cyan classified product 7, magenta classified product 7, yellow classified product 7, black classified product 7)
Classified product 8
(cyan classified product 8, magenta classified product 8, yellow classified product 8, black classified product 8)
Classified product 9
(cyan classified product 9, magenta classified product 9, yellow classified product 9, black classified product 9)
Classified product 10
(cyan classified product 10, magenta classified product 10, yellow classified product 10, and black classified product 10)
Classified Product 12
(black classified product 12)

Toner and Developer Production Examples

Based on 100 parts by weight of each classified product and according to the formulation as shown in Table 43, the organic-treated fine particles and the inorganic fine powder C were well agitated using a Henschel mixer, to obtain toners as shown in the table.

When the toners are used as one component type developers, they were used as they were. When used as two component type developers, the developers were prepared in the following way.

Cyan toner 147, magenta toner 132, yellow toner 132 and black toner 132 were each blended with a Cu—Zn—Fe ferrite carrier coated with 0.45% by weight of silicone resin, so as to be in a toner concentration of 5% by weight to obtain two component type developers.

Cyan toner 148, magenta toner 133, yellow toner 133 and black toner 133 were each blended with a Cu—Zn—Fe ferrite carrier coated with 0.35% by weight of a styrene-butyl methacrylate copolymer (weight ratio: 80:20) and 0.15% by weight of silicone resin, so as to be in a toner concentration of 7% by weight to obtain two component type developers.

Cyan toner 149, magenta toner 134, yellow toner 134 and black toner 134 were each blended with a Cu—Zn—Fe ferrite carrier coated with 2.5% by weight of a styrene-methyl methacrylate copolymer (weight ratio: 65:35), so as to be in a toner concentration of 7% by weight to obtain two component type developers.

Example 92

Cyan toner 131 was applied in a commercially available digital full-color electrophotographic copying machine (Color Laser Copyer 550, manufactured by Canon Inc.) having the construction as shown in FIG. 1, and 5,000 sheet running tests were made in environments of 23° C./60% RH and 23° C./5% RH. In this copying machine, the developing assembly was modified so as to enable one-component development (see FIG. 7). Stated specifically, the doctor blade was changed for an elastic blade comprising a 150 $\mu$m thick elastic plate made of phosphor bronze, to which 1 mm thick urethane rubber was stuck and a 20 $\mu$m thick nylon resin layer was provided on its surface, and so set as to come in touch with the developing sleeve under a linear pressure of 4 kg/m. A urethane foam rubber roller was used as the feed roller. The magnet was removed from the inside of the developing sleeve, and the sleeve was changed for a sleeve having a surface blasted with #600 glass beads.

The fog, image density, blank areas caused by poor transfer at line portions and gradation examined at the initial stage and on the 5,000th sheet, and the transfer efficiency and transfer latitude examined on the 1,000th sheet were examined to make evaluation in the same manner as in Examples of GROUP I. The results of evaluation in the environment of 23° C./60% RH are shown in Table 44 and the results of evaluation in the environment of 23° C./5% RH in Table 45.

The running test was also made in an environment of 30° C./80% RH. The test was started after the developing assembly and the supply toner were made adapted to the test environment for a week, and images were printed on 5,000 sheets. The fog, image density, blank areas caused by poor transfer at line portions and gradation examined at the initial stage and on the 5,000th sheet to make evaluation.

The results of evaluation are shown in Table 46.

As shown in Tables 44 to 46, using the cyan toner 131 of the present invention, sharp cyan images having a high image density, free of fog, free of blank areas at line portions and having a good gradation were obtained in both the environment of low humidity and the environment of high temperature and high humidity. The toner also showed a good transfer efficiency and a broad transfer latitude.

Examples 93 to 100, and Comparative Examples 44 to 50

Using cyan toners 132 to 146, images were formed and evaluated in the same manner as in Example 92 to obtain the results also shown in Tables 44 to 46.

Example 101

Cyan toner 131, magenta toner 131, yellow toner 131 and black toner 131 were applied in the modified machine of a digital full-color electrophotographic copying machine (Color Laser Copyer 550, manufactured by Canon Inc.) as used in Example 92, and a 2000 sheet full-color running test (copying test) was made in an environment of 23° C./5% RH. As a result, beautiful and pictorial images having good color reproduction and gradation were obtained, and color differences were little seen in the images during the copying. The fog was 1.3% or less as the worst value on the four colors superimposed, and there was always no problem during the running.

The running test was also made in an environment of 30° C./80% RH. Copies were taken on 2000 sheets after the developing assemblies and supply toners were made adapted to the test environment for a week. As a result, beautiful full-color images were obtained. The fog was 1.6% or less as the worst value on the four colors superimposed, and there was also no problem at the initial stage.

Example 102

Two component type developers produced using cyan toner 147, magenta toner 132, yellow toner 132 and black toner 132 were applied in a digital full-color electrophotographic copying machine (Color Laser Copyer 550, manufactured by Canon Inc.), and a 2000 sheet full-color running test (copying test) was made in an environment of 23° C./5% RH. As a result, beautiful and pictorial images having good color reproduction and gradation were obtained, and color differences were little seen in the images during the copying. The fog was 1.5% or less as the worst value on the four colors superimposed, and there was always no problem during the running.

The running test was also made in an environment of 30° C./80% RH. Copies were taken on 2000 sheets after the developing assemblies and supply toners were made adapted to the test environment for a week. As a result, beautiful full-color images were obtained. The fog was 1.6% or less as the worst value on the four colors superimposed, and there was also no problem at the initial stage.

Example 103

Two component type developers produced using cyan toner 148, magenta toner 133, yellow toner 133 and black toner 133 were applied in a commercially available digital full-color electrophotographic copying machine (PRETALE 550, manufactured by Ricoh Co., Ltd.), employing a transfer belt as the intermediate transfer member, and a 2000 sheet full-color running test (copying test) was made in an environment of 23° C./5% RH. As a result, beautiful images having good color reproduction were obtained, and color differences were little seen in the images during the copying. The fog was 1.2% or less as the worst value on the four colors superimposed, and there was no problem.

The running test was also made in an environment of 30° C./80% RH. Copies were taken on 2000 sheets after the developing assemblies and supply toners were made adapted to the test environment for a week. As a result, beautiful full-color images were obtained. The fog was 1.5% or less as the worst value on the four colors superimposed, and there was also no problem at the initial stage.

Example 104

Two component type developers produced using cyan toner 149, magenta toner 134, yellow toner 134 and black toner 134 were applied in a commercially available digital full-color electrophotographic copying machine (U-Bix 9028, manufactured by Konica Corporation), employing a multiple development one-time transfer system, and a 2000 sheet full-color running test (copying test) was made in an environment of 23° C./5% RH. As a result, beautiful full-color images having a good color reproduction were obtained, and color differences were little seen in the images during the copying. The fog was 0.9% or less as the worst value on the four colors superimposed, and there was no problem.

The running test was also made in an environment of 30° C./80% RH. Copies were taken on 2000 sheets after the developing assemblies and supply toners were made adapted to the test environment for a week. As a result, beautiful full-color images were obtained. The fog was 1.1% or less as the worst value on the four colors superimposed, and there was also no problem at the initial stage.

Example 105

Two component type developers produced using cyan toner 125, magenta toner 133 and yellow toner 133 and as a one component type developer, black toner 135 were applied in the same digital full-color electrophotographic copying machine as used in Example 71, and a 2000 sheet full-color running test (copying test) was made in an environment of 23° C./5% RH. In this instance, the black developing assembly was modified to a magnetic one-component developing system (using a magnetic transport, elastic blade type, see FIG. 6) so as to enable development and transfer from black images. As a result, sharp full-color graphic images having good gradation were obtained, and color differences were little seen in the images during the copying. The fog was 1.5% or less as the worst value on the four colors superimposed, and there was no problem.

The running test was also made in an environment of 30° C./80% RH. Copies were taken on 2000 sheets after the developing assemblies and supply toners were made adapted to the test environment for a week. As a result, beautiful full-color images were obtained. The fog was 1.4% or less as the worst value on the four colors superimposed, and there was also no problem at the initial stage.

TABLE 1

| Particles to be treated | Composition | Production process | Crystal form | BET specific surface area ($m^2/g$) | Primary particle diameter ($\mu m$) |
|---|---|---|---|---|---|
| A | $TiO_2$ | Sulfuric acid process | Rutile | 90 | 0.018 |
| B | $TiO_2$ | Chlorine process | Liquid crystal | 50 | 0.022 |
| C | $TiO_2$ | Sulfuric acid process | Anatase | 120 | 0.018 |
| D | $TiO_2$ | Low-temperature oxidation | Amorphous | 140 | 0.017 |

TABLE 1-continued

| Particles to be treated | Composition | Production process | Crystal form | BET specific surface area ($m^2/g$) | Primary particle diameter ($\mu m$) |
|---|---|---|---|---|---|
| | | of titanium alkoxide | | | |
| E | $Al_2O_3$ | Flame decomposition | Delta form | 95 | 0.013 |
| F | $SiO_2$ | Dry process | Amorphous | 205 | 0.012 |

TABLE 2

| [A] | [1] | Treating method | Treating agent 1 | Treating agent 2 | Diluent etc. | Order of treatment w.(1)&(2) |
|---|---|---|---|---|---|---|
| 1 | A | SV 1 | i-Butyltrimethoxysilane (10 pbw) | Dimethylsilicone 50 $mm^2/s$ (10 pbw) | — | Simultaneous |
| 2 | A | SV 1 | i-Butyltrimethoxysilane (10 pbw) | — | — | (1) |
| 3 | A | SV 1 | — | Dimethylsilicone 50 $mm^2/s$ (10 pbw) | — | (2) |
| 4 | A | SV 1 | t-Butyltrimethoxysilane (5 pbw) | Dimethylsilicone 50 $mm^2/s$ (10 pbw) | — | Simultaneous |
| 5 | 2 | SV 1 | — | Dimethylsilicone 50 $mm^2/s$ (10 pbw) | — | (1)→(2) |
| 6 | 2 | GP 1 | — | Methylhydrogen-silicone 20 $mm^2/s$ (10 pbw) | — | (1)→(2) |
| 7 | B | GP 1 | n-Butyltrimethoxysilane (12 pbw) | Dimethylsilicone 20 $mm^2/s$ (8 pbw) | — | Simultaneous |
| 8 | C | AQ 1 | i-Propyltrimethoxysilane (15 pbw) | — | — | (1) |
| 9 | 8 | SV 1 | — | Dimethylsilicone 100 $mm^2/s$ (15 pbw) | — | (1)→(2) |
| 10 | 8 | GP 1 | — | Fluorine-modified silicone 100 $mm^2/s$ (10 pbw) | n-Hexane (30 pbw) | (1)→(2) |
| 11 | D | GP 2 | i-Butyltrimethoxysilane (10 pbw) | Dimethylsilicone 10 $mm^2/s$ (20 pbw) | — | Simultaneous |
| 12 | D | GP 2 | n-Propyltrimethoxysilane (20 pbw) | — | — | (1) |
| 13 | 12 | SV 1 | — | Dimethylsilicone 200 $mm^2/s$ (20 pbw) | — | (1)→(2) |
| 14 | E | SV 1 | i-Butyltrimethoxysilane (10 pbw) | Dimethylsilicone 50 $mm^2/s$ (10 pbw) | — | Simultaneous |
| 15 | E | GP 1 | Hexamethyldisiloxane (20 pbw) | Methylphenyl-silicone 100 $mm^2/s$ (5 pbw) | n-Hexane (15 pbw) | Simultaneous |
| 16 | E | GP 1 | Dimethylsilicone (5 pbw) | Dimethylsilicone 50 $mm^2/s$ (20 pbw) | n-Hexane (20 pbw) | Simultaneous |
| 17 | A | SV 1 | Nonyltrimethoxysilane (10 pbw) | Dimethylsilicone 500 $mm^2/s$ (10 pbw) | — | Simultaneous |
| 18 | B | SV 1 | Phenyltrimethoxysilane (15 pbw) | Dimethylsilicone 20 $mm^2/s$ (7 pbw) | — | Simultaneous |
| 19 | C | SV 1 | Dimethyldimethoxysilane (15 pbw) | Fluorine-modified silicone 1000 $mm^2/s$ (10 pbw) | — | Simultaneous |
| 20 | D | GP 2 | Dimethyldimethoxysilane (15 pbw) | Dimethylsilicone 20 $mm^2/s$ (15 pbw) | — | Simultaneous |
| 21 | A | GP 1 | i-Butyltrimethoxysilane (10 pbw) | Dimethylsilicone 50 $mm^2/s$ (10 pbw) | n-Hexane (10 pbw) | Simultaneous |
| 22 | A | GP 3 | i-Butyltrimethoxysilane (10 pbw) | — | — | (1) |
| 23 | 22 | GP 3 | — | Dimethylsilicone 50 $mm^2/s$ (10 pbw) | n-Hexane (10 pbw) | (1)→(2) |
| 24 | A | SV 2 | i-Butyltrimethoxysilane (10 pbw) | Dimethylsilicone 50 $mm^2/s$ (10 pbw) | — | Simultaneous |
| 25 | A | SV 1 | Dimethyldichlorosilane (10 pbw) | Dimethylsilicone 50 $mm^2/s$ (10 pbw) | — | Simultaneous |
| 26 | A | GP 1 | Dimethyldichlorosilane (10 pbw) | Dimethylsilicone 50 $mm^2/s$ (10 pbw) | n-Hexane (10 pbw) | Simultaneous |

TABLE 2-continued

| [A] | [1] | Treating method | Treating agent 1 | Treating agent 2 | Diluent etc. | Order of treatment w.(1)&(2) |
|---|---|---|---|---|---|---|
| 27 | F | SV 1 | i-Butyltrimethoxysilane (10 pbw) | Dimethylsilicone 50 $mm^2/s$ (10 pbw) | — | Simultaneous |

[A]: Organic-treated fine particles;
[1]: Particles to be treated
SV: Solvent method;
GP: Gaseous phase method;
AQ: Aqueous method
(1): Treating agent 1;
(2): Treating agent 2

TABLE 3

| Organic = treated fine particles | Methanol wettability half value (%) | Methanol wettability end point (%) | Methanol hydrophobicity (%) | Moisture content (wt. %) | Average particle diameter (μm) |
|---|---|---|---|---|---|
| 1 | 70 | 75 | 80 | 0.93 | 0.021 |
| 2 | 51 | 55 | 58 | 1.68 | 0.019 |
| 3 | 53 | 73 | 75 | 1.17 | 0.020 |
| 4 | 59 | 78 | 81 | 1.03 | 0.021 |
| 5 | 66 | 76 | 79 | 1.02 | 0.023 |
| 6 | 64 | 69 | 73 | 0.48 | 0.025 |
| 7 | 67 | 72 | 73 | 0.65 | 0.025 |
| 8 | 48 | 55 | 58 | 2.35 | 0.019 |
| 9 | 68 | 78 | 82 | 1.05 | 0.021 |
| 10 | 72 | 77 | 79 | 0.63 | 0.023 |
| 11 | 72 | 82 | 85 | 0.88 | 0.019 |
| 12 | 52 | 58 | 59 | 3.82 | 0.018 |
| 13 | 70 | 78 | 81 | 1.15 | 0.021 |
| 14 | 67 | 72 | 75 | 0.85 | 0.017 |
| 15 | 63 | 68 | 69 | 0.79 | 0.019 |
| 16 | 64 | 67 | 69 | 0.77 | 0.022 |
| 17 | 69 | 75 | 83 | 1.02 | 0.022 |
| 18 | 66 | 71 | 74 | 1.22 | 0.023 |
| 19 | 73 | 77 | 80 | 0.98 | 0.020 |
| 20 | 72 | 80 | 83 | 1.17 | 0.019 |
| 21 | 66 | 70 | 72 | 0.62 | 0.025 |
| 22 | 49 | 60 | 62 | 0.81 | 0.025 |
| 23 | 51 | 68 | 70 | 0.51 | 0.028 |
| 24 | 52 | 73 | 77 | 1.34 | 0.024 |
| 25 | 50 | 69 | 70 | 1.22 | 0.023 |
| 26 | 52 | 72 | 76 | 0.54 | 0.027 |
| 27 | 51 | 68 | 71 | 1.75 | 0.016 |

TABLE 4

| Organic = treated fine particles | Specific surface area ($m^2/g$) | Bulk density ($g/cm^3$) | Quantity of triboelectricity (mC/kg) |
|---|---|---|---|
| 1 | 33 | 0.25 | −55 |
| 2 | 85 | 0.23 | −44 |
| 3 | 48 | 0.17 | −33 |
| 4 | 43 | 0.23 | −35 |
| 5 | 35 | 0.29 | −40 |
| 6 | 36 | 0.31 | −52 |
| 7 | 24 | 0.16 | −25 |
| 8 | 104 | 0.12 | −18 |
| 9 | 54 | 0.19 | −67 |
| 10 | 43 | 0.20 | −51 |
| 11 | 67 | 0.10 | −35 |
| 12 | 123 | 0.07 | −15 |
| 13 | 54 | 0.14 | −39 |
| 14 | 51 | 0.15 | −33 |
| 15 | 73 | 0.12 | −21 |
| 16 | 41 | 0.19 | −44 |
| 17 | 26 | 0.41 | −55 |
| 18 | 23 | 0.42 | −45 |
| 19 | 34 | 0.24 | −32 |
| 20 | 77 | 0.11 | −37 |
| 21 | 25 | 0.33 | −51 |
| 22 | 28 | 0.28 | −32 |
| 23 | 19 | 0.40 | −63 |
| 24 | 30 | 0.31 | −45 |
| 25 | 27 | 0.28 | −49 |
| 26 | 21 | 0.43 | −74 |
| 27 | 151 | 0.10 | −173 |

TABLE 5

| Toner | Classified product | Organic-treated fine particles | Amount (pbw) |
|---|---|---|---|
| Cyan Toner 1 | Cyan classified product 1 | Organic-treated fine particles 1 | 1.5 |
| Cyan Toner 2 | Cyan classified product 1 | Organic-treated fine particles 2 | 1.5 |
| Cyan Toner 3 | Cyan classified product 1 | Organic-treated fine particles 3 | 1.5 |
| Cyan Toner 4 | Cyan classified product 1 | Organic-treated fine particles 4 | 1.5 |
| Cyan Toner 5 | Cyan classified product 1 | Organic-treated fine particles 5 | 1.5 |
| Cyan Toner 6 | Cyan classified product 1 | Organic-treated fine particles 6 | 1.5 |
| Cyan Toner 7 | Cyan classified product 1 | Organic-treated fine particles 7 | 2.0 |

TABLE 5-continued

| | | | |
|---|---|---|---|
| Cyan Toner 8 | Cyan classified product 1 | Organic-treated fine particles 8 | 1.5 |
| Cyan Toner 9 | Cyan classified product 1 | Organic-treated fine particles 9 | 1.5 |
| Cyan Toner 10 | Cyan classified product 1 | Organic-treated fine particles 10 | 1.5 |
| Cyan Toner 11 | Cyan classified product 1 | Organic-treated fine particles 11 | 1.2 |
| Cyan Toner 12 | Cyan classified product 1 | Organic-treated fine particles 12 | 1.5 |
| Cyan Toner 13 | Cyan classified product 1 | Organic-treated fine particles 13 | 1.2 |
| Cyan Toner 14 | Cyan classified product 1 | Organic-treated fine particles 14 | 1.5 |
| Cyan Toner 15 | Cyan classified product 1 | Organic-treated fine particles 15 | 1.5 |
| Cyan Toner 16 | Cyan classified product 1 | Organic-treated fine particles 16 | 1.5 |
| Cyan Toner 17 | Cyan classified product 1 | Organic-treated fine particles 17 | 1.5 |
| Cyan Toner 18 | Cyan classified product 1 | Organic-treated fine particles 18 | 2.0 |
| Cyan Toner 19 | Cyan classified product 1 | Organic-treated fine particles 19 | 1.5 |
| Cyan Toner 20 | Cyan classified product 1 | Organic-treated fine particles 20 | 1.2 |
| Cyan Toner 21 | Cyan classified product 1 | Organic-treated fine particles 21 | 1.5 |
| Cyan Toner 22 | Cyan classified product 1 | Organic-treated fine particles 22 | 1.5 |
| Cyan Toner 23 | Cyan classified product 1 | Organic-treated fine particles 23 | 1.5 |
| Cyan Toner 24 | Cyan classified product 1 | Organic-treated fine particles 24 | 1.5 |
| Cyan Toner 25 | Cyan classified product 1 | Organic-treated fine particles 25 | 1.5 |
| Cyan Toner 26 | Cyan classified product 1 | Organic-treated fine particles 26 | 1.5 |
| Cyan Toner 27 | Cyan classified product 1 | Organic-treated fine particles 27 | 1.5 |
| Magenta Toner 1 | Magenta classified product 1 | Organic-treated fine particles 1 | 1.5 |
| Yellow Toner 1 | Yellow classified product 1 | Organic-treated fine particles 1 | 1.5 |
| Black Toner 1 | Black classified product 1 | Organic-treated fine particles 1 | 1.5 |
| Toner | Classified product | Titanium oxide or alumina | Amount (pbw) |
| Cyan Toner 28 | Cyan classified product 2 | Organic-treated fine particles 7 | 2.0 |
| Magenta Toner 2 | Magenta classified product 2 | Organic-treated fine particles 7 | 2.0 |
| Yellow Toner 2 | Yellow classified product 2 | Organic-treated fine particles 7 | 2.0 |
| Black Toner 2 | Black classified product 2 | Organic-treated fine particles 7 | 2.0 |
| Cyan Toner 29 | Cyan classified product 3 | Organic-treated fine particles 9 | 1.5 |
| Magenta Toner 3 | Magenta classified product 3 | Organic-treated fine particles 9 | 1.5 |
| Yellow Toner 3 | Yellow classified product 3 | Organic-treated fine particles 9 | 1.5 |
| Black Toner 3 | Black classified product 3 | Organic-treated fine particles 9 | 1.5 |
| Cyan Toner 30 | Cyan classified product 4 | Organic-treated fine particles 11 | 1.2 |
| Magenta Toner 4 | Magenta classified product 4 | Organic-treated fine particles 11 | 1.2 |
| Yellow Toner 4 | Yellow classified product 4 | Organic-treated fine particles 11 | 1.2 |
| Black Toner 4 | Black classified product 1 | Organic-treated fine particles 11 | 1.2 |
| Cyan Toner 31 | Cyan classified product 5 | Organic-treated fine particles 14 | 1.5 |
| Magenta Toner 5 | Magenta classified product 5 | Organic-treated fine particles 14 | 1.5 |
| Yellow Toner 5 | Yellow classified product 5 | Organic-treated fine particles 14 | 1.5 |
| Black Toner 5 | Black classified product 5 | Organic-treated fine particles 14 | 1.5 |
| Black Toner 6 | Black classified product 6 | Organic-treated fine particles 20 | 1.5 |

TABLE 6

| | | 23° C./60% RH | | | | | | | | | | | |
|---|---|---|---|---|---|---|---|---|---|---|---|---|---|
| | | Initial stage | | | | 1,000th sheet | | | | 10,000th sheet | | | |
| | Toner | Image density | Fog | (1) | Gradation | Image density | Fog | (1) | Gradation | Image density | Fog | (1) | Gradation |
| Example: | | | | | | | | | | | | | |
| 1 | Cyan 1 | 1.82 | 0.6 | A | A | 1.84 | 0.6 | A | A | 1.82 | 0.5 | A | A |
| 2 | Cyan 4 | 1.76 | 1.0 | A | A | 1.72 | 0.8 | A | A | 1.74 | 0.6 | A | A |
| 3 | Cyan 5 | 1.68 | 0.7 | A | B | 1.69 | 0.5 | A | B | 1.68 | 0.5 | A | B |
| 4 | Cyan 6 | 1.72 | 0.9 | A | A | 1.70 | 0.7 | B | A | 1.72 | 0.6 | B | B |
| 5 | Cyan 7 | 1.69 | 0.7 | A | B | 1.68 | 0.6 | A | B | 1.69 | 0.6 | A | B |
| 6 | Cyan 9 | 1.78 | 0.8 | A | A | 1.76 | 0.6 | A | A | 1.77 | 0.5 | A | A |
| 7 | Cyan 10 | 1.70 | 0.7 | A | A | 1.69 | 0.5 | A | A | 1.70 | 0.6 | A | B |
| 8 | Cyan 11 | 1.80 | 0.6 | A | A | 1.85 | 0.5 | A | A | 1.83 | 0.5 | A | A |
| 9 | Cyan 13 | 1.76 | 0.7 | A | A | 1.75 | 0.6 | A | A | 1.77 | 0.6 | A | A |
| 10 | Cyan 14 | 1.79 | 0.7 | A | A | 1.77 | 0.5 | A | A | 1.78 | 0.6 | A | A |
| 11 | Cyan 15 | 1.69 | 1.0 | B | A | 1.72 | 0.9 | B | B | 1.71 | 0.8 | C | B |
| 12 | Cyan 16 | 1.67 | 1.1 | A | B | 1.66 | 0.9 | A | B | 1.68 | 0.8 | A | C |
| 13 | Cyan 17 | 1.75 | 0.6 | A | B | 1.73 | 0.5 | A | B | 1.74 | 0.6 | A | B |
| 14 | Cyan 18 | 1.68 | 0.7 | A | B | 1.68 | 0.6 | B | B | 1.69 | 0.6 | A | B |
| 15 | Cyan 19 | 1.79 | 0.6 | A | A | 1.80 | 0.5 | A | A | 1.80 | 0.6 | A | A |
| 16 | Cyan 20 | 1.81 | 0.7 | A | A | 1.80 | 0.5 | A | A | 1.82 | 0.5 | A | A |
| 17 | Cyan 21 | 1.75 | 0.7 | A | B | 1.78 | 0.6 | A | B | 1.79 | 0.5 | A | B |

TABLE 6-continued

| | | 23° C./60% RH | | | | | | | | | | | |
|---|---|---|---|---|---|---|---|---|---|---|---|---|---|
| | | Initial stage | | | | 1,000th sheet | | | | 10,000th sheet | | | |
| | Toner | Image density | Fog | (1) | Gradation | Image density | Fog | (1) | Gradation | Image density | Fog | (1) | Gradation |
| Comparative Example: | | | | | | | | | | | | | |
| 1 | Cyan 2 | 1.80 | 1.4 | C | A | 1.81 | 0.7 | C | A | 1.83 | 0.5 | D | A |
| 2 | Cyan 3 | 1.71 | 1.0 | A | A | 1.69 | 0.8 | A | B | 1.70 | 0.6 | A | C |
| 3 | Cyan 8 | 1.75 | 1.2 | C | A | 1.70 | 1.0 | D | A | 1.71 | 0.8 | D | A |
| 4 | Cyan 12 | 1.80 | 1.1 | C | A | 1.80 | 0.9 | C | A | 1.78 | 0.7 | C | A |
| 5 | Cyan 22 | 1.71 | 1.2 | D | A | 1.73 | 0.8 | D | B | 1.75 | 0.7 | D | B |
| 6 | Cyan 23 | 1.70 | 1.0 | A | B | 1.71 | 0.9 | B | B | 1.73 | 0.7 | B | C |
| 7 | Cyan 24 | 1.58 | 1.2 | A | B | 1.61 | 1.0 | B | B | 1.63 | 0.6 | B | B |
| 8 | Cyan 25 | 1.60 | 1.1 | A | B | 1.65 | 0.9 | B | B | 1.68 | 0.7 | B | B |
| 9 | Cyan 26 | 1.65 | 1.1 | A | B | 1.67 | 0.9 | B | B | 1.70 | 0.6 | B | B |
| 10 | Cyan 27 | 1.71 | 0.6 | A | B | 1.75 | 1.0 | A | B | 1.77 | 1.6 | A | C |

(1): Blank areas caused by poor transfer

TABLE 7

| | 23° C./60% RH | | |
|---|---|---|---|
| | | Transfer efficiency (%) | Transfer latitude (μA) |
| Example: | | | |
| 1 | Cyan Toner 1 | 94 | 75–425 |
| 2 | Cyan Toner 4 | 92 | 100–400 |
| 3 | Cyan Toner 5 | 93 | 100–400 |
| 4 | Cyan Toner 6 | 89 | 125–400 |
| 5 | Cyan Toner 7 | 92 | 100–425 |
| 6 | Cyan Toner 9 | 93 | 75–425 |
| 7 | Cyan Toner 10 | 90 | 100–400 |
| 8 | Cyan Toner 11 | 95 | 50–450 |
| 9 | Cyan Toner 13 | 94 | 75–400 |
| 10 | Cyan Toner 14 | 91 | 100–400 |
| 11 | Cyan Toner 15 | 87 | 125–375 |
| 12 | Cyan Toner 16 | 92 | 75–425 |
| 13 | Cyan Toner 17 | 90 | 100–400 |
| 14 | Cyan Toner 18 | 89 | 100–375 |
| 15 | Cyan Toner 19 | 92 | 100–425 |

TABLE 7-continued

| | 23° C./60% RH | | |
|---|---|---|---|
| | | Transfer efficiency (%) | Transfer latitude (μA) |
| 16 | Cyan Toner 20 | 94 | 50–425 |
| 17 | Cyan Toner 21 | 89 | 125–425 |
| Comparative Example: | | | |
| 1 | Cyan Toner 2 | 80 | 175–325 |
| 2 | Cyan Toner 3 | 89 | 100–375 |
| 3 | Cyan Toner 8 | 78 | 150–300 |
| 4 | Cyan Toner 12 | 81 | 175–325 |
| 5 | Cyan Toner 22 | 88 | 100–375 |
| 6 | Cyan Toner 23 | 87 | 125–375 |
| 7 | Cyan Toner 24 | 89 | 125–375 |
| 8 | Cyan Toner 25 | 89 | 100–375 |
| 9 | Cyan Toner 26 | 88 | 100–350 |
| 10 | Cyan Toner 27 | 89 | 100–400 |

TABLE 8

| | | 30° C./80% RH | | | | | | | | | | | |
|---|---|---|---|---|---|---|---|---|---|---|---|---|---|
| | | Initial stage | | | | 100th sheet | | | | 1,000th sheet | | | |
| | Toner | Image density | Fog | (1) | Gradation | Image density | Fog | (1) | Gradation | Image density | Fog | (1) | Gradation |
| Example: | | | | | | | | | | | | | |
| 1 | Cyan 1 | 1.80 | 0.8 | A | A | 1.81 | 0.7 | A | A | 1.82 | 0.6 | A | A |
| 2 | Cyan 4 | 1.75 | 1.6 | A | A | 1.74 | 1.4 A | A | 1.76 | 0.8 | A | A | |
| 3 | Cyan 5 | 1.67 | 0.8 | A | A | 1.69 | 0.7 | A | A | 1.68 | 0.7 | A | B |
| 4 | Cyan 6 | 1.71 | 1.1 | A | A | 1.70 | 1.0 | A | A | 1.72 | 0.9 | B | A |
| 5 | Cyan 7 | 1.69 | 0.7 | A | A | 1.68 | 0.6 | A | A | 1.70 | 0.6 | A | A |
| 6 | Cyan 9 | 1.78 | 0.8 | A | A | 1.79 | 0.7 | A | A | 1.80 | 0.7 | A | A |
| 7 | Cyan 10 | 1.69 | 0.9 | A | A | 1.68 | 0.8 | A | A | 1.68 | 0.7 | A | A |
| 8 | Cyan 11 | 1.81 | 0.7 | A | A | 1.84 | 0.6 | A | A | 1.83 | 0.5 | A | A |
| 9 | Cyan 13 | 1.75 | 0.9 | A | A | 1.76 | 0.8 | A | A | 1.77 | 0.7 | A | A |
| 10 | Cyan 14 | 1.78 | 0.8 | A | A | 1.77 | 0.6 | A | A | 1.78 | 0.7 | A | A |
| 11 | Cyan 15 | 1.67 | 1.4 | A | A | 1.66 | 1.2 | A | A | 1.68 | 0.9 | B | A |
| 12 | Cyan 16 | 1.68 | 1.6 | A | B | 1.67 | 1.1 | A | B | 1.69 | 0.8 | A | B |

TABLE 8-continued

| | | 30° C./80% RH | | | | | | | | | | | |
|---|---|---|---|---|---|---|---|---|---|---|---|---|---|
| | | Initial stage | | | | 100th sheet | | | | 1,000th sheet | | | |
| | Toner | Image density | Fog | (1) | Gradation | Image density | Fog | (1) | Gradation | Image density | Fog | (1) | Gradation |
| 13 | Cyan 17 | 1.78 | 0.8 | A | A | 1.79 | 0.7 | A | A | 1.78 | 0.7 | A | A |
| 14 | Cyan 18 | 1.69 | 0.7 | A | B | 1.70 | 0.6 | A | B | 1.68 | 0.6 | A | B |
| 15 | Cyan 19 | 1.80 | 0.8 | A | A | 1.82 | 0.6 | A | A | 1.81 | 0.6 | A | A |
| 16 | Cyan 20 | 1.79 | 0.8 | A | A | 1.80 | 0.7 | A | A | 1.80 | 0.6 | A | A |
| 17 | Cyan 21 | 1.75 | 0.9 | A | B | 1.76 | 1.0 | A | B | 1.77 | 0.6 | A | B |
| Comparative Example: | | | | | | | | | | | | | |
| 1 | Cyan 2 | 1.58 | 2.4 | C | A | 1.60 | 1.8 | C | A | 1.66 | 1.4 | C | A |
| 2 | Cyan 3 | 1.61 | 2.1 | A | A | 1.66 | 1.6 | A | A | 1.68 | 1.2 | A | B |
| 3 | Cyan 8 | 1.44 | 2.6 | C | B | 1.40 | 2.1 | D | B | 1.51 | 1.7 | D | B |
| 4 | Cyan 12 | 1.59 | 2.2 | C | B | 1.61 | 1.9 | D | A | 1.62 | 1.5 | D | B |
| 5 | Cyan 22 | 1.62 | 1.8 | A | B | 1.63 | 1.6 | B | C | 1.65 | 1.3 | B | B |
| 6 | Cyan 23 | 1.53 | 1.6 | A | C | 1.58 | 1.2 | B | C | 1.63 | 1.0 | B | C |
| 7 | Cyan 24 | 1.60 | 1.7 | A | C | 1.61 | 1.3 | B | B | 1.65 | 1.1 | B | C |
| 8 | Cyan 25 | 1.58 | 1.8 | A | C | 1.60 | 1.4 | B | B | 1.62 | 1.2 | B | B |
| 9 | Cyan 26 | 1.68 | 1.6 | A | C | 1.71 | 1.4 | B | C | 1.72 | 1.1 | B | B |
| 10 | Cyan 27 | 1.51 | 1.0 | A | C | 1.56 | 1.2 | A | C | 1.53 | 1.4 | A | C |

(1): Blank areas caused by poor transfer

TABLE 9

| | | 30° C./80% RH | | | | | | | | | | | |
|---|---|---|---|---|---|---|---|---|---|---|---|---|---|
| | | After 1 week leaving | | | | 1,100th sheet | | | | 2,000th sheet | | | |
| | Toner | Image density | Fog | (1) | Gradation | Image density | Fog | (1) | Gradation | Image density | Fog | (1) | Gradation |
| Example: | | | | | | | | | | | | | |
| 1 | Cyan 1 | 1.81 | 0.8 | A | A | 1.82 | 0.6 | A | A | 1.81 | 0.6 | A | A |
| 2 | Cyan 4 | 1.74 | 1.4 | A | A | 1.73 | 1.1 | A | A | 1.75 | 0.7 | A | A |
| 3 | Cyan 5 | 1.68 | 0.9 | A | B | 1.67 | 0.8 | A | B | 1.66 | 0.7 | A | B |
| 4 | Cyan 6 | 1.71 | 1.2 | A | A | 1.72 | 1.0 | B | B | 1.70 | 0.8 | B | A |
| 5 | Cyan 7 | 1.70 | 0.9 | A | A | 1.71 | 0.7 | A | A | 1.69 | 0.7 | A | A |
| 6 | Cyan 9 | 1.79 | 0.9 | A | A | 1.80 | 0.7 | A | A | 1.81 | 0.8 | A | A |
| 7 | Cyan 10 | 1.67 | 0.9 | A | A | 1.69 | 0.8 | A | A | 1.70 | 0.8 | A | A |
| 8 | Cyan 11 | 1.82 | 0.8 | A | A | 1.81 | 0.6 | A | A | 1.83 | 0.6 | A | A |
| 9 | Cyan 13 | 1.76 | 0.8 | A | A | 1.79 | 0.7 | A | A | 1.78 | 0.7 | A | A |
| 10 | Cyan 14 | 1.79 | 0.8 | A | A | 1.77 | 0.8 | A | A | 1.78 | 0.6 | A | A |
| 11 | Cyan 15 | 1.65 | 1.3 | A | A | 1.64 | 1.0 | B | A | 1.66 | 0.9 | B | A |
| 12 | Cyan 16 | 1.69 | 1.4 | A | B | 1.68 | 1.0 | A | B. | 1.67 | 0.8 | A | B |
| 13 | Cyan 17 | 1.77 | 0.8 | A | A | 1.75 | 0.7 | A | A | 1.78 | 0.6 | A | A |
| 14 | Cyan 18 | 1.70 | 0.8 | A | A | 1.71 | 0.7 | A | A | 1.69 | 0.7 | B | B |
| 15 | Cyan 19 | 1.80 | 0.8 | A | A | 1.79 | 0.7 | A | A | 1.82 | 0.6 | A | A |
| 16 | Cyan 20 | 1.81 | 0.8 | A | A | 1.82 | 0.6 | A | A | 1.80 | 0.7 | A | A |
| 17 | Cyan 21 | 1.73 | 1.2 | A | B | 1.74 | 0.8 | A | B | | 0.6 | A | B |
| Comparative Example: | | | | | | | | | | | | | |
| 1 | Cyan 2 | 1.54 | 2.2 | C | A | 1.59 | 1.7 | C | A | 1.62 | 1.2 | D | A |
| 2 | Cyan 3 | 1.59 | 2.0 | A | A | 1.63 | 1.6 | A | A | 1.66 | 1.0 | A | B |
| 3 | Cyan 8 | 1.31 | 2.9 | C | B | 1.41 | 2.7 | C | B | 1.45 | 2.0 | D | B |
| 4 | Cyan 12 | 1.58 | 2.3 | C | B | 1.60 | 1.8 | D | B | 1.61 | 1.4 | D | B |
| 5 | Cyan 22 | 1.64 | 1.8 | B | B | 1.65 | 1.6 | B | C | 1.66 | 1.2 | B | C |
| 6 | Cyan 23 | 1.62 | 1.9 | B | C | 1.65 | 1.4 | B | C | 1.66 | 1.1 | B | C |
| 7 | Cyan 24 | 1.58 | 1.8 | B | C | 1.61 | 1.6 | B | C | 1.63 | 1.0 | B | C |
| 8 | Cyan 25 | 1.60 | 1.9 | B | C | 1.62 | 1.7 | B | C | 1.65 | 1.2 | B | B |
| 9 | Cyan 26 | 1.62 | 1.5 | B | C | 1.64 | 1.2 | B | C | 1.67 | 1.1 | B | C |
| 10 | Cyan 27 | 1.48 | 1.2 | A | C | 1.52 | 1.0 | A | C | 1.56 | 1.6 | A | C |

(1): Blank areas caused by poor transfer

TABLE 10

| | | 30° C./80% RH | | | | | | | | | | | |
|---|---|---|---|---|---|---|---|---|---|---|---|---|---|
| | | After 2 week leaving | | | | 2,100th sheet | | | | 3,000th sheet | | | |
| | Toner | Image density | Fog | (1) | Gradation | Image density | Fog | (1) | Gradation | Image density | Fog | (1) | Gradation |
| Example: | | | | | | | | | | | | | |
| 1 | Cyan 1 | 1.80 | 0.8 | A | A | 1.83 | 0.6 | A | A | 1.81 | 0.6 | A | A |
| 2 | Cyan 4 | 1.74 | 1.5 | A | A | 1.72 | 1.2 | A | A | 1.75 | 0.8 | A | A |
| 3 | Cyan 5 | 1.68 | 0.8 | A | B | 1.67 | 0.7 | A | B | 1.69 | 0.6 | A | B |
| 4 | Cyan 6 | 1.70 | 1.0 | B | B | 1.72 | 1.0 | B | A | 1.73 | 0.8 | B | B |
| 5 | Cyan 7 | 1.69 | 0.8 | A | A | 1.68 | 0.8 | A | A | 1.68 | 0.6 | A | A |
| 6 | Cyan 9 | 1.80 | 0.8 | A | A | 1.78 | 0.8 | A | A | 1.79 | 0 6 | A | A |
| 7 | Cyan 10 | 1.70 | 0.9 | A | A | 1.69 | 0.7 | A | B | 1.71 | 0.7 | A | B |
| 8 | Cyan 11 | 1.80 | 0.7 | A | A | 1.81 | 0.6 | A | A | 1.82 | 0.6 | A | A |
| 9 | Cyan 13 | 1.74 | 0.9 | A | A | 1.73 | 0.8 | A | A | 1.75 | 0.7 | A | A |
| 10 | Cyan 14 | 1.78 | 0.8 | A | A | 1.79 | 0.7 | A | A | 1.77 | 0.7 | A | A |
| 11 | Cyan 15 | 1.67 | 1.2 | B | A | 1.65 | 0.9 | B | A | 1.66 | 0.8 | C | B |
| 12 | Cyan 16 | 1.68 | 1.7 | A | B | 1.69 | 1.3 | A | B | 1.68 | 1.0 | A | B |
| 13 | Cyan 17 | 1.78 | 0.9 | A | A | 1.79 | 0.7 | A | B | 1.77 | 0.7 | A | B |
| 14 | Cyan 18 | 1.68 | 0.8 | B | A | 1.69 | 0.7 | B | B | 1.68 | 0.7 | B | B |
| 15 | Cyan 19 | 1.81 | 0.8 | A | A | 1.82 | 0.6 | A | A | 1.80 | 0.7 | A | A |
| 16 | Cyan 20 | 1.80 | 0.8 | A | A | 1.79 | 0.6 | A | A | 1.81 | 0.6 | A | A |
| 17 | Cyan 21 | 1.70 | 1.3 | A | B | 1.75 | 0.9 | A | B | 1.77 | 0.7 | A | B |
| Comparative Example: | | | | | | | | | | | | | |
| 1 | Cyan 2 | 1.47 | 2.4 | C | A | 1.51 | 1.9 | C | A | 1.58 | 1.4 | D | A |
| 2 | Cyan 3 | 1.58 | 2.1 | A | A | 1.62 | 1.8 | A | B | 1.68 | 1.2 | A | B |
| 3 | Cyan 8 | 1.22 | 3.3 | C | C | 1.31 | 2.8 | D | B | 1.38 | 1.8 | D | B |
| 4 | Cyan 12 | 1.55 | 2.4 | C | B | 1.59 | 2.0 | D | B | 1.63 | 1.3 | D | B |
| 5 | Cyan 22 | 1.62 | 2.1 | B | C | 1.63 | 1.8 | B | C | 1.62 | 1.3 | B | C |
| 6 | Cyan 23 | 1.60 | 2.0 | B | B | 1.60 | 1.7 | B | C | 1.65 | 1.4 | B | C |
| 7 | Cyan 24 | 1.56 | 2.0 | B | C | 1.58 | 1.8 | B | C | 1.57 | 1.2 | B | C |
| 8 | Cyan 25 | 1.57 | 2.0 | B | B | 1.59 | 1.7 | B | C | 1.60 | 1.1 | B | C |
| 9 | Cyan 26 | 1.62 | 2.1 | B | C | 1.61 | 1.5 | B | C | 1.62 | 1.1 | B | C |
| 10 | Cyan 27 | 1.50 | 1.1 | A | C | 1.51 | 1.6 | A | C | 1.48 | 2.1 | A | C |

(1): Blank areas caused by poor transfer

TABLE 11

| Organic = treated fine particles | Methanol wettability half value (%) | Methanol wettability end point (%) | Methanol hydrophobicity (%) | Moisture content (wt. %) | Average particle diameter (μm) |
|---|---|---|---|---|---|
| 1 | 70 | 75 | 80 | 0.93 | 0.021 |
| 2 | 51 | 55 | 58 | 1.68 | 0.019 |
| 3 | 53 | 73 | 75 | 1.17 | 0.020 |
| 4 | 59 | 78 | 81 | 1.03 | 0.021 |
| 7 | 67 | 72 | 73 | 0.65 | 0.025 |
| 11 | 72 | 82 | 85 | 0.88 | 0.019 |
| 14 | 67 | 72 | 75 | 0.85 | 0.017 |
| 17 | 69 | 75 | 83 | 1.02 | 0.022 |
| 18 | 66 | 71 | 74 | 1.22 | 0.023 |
| 19 | 73 | 77 | 80 | 0.98 | 0.020 |
| 21 | 66 | 70 | 72 | 0.62 | 0.025 |
| 23 | 51 | 68 | 70 | 0.51 | 0.028 |
| 24 | 52 | 73 | 77 | 1.34 | 0.024 |
| 25 | 50 | 69 | 70 | 1.22 | 0.023 |
| 26 | 52 | 68 | 71 | 0.54 | 0.027 |

TABLE 12

| Organic-treated fine particles | Specific surface area (m2/g) | Bulk density (g/cm3) | Quantity of triboelectricity (mC/kg) |
|---|---|---|---|
| 1 | 33 | 0.25 | −55 |
| 2 | 85 | 0.23 | −44 |
| 3 | 48 | 0.17 | −33 |
| 4 | 43 | 0.17 | −35 |
| 7 | 24 | 0.16 | −25 |
| 11 | 67 | 0.10 | −35 |
| 14 | 51 | 0.15 | −33 |
| 17 | 26 | 0.41 | −55 |
| 18 | 23 | 0.42 | −45 |
| 19 | 34 | 0.24 | −32 |
| 21 | 25 | 0.33 | −51 |
| 23 | 19 | 0.40 | −63 |
| 24 | 30 | 0.31 | −45 |
| 25 | 27 | 0.28 | −49 |
| 26 | 21 | 0.43 | −74 |

TABLE 13

| Toner | Classified product | Organic-treated fine particles | Amount (pbw) |
|---|---|---|---|
| Magenta Toner A | Magenta classified product 1 | Organic-treated fine particles 1 | 1.5 |
| Magenta Toner B | Magenta classified product 1 | Organic-treated fine particles 2 | 1.5 |
| Magenta Toner C | Magenta classified product 1 | Organic-treated fine particles 3 | 1.5 |
| Magenta Toner D | Magenta classified product 1 | Organic-treated fine particles 4 | 1.5 |
| Magenta Toner E | Magenta classified product 1 | Organic-treated fine particles 7 | 1.5 |
| Magenta Toner F | Magenta classified product 1 | Organic-treated fine particles 11 | 1.5 |
| Magenta Toner G | Magenta classified product 1 | Organic-treated fine particles 14 | 1.5 |
| Magenta Toner H | Magenta classified product 1 | Organic-treated fine particles 17 | 1.5 |
| Magenta Toner I | Magenta classified product 1 | Organic-treated fine particles 18 | 1.5 |
| Magenta Toner J | Magenta classified product 1 | Organic-treated fine particles 19 | 1.5 |
| Magenta Toner K | Magenta classified product 1 | Organic-treated fine particles 21 | 1.5 |
| Magenta Toner L | Magenta classified product 1 | Organic-treated fine particles 23 | 1.5 |
| Magenta Toner M | Magenta classified product 1 | Organic-treated fine particles 24 | 1.5 |
| Magenta Toner N | Magenta classified product 1 | Organic-treated fine particles 25 | 1.5 |
| Magenta Toner O | Magenta classified product 1 | Organic-treated fine particles 26 | 1.5 |
| Cyan Toner A | Cyan classified product 1 | Organic-treated fine particles 1 | 1.5 |
| Yellow Toner A | Yellow classified product 1 | Organic-treated fine particles 1 | 1.5 |
| Black Toner A | Black classified product 1 | Organic-treated fine particles 1 | 1.5 |
| Magenta Toner P | Magenta classified product 4 | Organic-treated fine particles 4 | 1.5 |
| Cyan Toner B | Cyan classified product 4 | Organic-treated fine particles 4 | 1.5 |
| Yellow Toner B | Yellow classified product 4 | Organic-treated fine particles 4 | 1.5 |
| Black Toner B | Biack classified product 4 | Organic-treated fine particles 4 | 1.5 |
| Magenta Toner Q | Magenta classified product 5 | Organic-treated fine particles 1 | 1.5 |
| Cyan Toner C | Cyan classified product 5 | Organic-treated fine particles 11 | 1.5 |
| Yellow Toner C | Yellow classified product 5 | Organic-treated fine particles 11 | 1.5 |
| Black Toner C | Black classified product 5 | Organic-treated fine particles 11 | 1.5 |
| Black Toner D | Black classified product 6 | Organic-treated fine particles 11 | 1.5 |

TABLE 14(A)

| | | 23° C./60% RH | | | | | | | |
|---|---|---|---|---|---|---|---|---|---|
| | | Initial stage | | | | 1,000th sheet | | | |
| | Toner | Image density | Fog | Spots around line images | Toner melt-adhesion, sticking | Image density | Fog | Spots around line images | Toner melt-adhesion, sticking |
| Example: | | | | | | | | | |
| 24 | Magenta A | 1.83 | 3.5% | A | A | 1.80 | 3.0% | A | A |
| 25 | Magenta D | 1.73 | 3.8% | A | A | 1.70 | 3.3% | A | A |
| 26 | Magenta E | 1.80 | 4.0% | A | A | 1.75 | 3.6% | A | A |
| 27 | Magenta F | 1.75 | 4.2% | A | A | 1.73 | 4.0% | A | A |
| 28 | Magenta G | 1.75 | 3.6% | A | A | 1.70 | 3.3% | A | A |
| 29 | Magenta H | 1.81 | 4.2% | A | A | 1.78 | 4.0% | A | A |
| 30 | Magenta I | 1.80 | 4.4% | A | A | 1.72 | 3.8% | A | A |
| 31 | Magenta J | 1.85 | 3.2% | A | A | 1.80 | 3.0% | A | A |
| 32 | Magenta K | 1.70 | 4.5% | A | A | 1.71 | 4.0% | A | A |
| 36 | Black D | 1.68 | 3.9% | A | A | 1.67 | 3.6% | A | A |
| 37 | Black D | 1.68 | 4.0% | A | A | 1.68 | 4.0% | A | A |
| 38 | Black D | 1.68 | 3.8% | A | A | 1.67 | 3.8% | A | A |
| Comparative Example: | | | | | | | | | |
| 11 | Magenta B | 1.76 | 4.2% | A | A | 1.73 | 4.2% | A | A |
| 12 | Magenta C | 1.73 | 4.9% | B | A | 1.70 | 4.8% | B | A |
| 13 | Magenta L | 1.68 | 3.7% | B | A | 1.70 | 3.6% | A | A |
| 14 | Magenta M | 1.58 | 4.2% | B | A | 1.60 | 3.8% | B | A |
| 15 | Magenta N | 1.60 | 4.6% | B | A | 1.62 | 3.8% | B | A |
| 16 | Magenta O | 1.62 | 4.8% | B | A | 1.65 | 3.9% | A | A |

TABLE 14(B)

| | | 23° C./60% RH | | | | | | | |
|---|---|---|---|---|---|---|---|---|---|
| | | Initial stage | | | | 1,000th sheet | | | |
| | Toner | Image density | Fog | Spots around line images | Toner melt-adhesion, sticking | Image density | Fog | Spots around line images | Toner melt-adhesion, sticking |
| Example: | | | | | | | | | |
| 24 | Magenta A | 1.80 | 3.1% | A | A | 1.78 | 3.0% | A | A |
| 25 | Magenta D | 1.71 | 3.2% | A | A | 1.70 | 3.3% | A | A |
| 26 | Magenta E | 1.75 | 3.7% | A | A | 1.75 | 3.6% | A | A |
| 27 | Magenta F | 1.71 | 4.2% | A | A | 1.70 | 4.0% | A | A |
| 28 | Magenta G | 1.71 | 3.5% | A | A | 1.73 | 4.0% | A | A |
| 29 | Magenta H | 1.75 | 4.3% | A | A | 1.73 | 3.7% | A | A |
| 30 | Magenta I | 1.70 | 3.8% | A | A | 1.73 | 4.0% | A | A |
| 31 | Magenta J | 1.82 | 2.9% | A | A | 1.81 | 3.1% | A | A |
| 32 | Magenta K | 1.70 | 3.7% | A | A | 1.72 | 3.6% | A | A |
| 36 | Black D | 1.66 | 3.7% | A | A | 1.65 | 3.6% | A | A |
| 37 | Black D | 1.68 | 3.6% | A | A | 1.67 | 3.8% | A | A |
| 38 | Black D | 1.67 | 3.7% | A | A | 1.66 | 3.7% | A | A |
| Comparative Example: | | | | | | | | | |
| 1 | Magenta B | 1.70 | 4.4% | A | B** | 1.70 | 4.8% | A | B* |
| 2 | Magenta C | 1.70 | 4.7% | A | A | 1.70 | 4.6% | B | A |
| 3 | Magenta L | 1.70 | 4.2% | A | A | 1.69 | 4.8% | A | B** |
| 4 | Magenta M | 1.62 | 3.7% | A | A | 1.60 | 3.6% | A | A |
| 5 | Magenta N | 1.65 | 4.3% | A | A | 1.66 | 5.1% | A | A |
| 6 | Magenta O | 1.67 | 4.5% | A | A | 1.66 | 4.8% | A | B** |

*Toner remains melt-adhered
**Toner remains stuck

TABLE 15(A)

| | | 30° C./80% RH | | | | | | | | | | | |
|---|---|---|---|---|---|---|---|---|---|---|---|---|---|
| | | After 10 day leaving before start | | | | | | | | | | | |
| | | Initial stage | | | | 1,000th sheet | | | | 2,000th sheet | | | |
| | Toner | Image density | Fog (%) | Spots around line images | (1) | Image density | Fog (%) | Spots around line images | (1) | Image density | Fog (%) | Spots around line images | (1) |
| Example: | | | | | | | | | | | | | |
| 24 | Magenta A | 1.86 | 5.0 | A | A | 1.86 | 4.8 | A | A | 1.85 | 3.9 | A | A |
| 25 | Magenta D | 1.75 | 5.1 | A | A | 1.74 | 5.0 | A | A | 1.75 | 4.3 | A | A |
| 26 | Magenta E | 1.82 | 5.0 | A | A | 1.80 | 4.1 | A | A | 1.82 | 4.0 | A | A |
| 27 | Magenta F | 1.76 | 5.3 | A | A | 1.77 | 5.0 | A | A | 1.74 | 4.2 | A | A |
| 28 | Magenta G | 1.76 | 6.1 | A | A | 1.76 | 5.2 | A | A | 1.75 | 5.0 | A | A |
| 29 | Magenta H | 1.82 | 5.7 | A | A | 1.80 | 5.0 | A | A | 1.80 | 4.8 | A | A |
| 30 | Magenta I | 1.82 | 5.8 | A | A | 1.82 | 5.0 | A | A | 1.80 | 4.3 | A | A |
| 31 | Magenta J | 1.85 | 4.9 | A | A | 1.84 | 4.5 | A | A | 1.85 | 3.8 | A | A |
| 32 | Magenta K | 1.72 | 5.2 | A | A | 1.72 | 4.7 | A | A | 1.73 | 4.0 | A | A |
| 36 | Black D | 1.67 | 4.1 | A | A | 1.66 | 4.3 | A | A | 1.69 | 4.3 | A | A |
| 37 | Black D | 1.68 | 4.6 | A | A | 1.70 | 4.4 | A | A | 1.66 | 4.3 | A | A |
| 38 | Black D | 1.66 | 3.9 | A | A | 1.65 | 4.0 | A | A | 1.67 | 4.2 | A | A |
| Comparative Example: | | | | | | | | | | | | | |
| 11 | Magenta B | 1.72 | 12.7 | B | A | 1.72 | 10.9 | B | A | 1.70 | 11.8 | B* | B |
| 12 | Magenta C | 1.72 | 13.8 | B | A | 1.70 | 12.1 | B | A | 1.70 | 12.2 | B | A |
| 13 | Magenta L | 1.62 | 8.5 | B | A | 1.60 | 7.8 | B | A | 1.63 | 6.3 | A | A |
| 14 | Magenta M | 1.58 | 9.3 | B | A | 1.59 | 6.8 | B | A | 1.62 | 5.9 | A | A |
| 15 | Magenta N | 1.61 | 7.8 | B | A | 1.63 | 6.2 | B | A | 1.64 | 5.3 | A | A |

TABLE 15(A)-continued

| | | 30° C./80% RH | | | | | | | | | | | |
|---|---|---|---|---|---|---|---|---|---|---|---|---|---|
| | | After 10 day leaving before start | | | | | | | | | | | |
| | | Initial stage | | | | 1,000th sheet | | | | 2,000th sheet | | | |
| | Toner | Image density | Fog (%) | Spots around line images | (1) | Image density | Fog (%) | Spots around line images | (1) | Image density | Fog (%) | Spots around line images | (1) |
| 16 | Magenta O | 1.56 | 8.8 | B | A | 1.58 | 6.1 | B | A | 1.61 | 5.4 | A | A |

(1): Toner melt-adhesion or sticking
*Toner remains melt-adhered
**Toner remains stuck

TABLE 15(B)

| | | 30° C./80% RH | | | | | | | |
|---|---|---|---|---|---|---|---|---|---|
| | | After 10 day leaving after 2,000 sheet running | | | | | | | |
| | | When again started | | | | 3,000th sheet | | | |
| | Toner | Image density | Fog (%) | Spots around line images | Toner melt-adhesion, sticking | Image density | Fog (%) | Spots around line images | Toner melt-adhesion, sticking |
| Example: | | | | | | | | | |
| 24 | Magenta A | 1.80 | 5.0 | A | A | 1.80 | 3.8 | A | A |
| 25 | Magenta D | 1.74 | 4.9 | A | A | 1.77 | 4.0 | A | A |
| 26 | Magenta E | 1.80 | 4.4 | A | A | 1.82 | 4.0 | A | A |
| 27 | Magenta F | 1.74 | 4.4 | A | A | 1.76 | 4.0 | A | A |
| 28 | Magenta G | 1.73 | 5.4 | A | A | 1.75 | 5.0 | A | A |
| 29 | Magenta H | 1.80 | 4.9 | A | A | 1.80 | 4.2 | A | A |
| 30 | Magenta I | 1.80 | 4.8 | A | A | 1.82 | 4.4 | A | A |
| 31 | Magenta J | 1.82 | 4.6 | A | A | 1.86 | 3.9 | A | A |
| 32 | Magenta K | 1.70 | 5.7 | A | A | 1.73 | 4.3 | A | A |
| 36 | Black D | 1.68 | 4.9 | A | A | 1.66 | 4.8 | A | A |
| 37 | Black D | 1.70 | 3.9 | A | A | 1.69 | 4.2 | A | A |
| 38 | Black D | 1.70 | 4.2 | A | A | 1.70 | 4.3 | A | A |
| Comparative Example: | | | | | | | | | |
| 11 | Magenta B | 1.70 | 15.9 | C | B* | 1.69 | 13.1 | B | C* |
| 12 | Magenta C | 1.69 | 15.2 | C | A | 1.72 | 13.8 | B | A |
| 13 | Magenta L | 1.60 | 12.5 | B | A | 1.62 | 8.3 | B | B** |
| 14 | Magenta M | 1.58 | 13.6 | B | A | 1.60 | 7.7 | B | B** |
| 15 | Magenta N | 1.54 | 14.1 | B | A | 1.59 | 9.3 | B | B** |
| 16 | Magenta O | 1.57 | 12.8 | B | A | 1.59 | 8.7 | B | B** |

*Toner remains melt-adhered
**Toner remains stuck

TABLE 16

| Particles to be treated | Composition | Production process | Crystal form | BET specific surface area ($m^2/g$) | Primary particle diameter ($\mu m$) |
|---|---|---|---|---|---|
| A | $TiO_2$ | Sulfuric acid process | Rutile | 90 | 0.018 |
| C | $TiO_2$ | Sulfuric acid process | Anatase | 120 | 0.018 |
| D | $TiO_2$ | Low-temperature oxidation of titanium alkoxide | Amorphous | 140 | 0.017 |
| G | $Al_2O_3$ | Thermal decomposition | Gamma form | 205 | 0.013 |

TABLE 17

| [A] | [1] | Treating method | Treating agent 1 | Treating agent 2 | Diluent etc. | Order of treatment w.(1)&(2) |
|---|---|---|---|---|---|---|
| 1 | A | SV 1 | i-Butyltrimethoxysilane (10 pbw) | Dimethylsilicone 50 $mm^2/s$ (10 pbw) | — | Simultaneous |
| 2 | A | SV 1 | i-Butyltrimethoxysilane (10 pbw) | — | — | (1) |
| 3 | A | SV 1 | — | Dimethylsilicone 50 $mm^2/s$ (10 pbw) | — | (1)→(2) |
| 28 | C | AQ 1 | n-Propyltrimethoxysilane (15 pbw) | — | — | (1) |
| 29 | 28 | SV 1 | — | Fluorine-modified silicone 100 $mm^2/s$ (10 pbw) | — | (1)→(2) |
| 30 | D | GP 2 | n-Butyltrimethoxysilane (10 pbw) | Dimethylsilicone 10 $mm^2/s$ (20 pbw) | — | Simultaneous |
| 31 | G | GP 1 | Dimethyldimethoxysilane (10 pbw) | Dimethylsilicone 20 $mm^2/s$ (10 pbw) | n-Hexane (30 pbw) | Simultaneous |
| 21 | A | GP 1 | i-Butyltrimethoxysilane (10 pbw) | Dimethylsilicone 50 $mm^2/s$ (10 pbw) | n-Hexane (10 pbw) | Simultaneous |
| 22 | A | GP 3 | i-Butyltrimethoxysilane (10 pbw) | — | — | (1) |
| 23 | 22 | GP 3 | — | Dimethylsilicone 50 $mm^2/s$ (10 pbw) | n-Hexane (10 pbw) | (1)→(2) |
| 24 | A | SV 2 | i-Butyltrimethoxysilane (10 pbw) | Dimethylsilicone 50 $mm^2/s$ (10 pbw) | — | Simultaneous |
| 25 | A | SV 1 | Dimethyldichlorosilane (10 pbw) | Dimethylsilicone 50 $mm^2/s$ (10 pbw) | — | Simultaneous |
| 26 | A | GP 1 | Dimethyldichlorosilane (10 pbw) | Dimethylsilicone 50 $mm^2/s$ (10 pbw) | n-Hexane (10 pbw) | Simultaneous |

[A]: Organic-treated fine particles;
[1]: Particles to be treated
SV: Solvent method;
GP: Gaseous phase method;
AQ: Aqueous method
(1): Treating agent 1;
(2): Treating agent 2

TABLE 18

| Organic = treated fine particles | Methanol wettability half value (%) | Methanol wettability end point (%) | Methanol hydrophobicity (%) | Moisture content (wt. %) | Average particle diameter (μm) |
|---|---|---|---|---|---|
| 1 | 70 | 75 | 80 | 0.93 | 0.021 |
| 2 | 51 | 55 | 58 | 1.68 | 0.019 |
| 3 | 53 | 73 | 75 | 1.17 | 0.020 |
| 28 | 47 | 54 | 56 | 2.42 | 0.019 |
| 29 | 68 | 77 | 79 | 1.20 | 0.021 |
| 30 | 72 | 80 | 82 | 0.85 | 0.018 |
| 31 | 74 | 81 | 83 | 0.36 | 0.015 |
| 21 | 66 | 70 | 72 | 0.62 | 0.025 |
| 22 | 49 | 60 | 62 | 0.81 | 0.025 |
| 23 | 51 | 68 | 70 | 0.51 | 0.028 |
| 24 | 52 | 73 | 77 | 1.34 | 0.024 |
| 25 | 50 | 69 | 70 | 1.22 | 0.023 |
| 26 | 52 | 72 | 76 | 0.54 | 0.027 |

TABLE 19

| Organic-treated fine particles | Specific surface area ($m^2/g$) | Bulk density ($g/cm^3$) |
|---|---|---|
| 1 | 33 | 0.25 |
| 2 | 85 | 0.23 |
| 3 | 48 | 0.17 |
| 28 | 102 | 0.12 |
| 29 | 56 | 0.18 |
| 30 | 66 | 0.12 |
| 31 | 135 | 0.09 |
| 21 | 25 | 0.33 |
| 22 | 28 | 0.28 |
| 23 | 19 | 0.40 |
| 24 | 30 | 0.31 |
| 25 | 27 | 0.28 |
| 26 | 21 | 0.43 |

TABLE 20

| Toner | Classified product | Organic-treated fine particles | Amount (pbw) |
|---|---|---|---|
| Cyan Toner 51 | Cyan classified product 1 | Organic-treated fine particles 1 | 1.5 |
| Magenta Toner 51 | Magenta classified product 1 | Organic-treated fine particles 1 | 1.5 |
| Yellow Toner 51 | Yellow classified product 1 | Organic-treated fine particles 1 | 1.5 |
| Black Toner 51 | Black classified product 1 | Organic-treated fine particles 1 | 1.5 |
| Cyan Toner 52 | Cyan classified product 1 | Organic-treated fine particles 2 | 1.5 |
| Magenta Toner 52 | Magenta classified product 1 | Organic-treated fine particles 2 | 1.5 |
| Yellow Toner 52 | Yellow classified product 1 | Organic-treated fine particles 2 | 1.5 |
| Black Toner 52 | Black classified product 1 | Organic-treated fine particles 2 | 1.5 |
| Cyan Toner 53 | Cyan classified product 1 | Organic-treated fine particles 3 | 1.5 |
| Magenta Toner 53 | Magenta classified product 1 | Organic-treated fine particles 3 | 1.5 |
| Yellow Toner 53 | Yellow classified product 1 | Organic-treated fine particles 3 | 1.5 |
| Black Toner 53 | Black classified product 1 | Organic-treated fine particles 3 | 1.5 |
| Cyan Toner 54 | Cyan classified product 1 | Organic-treated fine particles 28 | 1.5 |
| Magenta Toner 54 | Magenta classified product 1 | Organic-treated fine particles 28 | 1.5 |
| Yellow Toner 54 | Yellow classified product 1 | Organic-treated fine particles 28 | 1.5 |
| Black Toner 54 | Black classified product 1 | Organic-treated fine particles 28 | 1.5 |
| Cyan Toner 55 | Cyan classified product 1 | Organic-treated fine particles 29 | 1.5 |
| Magenta Toner 55 | Magenta classified product 1 | Organic-treated fine particles 29 | 1.5 |
| Yellow Toner 55 | Yellow classified product 1 | Organic-treated fine particles 29 | 1.5 |
| Black Toner 55 | Black classified product 1 | Organic-treated fine particles 29 | 1.5 |
| Cyan Toner 56 | Cyan classified product 1 | Organic-treated fine particles 30 | 1.5 |
| Magenta Toner 56 | Magenta classified product 1 | Organic-treated fine particles 30 | 1.5 |
| Yellow Toner 56 | Yellow classified product 1 | Organic-treated fine particles 30 | 1.5 |
| Black Toner 56 | Black classified product 1 | Organic-treated fine particles 30 | 1.5 |
| Cyan Toner 57 | Cyan classified product 1 | Organic-treated fine particles 31 | 1.5 |
| Magenta Toner 57 | Magenta classified product 1 | Organic-treated fine particles 31 | 1.5 |
| Yellow Toner 57 | Yellow classified product 1 | Organic-treated fine particles 31 | 1.5 |
| Black Toner 57 | Black classified product 1 | Organic-treated fine particles 31 | 1.5 |
| Cyan Toner 58 | Cyan classified product 1 | Organic-treated fine particles 21 | 1.5 |
| Magenta Toner 58 | Magenta classified product 1 | Organic-treated fine particles 21 | 1.5 |
| Yellow Toner 58 | Yellow classified product 1 | Organic-treated fine particles 21 | 1.5 |
| Black Toner 58 | Black classified product 1 | Organic-treated fine particles 21 | 1.5 |
| Cyan Toner 59 | Cyan classified product 1 | Organic-treated fine particles 22 | 1.5 |
| Magenta Toner 59 | Magenta classified product 1 | Organic-treated fine particles 22 | 1.5 |
| Yellow Toner 59 | Yellow classified product 1 | Organic-treated fine particles 22 | 1.5 |
| Black Toner 59 | Black classified product 1 | Organic-treated fine particles 22 | 1.5 |
| Cyan Toner 60 | Cyan classified product 1 | Organic-treated fine particles 23 | 1.5 |
| Magenta Toner 60 | Magenta classified product 1 | Organic-treated fine particles 23 | 1.5 |
| Yellow Toner 60 | Yellow classified product 1 | Organic-treated fine particles 23 | 1.5 |
| Black Toner 60 | Black classified product 1 | Organic-treated fine particles 23 | 1.5 |
| Cyan Toner 61 | Cyan classified product 1 | Organic-treated fine particles 24 | 1.5 |
| Magenta Toner 61 | Magenta classified product 1 | Organic-treated fine particles 24 | 1.5 |
| Yellow Toner 61 | Yellow classified product 1 | Organic-treated fine particles 24 | 1.5 |
| Black Toner 61 | Black classified product 1 | Organic-treated fine particles 24 | 1.5 |
| Cyan Toner 62 | Cyan classified product 1 | Organic-treated fine particles 25 | 1.5 |
| Magenta Toner 62 | Magenta classified product 1 | Organic-treated fine particles 25 | 1.5 |
| Yellow Toner 62 | Yellow classified product 1 | Organic-treated fine particles 25 | 1.5 |
| Black Toner 62 | Black classified product 1 | Organic-treated fine particles 25 | 1.5 |
| Cyan Toner 63 | Cyan classified product 1 | Organic-treated fine particles 26 | 1.5 |
| Magenta Toner 63 | Magenta classified product 1 | Organic-treated fine particles 26 | 1.5 |
| Yellow Toner 63 | Yellow classified product 1 | Organic-treated fine particles 26 | 1.5 |
| Black Toner 63 | Black classified product 1 | Organic-treated fine particles 26 | 1.5 |
| Cyan Toner 64 | Cyan classified product 3 | Organic-treated fine particles 29 | 1.5 |
| Magenta Toner 64 | Magenta classified product 3 | Organic-treated fine particles 29 | 1.5 |
| Yellow Toner 64 | Yellow classified product 3 | Organic-treated fine particles 29 | 1.5 |
| Black Toner 64 | Black classified product 3 | Organic-treated fine particles 29 | 1.5 |
| Cyan Toner 65 | Cyan classified product 4 | Organic-treated fine particles 30 | 1.2 |
| Magenta Toner 65 | Magenta classified product 4 | Organic-treated fine particles 30 | 1.2 |
| Yellow Toner 65 | Yellow classified product 4 | Organic-treated fine particles 30 | 1.2 |
| Black Toner 65 | Black classified product 4 | Organic-treated fine particles 30 | 1.2 |
| Cyan Toner 66 | Cyan classified product 5 | Organic-treated fine particles 31 | 1.2 |
| Magenta Toner 66 | Magenta classified product 5 | Organic-treated fine particles 31 | 1.2 |
| Yellow Toner 66 | Yellow classified product 5 | Organic-treated fine particles 31 | 1.2 |
| Black Toner 66 | Black classified product 6 | Organic-treated fine particles 31 | 1.2 |

TABLE 21

| | Group of toners | Initial stage Image density C | M | Y | Bk | Fog | 10,000th sheet Image density C | M | Y | Bk | Fog | (1) | (2) | (3) |
|---|---|---|---|---|---|---|---|---|---|---|---|---|---|---|
| Example: | | | | | | | | | | | | | | |
| 39 | Toners 51 | 1.78 | 1.76 | 1.77 | 1.79 | 0.9 | 1.80 | 1.79 | 1.80 | 1.77 | 1.1 | A | A | No |
| 40 | Toners 55 | 1.75 | 1.76 | 1.74 | 1.75 | 1.0 | 1.78 | 1.80 | 1.79 | 1.77 | 1.2 | A | A | No |
| 41 | Toners 56 | 1.81 | 1.83 | 1.82 | 1.83 | 0.8 | 1.82 | 1.84 | 1.81 | 1.83 | 0.9 | A | A | No |
| 42 | Toners 57 | 1.72 | 1.73 | 1.70 | 1.74 | 1.1 | 1.77 | 1.75 | 1.74 | 1.75 | 1.0 | A | A | No |
| 43 | Toners 58 | 1.70 | 1.71 | 1.72 | 1.71 | 1.0 | 1.71 | 1.72 | 1.73 | 1.72 | 1.0 | A | B | No |
| 44 | Toners 64 | 1.79 | 1.77 | 1.78 | 1.75 | 1.0 | 1.81 | 1.77 | 1.81 | 1.80 | 1.2 | A | A | No |
| 45 | Toners 65 | 1.76 | 1.78 | 1.79 | 1.77 | 1.2 | 1.79 | 1.79 | 1.79 | 1.79 | 1.1 | A | A | No |
| 46 | Toners 66 | 1.72 | 1.75 | 1.73 | 1.71 | 1.4 | 1.75 | 1.74 | 1.77 | 1.72 | 1.3 | A | A | No |
| 47 | Toners 51 | 1.79 | 1.77 | 1.79 | 1.79 | 1.0 | 1.77 | 1.79 | 1.74 | 1.79 | 1.2 | B | B | No |
| Comparative Example: | | | | | | | | | | | | | | |
| 17 | Toners 52 | 1.78 | 1.79 | 1.77 | 1.76 | 1.7 | 1.80 | 1.81 | 1.79 | 1.79 | 1.4 | D | C | Yes |
| 18 | Toners 53 | 1.68 | 1.69 | 1.66 | 1.65 | 1.3 | 1.62 | 1.60 | 1.59 | 1.58 | 1.8 | C | D | No |
| 19 | Toners 54 | 1.59 | 1.60 | 1.62 | 1.57 | 1.8 | 1.62 | 1.63 | 1.65 | 1.60 | 1.6 | D | C | Yes |
| 20 | Toners 59 | 1.62 | 1.61 | 1.63 | 1.60 | 1.7 | 1.64 | 1.65 | 1.63 | 1.62 | 1.7 | C | D | Yes |
| 21 | Toners 60 | 1.63 | 1.64 | 1.63 | 1.62 | 1.6 | 1.64 | 1.65 | 1.62 | 1.62 | 1.1 | D | B | No |
| 22 | Toners 61 | 1.59 | 1.60 | 1.61 | 1.60 | 1.5 | 1.62 | 1.62 | 1.63 | 1.60 | 1.2 | C | C | No |
| 23 | Toners 62 | 1.61 | 1.62 | 1.63 | 1.61 | 1.6 | 1.65 | 1.62 | 1.60 | 1.64 | 1.3 | B | C | No |
| 24 | Toners 63 | 1.68 | 1.62 | 1.60 | 1.64 | 1.7 | 1.69 | 1.65 | 1.63 | 1.61 | 1.4 | D | B | No |

C: Cyan;
M: Magenta;
Y: Yellow;
Bk: Black
(1): Faulty images caused by photosensitive member
(2): Faulty images caused by charging member
(3): Faulty cleaning (occurred or not)

TABLE 22

| | Group of toners | Toner scatter during fixing |
|---|---|---|
| Example: | | |
| 48 | Toners 51 | A |
| 49 | Toners 64 | A |
| 50 | Toners 65 | B |
| 51 | Toners 66 | B |
| Comparative Example: | | |
| 25 | Toners 52 | D |
| 26 | Toners 53 | C |
| 27 | Toners 54 | D |

TABLE 22-continued

| | Group of toners | Toner scatter during fixing |
|---|---|---|
| 28 | Toners 59 | D |
| 29 | Toners 60 | B |
| 30 | Toners 61 | B |
| 31 | Toners 62 | B |
| 32 | Toners 63 | B |

TABLE 23

| Particles to be treated | Composition | Production process | Crystal form | BET specific surface area ($m^2/g$) | Primary particle diameter ($\mu m$) |
|---|---|---|---|---|---|
| A | $TiO_2$ | Sulfuric acid process | Rutile | 90 | 0.018 |
| B | $TiO_2$ | Sulfuric acid process | Anatase | 120 | 0.018 |
| C | $TiO_2$ | Low-temperature oxidation of titanium alkoxide | Amorphous | 140 | 0.017 |
| D | $Al_2O_3$ | Flame decomposition | Delta form | 95 | 0.013 |

TABLE 24

| [A] | [1] | Treating method | Treating agent | Treating agent 2 | Treating agent 3 | Treating agent 4, Diluent etc. | Order of treatment w.(1)–(4) |
|---|---|---|---|---|---|---|---|
| 32 | A | SV 3 | n-Amyltriethoxysilane (10 pbw) | DMS 50 $mm^2/s$ (10 pbw) | γ-APETES (0.5 pbw) | — | Simultaneous |
| 33 | A | SV 3 | n-Amyltriethoxysilane (10 pbw) | DMS 50 $mm^2/s$ (10 pbw) | — | — | Simultaneous |
| 34 | A | SV 3 | — | DMS · 50 $mm^2/s$ (10 pbw) | γ-APETES (0.5 pbw) | — | Simultaneous |
| 35 | A | SV 3 | n-Amyltriethoxysilane (10 pbw) | — | γ-APETES (0.5 pbw) | — | Simultaneous |
| 36 | A | SV 3 | n-Butyltrimethoxysilane (10 pbw) | DMS 200 $mm^2/s$ (7 pbw) | AMS(*A) 90 $mm^2/s$ (3 pbw) | — | Simultaneous |
| 37 | A | SV 3 | n-Dodecyltriethoxysilane (10 pbw) | FMS 100 $mm^2/s$ (8 pbw) | γ-APMDMS (1.5 pbw) | AMS(*B) 1,200 $mm^2/s$ (2 pbw) | Simultaneous |
| 38 | B | AQ 2 | n-Propyltrimethoxysilane (15 pbw) | — | — | — | (1) |
| 39 | 38 | SV 3 | — | DMS 100 $mm^2/s$ (10 pbw) | Silane*1 (0.7 pbw) | — | (1)→[(2) (3) |
| 40 | C | GP 5 | Diethyldiethoxysilane (10 pbw) | MPS 15 $mm^2/s$ (20 pbw) | Siloxane*1 (1 pbw) | — | Simultaneous |
| 41 | B | GP 4 | Ethylmethyldimethoxysilane (5 pbw) | DMS 20 $mm^2/s$ (20 pbw) | AAMS(*c) 70 $mm^2/s$ (1 pbw) | n-Hexane (10 pbw) | Simultaneous |
| 42 | D | GP 4 | Hexamethyldisiloxane (20 pbw) | DMS 100 $mm^2/s$ (5 pbw) | Silane*2 (0.5 pbw) | n-Hexane (20 pbw) | Simultaneous |
| 43 | C | GP 5 | Dimethyldichlorosilane (17 pbw) | — | — | — | (1) |
| 44 | 43 | SV 3 | — | DMS 1000 $mm^2/s$ (12 pbw) | Silane*3 (1 pbw) | — | (1)→[(2) (3) |

| [A] | [1] | Treating method | Treating agent 1 | Treating agent 2 | Treating agent 3 | Treating agent 4, Diluent etc. | Order of treatment w.(1)&(2) |
|---|---|---|---|---|---|---|---|
| 45 | C | GP 5 | Dimethydimethoxysilane (10 pbw) | DMS 10 $mm^2/s$ (18 pbw) | AMS(*D) 30 $mm^2/s$ (2 pbw) | — | Simultaneous |
| 46 | B | SV 3 | Phenyltrimethoxysilane (10 pbw) | DMS 500 $mm^2/s$ (15 pbw) | Silane*4 (1 pbw) | — | Simultaneous |
| 47 | A | SV 3 | i-Butyltrimethoxysilane (7 pbw) | DMS 50 $mm^2/s$ (10 pbw) | Silane*5 (3 pbw) | — | Simultaneous |
| 48 | A | SV 3 | n-Butyltrimethoxysilane (5 pbw) | DMS 50 $mm^2/s$ (10 pbw) | AMS(*E) 60 $mm^2/s$ (5 pbw) | — | Simultaneous |

[A]: Organic-treated fine particles;
[1]: Particles to be treated
SV: Solvent method;
GP: Gaseous phase method;
AQ: Aqueous method
(1): Treating agent 1;
(2): Treating agent 2
DMS: Dimethylsilicone;
APTES: Aminopropyltriethoxysilane;
AMS: Amino-modified silicone
FMS: Fluorine-modified silicone;
APMDMS: Aminopropylmethyldimethoxysilane
MPS: Methylphenylsilicone;
AAMS: Amino-modified alkoxy-modified silicone
Silane*1: N-phenyl-γ-aminopropyltrimethoxysilane
Siloxane*1: Bis(γ-aminopropyltetramethyldisiloxane
Silane*2: N-(p-aminoethyl)-γ-aminopropyltrimethoxysilane
Silane*3: N-(p-aminoethyl)-γ-aminopropylmethyldimethoxysilane
Silane*4: N-dimethyl-γ-aminopropyltrimethoxysilane
Silane*5: N-dibutyl-γ-aminopropyltrimethoxysilane
(*A): Side-chain type, —$RNH_2$ type; amine equivalent weight of 4,400
(*B): Side-chain type, —RNH—$R'NH_2$ type; amine equivalent weight of 1,100
(*C): Both-terminal side-chain type, —OMe, —RNH—$R'NH_2$ type; amine equivalent weight of 830
(*D): Both-terminal type, —$R'NH_2$ type; amine equivalent weight of 840
(*E): Side-chain type, —RH—$R'NH_2$ type; amine equivalent weight of 360

TABLE 25

| Organic = treated fine particles | Methanol wettability half value (%) | Methanol wettability end point (%) | Methanol hydro-phobicity (%) | Moisture content (wt. %) | Average particle diameter (μm) |
|---|---|---|---|---|---|
| 32 | 68 | 75 | 77 | 1.14 | 0.021 |
| 33 | 71 | 76 | 79 | 0.95 | 0.021 |
| 34 | 53 | 76 | 77 | 1.07 | 0.021 |
| 35 | 49 | 52 | 55 | 1.27 | 0.020 |
| 36 | 70 | 77 | 79 | 0.98 | 0.023 |
| 37 | 64 | 70 | 74 | 1.06 | 0.024 |
| 38 | 47 | 53 | 56 | 1.68 | 0.019 |
| 39 | 64 | 71 | 75 | 1.12 | 0.020 |
| 40 | 71 | 78 | 81 | 0.85 | 0.019 |
| 41 | 70 | 78 | 79 | 0.78 | 0.024 |
| 42 | 76 | 81 | 83 | 0.54 | 0.017 |
| 43 | 47 | 50 | 54 | 3.24 | 0.019 |
| 44 | 65 | 69 | 71 | 1.74 | 0.020 |
| 45 | 63 | 68 | 69 | 0.79 | 0.020 |
| 46 | 68 | 74 | 76 | 1.38 | 0.019 |
| 47 | 69 | 77 | 78 | 1.21 | 0.022 |
| 48 | 66 | 73 | 75 | 1.19 | 0.022 |

TABLE 26

| Organic = treated fine particles | Specific surface area ($m^2/g$) | Bulk density ($g/cm^3$) | Quantity of tribo-elec-tricity (mC/kg) |
|---|---|---|---|
| 32 | 35 | 0.26 | −36 |
| 33 | 34 | 0.25 | −52 |
| 34 | 36 | 0.25 | −31 |
| 35 | 81 | 0.21 | −26 |
| 36 | 31 | 0.28 | −39 |
| 37 | 33 | 0.27 | −30 |
| 38 | 101 | 0.11 | −23 |
| 39 | 49 | 0.18 | −24 |
| 40 | 68 | 0.14 | −34 |
| 41 | 29 | 0.31 | −41 |
| 42 | 59 | 0.08 | −18 |
| 43 | 124 | 0.07 | −51 |
| 44 | 50 | 0.17 | −29 |
| 45 | 68 | 0.13 | −22 |
| 46 | 42 | 0.20 | −39 |
| 47 | 37 | 0.24 | +25 |
| 48 | 34 | 0.26 | +18 |

TABLE 27

| Tone | Classified product | Organic-treated fine particles | Amount (pbw) |
|---|---|---|---|
| Cyan Toner 71 | Cyan classified product 7 | Organic-treated fine particles 32 | 1.5 |
| Cyan Toner 72 | Cyan classified product 7 | Organic-treated fine particles 33 | 1.5 |
| Cyan Toner 73 | Cyan classified product 7 | Organic-treated fine particles 34 | 1.5 |
| Cyan Toner 74 | Cyan classified product 7 | Organic-treated fine particles 35 | 1.5 |
| Cyan Toner 75 | Cyan classified product 7 | Organic-treated fine particles 36 | 1.5 |
| Cyan Toner 76 | Cyan classified product 7 | Organic-treated fine particles 37 | 1.5 |
| Cyan Toner 77 | Cyan classified product 7 | Organic-treated fine particles 38 | 1.5 |
| Cyan Toner 78 | Cyan classified product 7 | Organic-treated fine particles 39 | 1.5 |
| Cyan Toner 79 | Cyan classified product 7 | Organic-treated fine particles 40 | 1.2 |
| Cyan Toner 80 | Cyan classified product 7 | Organic-treated fine particles 41 | 1.5 |
| Cyan Toner 81 | Cyan classified product 7 | Organic-treated fine particles 42 | 1.2 |
| Cyan Toner 82 | Cyan classified product 7 | Organic-treated fine particles 43 | 1.5 |
| Cyan Toner 83 | Cyan classified product 7 | Organic-treated fine particles 44 | 1.5 |
| Cyan Toner 84 | Cyan classified product 7 | Organic-treated fine particles 45 | 1.5 |
| Cyan Toner 85 | Cyan classified product 7 | Organic-treated fine particles 46 | 1.5 |
| Cyan Toner 86 | Cyan classified product 11 | Organic-treated fine particles 47 | 1.5 |
| Cyan Toner 87 | Cyan classified product 11 | Organic-treated fine particles 48 | 1.5 |
| Magenta Toner 71 | Magenta classified product 7 | Organic-treated fine particles 32 | 1.5 |
| Yellow Toner 71 | Yellow classified product 7 | Organic-treated fine particles 32 | 1.5 |
| Black Toner 71 | Black classified product 7 | Organic-treated fine particles 32 | 1.5 |
| Cyan Toner 88 | Cyan classified product 8 | Organic-treated fine particles 36 | 1.5 |
| Magenta Toner 72 | Magenta classified product 8 | Organic-treated fine particles 36 | 1.5 |
| Yellow Toner 72 | Yellow classified product 8 | Organic-treated fine particles 36 | 1.5 |
| Black Toner 72 | Black classified product 8 | Organic-treated fine particles 36 | 1.5 |
| Cyan Toner 89 | Cyan classified product 9 | Organic-treated fine particles 39 | 1.5 |
| Magenta Toner 73 | Magenta classified product 9 | Organic-treated fine particles 39 | 1.5 |
| Yellow Toner 73 | Yellow classified product 9 | Organic-treated fine particles 39 | 1.5 |
| Black Toner 73 | Black classified product 9 | Organic-treated fine particles 39 | 1.5 |
| Cyan Toner 90 | Cyan classified product 10 | Organic-treated fine particles 45 | 1.2 |
| Magenta Toner 74 | Magenta classified product 10 | Organic-treated fine particles 45 | 1.2 |
| Yellow Toner 74 | Yellow classified product 10 | Organic-treated fine particles 45 | 1.2 |
| Black Toner 74 | Black classified product 10 | Organic-treated fine particles 45 | 1.2 |
| Magenta Toner 75 | Magenta classified product 11 | Organic-treated fine particles 47 | 1.5 |
| Yellow Toner 75 | Yellow classified product 11 | Organic-treated fine particles 47 | 1.5 |
| Black Toner 75 | Black classified product 11 | Organic-treated fine particles 47 | 1.5 |
| Magenta Toner 76 | Magenta classified product 11 | Organic-treated fine particles 48 | 1.5 |

TABLE 27-continued

| Tone | Classified product | Organic-treated fine particles | Amount (pbw) |
|---|---|---|---|
| Yellow Toner 76 | Yellow classified product 11 | Organic-treated fine particles 48 | 1.5 |
| Black Toner 76 | Black classified product 12 | Organic-treated fine particles 48 | 1.5 |

TABLE 28

| | | 15° C./10% RH | | | | | | | | | |
|---|---|---|---|---|---|---|---|---|---|---|---|
| | | Initial stage | | | | 5,000th sheet | | | | 1,000th sheet | |
| | Toner | Image density | Fog | (1) | Gradation | Image density | Fog | (1) | Gradation | Transfer efficiency (%) | Transfer latitude (μA) |
| Example: | | | | | | | | | | | |
| 52 | Cyan 71 | 1.81 | 0.5 | A | A | 1.83 | 0.6 | A | A | 92 | 100–450 |
| 53 | Cyan 72 | 1.81 | 0.5 | A | B | 1.67 | 1.6 | A | C | 90 | 100–425 |
| 54 | Cyan 75 | 1.80 | 0.5 | A | A | 1.81 | 0.7 | A | A | 90 | 100–450 |
| 55 | Cyan 76 | 1.76 | 0.6 | A | A | 1.74 | 0.8 | A | A | 93 | 75–450 |
| 56 | Cyan 78 | 1.73 | 0.6 | A | A | 1.75 | 0.7 | A | A | 89 | 100–425 |
| 57 | Cyan 79 | 1.83 | 0.5 | A | A | 1.85 | 0.6 | A | A | 90 | 100–450 |
| 58 | Cyan 80 | 1.69 | 0.7 | A | A | 1.68 | 0.7 | A | A | 90 | 100–425 |
| 59 | Cyan 81 | 1.71 | 0.7 | A | A | 1.70 | 0.7 | B | A | 88 | 125–400 |
| 60 | Cyan 83 | 1.74 | 0.6 | A | A | 1.76 | 0.9 | A | A | 90 | 100–450 |
| 61 | Cyan 84 | 1.80 | 0.5 | A | A | 1.84 | 0.7 | A | A | 94 | 75–450 |
| 62 | Cyan 85 | 1.78 | 0.6 | A | A | 1.79 | 0.6 | A | A | 91 | 100–425 |
| 63 | Cyan 86 | 1.76 | 0.6 | A | A | 1.77 | 0.7 | A | A | 90 | 100–450 |
| 64 | Cyan 87 | 1.77 | 0.5 | A | A | 1.76 | 0.6 | A | A | 93 | 75–450 |
| Comparative Example: | | | | | | | | | | | |
| 33 | Cyan 73 | 1.81 | 0.5 | A | B | 1.78 | 1.4 | A | B | 89 | 125–400 |
| 34 | Cyan 74 | 1.83 | 0.5 | C | A | 1.84 | 0.6 | D | A | 80 | 200–350 |
| 35 | Cyan 77 | 1.75 | 1.2 | C | A | 1.73 | 0.6 | D | A | 79 | 175–325 |
| 36 | Cyan 82 | 1.80 | 1.4 | C | A | 1.81 | 0.5 | D | A | 81 | 175–350 |

(1): Blank areas caused by poor transfer

TABLE 29

| | | 30° C./80% RH | | | | | | | |
|---|---|---|---|---|---|---|---|---|---|
| | | Initial stage | | | | 5,000th sheet | | | |
| | Toner | Image density | Fog | (1) | Gradation | Image density | Fog | (1) | Gradation |
| Example | | | | | | | | | |
| 52 | Cyan 71 | 1.80 | 0.8 | A | A | 1.81 | 0.6 | A | A |
| 53 | Cyan 72 | 1.81 | 0.8 | A | A | 1.80 | 0.6 | A | A |
| 54 | Cyan 75 | 1.81 | 0.9 | A | A | 1.79 | 0.6 | A | A |
| 55 | Cyan 76 | 1.77 | 1.0 | A | A | 1.78 | 0.7 | A | A |
| 56 | Cyan 78 | 1.70 | 0.8 | A | A | 1.71 | 0.7 | A | A |
| 57 | Cyan 79 | 1.80 | 0.8 | A | A | 1.79 | 0.6 | A | A |
| 58 | Cyan 80 | 1.64 | 0.9 | A | A | 1.65 | 0.6 | A | A |
| 59 | Cyan 81 | 1.70 | 1.2 | A | A | 1.69 | 0.6 | A | A |
| 60 | Cyan 83 | 1.72 | 0.8 | A | A | 1.74. | 0.6 | A | A |
| 61 | Cyan 84 | 1.79 | 0.8 | A | A | 1.78 | 0.6 | A | A |
| 62 | Cyan 85 | 1.78 | 0.8 | A | A | 1.76 | 0.7 | A | A |
| 63 | Cyan 86 | 1.75 | 0.9 | A | A | 1.77 | 0.6 | A | A |
| 64 | Cyan 87 | 1.78 | 0.8 | A | A | 1.79 | 0.7 | A | A |

TABLE 29-continued

| | | 30° C./80% RH | | | | | | | |
|---|---|---|---|---|---|---|---|---|---|
| | | Initial stage | | | | 5,000th sheet | | | |
| | Toner | Image density | Fog | (1) | Gradation | Image density | Fog | (1) | Gradation |
| Comparative Example: | | | | | | | | | |
| 33 | Cyan 73 | 1.78 | 2.1 | A | A | 1.75 | 1.3 | A | A |
| 34 | Cyan 74 | 1.54 | 2.6 | B | B | 1.62 | 1.6 | D | A |
| 35 | Cyan 77 | 1.61 | 2.5 | C | B | 1.64 | 1.7 | D | B |
| 36 | Cyan 82 | 1.59 | 2.3 | C | B | 1.62 | 1.8 | D | B |

(1): Blank areas caused by poor transfer

TABLE 30

| Particles to be treated | Composition | Production process | Crystal form | BET specific surface area ($m^2/g$) | Primary particle diameter ($\mu m$) |
|---|---|---|---|---|---|
| a | $TiO_2$ | Sulfuric acid process | Rutile | 95 | 0.018 |
| b | $TiO_2$ | Chlorine process | Mixed crystal | 40 | 0.022 |
| c | $TiO_2$ | Sulfuric acid process | Anatase | 115 | 0.020 |
| d | $TiO_2$ | Low-temperature oxidation of titanium alkoxide | Amorphous | 130 | 0.019 |
| e | $Al_2O_3$ | Flame decomposition | Delta form | 110 | 0.014 |
| f | $Al_2O_3$ | Thermal decomposition | Gamma form | 125 | 0.013 |
| g | $SiO_2$ | Dry process | Amorphous | 55 | 0.024 |
| h | $SiO_2$ | Dry process | Amorphous | 125 | 0.016 |
| i | $SiO_2$ | Dry process | Amorphous | 210 | 0.012 |
| j | $SiO_2$ | Dry process | Amorphous | 320 | 0.007 |
| k | $SiO_2/Al_2O_3$ | Dry process | Amorphous | 165 | 0.016 |
| 1 | $SiO_2$ | Wet process | Amorphous | 230 | 0.018 |

TABLE 31

| [A] | [1] | Treating method | Treating agent 1 | Treating agent 2 | Diluent etc. | Order of treatment w.(1)&(2) |
|---|---|---|---|---|---|---|
| 49 | a | SV 3 | i-Butyltrimethoxysilane (10 pbw) | Dimethylsilicone 50 $mm^2/s$ (10 pbw) | — | Simultaneous |
| 50 | a | SV 3 | — | Dimethylsilicone 50 $mm^2/s$ (10 pbw) | — | (2) |
| 51 | a | SV 3 | n-Amyltrimethoxysilane (5 pbw) | Dimethylsilicone 1,000 $mm^2/s$ (10 pbw) | — | Simultaneous |
| 52 | b | GP 1 | Dimethyldimethoxysilane (10 pbw) | Dimethylsilicone 20 $mm^2/s$ (7 pbw) | n-Hexane (10 pbw) | Simultaneous |
| 53 | d | GP 2 | i-Propyltrimethoxysilane (10 pbw) | Dimethylsilicone 10 $mm^2/s$ (20 pbw) | — | Simultaneous |
| 54 | f | SV 3 | Decyltrimethoxysilane (15 pbw) | Fluorine-modified silicone 450 $mm^2/s$ (10 pbw) | — | Simultaneous |
| 55 | a | GP 1 | n-Butyltrimethoxysilane (10 pbw) | Dimethylsilicone 50 $mm^2/s$ (10 pbw) | n-Hexane (10 pbw) | Simultaneous |
| 56 | a | SV 3 | n-Butyltrimethoxysilane ( pbw) | — | — | (1) |
| 57 | a | GP 3 | n-Butyltrimethoxysilane (10 pbw) | — | — | (1) |
| 58 | 57 | GP 3 | — | Dimethylsilicone 50 $mm^2/s$ (10 pbw) | n-Hexane (10 pbw) | (1)→(2) |
| 59 | a | SV 2 | n-Butyltrimethoxysilane (10 pbw) | Dimethylsilicone 50 $mm^2/s$ (10 pbw) | — | Simultaneous |
| 60 | a | SV 3 | n-Dimethyldichlorosilane (10 pbw) | Dimethylsilicone 50 $mm^2/s$ (10 pbw) | — | Simultaneous |
| 61 | a | GP 1 | n-Dimethyldichlorosilane (10 pbw) | Dimethylsilicone 50 $mm^2/s$ (10 pbw) | n-Hexane (10 pbw) | Simultaneous |

[A]: Organic-treated fine particles;
[1]: Particles to be treated
SV: Solvent method;
GP: Gaseous phase method;
AQ: Aqueous method
(1): Treating agent 1;
(2): Treating agent 2

TABLE 32

| Organic = treated fine particles | Methanol wettability half value (%) | Methanol wettability end point (%) | Methanol hydro-phobicity (%) | Moisture content (wt. %) | Average particle diameter (μm) | Specific surface area ($m^2/g$) | Bulk density ($g/cm^3$) |
|---|---|---|---|---|---|---|---|
| 49 | 71 | 75 | 76 | 0.95 | 0.020 | 36 | 0.23 |
| 50 | 52 | 76 | 77 | 1.07 | 0.021 | 37 | 0.24 |
| 51 | 58 | 64 | 65 | 1.24 | 0.020 | 34 | 0.28 |
| 52 | 70 | 76 | 78 | 0.58 | 0.027 | 32 | 0.22 |
| 53 | 76 | 81 | 82 | 0.64 | 0.021 | 71 | 0.11 |
| 54 | 68 | 73 | 75 | 0.88 | 0.017 | 64 | 0.12 |
| 55 | 67 | 71 | 73 | 0.59 | 0.026 | 24 | 0.34 |
| 56 | 52 | 63 | 65 | 1.09 | 0.021 | 45 | 0.22 |
| 57 | 48 | 69 | 70 | 0.56 | 0.024 | 27 | 0.29 |
| 58 | 47 | 71 | 72 | 0.34 | 0.029 | 19 | 0.41 |
| 59 | 49 | 67 | 70 | 1.11 | 0.025 | 32 | 0.30 |
| 60 | 48 | 69 | 71 | 1.14 | 0.023 | 29 | 0.27 |
| 61 | 49 | 70 | 73 | 0.52 | 0.028 | 22 | 0.42 |

TABLE 33

| [B] | [1] | Treat-ing method | Treating agent 1 | Treating agent 2 | Diluent etc. |
|---|---|---|---|---|---|
| t | c | AQ 2 | Methyltrimethoxysilane (15 pbw) | — | — |
| u | d | GP 2 | Trimethylmethoxysilane (20 pbw) | — | — |
| v | e | SV 1 | n-Propyltrimethoxysilane (10 pbw) | — | — |
| w | i | GP 1 | Ethyltrichlorosilane (5 pbw) | — | — |
| x | j | GP 1 | Dimethyldichlorosilane (10 pbw) | — | — |
| y | k | GP 1 | Diethyldichlorosilane (20 pbw) | — | — |
| z | 1 | GP 1 | i-Butyltritrichlorosilane (10 pbw) | — | — |
| α | b | GP 1 | — | Methylhydro-gene-silicone 20 $mm^2/s$ (20 pbw) | — |

[B]: Inorganic fine powder B;
[1]: Particles to be treated
SV: Solvent method;
GP: Gaseous phase method;
AQ: Aqueous method

TABLE 34

| Inorganic fine powder B | Specific surface area ($mm^2/g$) | Methanol hydrophobicity (%) | Average particle diameter (μm) | Moisture content (wt. %) | Bulk density ($g/cm^3$) |
|---|---|---|---|---|---|
| b | 40 | 0 | 0.022 | 2.05 | 0.15 |
| g | 55 | 0 | 0.024 | 0.35 | 0.06 |
| h | 125 | 0 | 0.016 | 1.21 | 0.05 |
| i | 210 | 0 | 0.012 | 2.22 | 0.05 |
| j | 320 | 0 | 0.007 | 3.98 | 0.05 |
| t | 85 | 57 | 0.020 | 1.57 | 0.18 |
| u | 120 | 67 | 0.020 | 2.86 | 0.07 |
| v | 105 | 46 | 0.017 | 0.48 | 0.06 |
| w | 180 | 23 | 0.014 | 0.79 | 0.05 |
| x | 275 | 37 | 0.008 | 0.85 | 0.05 |
| y | 140 | 55 | 0.018 | 0.22 | 0.07 |
| z | 155 | 41 | 0.019 | 1.87 | 0.09 |
| α | 27 | 80 | 0.028 | 0.38 | 0.21 |

TABLE 35

| Toner | Classified product | Organic-treated fine particles | Amount (pbw) | Inorganic fine powder B | Amount (pbw) |
|---|---|---|---|---|---|
| Cyan Toner 101 | Cyan classified product 7 | 49 | 1.5 | g | 0.2 |
| Cyan Toner 102 | Cyan classified product 7 | 49 | 1.5 | — | — |
| Cyan Toner 103 | Cyan classified product 7 | 49 | 1.5 | α | 0.2 |
| Cyan Toner 104 | Cyan classified product 7 | 50 | 1.5 | — | — |
| Cyan Toner 105 | Cyan classified product 7 | 55 | 1.5 | — | — |
| Cyan Toner 106 | Cyan classified product 7 | 56 | 1.5 | — | — |
| Cyan Toner 107 | Cyan classified product 7 | 57 | 1.5 | — | — |
| Cyan Toner 108 | Cyan classified product 7 | 58 | 1.5 | — | — |
| Cyan Toner 109 | Cyan classified product 7 | 59 | 1.5 | — | — |
| Cyan Toner 110 | Cyan classified product 7 | 60 | 1.5 | — | — |
| Cyan Toner 111 | Cyan classified product 7 | 61 | 1.5 | — | — |
| Cyan Toner 112 | Cyan classified product 7 | 49 | 1.5 | h | 0.2 |
| Cyan Toner 113 | Cyan classified product 7 | 49 | 1.5 | i | 0.2 |
| Cyan Toner 114 | Cyan classified product 7 | 49 | 1.5 | j | 0.2 |
| Cyan Toner 115 | Cyan classified product 7 | 49 | 1.5 | w | 0.6 |
| Cyan Toner 116 | Cyan classified product 7 | 49 | 1.5 | x | 0.4 |

TABLE 35-continued

| Toner | Classified product | Organic-treated fine particles | Amount (pbw) | Inorganic fine powder B | Amount (pbw) |
|---|---|---|---|---|---|
| Cyan Toner 117 | Cyan classified product 7 | 51 | 1.5 | u | 0.5 |
| Cyan Toner 118 | Cyan classified product 7 | 52 | 2.0 | z | 0.4 |
| Cyan Toner 119 | Cyan classified product 7 | 53 | 1.5 | b | 0.2 |
| Cyan Toner 120 | Cyan classified product 7 | 53 | 1.5 | t | 0.4 |
| Cyan Toner 121 | Cyan classified product 7 | 53 | 1.2 | v | 0.8 |
| Cyan Toner 122 | Cyan classified product 7 | 53 | 1.2 | y | 0.6 |
| Cyan Toner 123 | Cyan classified product 7 | 54 | 1.2 | y | 0.4 |
| Magenta Toner 101 | Magenta class'd product 7 | 49 | 1.5 | w | 0.6 |
| Yellow Toner 101 | Yellow classified product 7 | 49 | 1.5 | w | 0.6 |
| Black Toner 101 | Black classified product 7 | 49 | 1.5 | w | 0.6 |
| Cyan Toner 124 | Cyan classified product 8 | 49 | 1.5 | y | 0.4 |
| Magenta Toner 102 | Magenta class'd product 8 | 49 | 1.5 | y | 0.4 |
| Yellow Toner 102 | Yellow class'd product 8 | 49 | 1.5 | y | 0.4 |
| Black Toner 102 | Black classified product 8 | 49 | 1.5 | y | 0.4 |
| Cyan Toner 125 | Cyan classified product 9 | 53 | 1.5 | w | 0.4 |
| Magenta Toner 103 | Magenta class'd product 9 | 53 | 1.5 | w | 0.4 |
| Yellow Toner 103 | Yellow class'd product 9 | 53 | 1.5 | w | 0.4 |
| Black Toner 103 | Black classified product 9 | 53 | 1.5 | w | 0.4 |
| Cyan Toner 126 | Cyan classified product 10 | 53 | 1.2 | x | 0.4 |
| Magenta Toner 104 | Magenta class'd product 10 | 53 | 1.2 | x | 0.4 |
| Yellow Toner 104 | Yellow class'd product 10 | 53 | 1.2 | x | 0.4 |
| Black Toner 104 | Black class'd product 10 | 53 | 1.2 | x | 0.4 |
| Black Toner 105 | Black class'd product 12 | 53 | 1.5 | w | 0.4 |

TABLE 36

| | | 23° C./60% RH | | | | | | | | | |
|---|---|---|---|---|---|---|---|---|---|---|---|
| | | Initial stage | | | | 5,000th sheet | | | | 1,000th sheet | |
| | Toner | Image density | Fog | (1) | Gradation | Image density | Fog | (1) | Gradation | Transfer efficiency (%) | Transfer latitude (μA) |
| Example: | | | | | | | | | | | |
| 71 | Cyan 101 | 1.80 | 0.7 | A | A | 1.80 | 0.5 | A | A | 91 | 100–450 |
| 72 | Cyan 102 | 1.81 | 0.8 | A | A | 1.82 | 0.7 | A | A | 88 | 100–425 |
| 73 | Cyan 103 | 1.80 | 0.7 | A | A | 1.79 | 0.7 | A | A | 89 | 100–425 |
| 74 | Cyan 105 | 1.79 | 0.8 | A | A | 1.80 | 0.8 | A | A | 89 | 100–425 |
| 75 | Cyan 112 | 1.80 | 0.6 | A | A | 1.78 | 0.6 | A | A | 90 | 100–450 |
| 76 | Cyan 113 | 1.80 | 0.6 | A | A | 1.80 | 0.6 | A | A | 90 | 100–450 |
| 77 | Cyan 114 | 1.81 | 0.5 | A | A | 1.79 | 0.6 | A | A | 90 | 100–450 |
| 78 | Cyan 115 | 1.79 | 0.6 | A | A | 1.81 | 0.5 | A | A | 91 | 75–425 |
| 79 | Cyan 116 | 1.78 | 0.7 | A | A | 1.81 | 0.5 | A | A | 91 | 75–425 |
| 80 | Cyan 117 | 1.80 | 0.6 | A | A | 1.80 | 0.6 | A | A | 89 | 100–450 |
| 81 | Cyan 118 | 1.82 | 0.7 | A | A | 1.79 | 0.6 | A | A | 88 | 125–450 |
| 82 | Cyan 119 | 1.81 | 0.6 | A | A | 1.81 | 0.6 | A | A | 90 | 100–450 |
| 83 | Cyan 120 | 1.80 | 0.6 | A | A | 1.80 | 0.5 | A | A | 90 | 75–425 |
| 84 | Cyan 121 | 1.82 | 0.6 | A | A | 1.79 | 0.5 | A | A | 91 | 75–450 |
| 85 | Cyan 122 | 1.81 | 0.7 | A | A | 1.81 | 0.5 | A | A | 89 | 75–450 |
| 86 | Cyan 123 | 1.80 | 0.7 | A | A | 1.83 | 0.6 | A | A | 89 | 100–425 |
| Comparative Example: | | | | | | | | | | | |
| 37 | Cyan 104 | 1.79 | 0.7 | A | B | 1.78 | 0.6 | A | B | 90 | 175–350 |
| 38 | Cyan 106 | 1.77 | 1.5 | C | C | 1.78 | 0.7 | D | B | 81 | 150–325 |
| 39 | Cyan 107 | 1.76 | 1.6 | C | C | 1.79 | 0.6 | D | B | 81 | 125–400 |
| 40 | Cyan 108 | 1.70 | 1.0 | A | A | 1.71 | 0.7 | B | B | 88 | 100–400 |
| 41 | Cyan 109 | 1.71 | 1.1 | A | A | 1.72 | 0.8 | B | B | 88 | 125–400 |
| 42 | Cyan 110 | 1.72 | 1.0 | A | A | 1.74 | 0.7 | B | B | 88 | 100–375 |
| 43 | Cyan 111 | 1.70 | 1.0 | A | A | 1.73 | 0.7 | B | B | 89 | 100–375 |

(1): Blank areas caused by poor transfer

TABLE 37

| | | 15° C./10% RH | | | | | | | | | |
|---|---|---|---|---|---|---|---|---|---|---|---|
| | | Initial stage | | | | 5,000th sheet | | | | 1,000th sheet | |
| | Toner | Image density | Fog | (1) | Gradation | Image density | Fog | (1) | Gradation | Transfer efficiency (%) | Transfer latitude (μA) |
| Example: | | | | | | | | | | | |
| 71 | Cyan 101 | 1.80 | 0.6 | A | A | 1.81 | 0.5 | A | A | 91 | 100–450 |
| 72 | Cyan 102 | 1.80 | 0.6 | A | B* | 1.73 | 1.7 | A | B* | 89 | 100–425 |
| 73 | Cyan 103 | 1.81 | 0.8 | A | B* | 1.65 | 1.8 | A | B* | 90 | 100–450 |
| 74 | Cyan 105 | 1.81 | 0.7 | A | B* | 1.66 | 1.6 | B | B* | 89 | 100–425 |
| 75 | Cyan 112 | 1.79 | 0.7 | A | A | 1.80 | 0.5 | A | A | 90 | 100–450 |
| 76 | Cyan 113 | 1.80 | 0.8 | A | A | 1.79 | 0.5 | A | A | 90 | 100–450 |
| 77 | Cyan 114 | 1.78 | 0.8 | A | A | 1.78 | 0.5 | A | A | 90 | 100–450 |
| 78 | Cyan 115 | 1.80 | 0.5 | A | A | 1.82 | 0.6 | A | A | 92 | 75–450 |
| 79 | Cyan 116 | 1.80 | 0.5 | A | A | 1.81 | 0.6 | A | A | 93 | 75–450 |
| 80 | Cyan 117 | 1.78 | 0.7 | A | B | 1.80 | 0.8 | A | B | 89 | 100–425 |
| 81 | Cyan 118 | 1.81 | 0.6 | A | A | 1.79 | 0.6 | A | A | 89 | 125–450 |
| 82 | Cyan 119 | 1.77 | 0.7 | A | B | 1.78 | 0.8 | A | B | 91 | 100–425 |
| 83 | Cyan 120 | 1.80 | 0.5 | A | A | 1.81 | 0.5 | A | B | 90 | 75–450 |
| 84 | Cyan 121 | 1.79 | 0.5 | A | A | 1.80 | 0.6 | A | A | 92 | 75–425 |
| 85 | Cyan 122 | 1.81 | 0.5 | A | A | 1.80 | 0.5 | A | A | 91 | 75–450 |
| 86 | Cyan 123 | 1.78 | 0.6 | A | A | 1.79 | 0.6 | A | A | 88 | 100–425 |
| Comparative Example: | | | | | | | | | | | |
| 37 | Cyan 104 | 1.79 | 0.6 | A | B* | 1.79 | 0.8 | A | B* | 89 | 100–425 |
| 38 | Cyan 106 | 1.76 | 0.6 | C | B | 1.81 | 0.7 | D | B | 80 | 175–350 |
| 39 | Cyan 107 | 1.78 | 0.6 | C | B | 1.80 | 0.8 | D | B | 80 | 150–325 |
| 40 | Cyan 108 | 1.70 | 0.7 | A | B* | 1.61 | 2.1 | B | B* | 88 | 125–400 |
| 41 | Cyan 109 | 1.72 | 0.8 | A | B* | 1.59 | 2.3 | B | B* | 89 | 100–375 |
| 42 | Cyan 110 | 1.73 | 0.7 | A | B* | 1.62 | 2.0 | B | B* | 89 | 125–400 |
| 43 | Cyan 111 | 1.70 | 0.6 | A | B* | 1.60 | 2.2 | B | B* | 88 | 100–375 |

(1): Blank areas caused by poor transfer
*Uneven image density was seen at halftone areas.

35

TABLE 38

| | | 30° C./80% RH | | | | | | | |
|---|---|---|---|---|---|---|---|---|---|
| | | Initial stage | | | | 5,000th sheet | | | |
| | Toner | Image density | Fog | (1) | Gradation | Image density | Fog | (1) | Gradation |
| Example: | | | | | | | | | |
| 71 | Cyan 101 | 1.80 | 0.8 | A | A | 1.80 | 0.6 | A | A |
| 72 | Cyan 102 | 1.80 | 0.7 | A | B | 1.79 | 0.5 | A | A |
| 73 | Cyan 103 | 1.80 | 0.7 | A | B | 1.80 | 0.6 | A | A |
| 74 | Cyan 105 | 1.79 | 0.9 | A | B | 1.77 | 0.8 | B | B |
| 75 | Cyan 112 | 1.80 | 0.9 | A | A | 1.79 | 0.7 | A | A |
| 76 | Cyan 113 | 1.79 | 0.9 | A | A | 1.81 | 0.7 | A | A |
| 77 | Cyan 114 | 1.77 | 0.9 | A | A | 1.79 | 0.8 | A | B |
| 78 | Cyan 115 | 1.78 | 0.7 | A | A | 1.78 | 0.5 | A | A |
| 79 | Cyan 116 | 1.79 | 0.6 | A | A | 1.78 | 0.5 | A | A |
| 80 | Cyan 117 | 1.77 | 0.9 | A | B | 1.79 | 0.8 | A | A |
| 81 | Cyan 118 | 1.75 | 0.9 | A | A | 1.74 | 0.8 | A | A |
| 82 | Cyan 119 | 1.74 | 0.9 | A | B | 1.76 | 0.9 | A | A |
| 83 | Cyan 120 | 1.80 | 0.7 | A | A | 1.81 | 0.5 | A | A |
| 84 | Cyan 121 | 1.81 | 0.8 | A | A | 1.82 | 0.5 | A | A |
| 85 | Cyan 122 | 1.82 | 0.6 | A | A | 1.80 | 0.5 | A | A |
| 86 | Cyan 123 | 1.77 | 0.9 | A | A | 1.75 | 0.8 | A | A |
| Comparative Example: | | | | | | | | | |
| 37 | Cyan 104 | 1.76 | 2.2 | A | B | 1.75 | 1.7 | A | B |
| 38 | Cyan 106 | 1.54 | 2.7 | C | C | 1.65 | 2.0 | C | C |
| 39 | Cyan 107 | 1.60 | 2.9 | C | C | 1.63 | 1.8 | C | C |

TABLE 38-continued

| | | 30° C./80% RH | | | | | | | |
|---|---|---|---|---|---|---|---|---|---|
| | | Initial stage | | | | 5,000th sheet | | | |
| | Toner | Image density | Fog | (1) | Gradation | Image density | Fog | (1) | Gradation |
| 40 | Cyan 108 | 1.65 | 1.8 | A | B | 1.67 | 1.1 | B | C |
| 41 | Cyan 109 | 1.60 | 1.7 | A | B | 1.66 | 1.0 | B | B |
| 42 | Cyan 110 | 1.62 | 1.9 | A | B | 1.63 | 1.2 | B | B |
| 43 | Cyan 111 | 1.64 | 1.7 | A | B | 1.64 | 1.1 | B | B |

(1): Blank areas caused by poor transfer

15

TABLE 39

| Particles to be treated | Composition | Production process | Crystal form | BET specific surface area ($m^2/g$) | Primary particle diameter ($\mu m$) |
|---|---|---|---|---|---|
| A | $TiO_2$ | Sulfuric acid process | Rutile | 95 | 0.018 |
| B | $TiO_2$ | Chlorine process | Mixed crystal | 40 | 0.022 |
| C | $TiO_2$ | Sulfuric acid process | Anatase | 115 | 0.020 |
| D | $TiO_2$ | Low-temperature oxidation of titanium alkoxide | Amorphous | 130 | 0.019 |
| E | $Al_2O_3$ | Flame decomposition | Delta form | 110 | 0.014 |
| F | $Al_2O_3$ | Thermal decomposition | Gamma form | 125 | 0.013 |
| G | $SiO_2$ | Dry process | Amorphous | 210 | 0.016 |
| H | $SiO_2$ | Dry process | Amorphous | 320 | 0.012 |
| I | $SiO_2$ | Dry process | Amorphous | 400 | 0.007 |
| J | $SiO_2/Al_2O_3$ | Dry process | Amorphous | 165 | 0.016 |

TABLE 40

| [A] | [1] | Treating method | Treating agent 1 | Treating agent 2 | Diluent etc. | Order of treatment w.(1)&(2) |
|---|---|---|---|---|---|---|
| 62 | A | SV 3 | n-Amyltrimethoxysilane (10 pbw) | Dimethylsilicone 50 $mm^2/s$ (10 pbw) | — | Simultaneous |
| 63 | A | SV 3 | — | Dimethylsilicone 50 $mm^2/s$ (10 pbw) | — | (2) |
| 64 | B | GP 1 | Dimethyldimethoxysilane (12 pbw) | Dimethylsilicone 20 $mm^2/s$ (8 pbw) | n-Hexane (10 pbw) | Simultaneous |
| 65 | D | GP 2 | i-Butyltrimethoxysilane (10 pbw) | Dimethylsilicone 10 $mm^2/s$ (20 pbw) | — | Simultaneous |
| 66 | E | SV 3 | n-Octyltrimethoxysilane (15 pbw) | Fluorine-modified silicone 450 $mm^2/s$ (10 pbw) | — | Simultaneous |
| 67 | A | GP 1 | n-Amyltrimethoxysilane (10 pbw) | Dimethylsilicone 50 $mm^2s$ (10 pbw) | | Simultaneous |
| 68 | A | SV 3 | n-Amyltrimethoxysilane (10 pbw) | — | — | (1) |
| 69 | A | GP 3 | n-Amyltrimethoxysilane (10 pbw) | — | — | (1) |
| 70 | 69 | GP 3 | — | Dimethylsilicone 50 $mm^2/s$ (10 pbw) | n-Hexane (10 pbw) | (1)→(2) |
| 71 | A | SV 2 | n-Amyltrimethoxysilane (10 pbw) | Dimethylsilicone 50 $mm^2/s$ (10 pbw) | — | Simultanious |
| 72 | A | SV 3 | Dimethyldichlorosilane (10 pbw) | Dimehtylsilicone 50 $mm^2/s$ (10 pbw) | — | Simultaneous |
| 73 | A | GP 1 | Dimethyldichlorosilane (10 pbw) | Dimethylsilicone 50 $mm^2/s$ (10 pbw) | n-Hexane (10 pbw) | Simultaneous |

[A]: Organic-treated fine particles; [1]: Particles to be treated
SV: Solvent method; GP: Gaseous phase method; AQ: Aqueous method
(1): Treating agent 1; (2): Treating agent (2)

TABLE 41

| organic= treated fine particles | Methanol wettability half value (%) | Methanol wettability end point (%) | Methanol hydro-phobicity (%) | Moisture content (wt. %) | Average particle diameter (μm) | Specific surface area ($m^2/g$) | Bulk density ($g/cm^3$) |
|---|---|---|---|---|---|---|---|
| 62 | 68 | 75 | 77 | 1.04 | 0.021 | 38 | 0.27 |
| 63 | 52 | 76 | 77 | 1.07 | 0.021 | 37 | 0.24 |
| 64 | 71 | 77 | 79 | 0.58 | 0.027 | 32 | 0.28 |
| 65 | 74 | 80 | 82 | 0.68 | 0.018 | 74 | 0.11 |
| 66 | 69 | 74 | 76 | 0.87 | 0.017 | 80 | 0.09 |
| 67 | 65 | 72 | 74 | 0.56 | 0.028 | 31 | 0.30 |
| 68 | 50 | 60 | 61 | 1.21 | 0.021 | 42 | 0.23 |
| 69 | 48 | 59 | 62 | 0.72 | 0.022 | 37 | 0.29 |
| 70 | 51 | 71 | 73 | 0.41 | 0.029 | 27 | 0.41 |
| 71 | 50 | 73 | 75 | 1.34 | 0.024 | 35 | 0.28 |
| 72 | 51 | 71 | 72 | 1.25 | 0.025 | 36 | 0.30 |
| 73 | 49 | 73 | 75 | 0.48 | 0.029 | 28 | 0.38 |

TABLE 42

| [C] | [1] | Treating method | Treating agent 1 | Treating agent 2 | Diluent etc. |
|---|---|---|---|---|---|
| K | C | SV | γ-Aminopropyltriethoxysilane (3 pbw) | i-Butyltrimethoxysilane (12 pbw) | — |
| L | F | SV | i-Butyltrimethoxysilane (12 pbw) | Amino-modified alkoxy-modified silicone 70 $mm^2/s$ (Both-terminal side chain type, —OMe, —RH—R'NH2 type; amine equivalent weight: 830 (3 pbw) | — |
| M | G | GP 1 | Hexamethylcyclotrisilazane (15 pbw) | — | — |
| N | H | GP 1 | Di-n-octyltetramethyldisilazane (20 pbw) | — | — |
| O | I | GP 1 | Hexamethyldisilazane (25 pbw) | — | — |
| P | U | GP 1 | Nonamethyltrisilazane (15 pbw) | — | — |
| Q | J | GP 1 | — | Dimethylsilicone 50 $mm^2/s$ (20 pbw) | — |

| Inorganic fine powder C | pH | Specific surface area ($mm^2/g$) | Methanol hydrophobicity (%) | Average particle diameter (um) | Moisture content (wt. %) | Bulk density ($g/cm^3$) |
|---|---|---|---|---|---|---|
| K | 8.1 | 81 | 53 | 0.019 | 1.25 | 0.21 |
| L | 7.8 | 95 | 59 | 0.016 | 1.04 | 0.08 |
| M | 9.3 | 168 | 61 | 0.013 | 0.39 | 0.05 |
| N | 8.8 | 224 | 70 | 0.008 | 0.62 | 0.05 |
| O | 0.0 | 270 | 64 | 0.008 | 0.89 | 0.05 |
| P | 7.4 | 125 | 71 | 0.014 | 0.48 | 0.05 |
| Q | 5.5 | 88 | 73 | 0.017 | 0.25 | 0.05 |

[C]: Inorganic fine powder C; [1]: Particles to be treated
SV: Solvent method; GP: Gaseous phase method; AQ: Aqueous method

TABLE 43

| Toner | Classified product | Organic-treated fine particles | Amount (pbw) | Inorganic fine powder C | Amount (pbw) |
|---|---|---|---|---|---|
| Cyan Toner 131 | Cyan classified product 7 | 62 | 1.5 | O | 0.4 |
| Cyan Toner 132 | Cyan classified product 7 | 62 | 1.5 | — | — |
| Cyan Toner 133 | Cyan classified product 7 | 62 | 1.5 | Q | 0.4 |
| Cyan Toner 134 | Cyan classified product 7 | 63 | 1.5 | — | — |
| Cyan Toner 135 | Cyan classified product 7 | 67 | 1.5 | — | — |
| Cyan Toner 136 | Cyan classified product 7 | 68 | 1.5 | — | — |
| Cyan Toner 137 | Cyan classified product 7 | 69 | 1.5 | — | — |
| Cyan Toner 138 | Cyan classified product 7 | 70 | 1.5 | — | — |

TABLE 43-continued

| Toner | Classified product | Organic-treated fine particles | Amount (pbw) | Inorganic fine powder C | Amount (pbw) |
|---|---|---|---|---|---|
| Cyan Toner 139 | Cyan classified product 7 | 71 | 1.5 | — | — |
| Cyan Toner 140 | Cyan classified product 7 | 72 | 1.5 | — | — |
| Cyan Toner 141 | Cyan classified product 7 | 73 | 1.5 | — | — |
| Cyan Toner 142 | Cyan classified product 7 | 62 | 1.5 | P | 0.6 |
| Cyan Toner 143 | Cyan classified product 7 | 64 | 2.0 | L | 0.6 |
| Cyan Toner 144 | Cyan classified product 7 | 65 | 1.2 | M | 0.4 |
| Cyan Toner 145 | Cyan classified product 7 | 65 | 1.2 | N | 0.8 |
| Cyan Toner 146 | Cyan classified product 7 | 66 | 1.5 | O | 0.2 |
| Magenta Toner 131 | Magenta class'd product 7 | 62 | 1.5 | O | 0.4 |
| Yellow Toner 131 | Yellow classified product 7 | 62 | 1.5 | O | 0.4 |
| Black Toner 131 | Black classified product 7 | 62 | 1.5 | O | 0.4 |
| Cyan Toner 147 | Cyan classified product 8 | 62 | 1.5 | N | 0.6 |
| Magenta Toner 132 | Magenta class'd product 8 | 62 | 1.5 | N | 0.6 |
| Yellow Toner 132 | Yellow classified product 8 | 62 | 1.5 | N | 0.6 |
| Black Toner 132 | Black classified product 8 | 62 | 1.5 | N | 0.6 |
| Cyan Toner 148 | Cyan classified product 9 | 65 | 1.2 | O | 0.4 |
| Magenta Toner 133 | Magenta class'd product 9 | 65 | 1.2 | O | 0.4 |
| Yellow Toner 133 | Yellow class'd product 9 | 65 | 1.2 | O | 0.4 |
| Black Toner 133 | Black classified product 9 | 65 | 1.2 | O | 0.4 |
| Cyan Toner 149 | Cyan c1ass'd product 10 | 65 | 1.2 | P | 0.6 |
| Magenta Toner 134 | Magenta class'd product 10 | 65 | 1.2 | P | 0.6 |
| Yellow Toner 134 | Yellow class'd product 10 | 65 | 1.2 | P | 0.6 |
| Black Toner 134 | Black class'd product 10 | 65 | 1.2 | P | 0.6 |
| Black Toner 135 | Black class'd product 11 | 65 | 1.2 | O | 0.4 |

TABLE 44

| | | 23° C./60% RH | | | | | | | | | |
|---|---|---|---|---|---|---|---|---|---|---|---|
| | | Initial stage | | | | 5,000th sheet | | | | 1,000th sheet | |
| | Toner | Image density | Fog | (1) | Gradation | Image density | Fog | (1) | Gradation | Transfer efficiency (%) | Transfer latitude (μA) |
| | | | | | Example: | | | | | | |
| 92 | Cyan 131 | 1.80 | 0.6 | A | A | 1.80 | 0.7 | A | A | 92 | 75–450 |
| 93 | Cyan 132 | 1.79 | 0.6 | A | A | 1.80 | 0.9 | A | A | 89 | 100–450 |
| 94 | Cyan 133 | 1.77 | 0.6 | A | A | 1.69 | 1.2 | A | B | 91 | 75–475 |
| 95 | Cyan 135 | 1.80 | 0.7 | A | A | 1.80 | 0.9 | A | A | 90 | 100–450 |
| 96 | Cyan 142 | 1.81 | 0.6 | A | A | 1.82 | 0.7 | A | A | 91 | 75–450 |
| 97 | Cyan 143 | 1.80 | 0.6 | A | A | 1.81 | 0.6 | A | A | 90 | 100–425 |
| 98 | Cyan 144 | 1.82 | 0.7 | A | A | 1.80 | 0.6 | A | A | 91 | 75–450 |
| 99 | Cyan 145 | 1.80 | 0.6 | A | A | 1.81 | 0.7 | A | A | 90 | 100–450 |
| 100 | Cyan 146 | 1.81 | 0.7 | A | A | 1.79 | 0.6 | A | A | 89 | 100–450 |
| | | | | | Comparative Example: | | | | | | |
| 44 | Cyan 134 | 1.75 | 1.6 | B | A | 1.73 | 1.0 | B | B | 86 | 125–400 |
| 45 | Cyan 136 | 1.68 | 1.3 | B | A | 1.66 | 0.8 | D | A | 79 | 150–350 |
| 46 | Cyan 137 | 1.67 | 1.2 | B | A | 1.69 | 0.9 | D | A | 80 | 150–325 |
| 47 | Cyan 138 | 1.66 | 0.9 | A | B | 1.63 | 0.7 | B | C | 89 | 100–425 |
| 48 | Cyan 139 | 1.65 | 0.8 | A | B | 1.66 | 0.8 | B | B | 88 | 100–425 |
| 49 | Cyan 140 | 1.67 | 0.9 | A | B | 1.65 | 0.7 | B | B | 89 | 100–425 |
| 50 | Cyan 141 | 1.62 | 1.0 | A | B | 1.63 | 0.7 | B | B | 89 | 125–450 |

(1): Blank areas caused by poor transfer

TABLE 45

| | | 23° C./5% RH | | | | | | | | | |
|---|---|---|---|---|---|---|---|---|---|---|---|
| | | Initial stage | | | | 5,000th sheet | | | | 1,000th sheet | |
| | Toner | Image density | Fog | (1) | Gradation | Image density | Fog | (1) | Gradation | Transfer efficiency (%) | Transfer latitude (μA) |
| | | | | | Example: | | | | | | |
| 92 | Cyan 131 | 1.80 | 0.5 | A | A | 1.81 | 0.6 | A | A | 92 | 75—450 |
| 93 | Cyan 132 | 1.80 | 0.6 | A | B | 1.68 | 1.6 | A | C* | 88 | 100–450 |
| 94 | Cyan 133 | 1.72 | 0.7 | A | B | 1.54 | 1.8 | A | C* | 90 | 75–450 |
| 95 | Cyan 135 | 1.80 | 0.6 | A | B | 1.65 | 1.7 | A | C* | 89 | 100–425 |
| 96 | Cyan 142 | 1.81 | 0.5 | A | A | 1.80 | 0.6 | A | A | 92 | 75–450 |
| 97 | Cyan 143 | 1.78 | 0.8 | A | A | 1.81 | 0.7 | A | B | 90 | 100–425 |
| 98 | Cyan 144 | 1.80 | 0.5 | A | A | 1.81 | 0.5 | A | A | 93 | 75–450 |
| 99 | Cyan 145 | 1.82 | 0.5 | A | A | 1.80 | 0.6 | A | A | 92 | 75–450 |
| 100 | Cyan 146 | 1.80 | 0.6 | A | A | 1.79 | 0.8 | A | A | 89 | 100–450 |
| | | | | | Comparative Example: | | | | | | |
| 44 | Cyan 134 | 1.76 | 0.5 | B | B | 1.75 | 0.9 | C | C* | 86 | 125—400 |
| 45 | Cyan 136 | 1.77 | 1.0 | C | A | 1.79 | 0.6 | D | B | 80 | 150–350 |
| 46 | Cyan 137 | 1.75 | 1.1 | C | A | 1.80 | 0.6 | D | B | 81 | 125–325 |
| 47 | Cyan 138 | 1.62 | 0.8 | A | C* | 1.44 | 2.6 | B | D* | 87 | 125—450 |
| 48 | Cyan 139 | 1.64 | 0.7 | A | C* | 1.46 | 2.5 | B | D* | 88 | 125—425 |
| 49 | Cyan 140 | 1.65 | 0.8 | A | C* | 1.45 | 2.5 | B | D* | 88 | 100—400 |
| 50 | Cyan 141 | 1.63 | 0.6 | A | C* | 1.43 | 2.6 | B | D* | 89 | 125—425 |

(1): Blank areas caused by poor transfer
*Uneven image density was seen at halftone areas.

TABLE 46

| | | 30° C./80% RH | | | | | | | |
|---|---|---|---|---|---|---|---|---|---|
| | | Initial stage | | | | 5,000th sheet | | | |
| | Toner | Image density | Fog | (1) | Gradation | Image density | Fog | (1) | Gradation |
| | | | | | Example: | | | | |
| 92 | Cyan 131 | 1.81 | 0.7 | A | A | 1.80 | 0.6 | A | A |
| 93 | Cyan 132 | 1.81 | 0.7 | A | A | 1.80 | 0.6 | A | B |
| 94 | Cyan 133 | 1.80 | 0.6 | A | B | 1.79 | 0.6 | A | C |
| 95 | Cyan 135 | 1.78 | 0.8 | A | A | 1.77 | 0.7 | A | B |
| 96 | Cyan 142 | 1.80 | 0.8 | A | A | 1.81 | 0.6 | A | A |
| 97 | Cyan 143 | 1.78 | 0.9 | A | A | 1.79 | 0.8 | A | A |
| 98 | Cyan 144 | 1.81 | 0.6 | A | A | 1.80 | 0.6 | A | A |
| 99 | Cyan 145 | 1.80 | 0.6 | A | A | 1.80 | 0.7 | A | A |
| 100 | Cyan 146 | 1.79 | 0.7 | A | A | 1.79 | 0.7 | A | A |
| | | | | | Comparative Example: | | | | |
| 44 | Cyan 134 | 1.56 | 2.1 | A | B | 1.61 | 1.8 | B | B |
| 45 | Cyan 136 | 1.51 | 2.2 | B | A | 1.62 | 1.7 | C | B |
| 46 | Cyan 137 | 1.52 | 2.1 | B | A | 1.59 | 1.6 | C | B |
| 47 | Cyan 138 | 1.66 | 0.8 | A | B | 1.65 | 0.7 | B | B |
| 48 | Cyan 139 | 1.63 | 1.8 | A | B | 1.62 | 1.2 | B | B |
| 49 | Cyan 140 | 1.61 | 1.7 | A | B | 1.61 | 1.1 | B | B |
| 50 | Cyan 141 | 1.60 | 1.9 | A | B | 1.64 | 1.0 | B | B |

What is claimed is:

1. A developing method comprising;

controlling on a developer carrying member the layer thickness of a one component developer through a developer layer thickness control means to form on the developer carrying member a thin layer of the one component developer; and developing an electrostatic latent image on an electrostatic latent image bearing member by the use of the one component developer carried on the developer carrying member; the developer carrying member being provided opposingly to the electrostatic latent image bearing member;

wherein said one component developer comprises toner particles containing a binder resin and a colorant, and fine titanium oxide particles or fine alumina particles; and the surfaces of said fine titanium oxide particles or fine alumina particles have been subjected to an organic treatment and have a methanol wettability half value of 55% or more.

2. The developing method according to claim 1, wherein said developer layer thickness control means comprises a magnetic blade, and said one component developer comprises a magnetic toner.

3. The developing method according to claim 1, wherein said developer layer thickness control means comprises an elastic blade.

4. The developing method according to claim 3, wherein said one component developer comprises a magnetic toner.

5. The developing method according to claim 3, wherein said one component developer comprises a non-magnetic toner.

6. The developing method according to claim 1, wherein said electrostatic latent image bearing member comprises an electrophotographic photosensitive member.

7. The developing method according to claim 1, wherein said one component developer is fed to said developer carrying member by means of a developer feeding member.

8. The developing method according to claim 1, wherein said one component developer comprises a magnetic toner.

9. The developing method according to claim 1, wherein said one component developer comprises a non-magnetic toner.

10. The developing method according to claim 1, wherein said fine titanium oxide particles or fine alumina particles have a methanol wettability half value of 60% or more.

11. The developing method according to claim 10, wherein said toner further comprises, in addition to the toner particles and the fine titanium oxide particles or fine alumina particles, an inorganic fine powder C having a pH of 7 or above, other than said fine titanium oxide particles or said fine alumina particles.

12. The developing method according to claim 11, wherein said inorganic fine powder C comprises a member selected from the group consisting of an oxide, a double oxide, a metal oxide, a metal, a silicon compound, carbon, a carbon compound, fullerene, a boron compound, a carbide, a nitride, a silicide and a ceramic.

13. The developing method according to claim 11, wherein said inorganic fine powder C has an average particle diameter smaller than 0.1 $\mu$m and has been treated with a silazane compound.

14. The developing method according to claim 11, wherein said inorganic fine powder C has been treated with a treating agent selected from the group consisting of a silazane compound, a silane compound in which a nitrogen atom is directly bonded to the silicon, a silane compound having a substituent containing nitrogen and a silicone oil having a substituent containing nitrogen.

15. The developing method according to claim 11, wherein said toner comprises the toner particles, the fine titanium oxide particles, and silica as the inorganic fine powder C.

16. The developing method according to claim 10, wherein said toner particles are color toner particles containing a pigment or a dye as the colorant.

17. The developing method according to claim 10, wherein said toner particles are magnetic toner particles containing a magnetic material as the colorant.

18. The developing method according to claim 1, wherein said fine titanium oxide particles or fine alumina particles have been subjected to said organic treatment with a silane compound and a silicone oil, and the organic-treated fine titanium oxide particles or organic-treated fine alumina particles have an average particle diameter of less than 0.1 $\mu$m and a moisture content of 3.0% by weight or less.

19. The developing method according to claim 1, wherein said fine titanium oxide particles or fine alumina particles are contained in the toner in an amount of from 0.2 part by weight to 5.0 parts by weight based on 100 parts by weight of the toner.

20. The developing method according to claim 1, wherein said fine titanium oxide particles or fine alumina particles have been treated with a silane compound and a silicone oil.

21. The developing method according to claim 20, wherein said silane compound comprises a silane compound represented by Formula (1):

$$(R_1)_nSi(OR_2)_{4-n} \quad (1)$$

wherein $R_1$ represents an aryl group, an aralkyl group, an alkynyl group, an alkenyl group or an alkyl group; $R_2$ represents an alkyl group; and n represents an integer of 1 to 3.

22. The developing method according to claim 21, wherein in Formula (1) the group represented by $R_1$ is an alkyl group having 5 or less carbon atoms.

23. The developing method according to claim 20, wherein said silicone oil comprises a member selected from the group consisting of (i) a reactive silicone oil selected from the group consisting of amino-modified silicone oil, epoxy-modified silicone oil, carboxyl-modified silicone oil, carbinol-modified silicone oil, methacryl-modified silicone oil, mercapto-modified silicone oil, phenol-modified silicone oil and heterofunctional group-modified silicone oil, (ii) a non-reactive silicone oil selected from the group consisting of polyether-modified silicone oil, methyl styryl-modified silicone oil, alkyl-modified silicone oil, fatty acid-modified silicone oil, alkoxyl-modified silicone oil and fluorine-modified silicone oil, and (iii) a straight silicone oil.

24. The developing method according to claim 20, wherein said silicone oil has a substituent selected from the group consisting of an alkyl group, an aryl group, an alkyl group at least partially substituted with fluorine and a hydrogen atom.

25. The developing method according to claim 20, wherein said silicone oil has a substituent selected from the group consisting of an alkyl group, an aryl group, an alkyl group at least partially substituted with fluorine and a hydrogen atom, and has a viscosity at 25° C. within the range of from 5 $mm^2/s$ to 2000 $mm^2/s$.

26. The developing method according to claim 10, wherein said fine titanium oxide particles or fine alumina particles have been subjected to an organic treatment on their surfaces, with a compound having a substituent containing nitrogen.

27. The developing method according to claim 26, wherein said fine titanium oxide particles or fine alumina particles have been treated with at least one silane compound and at least one silicone oil, and at least one of these compounds respectively comprises, as said compound having a substituent containing nitrogen, a silane compound having a substituent containing nitrogen or a silicone oil having a substituent containing nitrogen.

28. The developing method according to claim 27, wherein said silane compound comprises a silazane compound, a siloxane compound or a compound represented by Formula (1):

$$(R_1)_nSiX_{4-n} \quad (1)$$

wherein $R_1$ represents an aryl group, aralkyl group, alkynyl group, alkenyl group or alkyl group which is unsubstituted or at least partially substituted with fluorine; X represents a halogen atom or an alkoxyl group; and n represents an integer of 1 to 3.

29. The developing method according to claim 26, wherein said fine titanium oxide particles or fine alumina particles have been organic-treated with (i) at least one silane compound, (ii) at least one silicone oil and (iii), as said compound having a substituent containing nitrogen, at least one of at least one silane compound having a substituent containing nitrogen element and at least one silicone oil having a substituent containing nitrogen, and the organic-treated fine titanium oxide particles or organic-treated fine alumina-particles have a moisture content of 3.0% by weight or less.

30. The developing method according to claim 26, wherein said fine titanium oxide particles or fine alumina particles have been treated with (i) a silane compound, (ii) a silicone oil and (iii), as said compound having a substituent containing nitrogen, a silane compound having a substituent containing nitrogen or a silicone oil having a substituent containing nitrogen, and the (i) silane compound, the (ii) silicone oil and the (iii) silane compound having a substituent containing nitrogen or silicone oil having a substituent containing nitrogen are used in an amount not more than 50 parts by weight in total, based on 100 parts by weight of the fine titanium oxide particles or fine alumina particles.

31. The developing method according to claim 10, wherein said toner further comprises, in addition to the toner particles and the fine titanium oxide particles or fine alumina particles, an inorganic fine powder B other than said fine titanium oxide particles or said fine aluminum particles.

32. The developing method according to claim 31, wherein said inorganic fine powder B comprises a member selected from the group consisting of an oxide, a double oxide, a metal oxide, a metal, a silicon compound, carbon, a carbon compound, fullerene, a boron compound, a carbide, a nitride, a silicide and a ceramic.

33. The developing method according to claim 31, wherein said inorganic fine powder B has been subjected to an organic treatment.

34. The developing method according to claim 31, wherein said toner comprises the toner particles, the fine titanium oxide particles, and silica as the inorganic fine powder B.

35. The developing method according to claim 31, wherein said inorganic fine powder B is contained in the toner in an amount of from 0.05 part by weight to 1.5 parts by weight based on 100 parts by weight of the toner.

36. An image forming method comprising;

bringing a contact charging means into contact with an electrostatic latent image bearing member to electrostatically charge the surface of the electrostatic latent image bearing member;

forming an electrostatic latent image on the electrostatic latent image bearing member charged; and developing the electrostatic latent image by the use of a toner to render it visible;

wherein said toner comprises toner particles containing a binder resin and a colorant, and fine titanium oxide particles or fine alumina particles; and the surfaces of said fine titanium oxide particles or fine alumina particles have been subjected to an organic treatment and have a methanol wettability half value of 55% or more.

37. The image forming method according to claim 36, wherein said electrostatic latent image bearing member comprises an electrophotographic photosensitive member.

38. The image forming method according to claim 36, wherein said contact charging means comprises a charging roller.

39. The image forming method according to claim 36, wherein said contact charging means comprises a charging blade.

40. The image forming method according to claim 36, which further comprises, before electrostatically charging the surface of the electrostatic latent image bearing member by the contact charging means, the step of cleaning to clean the surface of the electrostatic latent image bearing member.

41. The image forming method according to claim 40, wherein the cleaning in said cleaning step is carried out by bringing a cleaning blade into touch with the surface of the electrostatic latent image bearing member.

42. The image forming method according to claim 36, wherein said electrostatic latent image bearing member has a protective layer on the outermost surface.

43. The image forming method according to claim 36, wherein said electrostatic latent image bearing member contains a lubricating material in at least its surface

44. The image forming method according to claim 43, wherein said lubricating material comprises a fluorine-containing material or a silicone-containing compound.

45. The image forming method according to claim 36, wherein said fine titanium oxide particles or fine alumina particles have a methanol wettability half value of 60% or more.

46. The image forming method according to claim 36, wherein said fine titanium oxide particles or fine alumina particles have been subjected to said organic treatment with a silane compound and a silicone oil, and the organic-treated fine titanium oxide particles or organic-treated fine alumina particles have an average particle diameter of less than 0.1 $\mu$m and a moisture content of 3.0% by weight or less.

47. The image forming method according to claim 36, wherein said fine titanium oxide particles or fine alumina particles are contained in the toner in an amount of from 0.2 part by weight to 5.0 parts by weight based on 100 parts by weight of the toner.

48. The image forming method according to claim 36, wherein said fine titanium oxide particles or fine alumina particles have been treated with a silane compound and a silicone oil.

49. The image forming method according to claim 48, wherein said silane compound comprises a silane compound represented by Formula (1):

$$(R_1)_nSi(OR_2)_{4-n} \quad (1)$$

wherein $R_1$ represents an aryl group, an aralkyl group, an alkynyl group, an alkenyl group or an alkyl group; $R_2$ represents an alkyl group; and n represents an integer of 1 to 3.

50. The image forming method according to claim 49, wherein in Formula (1) the group represented by $R_1$ is an alkyl group having 5 or less carbon atoms.

51. The image forming method according to claim 48, wherein said silicone oil comprises a member selected from the group consisting of (i) a reactive silicone oil selected from the group consisting of a amino-modified silicone oil, epoxy-modified silicone oil, carboxyl-modified silicone oil, carbinol-modified silicone oil, methacryl-modified silicone oil, mercapto-modified silicone oil, phenol-modified silicone oil and heterofunctional group-modified silicone oil, (ii) a non-reactive silicone oil selected from the group consisting of polyether-modified silicone oil, methyl styryl-modified silicone oil, alkyl-modified silicone oil, fatty acid-modified silicone oil, alkoxyl-modified silicone oil and fluorine-modified silicone oil, and (iii) a straight silicone oil.

52. The image forming method according to claim 48, wherein said silicone oil has a substituent selected from the group consisting of an alkyl group, an aryl group, an alkyl group at least partially substituted with fluorine, and a hydrogen atom.

53. The image forming method according to claim 48, wherein said silicone oil has a substituent selected from the group consisting of an alkyl group, an aryl group, an alkyl group at least partially substituted with fluorine and a hydrogen atom, and has a viscosity at 25° C. within the range of from 5 $mm^2/s$ to 2000 $mm^2/s$.

54. The image forming method according to claim 36, wherein said fine titanium oxide particles or fine alumina particles have been subjected to an organic treatment on their surfaces, with a compound having a substituent containing nitrogen.

55. The image forming method according to claim 54, wherein said fine titanium oxide particles or fine alumina particles have been treated with at least one silane compound and at least one silicone oil, and at least one of these compounds respectively comprises, as said compound having a substituent containing nitrogen, a silane compound having a substituent containing nitrogen or a silicone oil having a substituent containing nitrogen.

56. The image forming method according to claim 55, wherein said silane compound comprises a silazane compound, a siloxane compound or a compound represented by Formula (1):

$$(R_1)_nSiX_{4-n} \quad (1)$$

wherein $R_1$ represents an aryl group, aralkyl group, alkynyl group, alkenyl group or alkyl group which is unsubstituted or at least partially substituted with fluorine; X represents a halogen atom or an alkoxyl group; and n represents an integer of 1 to 3.

57. The image forming method according to claim 54, wherein said fine titanium oxide particles or fine alumina particles have been organic-treated with (i) at least one silane compound, (ii) at least one silicone oil and (iii), as said compound having a substituent containing nitrogen, at least one of at least one silane compound having a substituent containing nitrogen and at least one silicone oil having a substituent containing nitrogen and the organic-treated fine titanium oxide particles or organic-treated fine alumina particles have a moisture content of 3.0% by weight or less.

58. The image forming method according to claim 54, wherein said fine titanium oxide particles or fine alumina particles have been treated with (i) a silane compound, (ii) a silicone oil and (iii), as said compound having a substituent containing nitrogen, a silane compound having a substituent containing nitrogen or a silicone oil having a substituent containing nitrogen, and the (i) silane compound, the (ii) silicone oil and the (iii) silane compound having a substituent containing nitrogen or silicone oil having a substituent containing nitrogen are used in an amount not more than 50 parts by weight in total, based on 100 parts by weight of the fine titanium oxide particles or fine alumina particles.

59. The image forming method according to claim 36, wherein said toner further comprises, in addition to the toner particles and the fine titanium oxide particles or fine alumina particles, an inorganic fine powder B other than said fine titanium oxide particles or said fine aluminum particles.

60. The image forming method according to claim 59, wherein said inorganic fine powder B comprises a member selected from the group consisting of an oxide, a double oxide, a metal oxide, a metal, a silicon compound, carbon, a carbon compound, fullerene, a boron compound, a carbide, a nitride, a silicide and a ceramic.

61. The image forming method according to claim 59, wherein said inorganic fine powder B has been subjected to an organic treatment.

62. The image forming method according to claim 59, wherein said toner comprises the toner particles, the fine titanium oxide particles, and silica as the inorganic fine powder B.

63. The image forming method according to claim 59, wherein said inorganic fine powder B is contained in the toner in an amount of from 0.05 part by weight to 1.5 parts by weight based on 100 parts by weight of the toner.

64. The image forming method according to claim 36, wherein said toner further comprises, in addition to the toner particles and the fine titanium oxide particles or fine alumina particles, an inorganic fine powder C having a pH of 7 or above, other than said fine titanium oxide particles or said fine aluminum particles.

65. The image forming method according to claim 64, wherein said inorganic fine powder C comprises a member selected from the group consisting of an oxide, a double oxide, a metal oxide, a metal, a silicon compound, carbon, a carbon compound, fullerene, a boron compound, a carbide, a nitride, a silicide and a ceramic.

66. The image forming method according to claim 64, wherein said inorganic fine powder C has an average particle diameter smaller than 0.1 $\mu$m and has been treated with a silazane compound.

67. The image forming method according to claim 64, wherein said inorganic fine powder C has been treated with a treating agent selected from the group consisting of a silazane compound, a silane compound in which a nitrogen atom is directly bonded to silicon, a silane compound having a substituent containing nitrogen and a silicone oil having a substituent containing nitrogen.

68. The image forming method according to claim 64, wherein said toner comprises the toner particles, the fine titanium oxide particles, and silica as the inorganic fine powder C.

69. The image forming method according to claim 36, wherein said toner particles are color toner particles containing a pigment or a dye as the colorant.

70. The image forming method according to claim 36, wherein said toner particles are magnetic toner particles containing a magnetic material as the colorant.

71. An image forming method comprising;

forming toner images superimposingly on an electrostatic latent image bearing member or an intermediate transfer member by the use of a plurality of toners; and transferring the toner images at one time as a multiple toner image to a recording medium;

wherein said toner comprises toner particles containing a binder resin and a colorant, and fine titanium oxide particles or fine alumina particles; and the surfaces of said fine titanium oxide particles or fine alumina particles have been subjected to an organic treatment and have a methanol wettability half value of 55% or more.

72. The image forming method according to claim 71, wherein said multiple toner image is formed on said electrostatic latent image bearing member by repeating times the step of development to form a toner image on said electrostatic latent image bearing member.

73. The image forming method according to claim 72, wherein said multiple toner image is formed by at least two color toners selected from the group consisting of a cyan toner, a magenta toner and a yellow toner.

74. The image forming method according to claim 72, wherein said multiple toner image is formed by at least two color toners selected from the group consisting of a cyan toner, a magenta toner, a yellow toner and a black toner.

75. The image forming method according to claim 72, wherein said multiple toner image is formed on said intermediate transfer member by repeating times the step of transferring to said intermediate transfer member the toner image formed by development on said electrostatic latent image bearing member.

76. The image forming method according to claim 75, wherein said multiple toner image is formed by at least two color toners selected from the group consisting of a cyan toner, a magenta toner and a yellow toner.

77. The image forming method according to claim 75, wherein said multiple toner image is formed by at least two color toners selected from the group consisting of a cyan toner, a magenta toner, a yellow toner and a black toner.

78. The image forming method according to claim 71, wherein said fine titanium oxide particles or fine alumina particles have a methanol wettability half value of 60% or more.

79. The image forming method according to claim 71, wherein said fine titanium oxide particles or fine alumina particles have been subjected to said organic treatment with a silane compound and a silicone oil, and the organic-treated fine titanium oxide particles or organic-treated fine alumina particles have an average particle diameter of less than 0.1 μm and a moisture content of 3.0% by weight or less.

80. The image forming method according to claim 71, wherein said fine titanium oxide particles or fine alumina particles are contained in the toner in an amount of from 0.2 part by weight to 5.0 parts by weight based on 100 parts by weight of the toner.

81. The image forming method according to claim 71, wherein said fine titanium oxide particles or fine alumina particles have been treated with a silane compound and a silicone oil.

82. The image forming method according to claim 81, wherein said silane compound comprises a silane compound represented by Formula (1):

$$(R_1)_nSi(OR_2)_{4-n} \quad (1)$$

wherein $R_1$ represents an aryl group, an aralkyl group, an alkynyl group, an alkenyl group or an alkyl group; $R_2$ represents an alkyl group; and n represents an integer of 1 to 3.

83. The image forming method according to claim 82, wherein in Formula (1) the group represented by $R_1$ is an alkyl group having 5 or less carbon atoms.

84. The image forming method according to claim 81, wherein said silicone oil comprises a member selected from the group consisting of (i) a reactive silicone oil selected from the group consisting of a amino-modified silicone oil, epoxy-modified silicone oil, carboxyl-modified silicone oil, carbinol-modified silicone oil, methacryl-modified silicone oil, mercapto-modified silicone oil, phenol-modified silicone oil and heterofunctional group-modified silicone oil, (ii) a non-reactive silicone oil selected from the group consisting of polyether-modified silicone oil, methyl styryl-modified silicone oil, alkyl-modified silicone oil, fatty acid-modified silicone oil, alkoxyl-modified silicone oil and fluorine-modified silicone oil, and (iii) a straight silicone oil.

85. The image forming method according to claim 81, wherein said silicone oil has a substituent selected from the group consisting of an alkyl group, an aryl group, an alkyl group part, at least partially substituted with fluorine and a hydrogen atom.

86. The image forming method according to claim 81, wherein said silicone oil has a substituent selected from the group consisting of an alkyl group, an aryl group, an alkyl group at least partially substituted with fluorine and a hydrogen atom and has a viscosity at 25° C. within the range of from 5 $mm^2/s$ to 2000 $mm^2/s$.

87. The image forming method according to claim 71, wherein said fine titanium oxide particles or fine alumina particles have been subjected to an organic treatment on their surfaces, with a compound having a substituent containing nitrogen.

88. The image forming method according to claim 87, wherein said fine titanium oxide particles or fine alumina particles have been treated with at least one silane compound and at least one silicone oil, and at least one of these compounds respectively comprises, as said compound having a substituent containing nitrogen, a silane compound having a substituent containing nitrogen or a silicone oil having a substituent containing nitrogen.

89. The image forming method according to claim 88, wherein said silane compound comprises a silazane compound, a siloxane compound or a compound represented by Formula (1):

$$(R_1)_nSiX_{4-n} \quad (1)$$

wherein $R_1$ represents an aryl group, aralkyl group, alkynyl group, alkenyl group or alkyl group which is unsubstituted or at least partially substituted with fluorine; X represents a halogen atom or an alkoxyl group; and n represents an integer of 1 to 3.

90. The image forming method according to claim 87, wherein said fine titanium oxide particles or fine alumina particles have been organic-treated with (i) at least one silane compound, (ii) at least one silicone oil and (iii), as said compound having a substituent containing nitrogen, at least one of at least one silane compound having a substituent containing nitrogen and at least one silicone oil having a substituent containing nitrogen and the organic-treated fine titanium oxide particles or organic-treated fine alumina particles have a moisture content of 3.0% by weight or less.

91. The image forming method according to claim 87, wherein said fine titanium oxide particles or fine alumina particles have been treated with (i) a silane compound, (ii) a silicone oil and (iii), as said compound having a substituent containing nitrogen, a silane compound having a substituent containing nitrogen or a silicone oil having a substituent containing nitrogen, and the (i) silane compound, the (ii) silicone oil and the (iii) silane compound having a substituent containing nitrogen or silicone oil having a substituent containing nitrogen are used in an amount not more than 50 parts by weight in total, based on 100 parts by weight of the fine titanium oxide particles or fine alumina particles.

92. The image forming method according to claim 71, wherein said toner further comprises, in addition to the toner particles and the fine titanium oxide particles or fine alumina particles, an inorganic fine powder B other than said fine titanium oxide particles or said fine aluminum particles.

93. The image forming method according to claim 92, wherein said inorganic fine powder B comprises a member selected from the group consisting of an oxide, a double oxide, a metal oxide, a metal, a silicon compound, carbon, a carbon compound, fullerene, a boron compound, a carbide, a nitride, a silicide and a ceramic.

94. The image forming method according to claim 92, wherein said inorganic fine powder B has been subjected to an organic treatment.

95. The image forming method according to claim 92, wherein said toner comprises the toner particles, the fine titanium oxide particles, and silica as the inorganic fine powder B.

96. The image forming method according to claim 92, wherein said inorganic fine powder B is contained in the toner in an amount of from 0.05 part by weight to 1.5 parts by weight based on 100 parts by weight of the toner.

97. The image forming method according to claim 71, wherein said toner further comprises, in addition to the toner particles and the fine titanium oxide particles or fine alumina particles, an inorganic fine powder C having a pH of 7 or above, other than said fine titanium oxide particles or said fine alumina particles.

98. The image forming method according to claim 97, wherein said inorganic fine powder C comprises a member selected from the group consisting of an oxide, a double oxide, a metal oxide, a metal, a silicon compound, carbon, a carbon compound, fullerene, a boron compound, a carbide, a nitride, a silicide and a ceramic.

99. The image forming method according to claim 97, wherein said inorganic fine powder C has an average particle diameter smaller than 0.1 $\mu$m and has been treated with a silazane compound.

100. The image forming method according to claim 97, wherein said inorganic fine powder C has been treated with a treating agent selected from the group consisting of a silazane compound, a silane compound in which a nitrogen atom is directly bonded to silicon, a silane compound having a substituent containing nitrogen, and a silicone oil having a substituent containing nitrogen.

101. The image forming method according to claim 97, wherein said toner comprises the toner particles, the fine titanium oxide particles, and silica as the inorganic fine powder C.

102. An image forming method comprising;

developing an electrostatic latent image formed on an electrostatic latent image bearing member, by the use of a toner to form a toner image; and transferring to a recording medium the toner image formed on the electrostatic latent image bearing member;

wherein said toner comprises toner particles containing a binder resin and a colorant, and fine titanium oxide particles or fine alumina particles; and the surfaces of said fine titanium oxide particles or fine alumina particles have been subjected to an organic treatment and have a methanol wettability half value of 55% or more.

103. The image forming method according to claim 102, wherein said electrostatic latent image bearing member comprises an electrophotographic photosensitive member.

104. The image forming method according to claim 102, wherein a multiple toner image is formed on said recording medium by repeating times the step of transferring to said recording medium the toner image formed on said electrostatic latent image bearing member.

105. The image forming method according to claim 104, wherein said multiple toner image is formed by at least two color toners selected from the group consisting of a cyan toner, a magenta toner and a yellow toner.

106. The image forming method according to claim 104, wherein said multiple toner image is formed by at least two color toners selected from the group consisting of a cyan toner, a magenta toner, a yellow toner and a black toner.

107. The image forming method according to claim 102, wherein said fine titanium oxide particles or fine alumina particles have a methanol wettability half value of 60% or more.

108. The image forming method according to claim 102, wherein said fine titanium oxide particles or fine alumina particles have been subjected to said organic treatment with a silane compound and a silicone oil, and the organic-treated fine titanium oxide particles or organic-treated fine alumina particles have an average particle diameter of less than 0.1 $\mu$m and a moisture content of 3.0% by weight or less.

109. The image forming method according to claim 102, wherein said fine titanium oxide particles or fine alumina particles are contained in the toner in an amount of from 0.2 part by weight to 5.0 parts by weight based on 100 parts by weight of the toner.

110. The image forming method according to claim 102, wherein said fine titanium oxide particles or fine alumina particles have been treated with a silane compound and a silicone oil.

111. The image forming method according to claim 110, wherein said silane compound comprises a silane compound represented by Formula (1):

$$(R_1)_nSi(OR_2)_{4-n} \quad (1)$$

wherein $R_1$ represents an aryl group, an aralkyl group, an alkynyl group, an alkenyl group or an alkyl group; $R_2$ represents an alkyl group; and n represents an integer of 1 to 3.

112. The image forming method according to claim 111, wherein in Formula (1) the group represented by $R_1$ is an alkyl group having 5 or less carbon atoms.

113. The image forming method according to claim 110, wherein said silicone oil comprises a member selected from the group consisting of (i) a reactive silicone oil selected from the group consisting of a amino-modified silicone oil, epoxy-modified silicone oil, carboxyl-modified silicone oil, carbinol-modified silicone oil, methacryl-modified silicone oil, mercapto-modified silicone oil, phenol-modified silicone oil and heterofunctional group-modified silicone oil, (ii) a non-reactive silicone oil selected from the group consisting of polyether-modified silicone oil, methyl styryl-modified silicone oil, alkyl-modified silicone oil, fatty acid-modified silicone oil, alkoxyl-modified silicone oil and fluorine-modified silicone oil, and (iii) a straight silicone oil.

114. The image forming method according to claim 110, wherein said silicone oil has a substituent selected from the group consisting of an alkyl group, an aryl group, an alkyl group at least partially substituted with fluorine and a hydrogen atom.

115. The image forming method according to claim 110, wherein said silicone oil has a substituent selected from the group consisting of an alkyl group, an aryl group, an alkyl group at least partially substituted with fluorine and a hydrogen atom, and has a viscosity at 25° C. within the range of from 5 $mm^2/s$ to 2000 $mm^2/s$.

116. The image forming method according to claim 102, wherein said fine titanium oxide particles or fine alumina particles have been subjected to an organic treatment on their surfaces, with a compound having a substituent containing nitrogen.

117. The image forming method according to claim 116, wherein said fine titanium oxide particles or fine alumina particles have been treated with at least one silane compound and at least one silicone oil, and at least one of these compounds respectively comprises, as said compound having a substituent containing nitrogen, a silane compound having a substituent containing nitrogen or a silicone oil having a substituent containing nitrogen.

118. The image forming method according to claim 117, wherein said silane compound comprises a silazane compound, a siloxane compound or a compound represented by Formula (1):

$$(R_1)_nSiX_{4-n} \quad (1)$$

wherein $R_1$ represents an aryl group, aralkyl group, alkynyl group, alkenyl group or alkyl group which is unsubstituted or at least partially substituted with fluorine; X represents a halogen atom or an alkoxyl group; and n represents an integer of 1 to 3.

119. The image forming method according to claim 116, wherein said fine titanium oxide particles or fine alumina particles have been organic-treated with (i) at least one silane compound, (ii) at least one silicone oil and (iii), as said compound having a substituent containing nitrogen, at least one of at least one silane compound having a substituent containing nitrogen and at least one silicone oil having a substituent containing nitrogen and the organic-treated fine titanium oxide particles or organic-treated fine alumina particles have a moisture content of 3.0% by weight or less.

120. The image forming method according to claim 116, wherein said fine titanium oxide particles or fine alumina particles have been treated with (i) a silane compound, (ii) a silicone oil and (iii), as said compound having a substituent containing nitrogen, a silane compound having a substituent containing nitrogen or a silicone oil having a substituent containing nitrogen, and the (i) silane compound, the (ii) silicone oil and the (iii) silane compound having a substituent containing nitrogen or silicone oil having a substituent containing nitrogen are used in an amount not more than 50 parts by weight in total, based on 100 parts by weight of the fine titanium oxide particles or fine alumina particles.

121. The image forming method according to claim 102, wherein said toner further comprises, in addition to the toner particles and the fine titanium oxide particles or fine alumina particles, an inorganic fine powder B other than said fine titanium oxide particles or said fine aluminum particles.

122. The image forming method according to claim 121, wherein said inorganic fine powder B comprises a member selected from the group consisting of an oxide, a double oxide, a metal oxide, a metal, a silicon compound, carbon, a carbon compound, fullerene, a boron compound, a carbide, a nitride, a silicide and a ceramic.

123. The image forming method according to claim 121, wherein said inorganic fine powder B has been subjected to an organic treatment.

124. The image forming method according to claim 121, wherein said toner comprises the toner particles, the fine titanium oxide particles, and silica as the inorganic fine powder B.

125. The image forming method according to claim 121, wherein said inorganic fine powder B is contained in the toner in an amount of from 0.05 part by weight to 1.5 parts by weight based on 100 parts by weight of the toner.

126. The image forming method according to claim 102, wherein said toner further comprises, in addition to the toner particles and the fine titanium oxide particles or fine alumina particles, an inorganic fine powder C having a pH of 7 or above other than said fine titanium oxide particles or said fine alumina particles.

127. The image forming method according to claim 126, wherein said inorganic fine powder C comprises a member selected from the group consisting of an oxide, a double oxide, a metal oxide, a metal, a silicon compound, carbon, a carbon compound, fullerene, a boron compound, a carbide, a nitride, a silicide and a ceramic.

128. The image forming method according to claim 126, wherein said inorganic fine powder C has an average particle diameter smaller than 0.1 $\mu$m and has been treated with a silazane compound.

129. The image forming method according to claim 126, wherein said inorganic fine powder C has been treated with a treating agent selected from the group consisting of a silazane compound, a silane compound in which a nitrogen atom is directly bonded to silicon, a silane compound having a substituent containing nitrogen, and a silicone oil having a substituent containing nitrogen.

130. The image forming method according to claim 126, wherein said toner comprises the toner particles, the fine titanium oxide particles, and silica as the inorganic fine powder C.

131. The image forming method according to claim 102, wherein said toner particles are color toner particles containing a pigment or a dye as the colorant.

132. The image forming method according to claim 102, wherein said toner particles are magnetic toner particles containing a magnetic material as the colorant.

133. A heat fixing method comprising;

heat-fixing toner images superimposingly formed on a recording medium as a multiple image by the use of at least two kinds of toners; the toner images being fixed to the recording medium through a heat fixing means comprised of a heater element and a pressure member that stands opposite to the heater element in pressure contact and brings the recording medium into close contact with the heater element through a film interposed between them;

wherein said toners comprise toner particles containing a binder resin and a colorant, and fine titanium oxide particles or fine alumina particles; and the surfaces of said fine titanium oxide particles or fine alumina particles have been subjected to an organic treatment and have a methanol wettability half value of 55% or more.

134. The heat fixing method according to claim 133, wherein said multiple toner image is formed by at least two color toners selected from the group consisting of a cyan toner, a magenta toner and a yellow toner.

135. The heat fixing method according to claim 133, wherein said multiple toner image is formed by at least two color toners selected from the group consisting of a cyan toner, a magenta toner, a yellow toner and a black toner.

136. The heat fixing method according to claim 133, wherein said fine titanium oxide particles or fine alumina particles have a methanol wettability half value of 60% or more.

137. The heat fixing method according to claim 133, wherein said fine titanium oxide particles or fine alumina particles have been subjected to said organic treatment with a silane compound and a silicone oil, and the organic-treated fine titanium oxide particles or organic-treated fine alumina particles have an average particle diameter of less than 0.1 $\mu$m and a moisture content of 3.0% by weight or less.

138. The heat fixing method according to claim 133, wherein said fine titanium oxide particles or fine alumina particles are contained in the toner in the amount of from 0.2 part by weight to 5.0 parts by weight based on 100 parts by weight of the toner.

139. The heat fixing method according to claim 133, wherein said fine titanium oxide particles or fine alumina particles have been treated with a silane compound and a silicone oil.

140. The heat fixing method according to claim 139, wherein said silane compound comprises a silane compound represented by Formula (1):

$$(R_1)_n Si(OR_2)_{4-n} \quad (1)$$

wherein $R_1$ represents an aryl group, an aralkyl group, an alkynyl group, an alkenyl group or an alkyl group; $R_2$ represents an alkyl group; and n represents an integer of 1 to 3.

141. The heat fixing method according to claim 140, wherein in Formula (1) the group represented by $R_1$ is an alkyl group having 5 or less carbon atoms.

142. The heat fixing method according to claim 139, wherein said silicone oil comprises a member selected from the group consisting of (i) a reactive silicone oil selected from the group consisting of a amino-modified silicone oil, epoxy-modified silicone oil, carboxyl-modified silicone oil, carbinol-modified silicone oil, methacryl-modified silicone oil, mercapto-modified silicone oil, phenol-modified silicone oil and heterofunctional group-modified silicone oil, (ii) a non-reactive silicone oil selected from the group consisting of polyether-modified silicone oil, methyl styryl-modified silicone oil, alkyl-modified silicone oil, fatty acid-modified silicone oil, alkoxyl-modified silicone oil and fluorine-modified silicone oil, and (iii) a straight silicone oil.

143. The heat fixing method according to claim 139, wherein said silicone oil has a substituent selected from the group consisting of an alkyl group, an aryl group, an alkyl group at least partially substituted with fluorine, and a hydrogen atom.

144. The heat fixing method according to claim 139, wherein said silicone oil has a substituent selected from the group consisting of an alkyl group, an aryl group, an alkyl group at least partially substituted with fluorine, and a hydrogen atom, and has a viscosity at 25° C. within the range of from 5 $mm^2/s$ to 2000 $mm^2/s$.

145. The heat fixing method according to claim 133, wherein said fine titanium oxide particles or fine alumina particles have been subjected to an organic treatment on their surfaces, with a compound having a substituent containing nitrogen.

146. The heat fixing method according to claim 145, wherein said fine titanium oxide particles or fine alumina particles have been treated with at least one silane compound and at least one silicone oil, and at least one of these compounds respectively comprises, as said compound having a substituent containing nitrogen, a silane compound having a substituent containing nitrogen or a silicone oil having a substituent containing nitrogen.

147. The heat fixing method according to claim 146, wherein said silane compound comprises a silazane compound, a siloxane compound or a compound represented by Formula (1):

$$(R_1)_nSiX_{4-n}$$

wherein $R_1$ represents an aryl group, aralkyl group, alkynyl group, alkenyl group or alkyl group which is unsubstituted or at least partially substituted with fluorine; X represents a halogen atom or an alkoxyl group; and n represents an integer of 1 to 3.

148. The heat fixing method according to claim 145, wherein said fine titanium oxide particles or fine alumina particles have been organic-treated with (i) at least one silane compound, (ii) at least one silicone oil and (iii), as said compound having a substituent containing nitrogen, at least one of at least one silane compound having a substituent containing nitrogen and at least one silicone oil having a substituent containing nitrogen, and the organic-treated fine titanium oxide particles or organic-treated fine alumina particles have a moisture content of 3.0% by weight or less.

149. The heat fixing method according to claim 145, wherein said fine titanium oxide particles or fine alumina particles have been treated with (i) a silane compound, (ii) a silicone oil and (iii), as said compound having a substituent containing nitrogen, a silane compound having a substituent containing nitrogen or a silicone oil having a substituent containing nitrogen, and the (i) silane compound, the (ii) silicone oil and the (iii) silane compound having a substituent containing nitrogen or silicone oil having a substituent containing nitrogen are used in an amount not more than 50 parts by weight in total, based on 100 parts by weight of the fine titanium oxide particles or fine alumina particles.

150. The heat fixing method according to claim 133, wherein said toner further comprises, in addition to the toner particles and the fine titanium oxide particles or fine alumina particles, an inorganic fine powder B other than said fine titanium oxide particles or said fine aluminum particles.

151. The heat fixing method according to claim 150, wherein said inorganic fine powder B comprises a member selected from the group consisting of an oxide, a double oxide, a metal oxide, a metal, a silicon compound, carbon, a carbon compound, fullerene, a boron compound, a carbide, a nitride, a silicide and a ceramic.

152. The heat fixing method according to claim 150, wherein said inorganic fine powder B has been subjected to an organic treatment.

153. The heat fixing method according to claim 150, wherein said toner comprises the toner particles, the fine titanium oxide particles, and silica as the inorganic fine powder B.

154. The heat fixing method according to claim 150, wherein said inorganic fine powder B is contained in the toner in an amount of from 0.05 part by weight to 1.5 parts by weight based on 100 parts by weight of the toner.

155. The heat fixing method according to claim 133, wherein said toner further comprises, in addition to the toner particles and the fine titanium oxide particles or fine alumina particles, an inorganic fine powder C having a pH of 7 or above, other than said fine titanium oxide particles or said fine alumina particles.

156. The heat fixing method according to claim 155, wherein said inorganic fine powder C comprises a member selected from the group consisting of an oxide, a double oxide, a metal oxide, a metal, a silicon compound, carbon, a carbon compound, fullerene, a boron compound, a carbide, a nitride, a silicide and a ceramic.

157. The heat fixing method according to claim 155, wherein said inorganic fine powder C has an average particle diameter smaller than 0.1 $\mu$m and has been treated with a silazane compound.

158. The heat fixing method according to claim 155, wherein said inorganic fine powder C has been treated with a treating agent selected from the group consisting of a silazane compound, a silane compound in which a nitrogen atom is directly bonded to silicon, a silane compound having a substituent containing nitrogen, and a silicone oil having a substituent containing nitrogen.

159. The heat fixing method according to claim 155, wherein said toner comprises the toner particles, the fine titanium oxide particles, and silica as the inorganic fine powder C.

160. The heat fixing method according to claim 133, wherein said toner particles are color toner particles containing a pigment or a dye as the colorant.

161. The heat fixing method according to claim 133, wherein said toner particles are magnetic toner particles containing a magnetic material as the colorant.

* * * * *

UNITED STATES PATENT AND TRADEMARK OFFICE
CERTIFICATE OF CORRECTION

PATENT NO. : 5,824,442

DATED : October 20, 1998

INVENTOR(S) : HIROHIDE TANIKAWA, ET AL.

It is certified that error appears in the above-identified patent and that said Letters Patent is hereby corrected as shown below:

On the title page:

AT [56] REFERENCES CITED

U.S. PATENT DOCUMENTS

"5,501,963 should read --5,501,933--.

AT [56] REFERENCES CITED

FOREIGN PATENT DOCUMENTS

Page 2, "OTHER PUBLICATIONS" should read --FOREIGN PATENT DOCUMENTS--.

COLUMN 2

Line 25, "excess" should read --excessive--;
Line 28, "not" should be deleted;
Line 31, "not" should be deleted;
Line 48, "adhere" should read --adhere to--; and
Line 56, "is" should read --are--.

COLUMN 4

Line 19, "not" should be deleted;
Line 22, "not" should be deleted;
Line 49, "There are such" should be deleted;
Line 50, "problems." should be deleted; and
Line 54, "not" should be deleted.

COLUMN 5

Line 8, "wears" should read --wear--;
Line 15, "of" should read --than--; and
Line 22, "concaves" should read --concavities--.

UNITED STATES PATENT AND TRADEMARK OFFICE

CERTIFICATE OF CORRECTION

PATENT NO. : 5,824,442

DATED : October 20, 1998

INVENTOR(S) : HIROHIDE TANIKAWA, ET AL.

It is certified that error appears in the above-identified patent and that said Letters Patent is hereby corrected as shown below:

COLUMN 9

Line 60, "less occur" should read --occur less--.

COLUMN 12

Line 11, "put" should read --placed--.

COLUMN 13

Line 28, "A plural" should read --Plural--.

COLUMN 16

Line 1, "any" should read --than any--.

COLUMN 17

Line 5, "bulymethyldimethoxysilane," should read --butylmethyldimethoxysilane,--; and
Line 6, "buyldimethylmethoxysilane," should read --butylmethylmethoxysilane--.

COLUMN 24

Line 14, "excess." should read --excessive.--; and
Line 51, "excess" should read --excessive--.

COLUMN 25

Line 1, "less occur," should read --occur less,--; and
Line 40, "excess" should read --excessive--.

UNITED STATES PATENT AND TRADEMARK OFFICE

CERTIFICATE OF CORRECTION

PATENT NO. : 5,824,442

DATED : October 20, 1998

INVENTOR(S) : HIROHIDE TANIKAWA, ET AL.

It is certified that error appears in the above-identified patent and that said Letters Patent is hereby corrected as shown below:

COLUMN 26

Line 1, "adsorbed" should read --be adsorbed--.

COLUMN 27

Line 7, "obtained," should read --be obtained,--.

COLUMN 28

Line 17, ")aminopropyl)}" should read --)aminopropyl]--; and

Line 38, "of" should be deleted.

COLUMN 29

Line 3, "become excessively largely" should read --excessively--; and

Line 34, "includes" should read --include--.

COLUMN 30

Line 57, "metanol" should read --methanol--.

COLUMN 31

Line 17, "sulk" should read --bulk--.

COLUMN 37

Line 22, "a" should read --as--.

UNITED STATES PATENT AND TRADEMARK OFFICE

CERTIFICATE OF CORRECTION

PATENT NO. : 5,824,442

DATED : October 20, 1998

INVENTOR(S) : HIROHIDE TANIKAWA, ET AL.

It is certified that error appears in the above-identified patent and that said Letters Patent is hereby corrected as shown below:

COLUMN 40

Line 53, "include," should read --includes,--.

COLUMN 47

Line 34, "KR271," (2nd occurrence) should be deleted;
Line 35, "KR255" (2nd occurrence) should be deleted; and
Line 37, "KR206" (2nd occurrence) should be deleted.

COLUMN 48

Line 5, "80:20))" should read --80:20)--; and
Line 17, "con centration" should read --concentration--.

COLUMN 49

Line 19, "great so much," should read --so great,--; and
Line 20, "made less occur." should read
--made to occur less.--.

COLUMN 51

Line 42, "an" should read --a--.

COLUMN 53

Line 14, "ozone can be less" should read
--less ozone can be--; and
Line 24, "turn" should read --turns--.

COLUMN 58

Line 41, "tin" should read --thin--.

UNITED STATES PATENT AND TRADEMARK OFFICE

CERTIFICATE OF CORRECTION

PATENT NO. : 5,824,442

DATED : October 20, 1998

INVENTOR(S) : HIROHIDE TANIKAWA, ET AL.

It is certified that error appears in the above-identified patent and that said Letters Patent is hereby corrected as shown below:

COLUMN 59

Line 24, "In stead" should read --Instead--;
Line 45, "is" should read --are--;
Line 47, "sleeve." should read --sleeve, are employed.--;
Line 48, "is" should read --are--;
Line 51, "preferably." should read --preferably employed--; and
Line 58, "are preferably." should read --are preferably employed.--.

COLUMN 60

Line 14, "forbitarly" should read --forcibly--;
Line 21, "be occurred," should read --occur,--;
Line 34, "pnenomina" should read --phenomena--; and
Line 39, "not preferably." should read --not preferably employed.--

COLUMN 61

Line 20, "has" should read --have--; and
Line 67, "heatcurable" should read --heat-curable--.

COLUMN 62

Line 61, "phenomina" should read --phenomena--;
Line 66, "pref-" should read --preferably employed.--; and
Line 67, "erably." should be deleted.

UNITED STATES PATENT AND TRADEMARK OFFICE

CERTIFICATE OF CORRECTION

PATENT NO. : 5,824,442

DATED : October 20, 1998

INVENTOR(S) : HIROHIDE TANIKAWA, ET AL.

It is certified that error appears in the above-identified patent and that said Letters Patent is hereby corrected as shown below:

COLUMN 63

Line 1, "preferably." should read --preferably used.--;
Line 6, "risen" should read --raised--; and
Line 15, "preferably." should read --preferably employed.--.

COLUMN 65

Line 56, "with several μm oeder." should read --of several μm diameter--.

COLUMN 66

Line 35, "silicone containing" should read --silicone-containing--.

COLUMN 67

Line 66, "belt shaped" should read --belt-shaped--.

COLUMN 74

Line 30, "Copyer" should read --Copier--.

COLUMN 77

Line 17, "Copyer" should read --Copier--.

COLUMN 78

Line 8, "an" should read --a--; and
Line 59, "to" should be deleted.

UNITED STATES PATENT AND TRADEMARK OFFICE

CERTIFICATE OF CORRECTION

PATENT NO. : 5,824,442

DATED : October 20, 1998

INVENTOR(S) : HIROHIDE TANIKAWA, ET AL.

It is certified that error appears in the above-identified patent and that said Letters Patent is hereby corrected as shown below:

COLUMN 63

Line 1, "preferably." should read --preferably used.--;
Line 6, "risen" should read --raised--;
Line 15, "preferably." should read --preferably employed.--.

COLUMN 65

Line 56, "with several μm oeder." should read --of several μm diameter--.

COLUMN 66

Line 35, "silicone containing" should read --silicone-containing--.

COLUMN 67

Line 66, "belt shaped" should read --belt-shaped--.

COLUMN 74

Line 30, "Copyer" should read --Copier--.

COLUMN 77

Line 17, "Copyer" should read --Copier--.

COLUMN 78

Line 8, "an" should read --a--; and
Line 59, "to" should be deleted.

UNITED STATES PATENT AND TRADEMARK OFFICE

CERTIFICATE OF CORRECTION

PATENT NO. : 5,824,442

DATED : October 20, 1998

INVENTOR(S) : HIROHIDE TANIKAWA, ET AL.

It is certified that error appears in the above-identified patent and that said Letters Patent is hereby corrected as shown below:

COLUMN 80

Line 34, "Copyer" should read --Copier--.

COLUMN 81

Line 29, "way" should read --day--; and
Line 59, "not so occurred," should read --not much occurred--.

COLUMN 82

Line 66, "not" should be deleted.

COLUMN 84

Line 27, "Copyer" should read --Copier--.

COLUMN 87

Line 40, "were" should read --was--; and
Line 59, "occur" should read --occurs--.

COLUMN 94

Line 61, "Copyer" should read --Copier--.

COLUMN 98

Line 7, "Copyer" should read --Copier--; and
Line 55, "image" should read --images--.

UNITED STATES PATENT AND TRADEMARK OFFICE

CERTIFICATE OF CORRECTION

PATENT NO. : 5,824,442

DATED : October 20, 1998

INVENTOR(S) : HIROHIDE TANIKAWA, ET AL.

It is certified that error appears in the above-identified patent and that said Letters Patent is hereby corrected as shown below:

COLUMN 99

Line 52, "Copyer" should read --Copier--;
Line 58, "as" should read --than--; and
Line 66, "as" should read --than--.

COLUMN 100

Line 5, "Copyer" should read --Copier--;
Line 11, "as" should read --than--;
Line 33, "as" should read --than--;
Line 40, "as" should read --than--;
Line 54, "as" should read --than--; and
Line 62, "as" should read --than--.

COLUMN 101

Line 12, "as" should read --than--; and
Line 19, "as" should read --than--.

COLUMN 103

Line 11, "as" should read --than--;
Line 20, "as" should read --than--;
Line 27, "Copyer" should read --Copier--;
Line 33, "as" should read --than--; and
Line 41, "as" should read --than--.

UNITED STATES PATENT AND TRADEMARK OFFICE

CERTIFICATE OF CORRECTION

PATENT NO. : 5,824,442

DATED : October 20, 1998

INVENTOR(S) : HIROHIDE TANIKAWA, ET AL.

It is certified that error appears in the above-identified patent and that said Letters Patent is hereby corrected as shown below:

COLUMN 104

Line 1, "as" should read --than--;
Line 8, "as" should read --than--;
Line 22, "as" should read --than--;
Line 30, "as" should read --than--;
Line 47, "as" should read --than--; and
Line 54, "as" should read --than--.

COLUMN 109

Table 6,
"14 Cyan 18 1.68 0.7 A B 1.68 0.6 B B 1.69 0.6 A B"
should read
--14 Cyan 18 1.68 0.7 A B 1.68 0.6 B B 1.69 0.6 B B--.

COLUMN 112

Table 8,
"0.7 A A 1.82 0.6 A A
1.4A A 1.76 0.8 A A" should read --
--0.7 A A 1.82 0.6 A A
1.4 A A 1.76 0.8 A A--.

COLUMN 145

Table 42,
"O 0.0
P 7.4
Q 5.5" should read
--O 10.0
P 7.4
Q 9.9--.

UNITED STATES PATENT AND TRADEMARK OFFICE

CERTIFICATE OF CORRECTION

PATENT NO. : 5,824,442

DATED : October 20, 1998

INVENTOR(S) : HIROHIDE TANIKAWA, ET AL.

It is certified that error appears in the above-identified patent and that said Letters Patent is hereby corrected as shown below:

COLUMN 153

Line 24, "aluminum" should read --alumina--.

COLUMN 154

Line 51, "a" should read --an--.

COLUMN 155

Line 54, "aluminum" should read --alumina--.

COLUMN 156

Line 10, "aluminum" should read --alumina--; and
Line 51, "times" should be deleted.

COLUMN 157

Line 44, "a" should read --an--.

COLUMN 159

Line 44, "times" should be deleted.

UNITED STATES PATENT AND TRADEMARK OFFICE

CERTIFICATE OF CORRECTION

PATENT NO. : 5,824,442

DATED : October 20, 1998

INVENTOR(S) : HIROHIDE TANIKAWA, ET AL.

It is certified that error appears in the above-identified patent and that said Letters Patent is hereby corrected as shown below:

COLUMN 160

Line 24, "a" should read --an--.

Signed and Sealed this

Seventeenth Day of August, 1999

*Attest:*

*Attesting Officer*

Q. TODD DICKINSON

*Acting Commissioner of Patents and Trademarks*